US005442370A

United States Patent [19]

Yamazaki et al.

[11] Patent Number: 5,442,370

[45] Date of Patent: Aug. 15, 1995

[54] SYSTEM FOR DRIVING A LIQUID CRYSTAL DISPLAY DEVICE

[75] Inventors: Katsunori Yamazaki; Satoshi Yatabe, both of Suwa, Japan

[73] Assignee: Seiko Epson Corporation, Tokyo, Japan

[21] Appl. No.: 61,890

[22] Filed: May 14, 1993

Related U.S. Application Data

[63] Continuation-in-part of Ser. No. 918,113, Jul. 22, 1992, which is a continuation of Ser. No. 456,123, Dec. 22, 1989, which is a continuation of Ser. No. 232,750, Aug. 15, 1988, Pat. No. 5,010,326.

[30] Foreign Application Priority Data

| | | | |
|---|---|---|---|
| Aug. 13, 1987 | [JP] | Japan | 62-202154 |
| Feb. 9, 1988 | [JP] | Japan | 63-27922 |
| Feb. 9, 1988 | [JP] | Japan | 63-27923 |
| Feb. 9, 1988 | [JP] | Japan | 63-27924 |
| May 14, 1992 | [JP] | Japan | 4-122144 |
| May 14, 1992 | [JP] | Japan | 4-122145 |
| Nov. 17, 1992 | [JP] | Japan | 4-307323 |

[51] Int. Cl.[6] ..... G09G 3/36

[52] U.S. Cl. ..... 345/94; 345/58

[58] Field of Search ..... 345/89, 94, 95, 208, 345/210, 52, 63, 77, 147, 58

[56] References Cited

U.S. PATENT DOCUMENTS

| | | | |
|---|---|---|---|
| 4,645,303 | 2/1987 | Sekiya et al. | 345/208 |
| 4,801,933 | 1/1989 | Yamamoto et al. | 345/103 |

FOREIGN PATENT DOCUMENTS

| | | | |
|---|---|---|---|
| 3-25491 | 2/1991 | Japan | 345/63 |

*Primary Examiner*—Jeffery Brier

*Attorney, Agent, or Firm*—Stroock & Stroock & Lavan

[57] ABSTRACT

A matrix liquid crystal display device includes a first substrate with a plurality of common electrodes disposed thereon. A second substrate includes a plurality of second segment electrodes disposed thereon. A liquid crystal is sandwiched between the two substrates. A power circuit generates a plurality of voltage waveforms. A segment electrode driver receives at least a portion of the plurality of voltage waveforms to produce a voltage segment waveform in response thereto which are applied to the segment electrodes. A common electrode driver receives at least a portion of the plurality of waveforms and produces a common voltage waveform in response thereto. The power circuit includes a voltage compensating circuit for determining a voltage change within the matrix liquid crystal display device and, based thereon, determining the amount of distortion in one of the segment voltage waveforms or the common voltage waveforms and generating a correction voltage which is added to the segment voltage waveform or common voltage waveform which exhibits the amount of distortion.

31 Claims, 95 Drawing Sheets

103
102
SIGNAL LP
SIGNAL XSCL
104
401
COUNT CIRCUIT
402
FIRST COUNT HOLDING CIRCUIT
404
ARITHMETIC CIRCUIT
403
SECOND COUNT HOLDING CIRCUIT
405
PULSE WIDTH CONTROL CIRCUIT
108
109

SYSTEM FOR DRIVING A LIQUID CRYSTAL DISPLAY DEVICE

CROSS-REFERENCE TO RELATED APPLICATIONS

This application is a Continuation-In-Part of U.S. patent application Ser. No. 07/918,113 filed July 22, 1992, which is a Continuation of U.S. patent application Ser. No. 07/456,123, filed Dec. 22, 1989, which is a Continuation of U.S. patent application Ser. No. 07/232,750 filed on Aug. 15, 1988, now U.S. Pat. No. 5,010,326.

BACKGROUND OF THE INVENTION

The present invention relates to a liquid crystal display device, and in particular, to a circuit for driving a matrix liquid crystal display device.

Matrix liquid crystal displays are known in the art. Reference is made to FIGS. 1 through 3 in which a conventional matrix liquid crystal display is provided. A liquid crystal panel generally indicated as 1 is composed of a liquid crystal layer 5, a first substrate 2 and a second substrate 3 for sandwiching the liquid crystal layer 5 therebetween. A plurality of common electrodes Y1 through Y6 are oriented on substrate 2 in the horizontal direction and a plurality of segment electrodes X1 through X6 are formed on substrate 3 in substantially the vertical direction to form a matrix. Each intersection of common electrodes Y1 through Y6 and segment electrodes X1 through X6 forms a display dot 7. Display dots 7 marked by the hatching indicate an ON state, and the blank dots 7 indicate an OFF state. The dot structure of liquid crystal panel 1 is limited to a six by six matrix for simplicity however, in exemplary embodiments the number of dots of liquid crystal panel 1 may be much greater.

The voltage standard method is conventionally used for driving the prior art matrix liquid crystal display device. A selected voltage or non-selected voltage is sequentially applied to each of common electrodes Y1 through Y6. The period required to apply the successive selected voltage or non-selected voltage to all the common electrodes Y1 to Y6 is one frame.

Simultaneous to the successive application of the selected voltage or non-selected voltage to each common electrodes Y1 through-Y6, an ON voltage or OFF voltage is applied to each segment electrode X1 through X6. Accordingly, to turn a display dot 7, the area in which one common electrode intersects one segment electrode, to the ON state, an ON voltage is applied to a desired segment electrode when the common electrode is selected by providing a selected voltage to the desired common electrode. Similarly if the display dot is turned OFF, the OFF voltage is applied to the desired segment electrode.

Reference is now also made to FIGS. 2 and 3 in which examples of the actual driving waveforms (waveform of the applied voltage) applied at the electrodes are provided. FIG. 2A shows the segment voltage waveform applied to segment electrode X5 over time. FIG. 2B shows the common electrode waveform applied to common electrode Y3 over time. FIG. 2C shows the voltage waveform applied for producing the ON state at display dot 8, the intersection of segment electrode X5 and common electrode Y3.

FIG. 3A shows the segment voltage waveform applied to segment electrode X5 over time. FIG. 3B shows the common voltage waveform applied to common electrode Y4 over time. FIG. 3C shows the voltage waveform applied to the display dot at the intersection of segment electrode X5 and common electrode Y4 to produce the OFF state.

In FIGS. 2 and 3, F1 and F2 indicate the frame period.

During frame period F1, selected voltage = $V0$, non-selected voltage = $V4$

ON voltage = $V5$, OFF voltage = $V3$

During frame period F2, selected voltage = $V5$, non-selected voltage = $V1$

ON voltage = $V0$, OFF voltage = $V2$, wherein;

$$V0-V1=V1-V2=V$$

$$V3-V4=V4-V5=V$$

$$V1-V5=n\ V$$

(n is a constant).

Accordingly, by changing the polarity of the voltage which is applied to display dots 7 during frame periods F1 and F2, alternating driving is accomplished. It follows that whether the display dot 7 is ON or OFF depends on whether the ON voltage or OFF voltage is applied to the desired segment electrode when the selected voltage is applied to the intersecting common electrode corresponding to the desired display dot. This driving method is the voltage standard means used in the prior art.

The prior art structure and driving method has been less than satisfactory. When matrix liquid crystal display 1 is driven by the above conventional voltage standard method, the uniform rectangular waveforms illustrated in FIGS. 2 and 3 are not actually applied to display dots 7. Distortions in the applied waveforms occur. A first reason for the distortion is that each display dot 7 has an inherent electrical capacity based on the area of each dot 7, the thickness of the liquid crystal layers, the dielectric constant of the liquid crystal materials and so on. Secondly, both the common electrode and segment electrode are formed of a transparent conductive film having a surface resistance of about several tens of ohms as well as fixed electrical resistance. Therefore, even if the uniform rectangular waveforms as shown in FIGS. 2 and 3 are applied by the driving circuit, the waveform which is actually applied to the display dots becomes deformed and cross talk results. As a result, it becomes necessary to generate the difference of the effective voltage of the waveform which is applied to each display dot, resulting in the generation of contrast cross talk.

Observation has demonstrated that deformation of the voltage waveform being applied to the display dots occurs based upon relationship dependent on the pattern of the characters or drawings which is displayed by the liquid crystal display device. Secondly, the change of the effective voltage based on the deformation of the voltage waveform which is applied to the display dots causes the contrast crosstalk.

1. The First Mode (zebra crosstalk)

Reference is now made to FIGS. 1, 4, 5, and 6A through 6C wherein zebra crosstalk is depicted. For simplicity of explanation, the common electrodes Y1 through Y6 are sequentially selected from the first common electrode Y1 to the sixth common electrode Y6, again returning to the first common electrode Y1. Additionally, liquid crystal panel 1 is a positive display wherein the greater the effective voltage applied to the display dots 7, the darker the display dot. A scale is provided in FIG. 4 to indicate relative darkness. This type of display is used for each explanation unless otherwise indicated.

If the display of FIG. 1 is desired and the inputs of FIGS. 2 and 3 are provided, the crosstalk of the display contrast as shown in FIG. 4 actually occurs in the liquid crystal display device 1. As can be seen, segment electrodes X1 through X4 receive identical inputs. The segment voltage waveform at the display dots portion of segment electrodes X1 through X4 is shown in FIG. 5A, the common voltage waveform applied at the display dot portion of the common electrode Y3 is shown in FIG. 5B. The voltage waveform applied at the display dots located at the intersections of segment electrodes X1 through X4 and common electrode Y3 is shown in FIG. 5C. The voltage waveforms applied to the four display dots will differ from each other slightly. However, this slight difference can be ignored here.

A spike shaped deformation of the voltage waveform occurs at the non-selected voltage level of the common voltage waveform as shown in FIG. 5B. The relationship between the direction and the size of the spike shaped voltage and the display pattern is as follows. Generally, when the selection of the successive common electrode moves from the nth common electrode to the (n+1)th common electrode, the number of segment electrodes to which the ON voltage is successively added is a, the number of segment electrodes to which the OFF voltage is successively applied is b, the number of segment electrodes to which a voltage is applied by switching from the ON voltage to OFF voltage is c and the number of segment electrodes to which the voltage is added by switching from the OFF voltage to ON voltage is d. The number of ON dots 7 on the nth common electrode is $N_{ON}$. The number of OFF dots 7 on the nth common electrode is $N_{OFF}$ and the number of ON dots 7 on the (n+2)th common electrode is $M_{ON}$ while the number OFF dots on the (n+2)th common electrode is $M_{OFF}$. The relationship between the segmented electrodes and common electrodes is as follows:

$$N_{ON}=a+c,$$

$$N_{OFF}=b+d$$

$$M_{ON}=a+d,$$

$$M_{OFF}=b+c$$

$$N_{ON}+N_{OFF}=M_{ON}+M_{OFF}=K$$

K is a constant and equal to the total number of display dots on each common electrode Y.

A value of I equal to the difference in ON dots between successive segment electrodes is defined as follows:

$$I = c - d$$

-continued $$= N_{ON} - M_{ON},$$

so, when the value of I is negative, the direction of the spike shaped voltage is in the direction of the ON voltage. On the other hand, where the value of I is positive, the direction of the spiked shaped voltage is in the direction of the OFF voltage. The size of the spike increases in accordance with the absolute value of I.

In other words, when the number d of segment electrodes in which the applied voltage switches from the OFF voltage to ON voltage is larger than the number c of segment electrodes in which the applied voltage switches from the ON voltages to OFF voltage, the spike shaped voltage occurs on the common voltage waveform in the direction of the ON voltage. In contrast thereto, when the sign of I, which is the difference between c and d, changes the spike shaped voltage occurs in the direction of the OFF voltage. Additionally, the value of the spike shaped voltage corresponds to the absolute value of I.

As shown in FIGS. 5A and 5B, when the relationship between the change of the segment voltage waveform and the direction of the spike shaped voltage of the common voltage waveform on the non-selected voltage are in-phase, a rounded corner occurs in the voltage waveform of the voltage applied at the display dots (FIG. 5C). The longer the in-phase period, the smaller the effective voltage value of the applied waveform, resulting in the displayed color becoming very light.

Reference is now made to FIG. 6 which illustrates the change of the segment voltage waveform and the direction of the spike on the common voltage waveform when the waveforms are out of phase. FIG. 6A shows the segment voltage waveform applied at the display dot portion of the segment electrode X5 of display 10. FIG. 6B shows the common voltage waveform applied at the display dot 7 portion of the common electrode Y3. FIG. 6C shows the combined voltage waveform which is applied to the display dot at the intersection of segment electrode X5 and common electrode Y3. As shown, where the relationship between the change in the segment voltage waveform (FIG. 6A) and the direction of the spike shaped voltage of the common voltage waveform of the non-selected voltage (FIG. 6B) are out of phase, a spike shaped voltage is generated in the combined voltage waveform applied to the display dots 7 (FIG. 6B), thereby increasing the effective value of the applied voltage. The longer the out of phase period, the larger the effective value, resulting in a darkening of the displayed color. Therefore, display dots 7 on segment electrodes X1 to X4 become light, and the display dots on the segment electrode X5 become dark regardless of the applied ON state or OFF state voltages. The darkness of display dots 7 on segment electrode X6 become a color of intermediate degree between the above on segment electrodes X1 to X4 and those on X5.

2. The Second Mode (horizontal crosstalk)

Reference is now made to FIGS. 7 through 10 in which a desired pattern is illustrated. FIG. 7 illustrates a display 11 on which a horizontal crosstalk pattern is displayed. Display 11 is the same as liquid crystal panel 1. The actual contrast crosstalk generated by display 11 is shown by display 12 of FIG. 8.

Display dot 7 acts as a capacitor. The capacity of this capacitor has a different value in the ON state than in the OFF state. The value of the capacitance in the ON state is larger than the capacitance in the OFF state. This occurs because the liquid crystal 5 acts as an anisotropic dielectric and the resulting alignment change occurs between the ON state and OFF state. Accordingly, the capacitance of all dots 7 on common electrode Y2 having many ON dots 13 is larger than that on common electrode Y4 having a few ON dots 13. Since common electrodes have the same circuit resistance, the rounded waveform generated in the voltage waveform of common electrode Y2 becomes larger.

FIG. 9A shows the segment voltage waveform over time applied at the display dot portion on the segment electrode X1 of display 11. FIG. 10B shows the common electrode waveform over time applied at the display dot portion on the common electrode Y2. FIG. 9C shows the combined voltage waveform over time applied to dot 7 at the intersection of segment electrode X1 and common electrode Y2.

FIG. 10A shows the segment voltage waveform over time applied at the display dot portion on the segment electrode X1 of display 11. FIG. 10B shows the common voltage waveform over time applied at the display dot portion on the common electrode Y4. FIG. 10C shows the combined voltage waveform over time which is applied to the dot at the intersection of segment electrode X1 and common electrode Y4.

As can be seen from a comparison of FIG. 9B and FIG. 10B the waveform of common electrode Y2 which has many ON dots is more rounded when a change from the non-selected voltage to selected voltage occurs. This area is marked by the hatched area. As can be seen by comparing FIG. 9C with FIG. 10C the voltage effective value of the waveform which is applied to dots 13 on common electrode Y2 also decreases by the hatched area. Accordingly, the color produced at each display dot 7 of common electrode Y2 having many ON dots 13 becomes very light. Thus, if the number of ON dots on each common electrode is represented by Z, the larger the value of Z of the common electrode, the lighter the displayed color.

3. The Third Mode (vertical crosstalk)

Reference is now made to FIGS. 12 through 17C in which vertical crosstalk is illustrated. The pattern of display 14 is actually displayed as display 15 due to vertical crosstalk. the segment voltage waveform applied at the display dot portion on segment electrode X6 is shown in FIG. 13A. The common voltage waveform applied to the display dot portion on the common electrode Y2 is shown in FIG. 13B. The combined voltage waveform which is applied at the display dot at the intersection of segment electrode X6 and common electrode Y2 is shown in FIG. 13C. Further, FIGS. 14A through 14C show each voltage waveform on segment electrode X5 and common electrode Y2 and the voltage waveforms which are combined to form the actual waveform at the display dot at the intersection of segment electrode X5 and common electrode Y2.

A second example of vertical crosstalk is now described. The segment voltage waveform applied at the display dot portion of segment electrode X6 is shown in FIG. 17A. A desired pattern is input to produce the pattern on display 15. However, due to vertical crosstalk a pattern such as that of display 16 results. The common voltage waveform applied at the display dot portion of common electrode Y3 is shown in FIG. 17B. FIG. 17C shows the combined voltage waveform which is applied to the display dot at the intersection of segment electrode X6 and common electrode Y3. Similarly, FIGS. 18A through 18C show each voltage waveform applied at segment electrode X5, common electrode Y2 and the combined voltage waveform applied at display dot 7 at the intersection of segment electrode X5 and common electrode Y2.

The non-selected voltage level of the common voltage waveform during the displaying of the pattern of display 14 having many ON dots varies in the ON voltage direction as shown in FIG. 13B. Conversely, the non-selected voltage level of the common voltage waveform of display 15 having few ON dots varies in the OFF voltage direction as shown in FIG. 17B.

Where there are many ON dots, the variation is caused because each of common electrodes Y1 through Y6 is electrically connected to the segment electrode to which the ON voltage is applied through the condenser of display dots to a greater extent than to the segment electrode to which the OFF voltage is applied. The reason for this phenomenon is unclear, but it may occur due to a lack of sufficient output impedance of the power circuit relative to the load of the liquid crystal panel. The relationship for the generated voltage shift is described below.

For all display dots 7 of displays 14 and 15 T is the number of ON dots and L is the number of OFF dots. A value T′ is defined as $T'=T-L$ when T′ is positive, the non-selected voltage level varies in the ON voltage direction. On the other hand, when T′ is negative the non-selected voltage level varies in the OFF voltage direction. The size of the variation increases in accordance with the absolute value of T′.

Where the pattern includes many ON dots 13 as shown in display 14, the difference between the OFF voltage and the non-selected voltage becomes large and the difference between the ON voltage and the non-selected voltage becomes small. Therefore, comparing the voltage waveform (FIG. 14A) which is added to display dots 7 on segment electrode X5 of display 15 (FIG. 12) having no ON dot 13, with the voltage waveform FIG. 13A which is added to display dots 7 on segment electrode X6 having ON dot 13, illustrates that the effective combined voltage which is applied to display dot 7 on the segment electrode X5 is larger for the portion marked by the hatched area (FIG. 14C), thereby making the display dots on the segment electrode X5 dark when they should be blank.

Similarly, where the display has few ON dots 13 such as display 15, the difference between the ON voltage and the non-selected voltage becomes large, and the difference between the OFF voltage and the non-selected voltage becomes small. Therefore, comparing the voltage waveform which is provided to display dots 7 by segment electrode X6 including ON dot 13, and the voltage waveform which is provided to display dots 7 on the segment electrode X5 having no ON dot 13, the effective voltage which is provided to the display dots on the segment electrode X6 is larger than that of electrode X5 for the period marked by the hatched area (FIG. 17C) resulting in a dark display dot on segment electrode X6.

4. The Fourth Mode (inversion crosstalk)

Reference is made to FIGS. 18 through 21 in which inversion crosstalk is illustrated. A desired pattern is input to a display 17 (FIG. 19), but in reality appears as the pattern on a display 18 (FIG. 20) due to inversion crosstalk. FIG. 21A shows a segment voltage waveform provided at the display dot portion on segment electrode X6. FIG. 21B shows a common voltage waveform provided at the display dot portion on common electrode Y2. FIG. 21C shows a combined voltage waveform which is provided to display dot 7 at the intersection of segment electrode X6 and the common electrode Y2. FIG. 22 shows the combined voltage waveform provided to display dot 7 at the intersection of segment electrode X5 and common electrode Y2.

Reference is now made to FIGS. 23 through 26 wherein a second example of inversion crosstalk is provided. A pattern is input to appear as display 20 (FIG. 23), but in reality appears as the pattern of display 19 (FIG. 24) due to inversion crosstalk. FIG. 25A shows a segment voltage waveform provided at the display dot portion of segment electrode Y6. FIG. 25B shows a common voltage waveform provided at the display dot portion of common electrode Y2. FIG. 25C shows the combined voltage waveform which is provided at display dot 7 at the intersection of segment electrode X6 and common electrode Y2. FIG. 26 shows a combined voltage waveform provided by electrodes Y2 and X5 to display dot 7 at the intersection of segment electrode X5 and common electrode Y2.

The time period of switching between frame periods, i.e. before or after the switching from F1 to F2 of FIG. 21 and FIG. 25 is known as the inversion. As shown in FIG. 19 when the number of segment electrodes in which the voltage applied to the segment electrode is an ON voltage before and after the inversion (only the 6th segment electrode X6 in FIG. 19) is less than the number of segment electrodes in which the voltage applied to the segment electrode is an OFF voltage before and after the inversion (the five segment electrodes X1 to X5 in FIG. 19), a rounded waveform is as shown in FIG. 21B occurs at the time of inversion.

Therefore, when the pattern as shown in FIG. 19 is displayed, the rounded waveform occurs in the common voltage waveform as shown in FIG. 21B at the time of inversion.

Simultaneously, the voltage waveform applied to the segment electrode X6 (FIG. 21A) applied to display dots 7 on segment electrode X6 for changing from an ON voltage to an ON voltage before and after the inversion, generates a spike shaped voltage as shown in FIG. 21C, thereby increasing the effective voltage making the display dark. On the other hand, for the voltage waveform which is applied to display dots 7 of segment electrodes X1 through X5 for changing from an OFF voltage to an OFF voltage before and after the inversion, the rounded portion of the waveform as shown in FIG. 22 occurs, thereby decreasing the effective voltage, thus lightening the display.

Conversely, in display 20 (FIG. 23) the spike shaped voltage is generated in the common voltage waveform as shown in FIG. 25B at the time of inversion. Simultaneously, when the applied waveform changes from an ON voltage to an OFF voltage before and after the inversion, a rounded section (FIG. 25C) is generated in the voltage waveform which is applied to display dots 7 on segment electrodes X1, X2, X3, X4 and X6, thereby decreasing the effective voltage and further lightening the displayed color. Additionally, when the: voltage applied to the display dots on the segment electrode X5, switches from an OFF voltage to an OFF voltage before and after the inversion, a spike shaped voltage (FIG. 26) is generated thereby increasing the effective voltage, darkening the displayed color.

The above relationship is defined as follows. The number of segment electrodes switching from an ON voltage to an ON voltage at the time of inversion is a. The number of segment electrodes switching from an OFF voltage to an OFF voltage at the time of inversion is b. The number of segment electrodes switching from an ON voltage to an OFF voltage is c. The number of segment electrodes switching from an OFF to an ON voltage is d. Further, the number of ON dots on the common electrode (Y6, FIGS. 19 and 23) which is selected just before the inversion is $N_{ON}$ and the number of OFF dots on the common electrode is $N_{OFF}$ while the number of ON dots on the common electrode (Y1, FIGS. 19 and 23 ) which is selected just after the: inversion is $M_{ON}$ and the number of OFF dots on the common electrode is $M_{OFF}$.

$$N_{ON}=a+c,$$

$$N_{OFF}=b+d$$

$$M_{ON}=a+d,$$

$$M_{OFF}=b+c$$

$$N_{ON}+N_{OFF}=M_{ON}+M_{OFF}=K$$

K is a constant representing the number of display dots on each common electrode. Wherein, $$\begin{aligned} F &= a - b \\ &= N_{ON} - M_{OFF} \\ &= N_{ON} + M_{ON} - K. \end{aligned}$$

If the value of F is negative, at the time of the inversion, the rounded waveform occurs when the non-selected voltage changes on the common electrode. Conversely, if the value of F is positive, the spike shaped voltage occurs in the direction of the ON voltage. The value the applied voltage increases in accordance with the absolute value of F. This introduces the display crosstalk as mentioned above.

The general crosstalk problem has been well known in the art. A method for correcting crosstalk is also known in the art and is illustrated in Japanese Laid-Open Patent Nos. 31825/87, 19195/85 and 19196/85. The method consists of reversing the polarity of the voltage which is applied to the liquid crystal panel a predetermined number of times per frame. This method is known as the line reverse driving method.

However, this method has been less than satisfactory. The line reverse driving method corrects only one mode of crosstalk (zebra crosstalk) of the plurality of cross talk modes. As mentioned above, there are four modes of crosstalk in the display relating to the mechanism which arise due to changes of the voltage waveform. Accordingly, the crosstalk of the display contrast is not completely removed.

Summarizing the four methods for correcting cross talk known above, a liquid crystal panel of a liquid crystal display unit is driven by providing a voltage waveform of different voltages generated by a power supply circuit. These driving voltage waveforms are applied to common electrodes and segment electrodes which intersect to form the liquid crystal display panel. These driving voltage waveforms are changed in accordance with the content of a display to be provided on the liquid crystal panel.

The liquid crystal panel itself acts as a capacitive load. Furthermore, the common electrodes and segment electrodes have inherent electrical resistance. This results in a problem in that distortions occur in the voltage waveforms applied to the common electrodes and segment electrodes depending upon the voltage waveforms, resulting in the occurrence of a display non-uniformity. A further prior art method for correcting distortions is known which adds a correction voltage to the driving voltage waveforms. This method is disclosed in Japanese Patent Laid-Open Application Hei 2-89. This method has been satisfactory, but requires a circuit which calculates in advance the amount of correction required in order to effect a uniform display. As a result, the liquid crystal display unit is complicated in structure and difficult to miniaturize or to reduce the weight thereof.

Accordingly, a mechanism for driving a liquid crystal display which overcomes the limitations of the prior art is desired.

SUMMARY OF THE INVENTION

A system for driving a matrix liquid crystal display having two substrates and a liquid crystal formed therebetween in accordance with the invention is provided. A group of common electrodes is formed on one substrate. A group of segment electrodes is formed on the other substrate. The common electrodes intersect the segment electrodes providing display dots on the liquid crystal display at each intersection. A scanning electrode driving circuit inputs a driving voltage waveform to the plurality of common electrodes. A segment electrode driving circuit inputs a driving voltage waveform to the plurality of segment electrodes. A power supply circuit generates a plurality of voltages input to the common electrode driving circuit to form the common electrode driving voltage waveform and to the segment electrode driving circuit to form the segment driving voltage waveform. A correction circuit adds a correction voltage to either the segment electrode driving circuit or the common electrode driving circuit in accordance with a character or figure displayed on the liquid crystal panel. The correction circuit includes a detection circuit for detecting a voltage change or a current change occurring at at least a portion of the liquid crystal panel and causes a correction voltage to be generated in accordance with the voltage change or current change detected by the detection circuit.

In an exemplary embodiment of the invention, the detection circuit detects a voltage change in the difference between the driving voltage waveform applied to at least one of the common electrodes and at least one of the voltages generated by the power supply circuit utilized by the common electrode driving circuit to form the driving voltage waveform input to the common electrodes.

In a third embodiment of the invention, at least one voltage detection electrode is formed on the substrate of the liquid crystal panel supporting the common electrodes so that the detection electrode intersects at least a portion of the segment electrodes. The voltage detection electrode may alternatively be formed on the substrate of the liquid crystal panel supporting the segment electrodes in such a manner as to intersect at least a portion of the common electrodes. In either embodiment, the detection circuit detects a voltage change generated across the voltage detection electrode. The correction circuit generates a correction voltage in accordance with the number of lighted dots provided on the liquid crystal display. Furthermore, the areas of the voltage detection electrodes which intersect the plurality of either common electrodes or segment electrodes may be varied dependent upon the length and number of the common electrodes and segment electrodes being intersected.

In a fourth embodiment of the invention, the detection circuit detects a current flowing between the power supply circuit and the common electrode driving circuit with respect to at least one of the voltages output from the power supply circuit to the common electrode driving circuit.

In a fifth embodiment of the invention, the detection circuit detects a plurality of voltage or current changes. The correction circuit produces a correction voltage in accordance with a predetermined function using as a plurality of variables the plurality of voltage or current changes detected by the detection circuit and in response thereto generates the correction voltage. In an exemplary embodiment, the function is based upon averaging the plurality of variables.

In a sixth embodiment of the invention, a plurality of voltage detection electrodes are formed on the liquid crystal panel. The correction circuit produces a correction voltage in accordance with a predetermined function which utilizes as the input variables the voltages or current changes detected through the voltage detection electrodes by the detection circuits and in response thereto generates a plurality of correction voltages in accordance with the function. The correction voltage added to the driving voltage waveform input at the common electrodes or the segment electrodes is selected from one of the plurality of correction voltages according to the position in which this common electrode or segment electrode is positioned in the liquid crystal panel.

Accordingly, it is an object of the present invention to provide an improved circuit for driving a liquid crystal display.

Another object of the present invention is to provide a circuit for driving a liquid crystal display which eliminates at least four modes of crosstalk.

Still another object of the invention is to provide a circuit for driving a liquid crystal display in which a voltage change or current change detected on a portion of the liquid crystal display is utilized to predict a distortion generated on electrodes of the liquid crystal display and the correction voltage is generated on the basis of the predicted distortion and added to the driving voltage waveform as a correction voltage.

Yet another object of this invention is to provide a circuit for driving a liquid crystal display which requires no circuit for calculating the amount of distortion from display data resulting in a simplified circuit arrangement while maintaining a high quality display resulting in a reduction in size and weight of the overall system.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
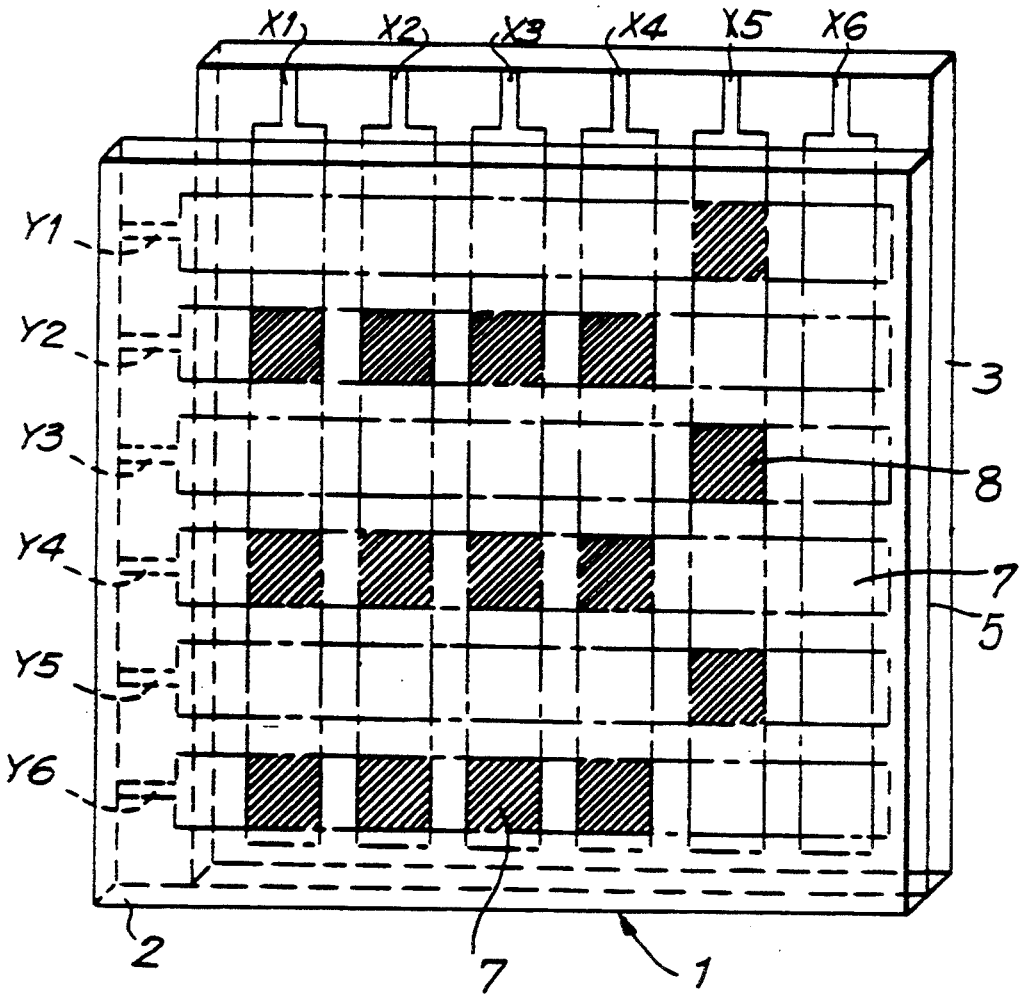
FIG. 1 PRIOR ART
FIG. 1 is a perspective view of a liquid crystal display and pattern in accordance with the prior art.
Figure 2A:
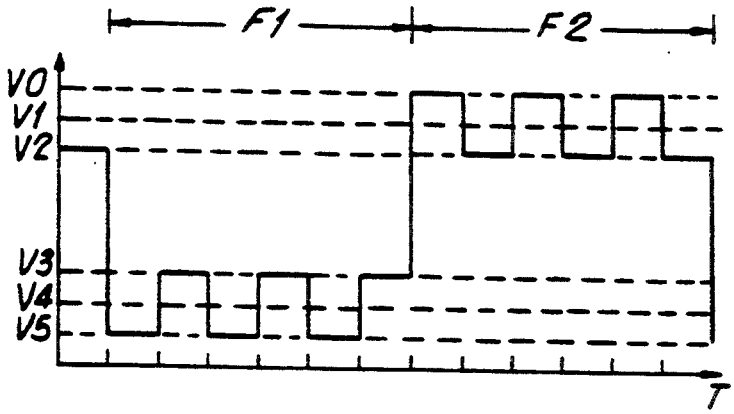
FIG. 2A PRIOR ART
FIGS. 2A–2C and 3A–3C are graphs of ideal waveforms of the voltage applied to the liquid crystal panel for forming the display pattern of FIG. 1.
Figure 2B:
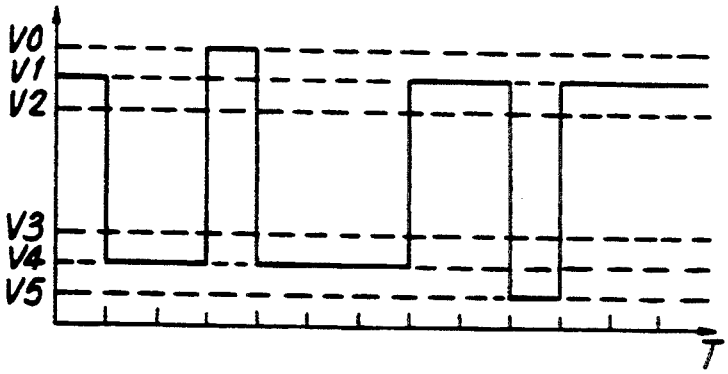
FIG. 2B PRIOR ART
Figure 2C:
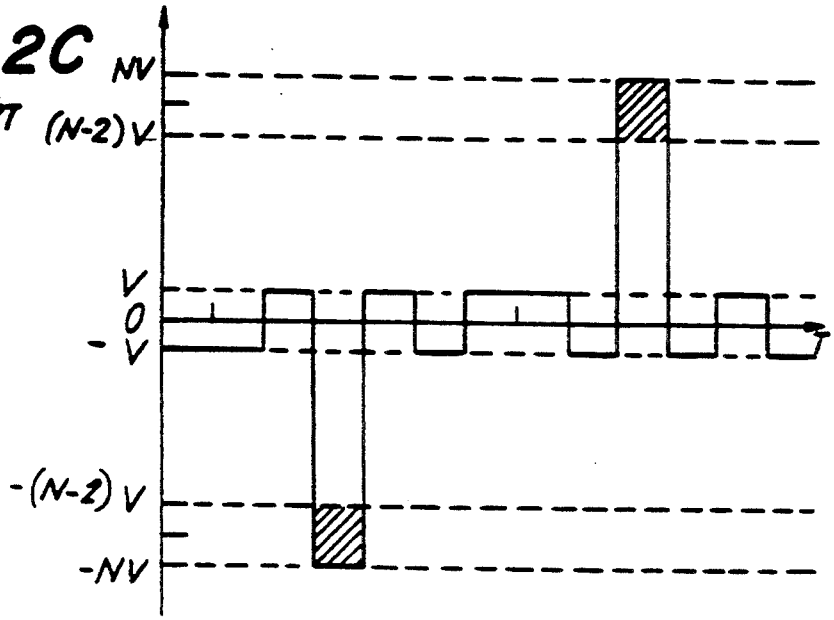
FIG. 2C PRIOR ART
Figure 3A:
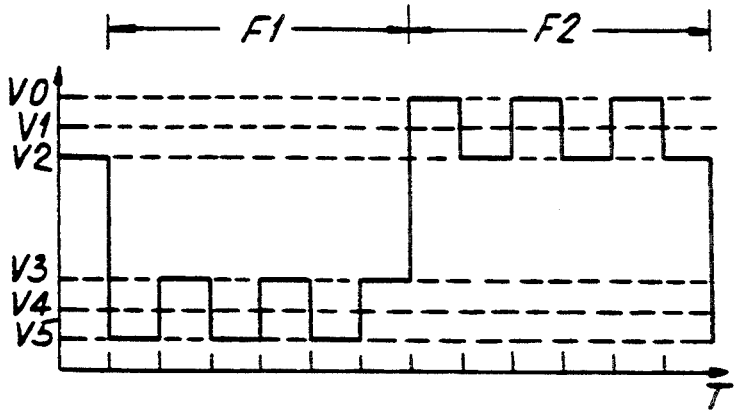
FIG. 3A PRIOR ART
Figure 3B:
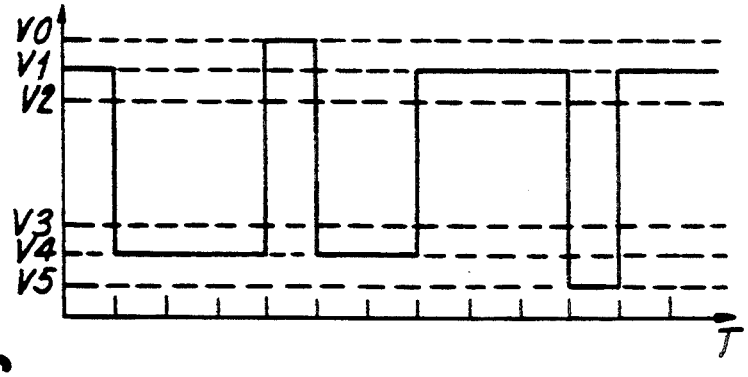
FIG. 3B PRIOR ART
Figure 3C:
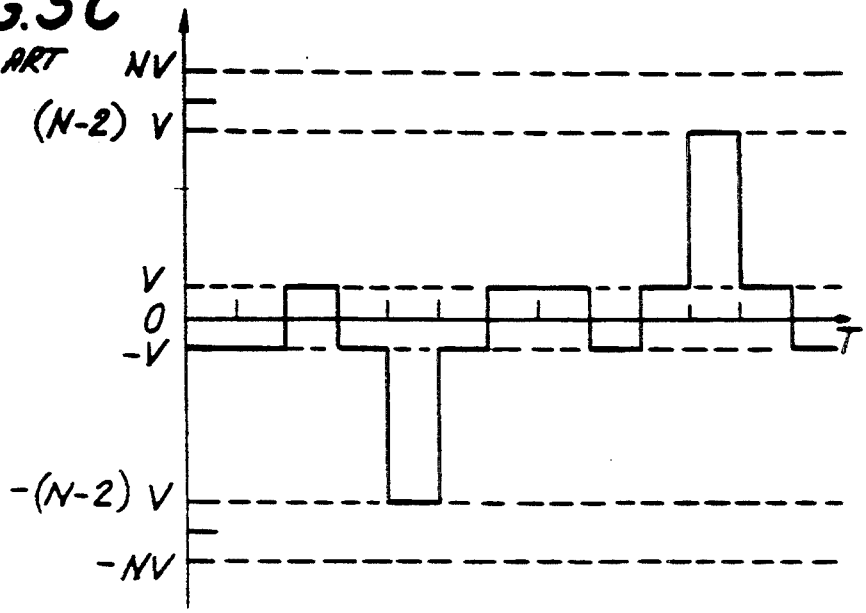
FIG. 3C PRIOR ART
Figure 4:
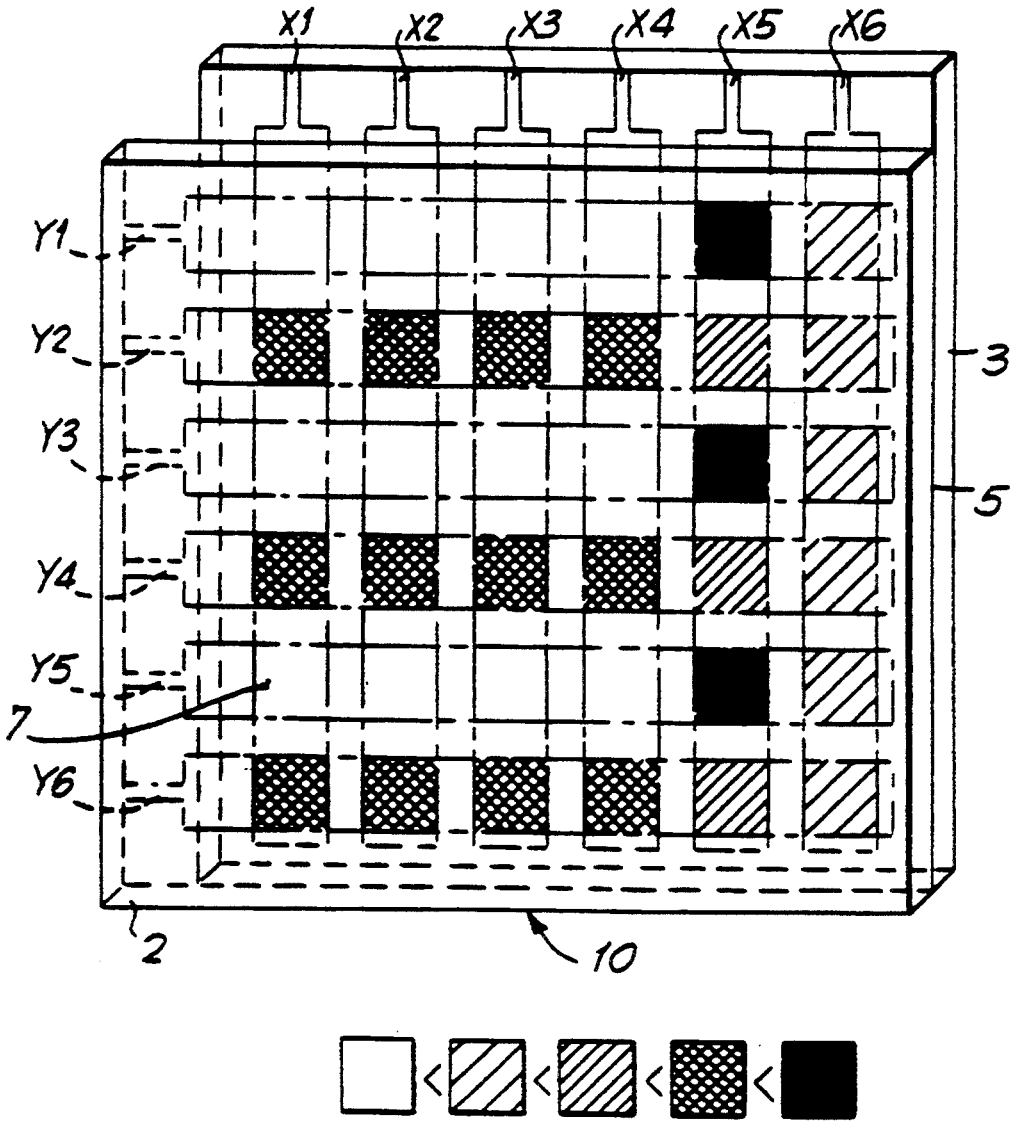
FIG. 4 PRIOR ART
FIG. 4 is a perspective view of the liquid crystal panel and actual display pattern of FIG. 1.
Figure 5A:
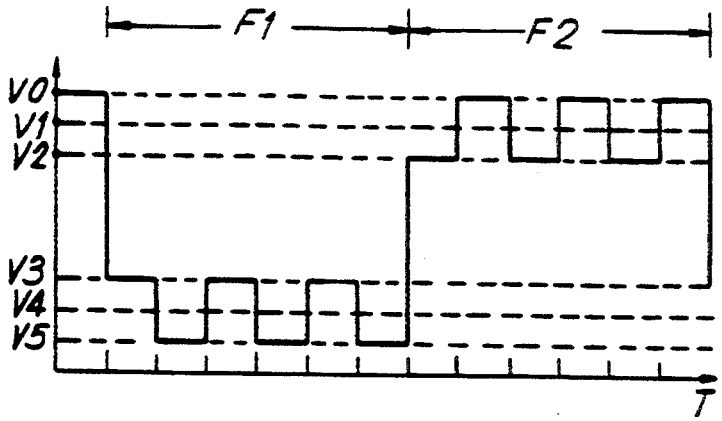
FIG.5A PRIOR ART
FIGS. 5A–5C and 6A–6C are graphs of waveforms of the voltage actually applied to the liquid crystal panel when forming the display pattern of FIG. 1.
Figure 5B:
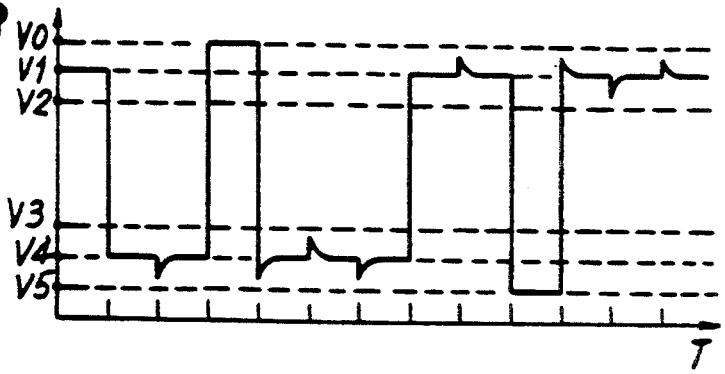
FIG.5B PRIOR ART
Figure 5C:
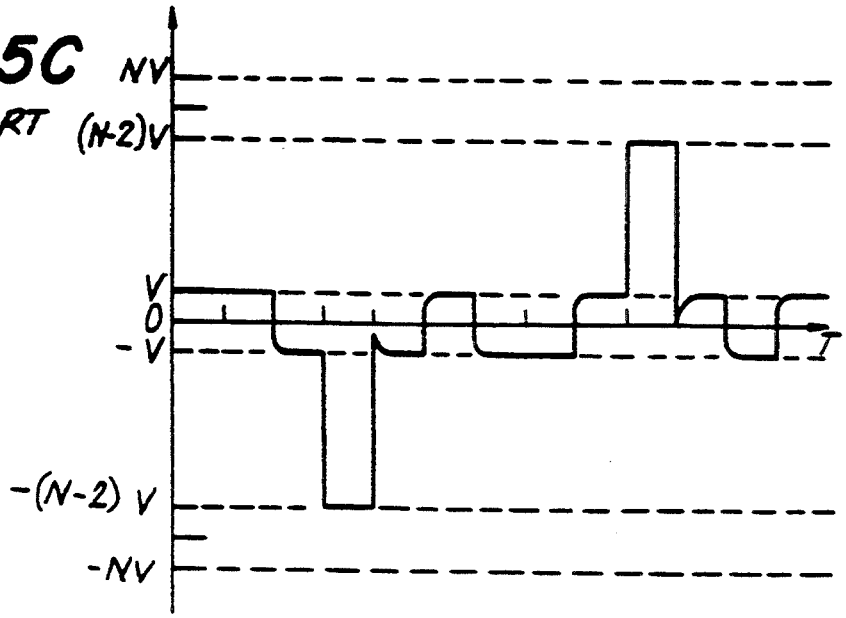
FIG.5C PRIOR ART
Figure 6A:
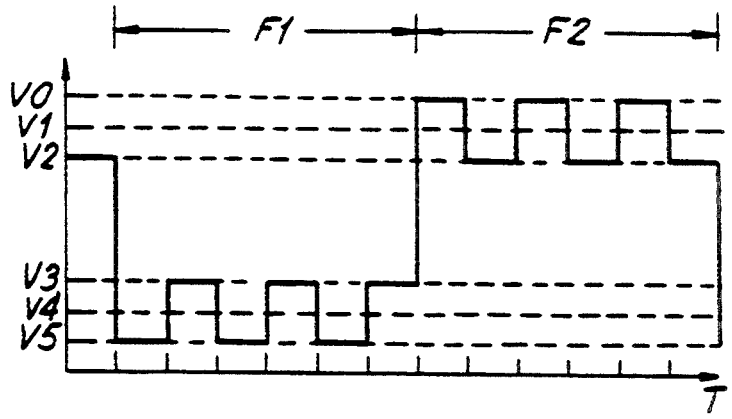
FIG. 6A PRIOR ART
Figure 6B:
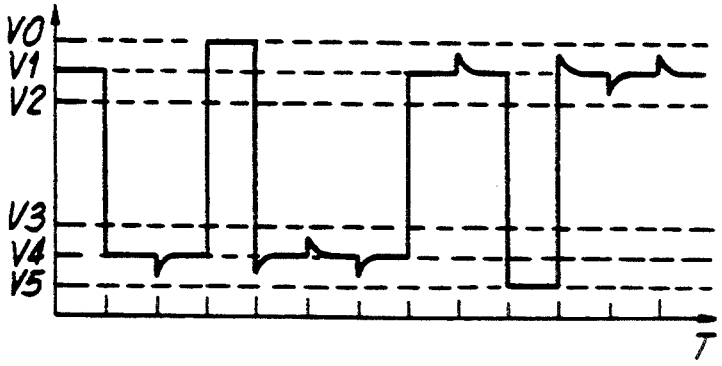
FIG. 6B PRIOR ART
Figure 6C:
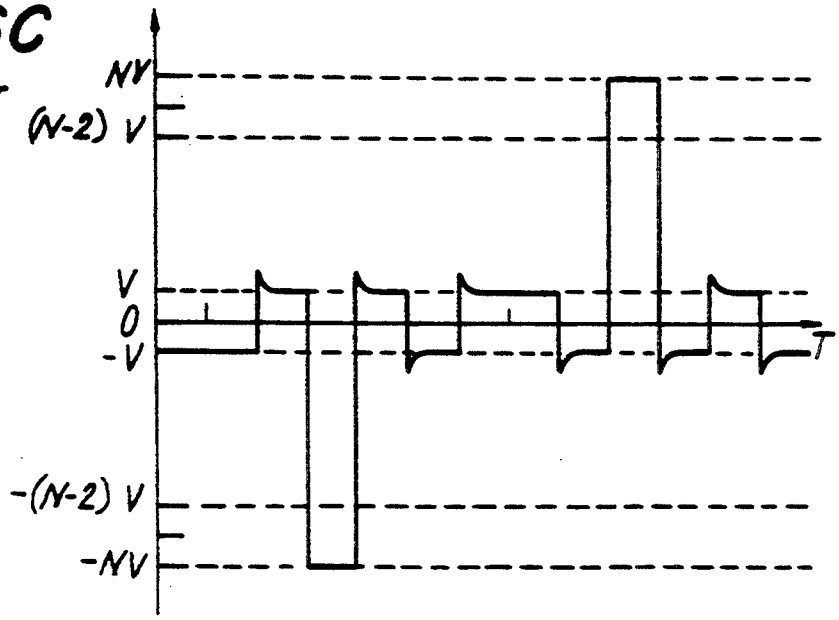
FIG. 6C PRIOR ART
Figure 7:
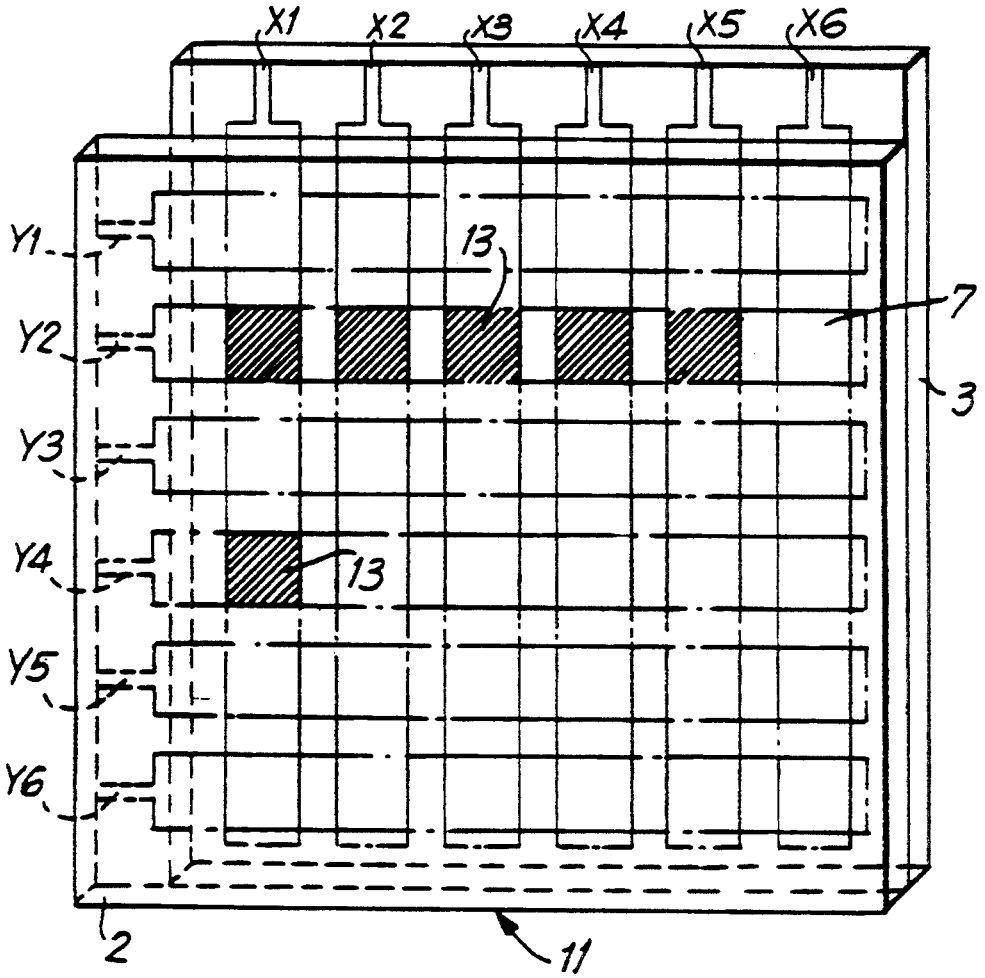
FIG. 7 PRIOR ART
FIG. 7 is a perspective view of a liquid crystal panel having another ideal display pattern.
Figure 8:
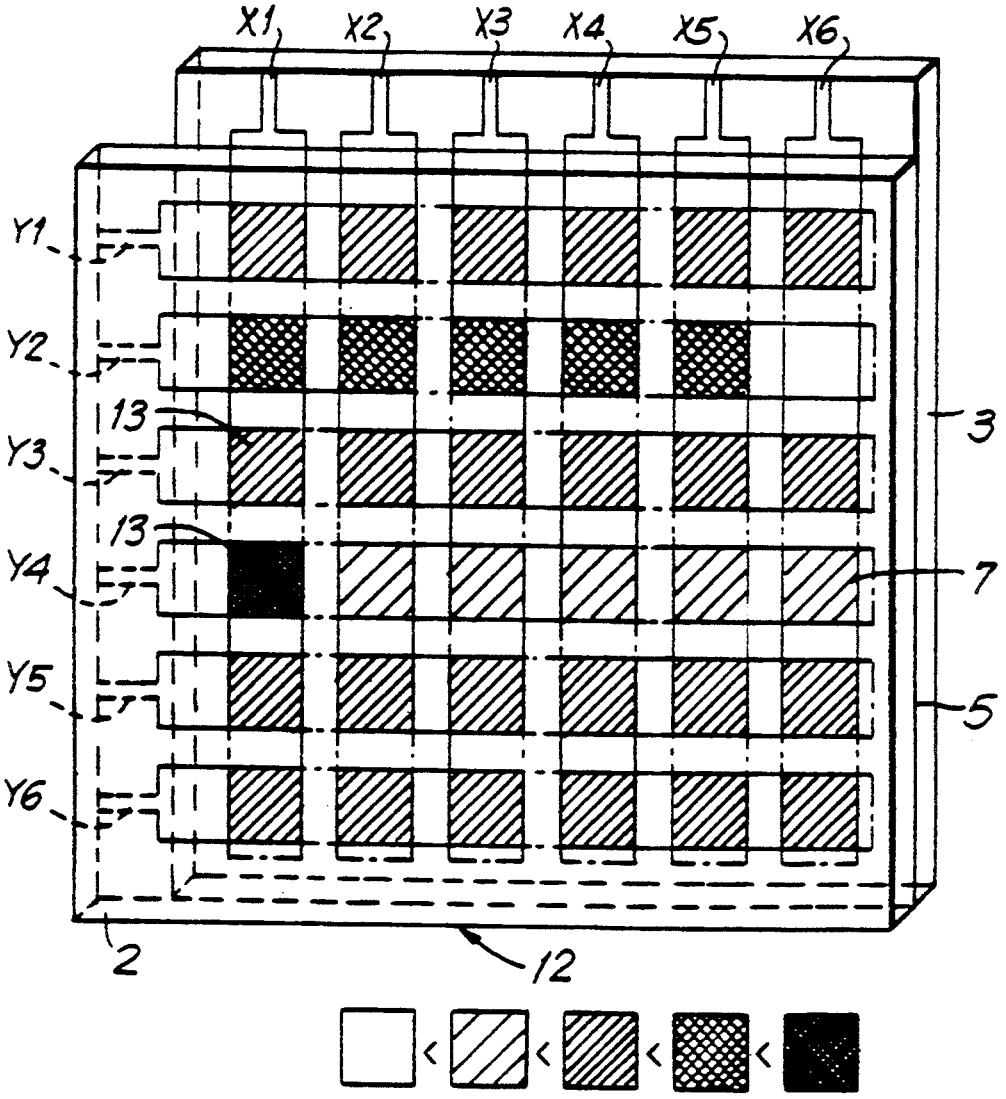
FIG. 8 PRIOR ART
FIG. 8 is a perspective view of a liquid crystal panel showing the actual display condition when the display pattern of FIG. 7 is formed.
Figure 9A:
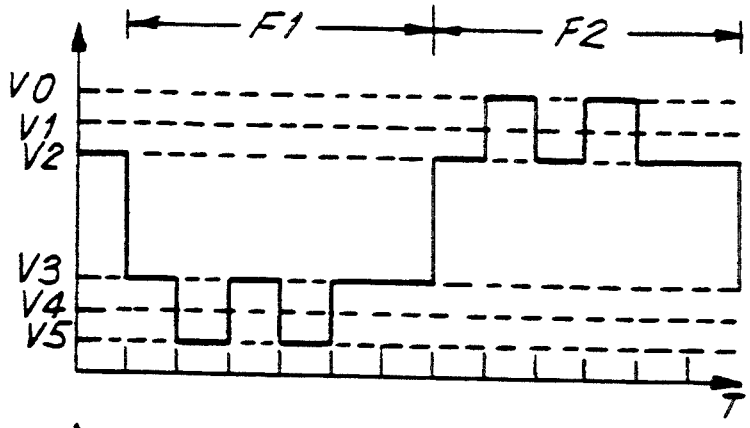
FIG. 9A PRIOR ART
FIGS. 9A–9C and 10A–10C are graphs of waveforms of the voltage actually applied to the liquid crystal panel when forming the display pattern of FIG. 7.
Figure 9B:
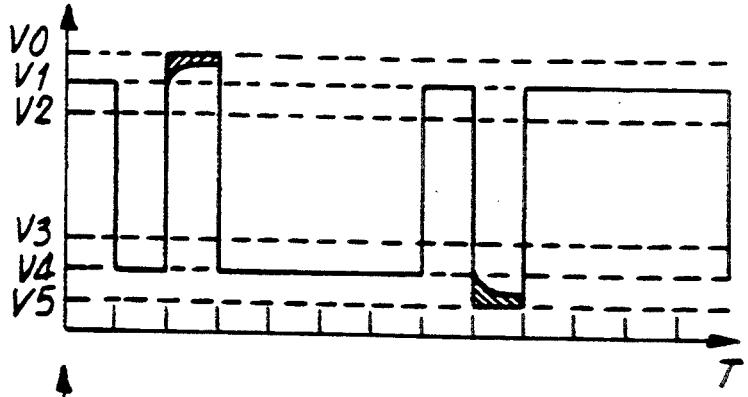
FIG. 9B PRIOR ART
Figure 9C:
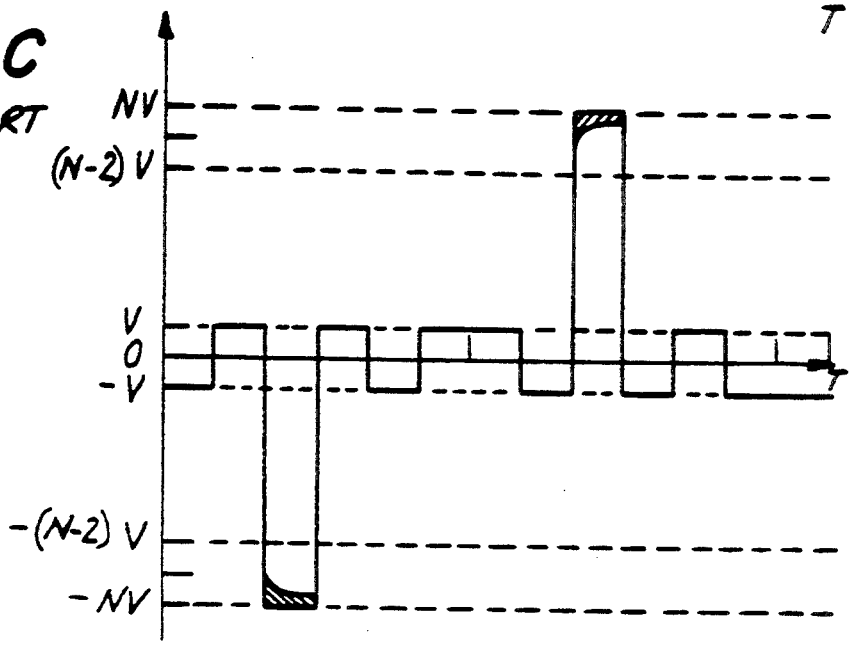
FIG. 9C PRIOR ART
Figure 10A:
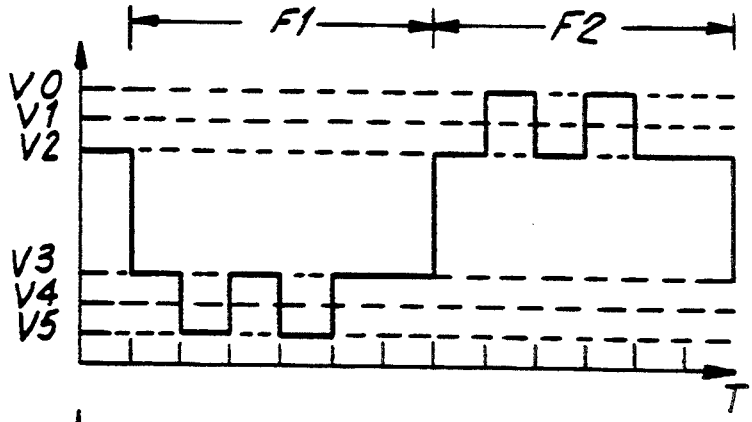
FIG. 10A PRIOR ART
Figure 10B:
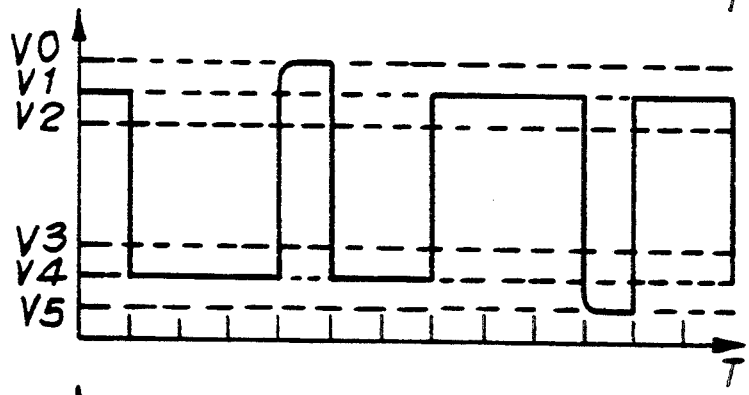
FIG. 10B PRIOR ART
Figure 10C:
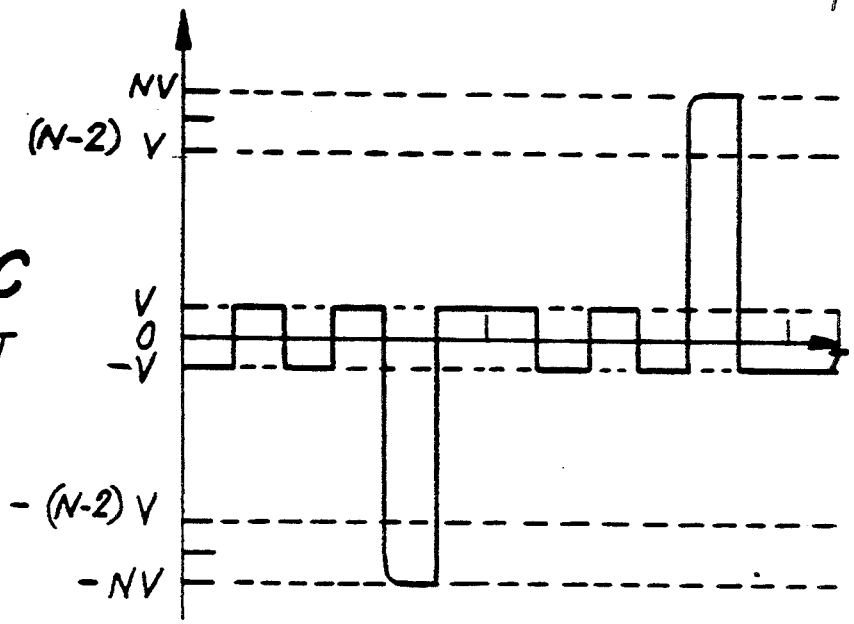
FIG. 10C PRIOR ART
Figure 11:
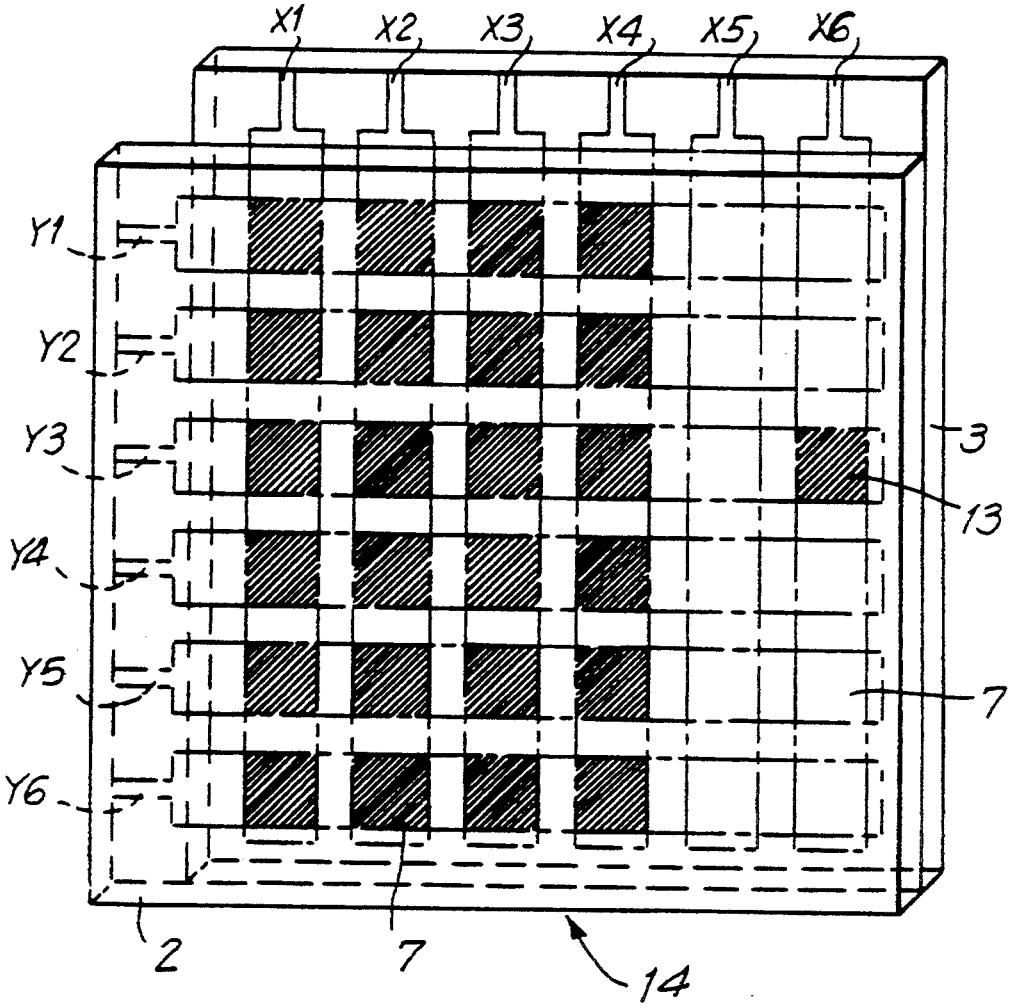
FIG. 11 PRIOR ART
FIG. 11 is a perspective view of a liquid crystal panel wherein another ideal display pattern is formed.
Figure 12:
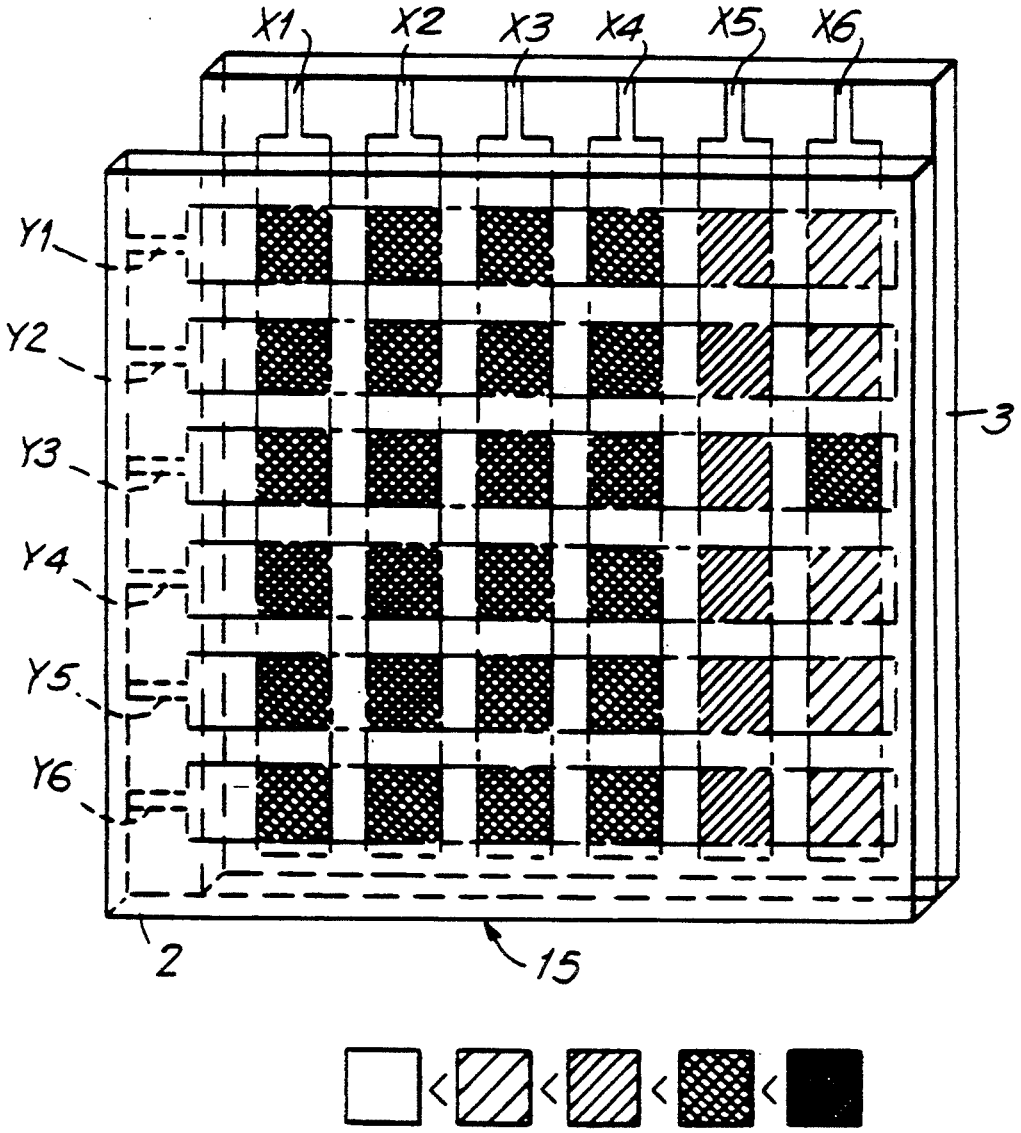
FIG. 12 PRIOR ART
FIG. 12 is a perspective view of the actual display when the display pattern of FIG. 11 is formed.
Figure 13A:
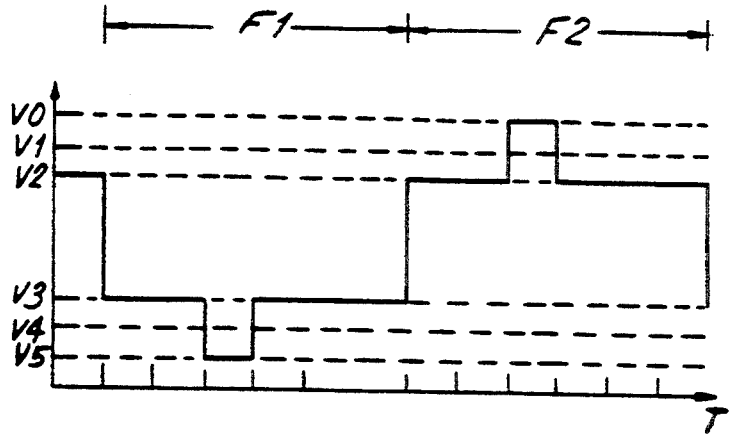
FIG. 13A PRIOR ART
FIGS. 13A–13C and 14A–14C are graphs of waveforms of the voltage actually applied to the liquid crystal panel for forming the display pattern of FIG. 11.
Figure 13B:
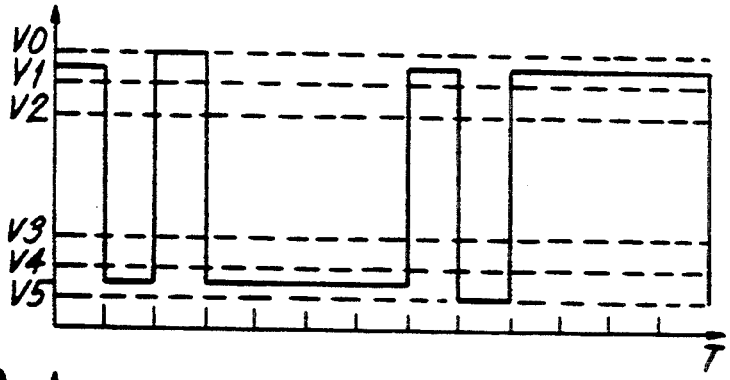
FIG. 13B PRIOR ART
Figure 13C:
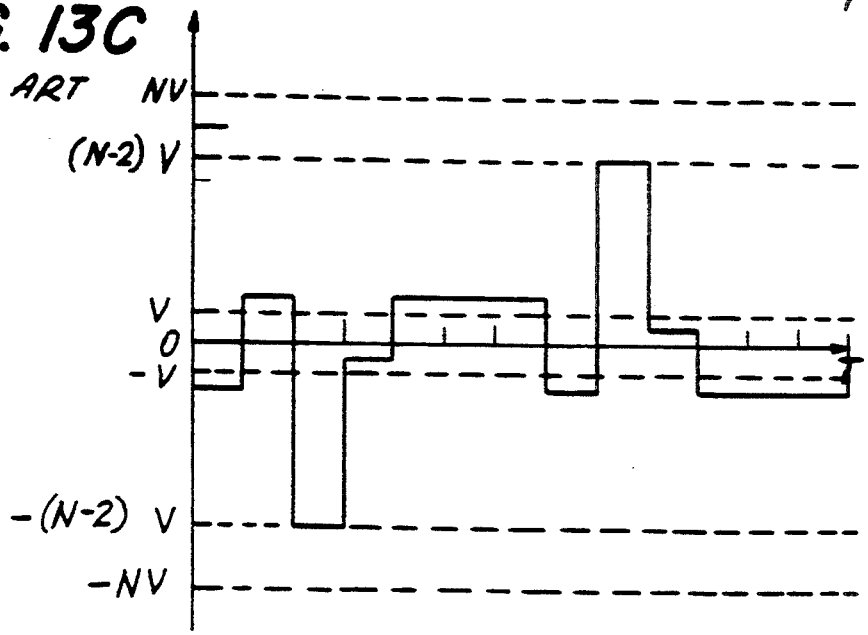
FIG. 13C PRIOR ART
Figure 14A:
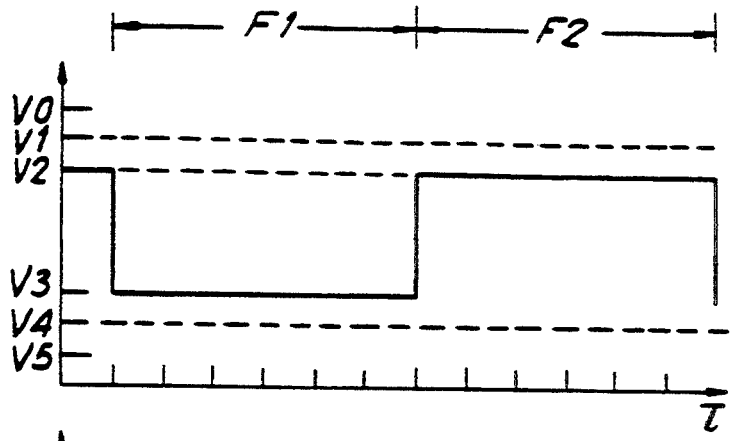
FIG. 14A PRIOR ART
Figure 14B:
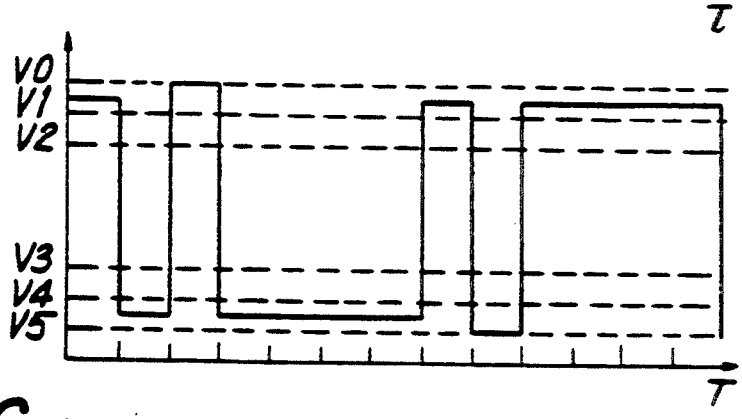
FIG. 14B PRIOR ART
Figure 14C:
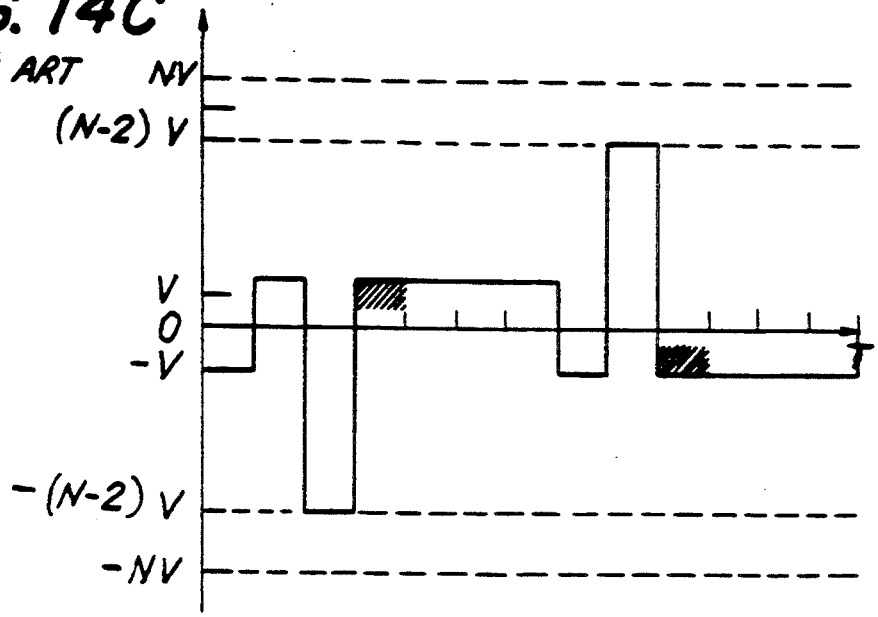
FIG. 14C PRIOR ART
Figure 15:
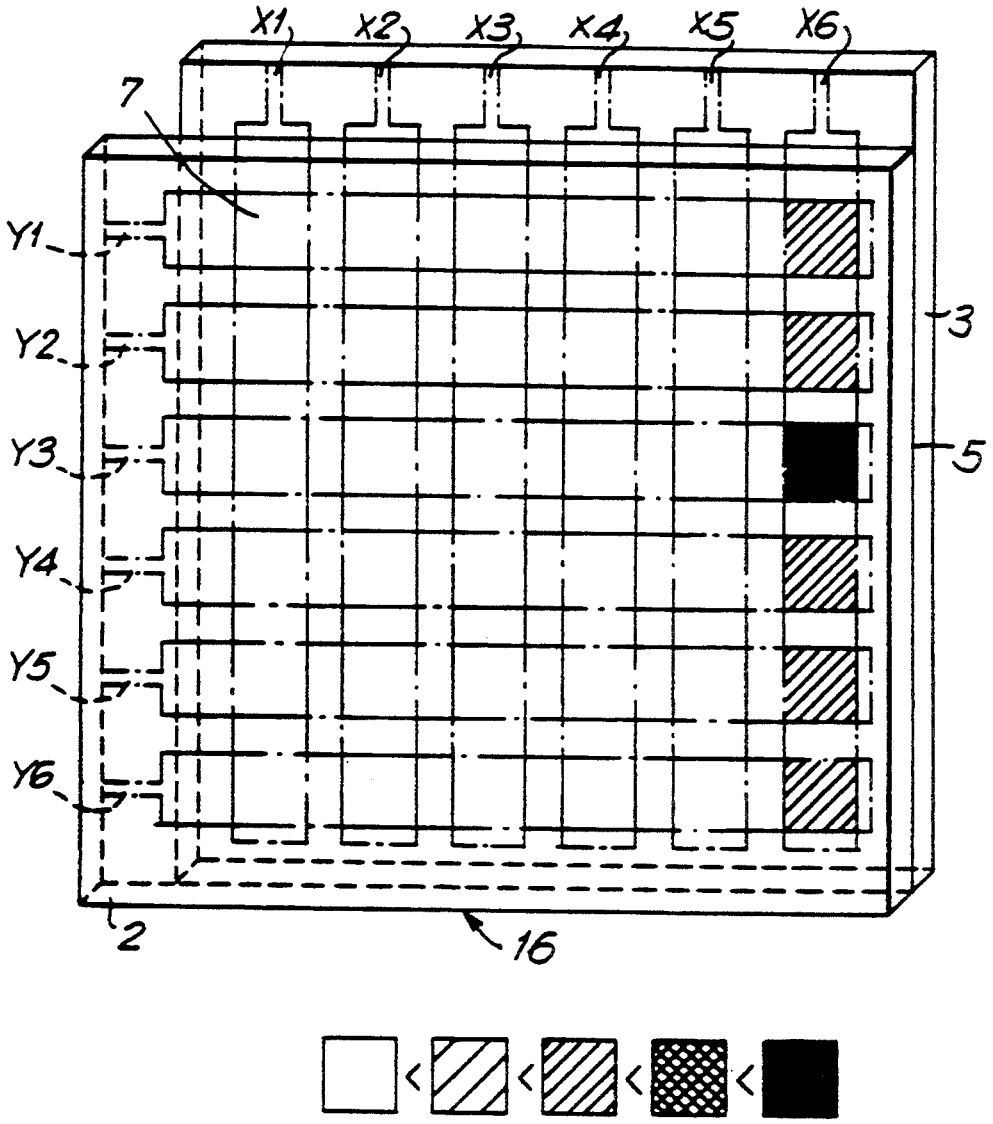
FIG. 15 PRIOR ART
FIG. 15 is a view showing the actual display when the display pattern of FIG., 16 is formed.
Figure 16:
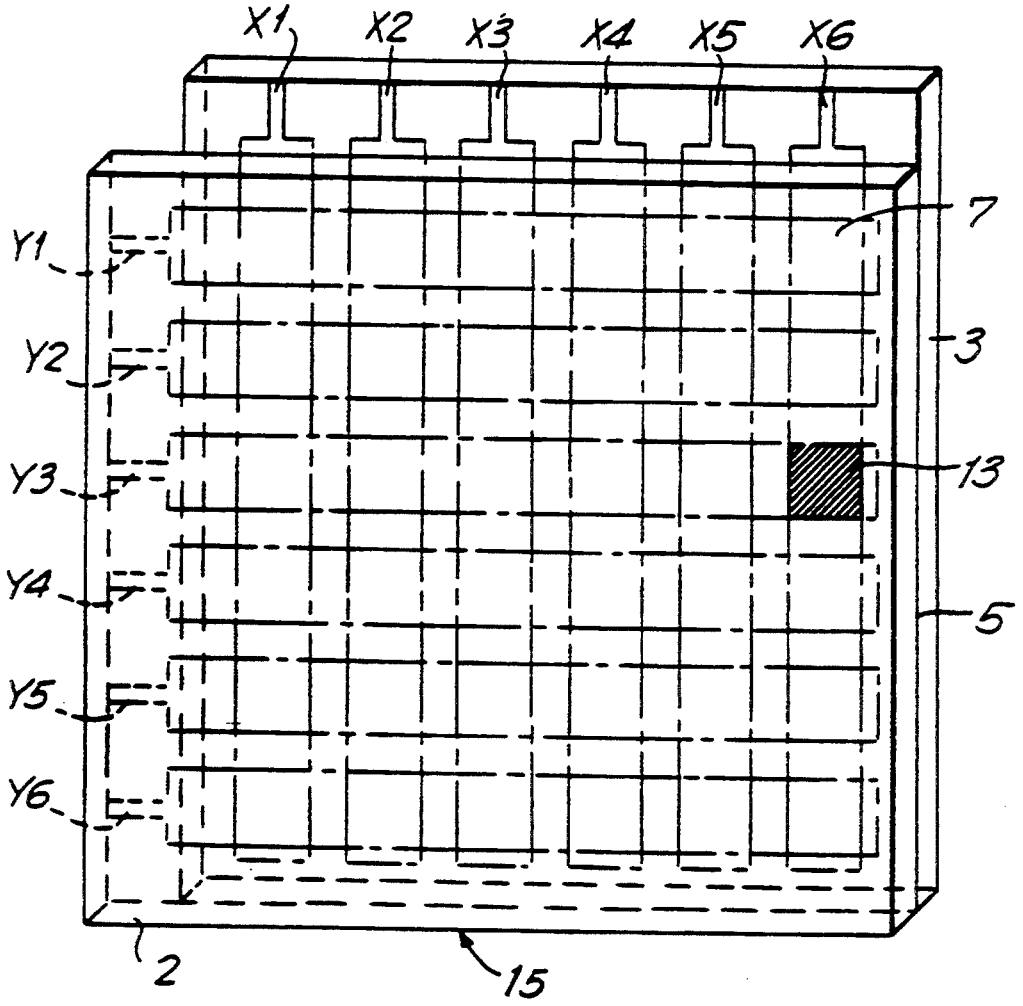
FIG. 16 PRIOR ART
FIG. 16 is a perspective view of a liquid crystal panel wherein another ideal display pattern is formed.
Figure 17A:
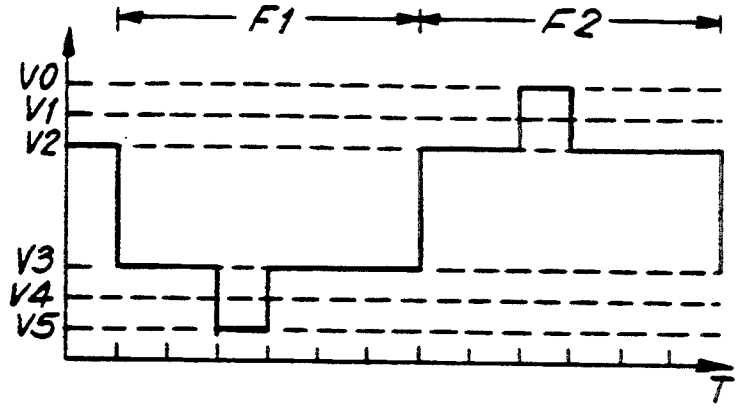
FIG. 17A PRIOR ART
FIGS. 17A–17C and 18A–18C are graphs of waveforms of the actual voltage applied to the liquid crystal panel for forming the display pattern of FIG. 16.
Figure 17B:
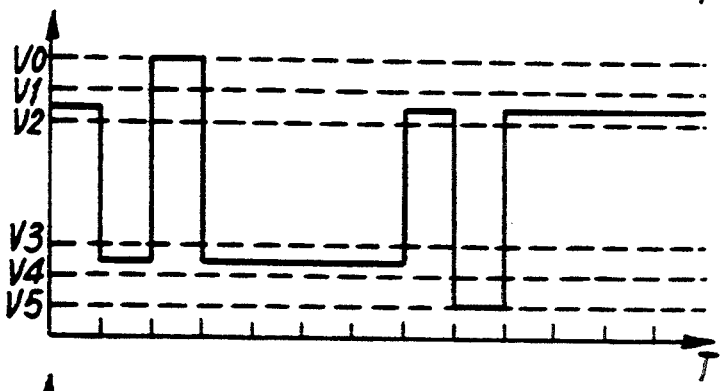
FIG. 17B PRIOR ART
Figure 17C:
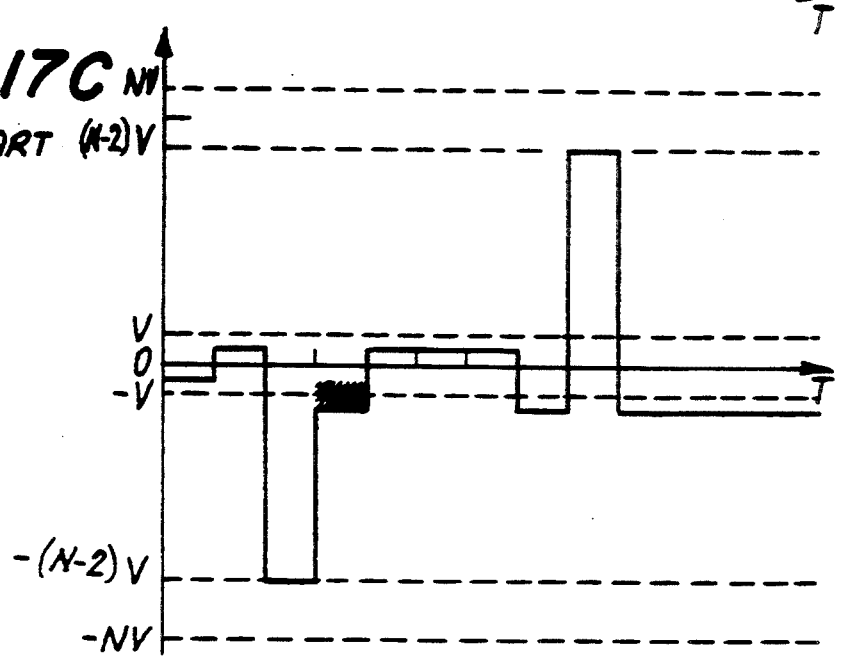
FIG. 17C PRIOR ART
Figure 18A:
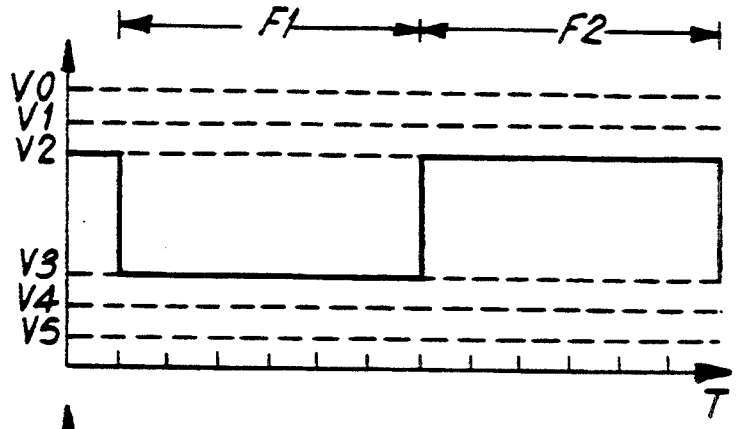
FIG. 18A PRIOR ART
Figure 18B:
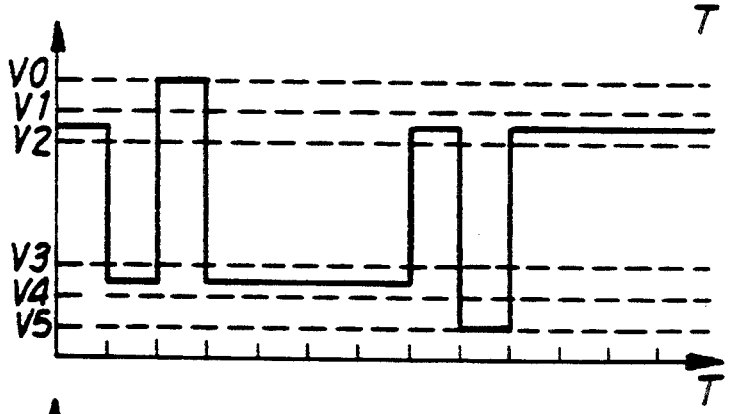
FIG. 18B PRIOR ART
Figure 18C:
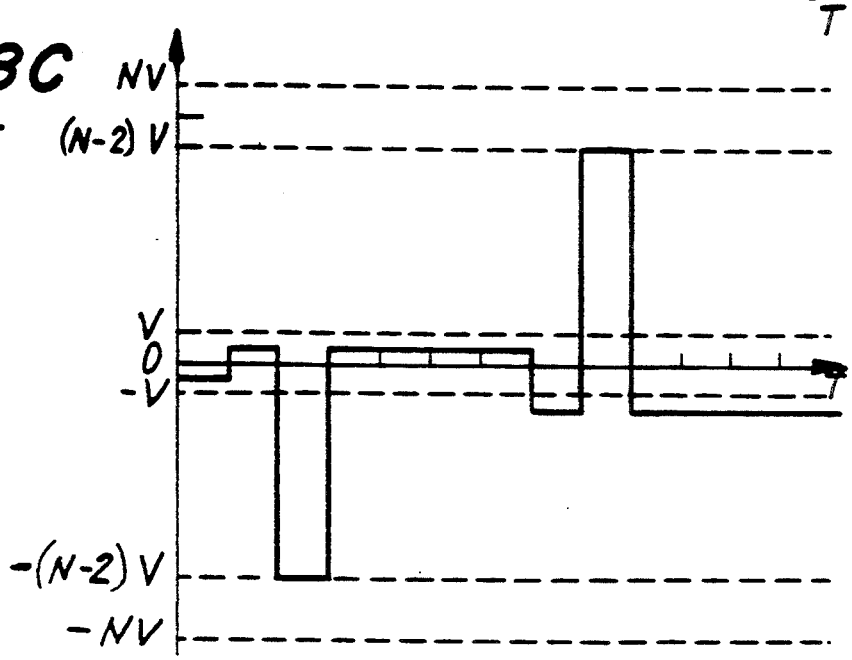
FIG. 18C PRIOR ART
Figure 19:
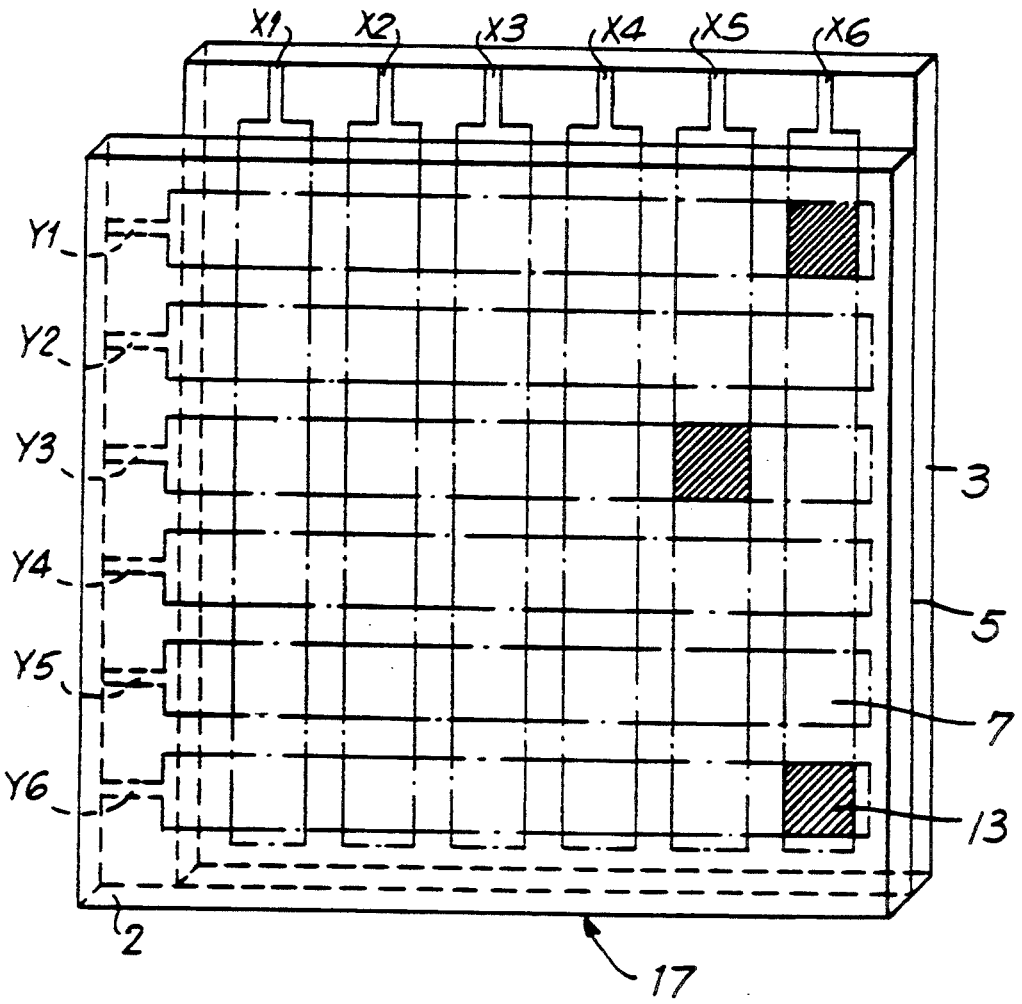
FIG. 19 PRIOR ART
FIG. 19 is a perspective view of the liquid crystal panel wherein another ideal display pattern is formed.
Figure 20:
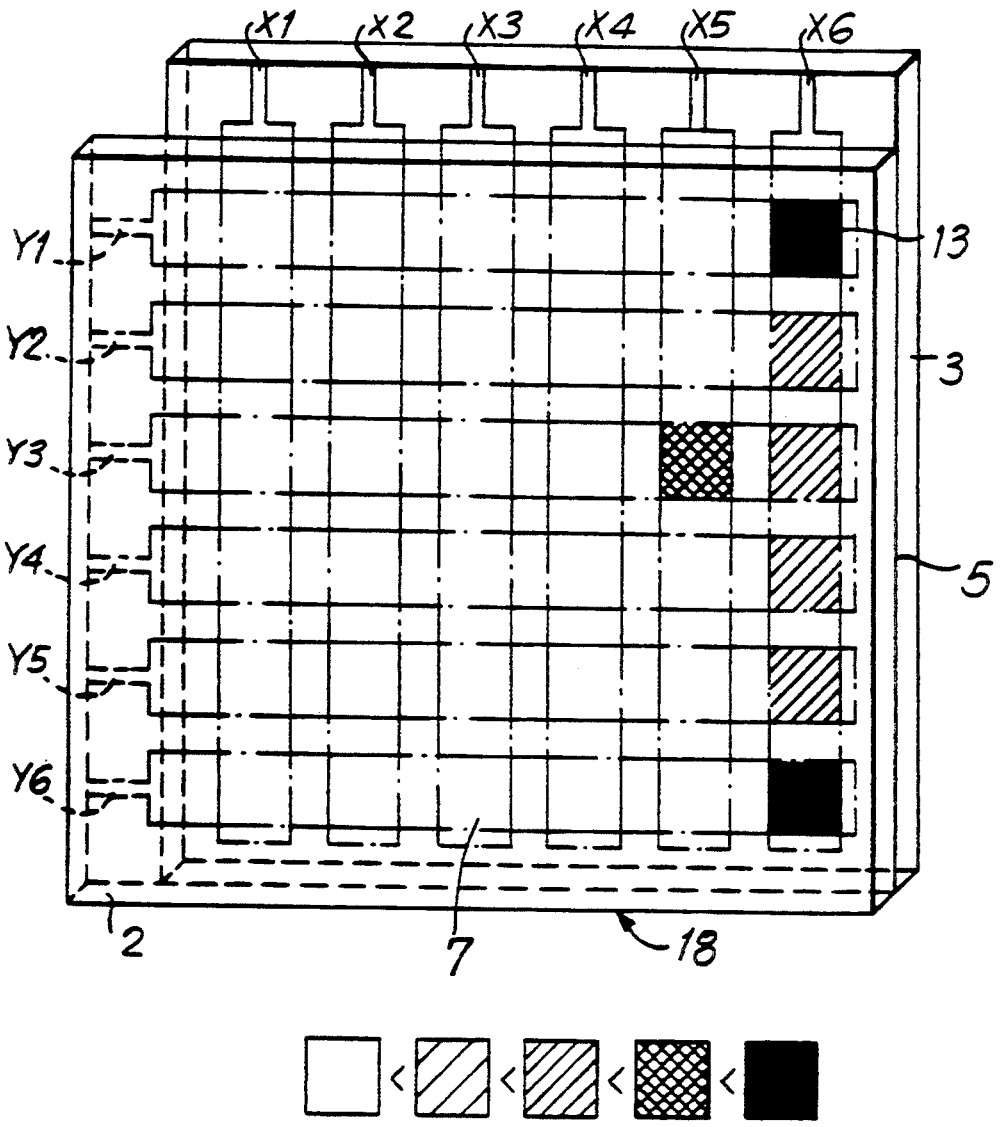
FIG. 20 PRIOR ART
FIG. 20 is a perspective view of the actual display condition when the display pattern of FIG. 19 is formed.
Figure 21A:
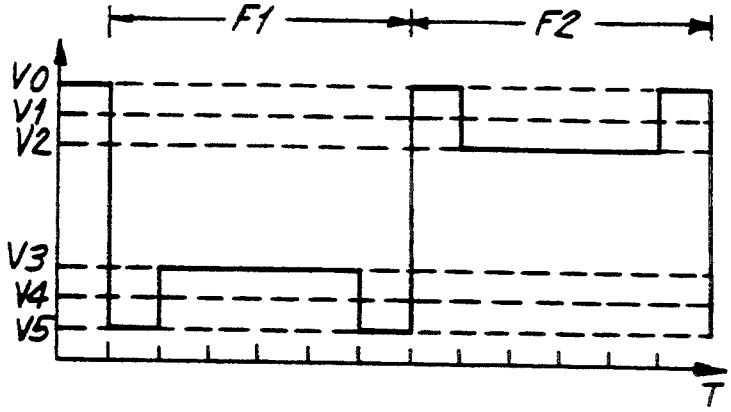
FIG. 21A PRIOR ART
FIGS. 21A–21C and 22 are graphs of waveforms of the voltage actually applied to the liquid crystal panel at the time of forming the display pattern of FIG. 19.
Figure 21B:
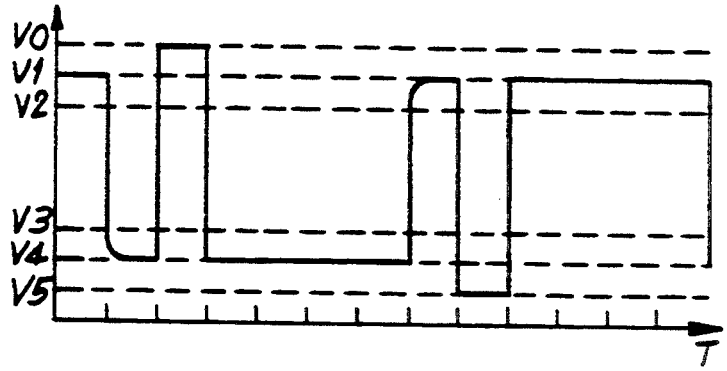
FIG. 21B PRIOR ART
Figure 21C:
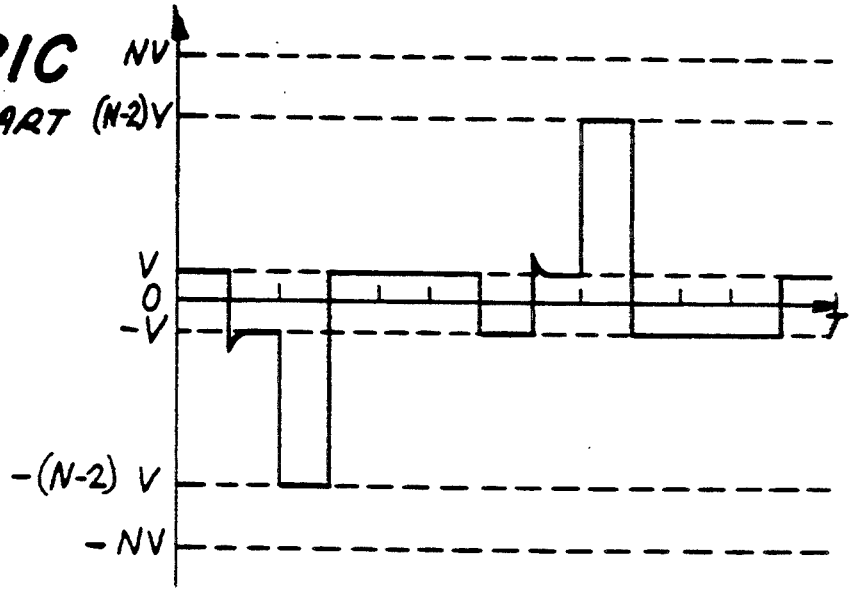
FIG. 21C PRIOR ART
Figure 22:
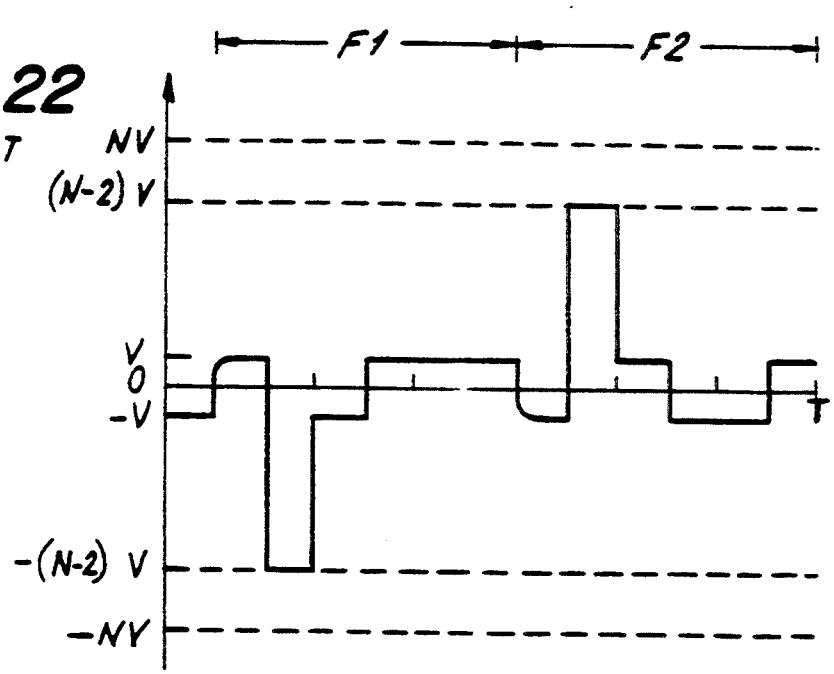
FIG. 22 PRIOR ART
Figure 26:
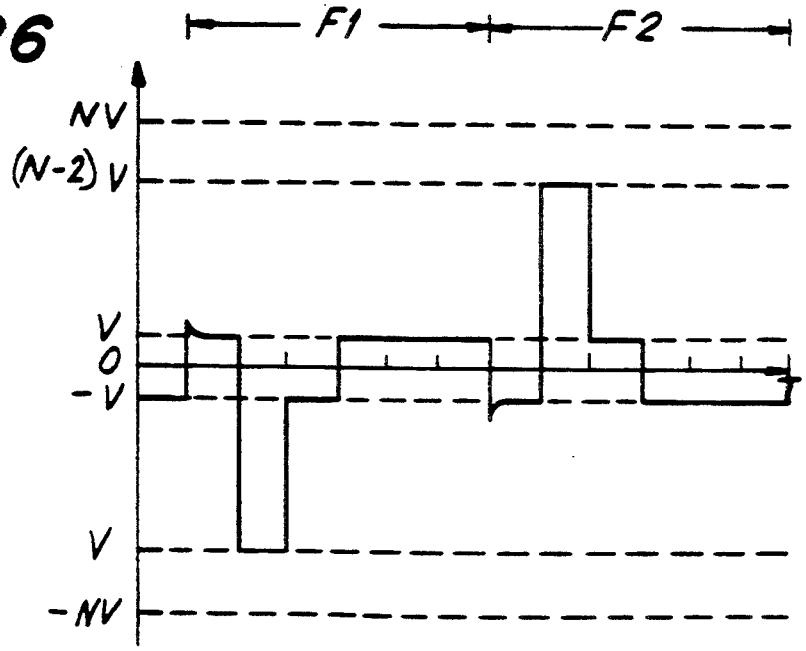
FIG. 26 PRIOR ART
FIGS. 25A–25C and 26 are waveforms of the voltage actually applied to the liquid crystal panel at the time of forming the display pattern of FIG. 23.
Figure 23:
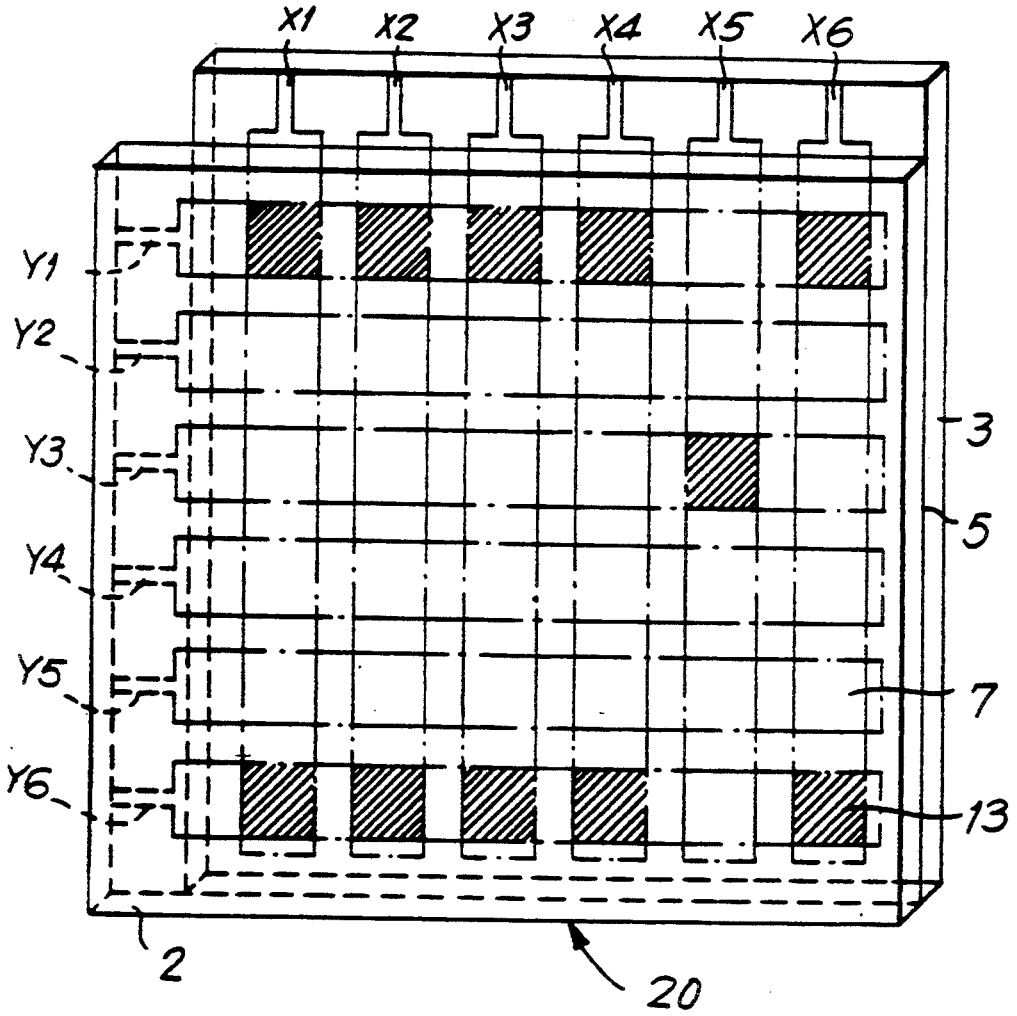
FIG. 23 PRIOR ART
FIG. 23 is a perspective view of a liquid crystal panel wherein another ideal display pattern is formed.
Figure 24:
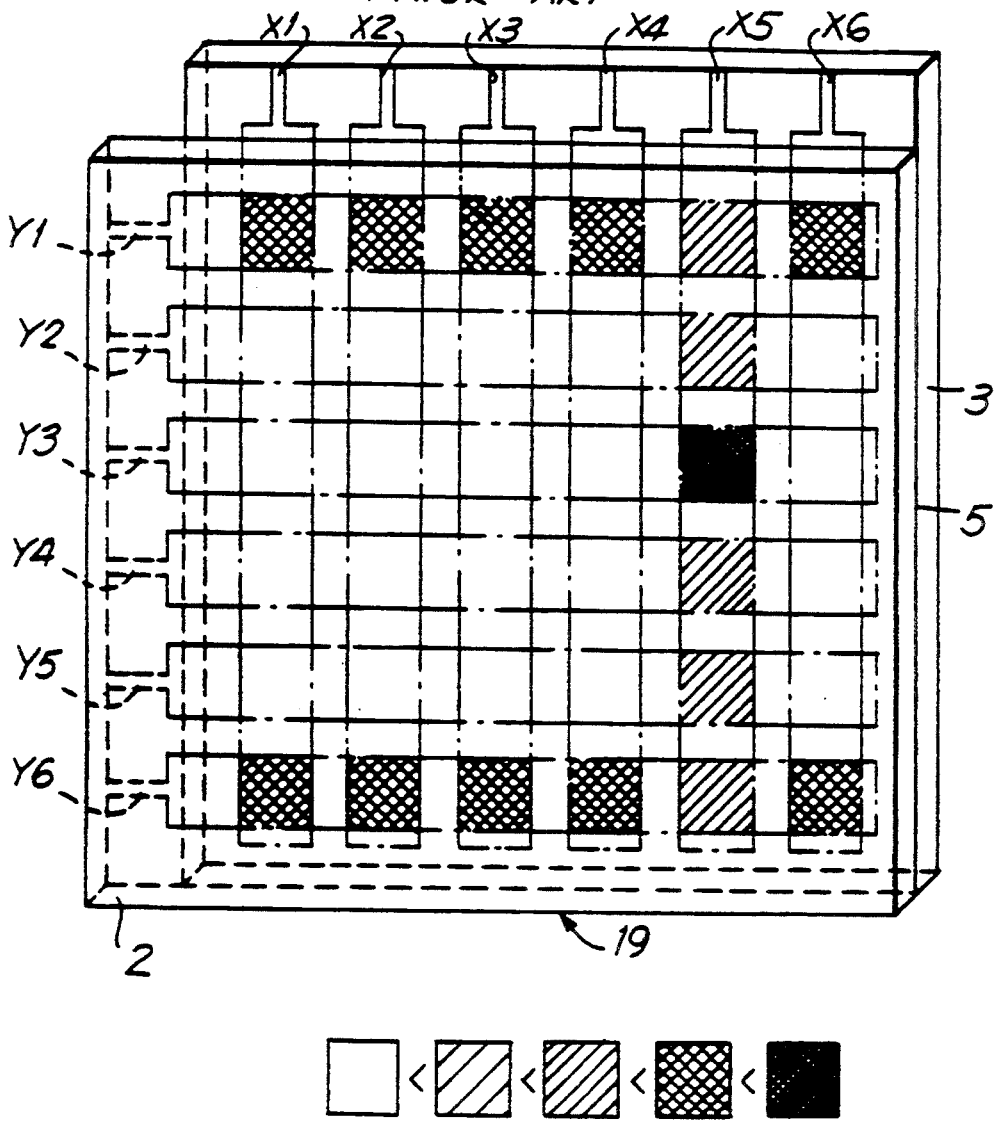
FIG. 24 PRIOR ART
FIG. 24 is a view showing the actual display condition when the display pattern of FIG. 23 is formed.
Figure 25A:
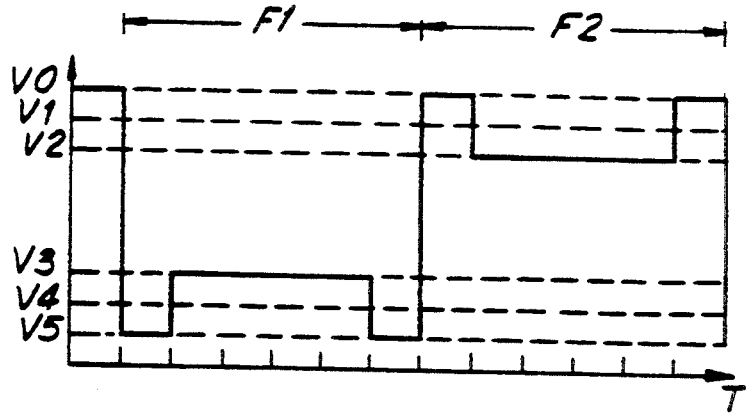
FIG. 25A PRIOR ART
Figure 25B:
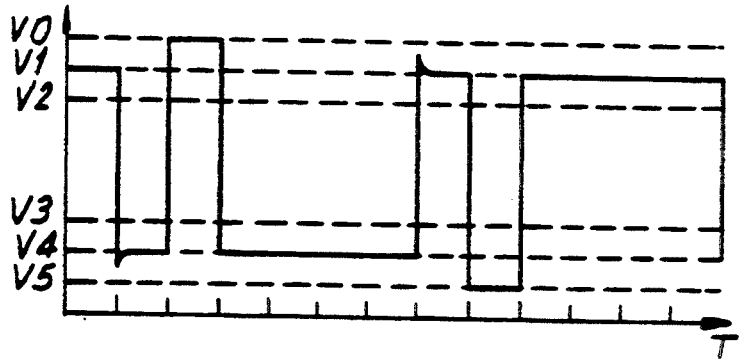
FIG. 25B PRIOR ART
Figure 25C:
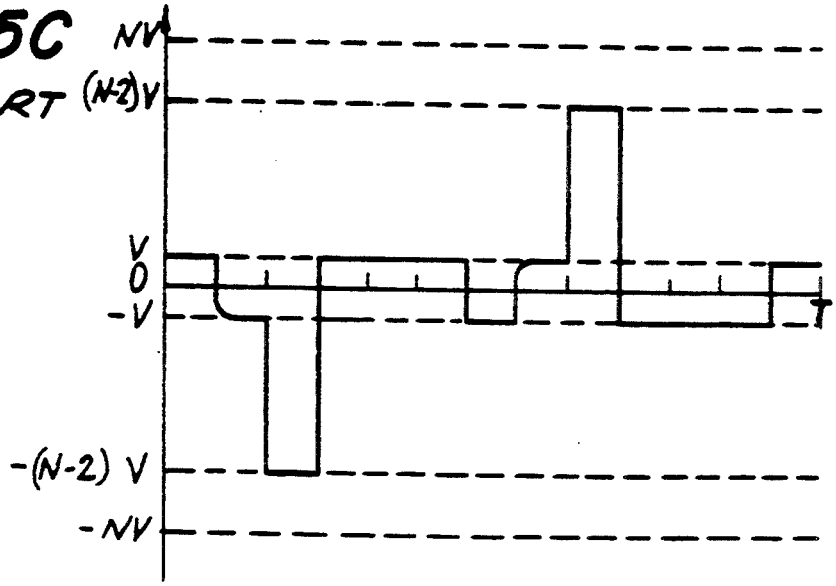
FIG. 25C PRIOR ART
Figure 27:
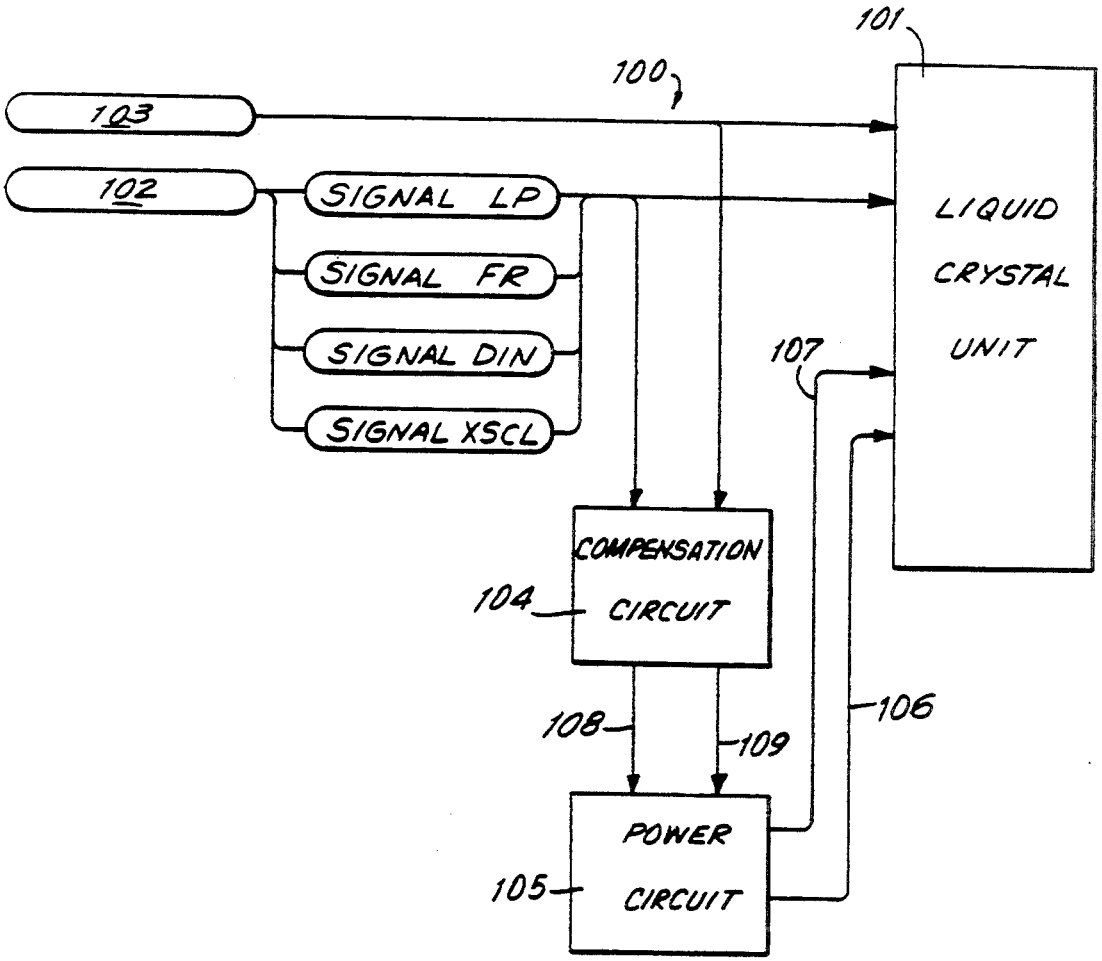
FIG. 27 is a block diagram of the liquid crystal display device constructed in accordance with the present invention.

Reference is made to FIGS. 27 through 34 in which a liquid crystal display device (LCD), generally indicated as 100, for eliminating zebra crosstalk is provided. As mentioned above, the degree of zebra crosstalk is based upon the difference I ($I=N_{ON}-M_{ON}$) between the number of ON dots $N_{ON}$ on the common electrode which is to be selected next and the number of ON dots $M_{ON}$ on the common electrode which is presently selected. Accordingly, during operation of the liquid crystal display device, a waveform compensation value based upon the value of I must be calculated to eliminate zebra crosstalk.

To make this compensation LCD 100 includes a liquid crystal unit 101 having a liquid crystal panel and corresponding driving circuit. A combined control signal 102 for controlling the liquid crystal display device composed of a plurality of signals including a latch signal LP, a frame signal FR, a data-in signal DIN, an X driver shift: clock signal XSCL and others (not shown) is input into liquid crystal unit 101. A data signal 103 is also input in liquid crystal unit 101.

LCD 100 also includes a waveform compensation signal generating compensation circuit 104 which receives control signal 102 and data signal 103. Compensation circuit 104 calculates the value of I and transmits a sign signal 108 indicating the sign of I and a strength signal 109 indicating the absolute value of I. Strength signal 109 is in an active condition during the period corresponding to the absolute value of I.

A power circuit 105 receives strength signal 109. Power circuit 105 produces a common electrode driving power source (Y power source) 106, supplying voltage to liquid crystal unit 101 in accordance with sign signal 108 and the strength signal 109. Simultaneously, power source 105 produces a segment electrode driving power source (X power source) 107. Power circuit 105 also performs the voltage compensation of Y power source 106.

The operation of LCD 101 is now explained below. Compensation circuit 104 first receives data signal 103 during the period when a common electrode is selected. Compensation circuit 104 calculates the number of ON dots $N_{ON}$ on the common electrodes presently selected and the number of ON dots $M_{ON}$ on the common electrode which is to be selected next, and the difference between the number of ON dots $N_{ON}$ on the common electrode which is presently selected and the number of ON dots $M_{ON}$ on the common electrode, the value of I. When the switch is made between successive selected common electrodes, the resulting sign and absolute value of I are output as sign signal 108 and strength signal 109, respectively. At the same time, the received $M_{ON}$ value is stored as the number of ON dots, $N_{ON}$, on the common electrode which is presently selected. Power circuit 105 compensates the voltage of Y power source 106 in accordance with sign signal 108 and strength signal 109.

Due to the above operation, the display unevenness resulting from the zebra crosstalk on the liquid crystal panel can be prevented. To compensate the applied voltage, a predetermined voltage is applied to the spike shaped noise generated in the driving waveform applied to the liquid crystal panel in a direction which cancels the noise for a period corresponding to the strength of the noise. The direction of the predetermined voltage is determined by sign signal 108, while the period for using the predetermined voltage is determined by strength signal 109.

Figure 28:
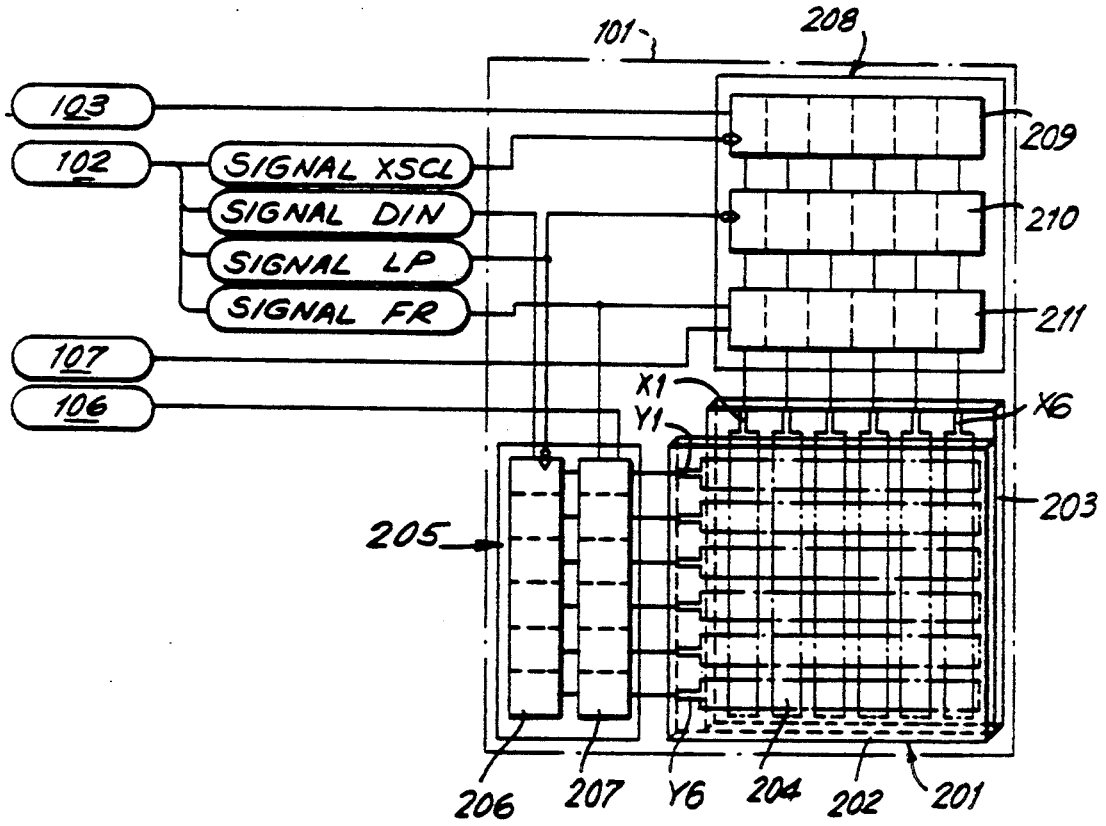
FIG. 28 is a schematic diagram of a liquid crystal unit constructed in accordance with the invention.

As seen from FIG. 28 liquid crystal unit 101 includes a liquid crystal panel 201, having a plurality of common electrodes Y1 through Y6 horizontally oriented on substrate 202 and a plurality of segment electrodes X1 through X6 vertically oriented on a substrate 203. A liquid crystal layer 215 is sandwiched between substrates 202 and 203. Common electrodes Y1 through Y6 and segment electrodes X1 through X6 intersect each other, forming a display dot 204 at each intersection, forming a crystal panel having a 6×6 dot structure. This size is by way of example only for ease of explanation, the size of liquid crystal panel 201 may be larger or smaller.

A common electrode driving circuit 205 comprises a shift register circuit 206 and a level shifter circuit 207. Shift register circuit 206 receives signal DIN and provides an output to level shifter circuit 207. Level shifter 207 also receives signal FR and power signal 106 as inputs. The output from level shifter circuit 207 is introduced to each common electrode Y1 through Y6 of the liquid crystal panel 201.

A segment electrode driving circuit 208 comprises a shift register circuit 209, a latch circuit 210 and a level shifter circuit 211. Shift register circuit 209 receives signal XSCL and data signal 103 and provides an output to latch circuit 210. Latch circuit 210 also receives signal DIN and provides an output to level shifter circuit 211. Level shifter circuit 211 also receives signal FR and power signal 107 as inputs. The output from level shifter circuit 211 is introduced to each segment electrode X1 through X6 of liquid crystal panel 201.

Figure 29:
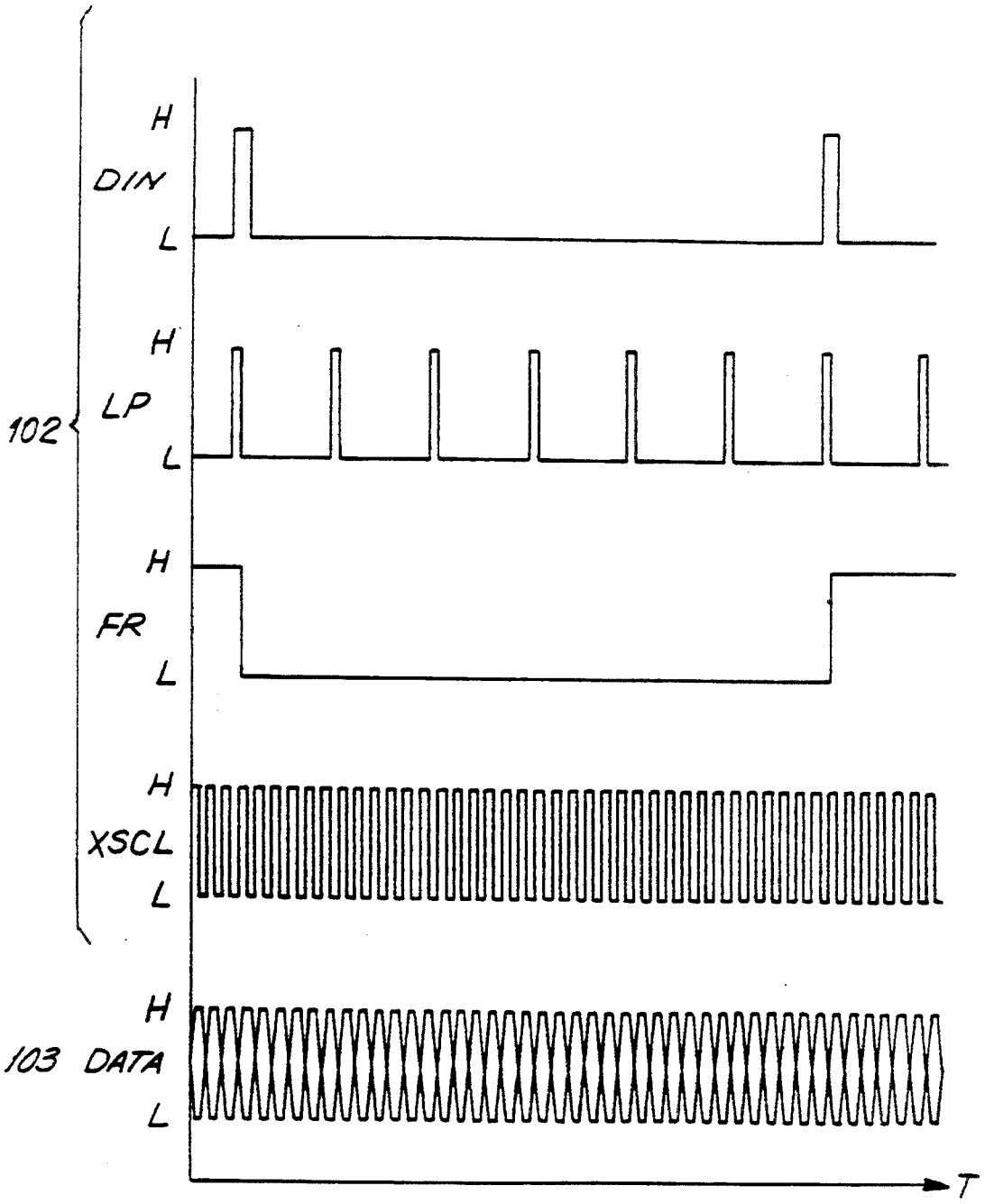
FIG. 29 is a timing chart for the control signal and the data signal in accordance with the present invention.

Reference is made to FIG. 29 wherein a timing chart showing each signal DIN, LP, FR, XSCL of the control signal 102 and the data signal 103 is provided. Signals DIN and LP act as the data clock and shift clock, respectively, for shift register circuit 206 of common electrode driving circuit 205. Signal DIN is input to shift register circuit 206 at the falling edge of signal LP triggering the transmission of signal DIN.

Signal DIN has "H" as an active element, i.e., when signal DIN is generated. Signal DIN is sequentially output over an interval corresponding to the number of common electrodes Y1 through Y6 of liquid crystal panel 201 or a number of occurrences of the signal LP larger than the number of common electrodes Y1 through Y6 in the normal case. The "H" data passes through shift register circuit 206, while the "L" data passes through the others. Depending upon the content of shift register circuit 206, the selected voltage is supplied to common electrodes Y1 through Y6 by level shifter circuit 207 during an active period and the non-selected voltage is supplied to common electrodes Y1 through Y6 during the passive period. The selected voltage and the non-selected voltage are supplied from Y power source 106.

Data signal 103 and signals XSCL and LP act as the data and shift clock of shift register circuit 209 of segment electrode driving circuit 208, and the latch clock of latch circuit 210. Data signal 103 acts as a signal for determining whether display dot 204 on the next common electrode to be selected is ON or OFF during the period when the common electrode of the liquid crystal panel 201 is selected. Data signal 103 indicates the ON state. Data signal 103 is received in shift register circuit 209 at the falling edge of signal XSCL. Data signal 103 thus corresponds to the display dots on the common electrode which is next to be selected during the period when a common electrode is presently selected. When the receipt of data signal 103 in accordance with the signal XSCL is terminated, the contents of shift register circuit 209 is received in latch circuit 210 at the falling edge of signal LP. Then, in the active case, the ON voltage is supplied to segment electrodes X1 through X6 by shift register circuit 211. Conversely, in the passive case, the OFF voltage is supplied to the segment electrodes X1 through X6. The ON voltage and OFF voltage are supplied by X power source 107.

Additionally, signal FR (frame signal) is input to driving circuits 205, 208 to achieve alternating driving of liquid crystal panel 201. Signal FR switches in response to the falling edge of signal LP, and switches the selection of the potential of the driving voltage. Namely, the driving voltage includes two sets of selected and non-selected voltages, and ON and OFF voltages, which are switched by frame signal FR.

The above structure of the liquid crystal unit 101 and the driving method therefor is only by way of example for explaining the present invention. The structure of liquid crystal unit 101 is not limited to the structure.

Figure 30:
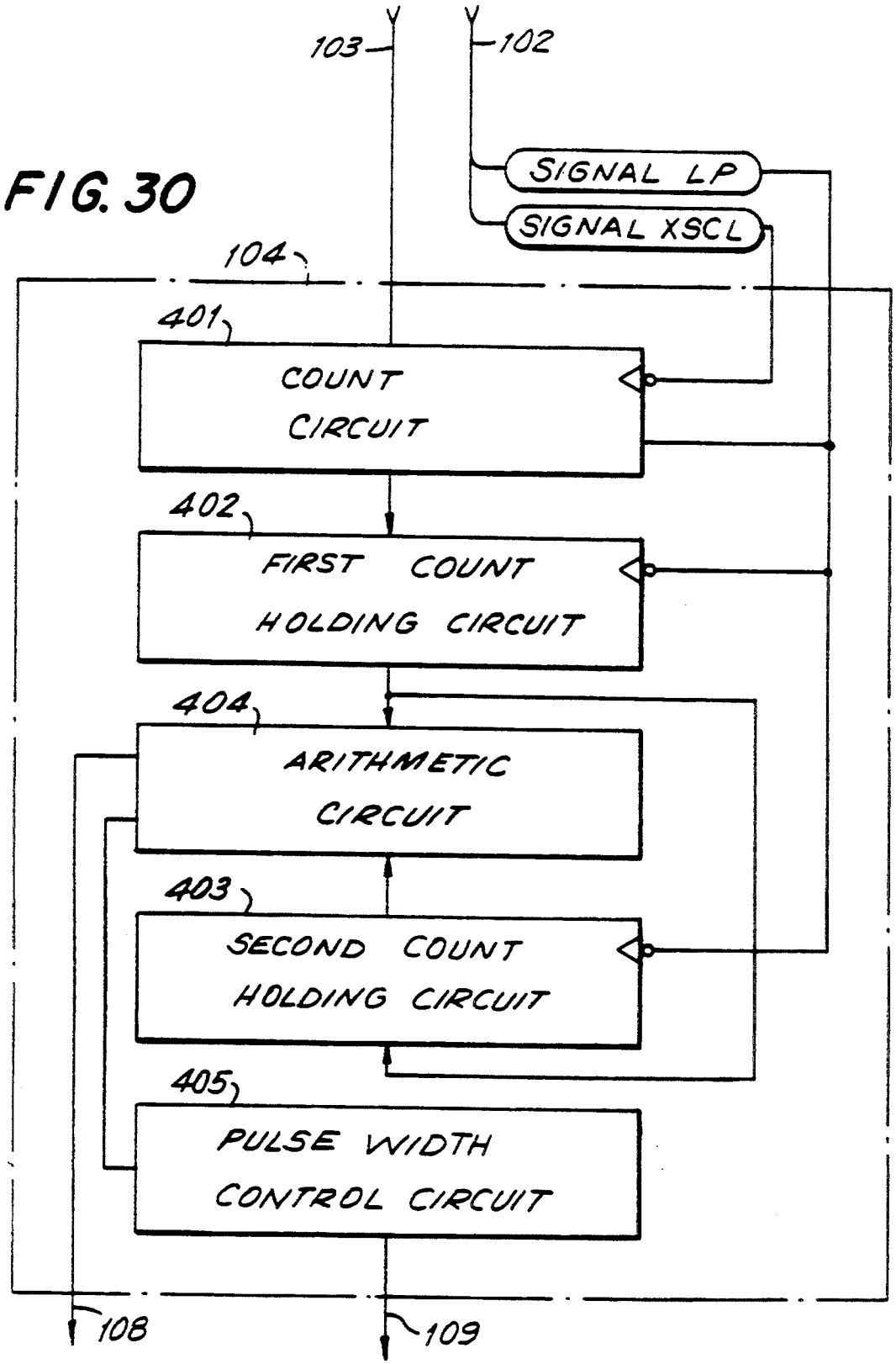
FIG. 30 is a block diagram of a compensation circuit in accordance with the present invention.

Reference is now specifically made to FIG. 30 in which a block diagram of compensation circuit 104 is provided. A count circuit 401 receives data signal 103 and counts the number of ON dots within the display dots 204 on the (n+1)th common electrode during the period when the nth common electrode of the liquid crystal panel 201 is selected. Counter circuit 401 counts the number of ON dots on the (N+1)th common electrode by counting the number of dots from the falling edge of signal LP of control signal 102 to the falling edge of the next signal LP when data signal 103 is active at the falling edge of signal XSCL. The count value of the counter circuit 401 is reset to zero, while the discrete counted value is output to a first counter holding circuit 402 at the time of falling edge of signal LP. The counting is begun again and repeats successively. It is not always necessary to count every dot unit if circumstances require, for example, if the number of segment electrodes X1 through X6 were as high as 640, there is no noticeable loss in performance even with a counting error set as high as 16 dots.

First counter holding circuit 402 receives the count value just before the count value of counter circuit 401 becomes zero at the falling edge of signal LP. At the same time, a second counter holding circuit 403 receives the count value from first counter holding circuit 402, wherein the discrete value is transferred just before first counter holding circuit 402 receives the next count value from counter circuit 401, at the falling edge of the signal LP. Accordingly, when first counter holding circuit 402 receives the number of ON dots $M_{ON}$ of display dots 204 on the (n+1)th common electrode, second counter holding circuit 403 receives the number of ON dots $N_{ON}$ of display dots 204 on the nth common electrode.

First counter holding circuit 402 and second holding counter circuit 403 output their respective $M_{ON}$ and $N_{ON}$ values to an arithmetic circuit 404. Arithmetic circuit 404 calculates the difference between the value of $M_{ON}$ and $N_{ON}$ produced from first and second counter holding circuits 402 and 403, namely $I=N_{ON}-M_{ON}$, and outputs the sign of I as sign signal 108, and at the same time, the absolute value of I is output to a pulse width control circuit 405.

Pulse width control circuit 405 outputs the active signal for a period corresponding to the absolute value of I, which is input from the arithmetic circuit 404, as strength signal 109. Pulse width control circuit 405 outputs strength signal 109 at the falling edge of signal. LP. However, the above signal is not output at the falling edge of signal LP when the signal FR is changing.

The width W of strength signal 109 is related to the absolute value of I through an increment function: $W=a_K\times I^K+b_K\times I^K$, where $a_K$ and $b_K$ are constants and K is 0, 1, 2, 3 . . . . The above width W can be differentiated for both positive and negative values of I. In this embodiment, $W=a_1\times I$ and is defined regardless of whether the value of I is positive or negative.

Figure 31:
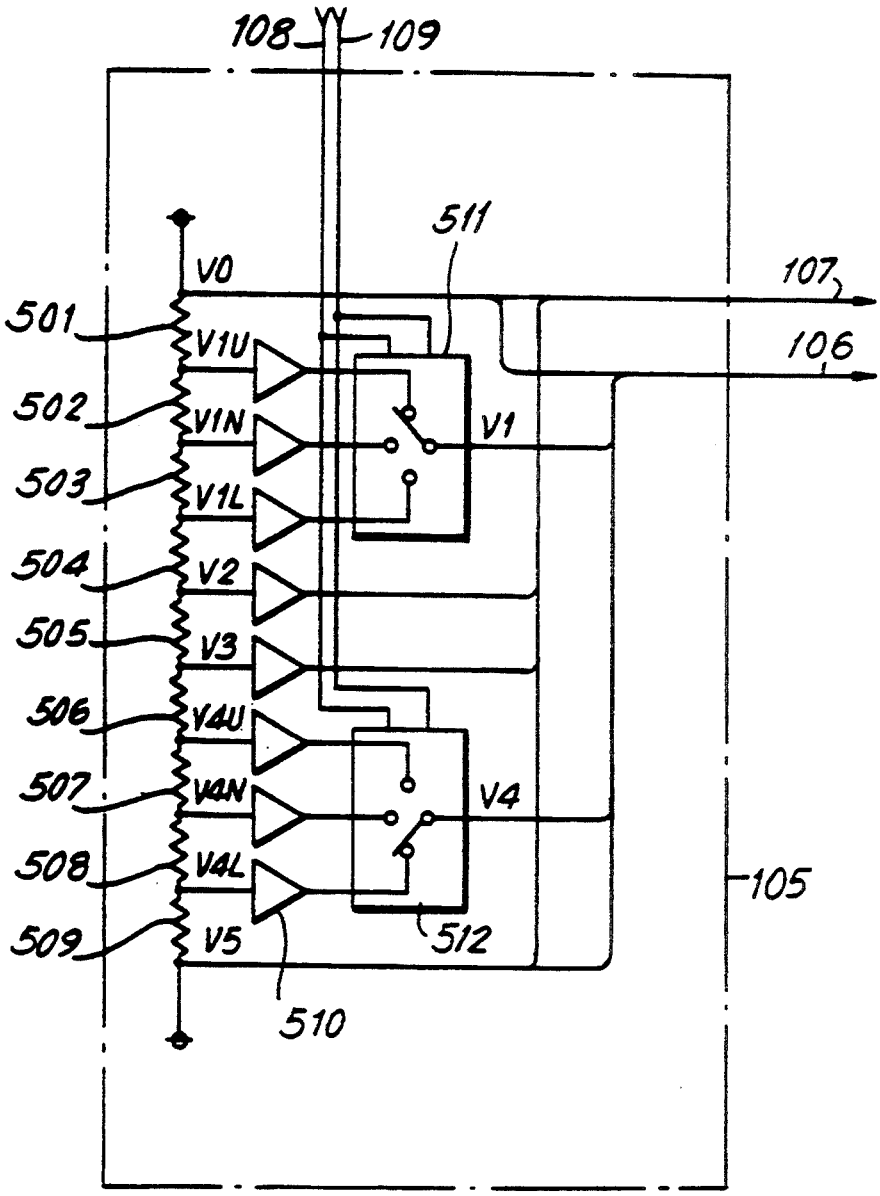
FIG. 31 is a circuit diagram of the power circuit in accordance with the present invention.

Reference is now specifically had to FIG. 31 in which a circuit diagram of the voltage power circuit 105 is provided. A plurality of resistors 501 through 509 are serially connected and a voltage V0 and a voltage V5 are supplied at the ends of the resistors providing a series of voltage dividers thereof. If the resistance value of each resistor 501 through 509 are defined as R1 through R9, respectively, the relation is $$R1=R9$$

$$R2=R8$$

$$R3=R7,$$

$$R4=R6$$

and;

$$R1+R2=R3+R4=R9+R8=R7+R6==R5/(n-4).$$

(n is a constant)

Therefore, if the voltage at the end of each respective resistor 501 through 509 is defined as V0, V1U, V1N, V1L, V2, V3, V4U, V4N, V4L, and V5, the following relationships occur.

$$\begin{aligned} V0 - V1N &= V1N - V2 \\ &= V4N - V5 = V3 - V4N \\ &= (V2 - V3)/(n - 4) \\ K1 &= (V1U - V1N)/(V0 - V1N) \\ &= (V4N - V4L)/(V4N - V5) \\ K2 &= (V1N - V1L)/(V0 - V1N) \\ &= (V4U - V4N)/(V4N - V5) \end{aligned}$$ ($n$ is a constant).

Wherein, the resistance value of each resistors 501 through 509 is set so that the relation of K1 and K2 satisfies the condition:

$$0<K2,\ K1\leqq 1.$$

A respective voltage circuit 510 for stabilizing divided voltages V1U, V1N, V1L, V2, V3, V4U, V4N, and V4L formed by each resistor 501 through 509, is provided at the junction of the respective resistors, having the same voltage as the input voltage but having a low impedance. In an exemplary embodiment stabilizing circuit 510 includes an operational amplifier having a voltage follower circuit construction.

A switch 511 and a switch 512 are provided. Both receive sign signal 108 and strength signal 109 as inputs. Switches 511 and 512 are switched in accordance with the inputs of sign signal 108 and strength signal 109. Switch 511 selects between voltage inputs V1U, V1N and V1L, while switch 512 selects between V4U, V4N and V4L. Where strength signal 109 is active and sign signal 108 is positive, switches 511 and 512 are switched to the voltage V1U and the voltage V4L, respectively. When strength signal 109 is active and sign signal 108 is positive, switches 511 and 512 are switched to the voltage V1L and the voltage V4U, respectively. When strength signal 109 is passive, switches 511 and 512 are switched to the voltage V1N and the voltage V4N, respectively. Each voltage is output from switches 511 and 512 as the output voltages V1 and V4 respectively. Voltages V1 and V4, and the voltages V0 and V5 are output as Y power source 106. Additionally, the voltages V0, V2, V3, and V5 are output as the X power source 107. Accordingly, Y power source 106 is comprised of the voltages V0, V1, V4, and V5; the X power source is comprised of the voltages V0, V2, V3, and V5. The voltages are output to liquid crystal unit 101 as a combination of two groups of voltages.

Namely, one set of voltage is as follows.

The voltage V0 of Y power source 106 (selected voltage)

The voltage of V4 of Y power source 106 (non-selected voltage)

The voltage V5 of X power source 107 (ON voltage)

The voltage V3 of X power source 107 (OFF voltage)

The other set of voltage is as follows.

The voltage V5 of Y power source 106 (selected voltage)

The voltage V1 of Y power source 106 (non-selected voltage)

The voltage V0 of X power source 107 (ON voltage)

The voltage V2 of X power source 107 (OFF voltage)

Switching between the two sets of voltages is periodically controlled by signal FR of control signal 102 in the common electrode driving circuit 205 and the segment electrode driving circuit 208.

According to the above structure, when I has a positive value and the selection between common electrodes Y1 through Y6 changes from nth electrode to the (n+1)th electrode, Y power source 106 outputs voltages V1U and V4L during the period corresponding to absolute value of I. When the value of I is negative, Y power source 106 outputs voltages of V1L and V4U to the liquid crystal unit 101 during the period corresponding to the absolute value of I. Further, the voltages V1N and V4N are output as voltages V1 and V4 when strength signal 109 is passive including when I equals zero.

Reference is now made to FIGS. 32 through 35 in which a display and input waveforms for forming the display are provided. FIGS. 33A–33C show one example of the voltage waveform applied to form the displayed pattern of FIG. 32. The waveform of FIG. 33A is the voltage waveform which is applied to segment electrode X4 for forming display dot 601. FIG. 33B is the voltage waveform which is applied to common electrode Y3 for forming display dot 601. FIG. 33C shows the combination voltage waveform derived from FIGS. 33A, 33B which is applied to display dot 601.

Figure 33A:
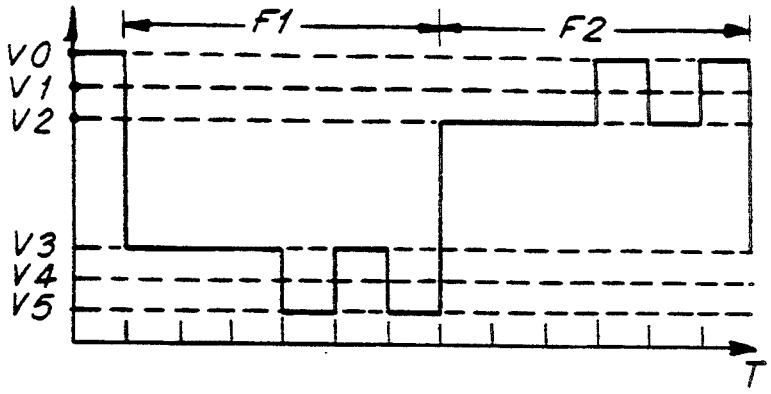
FIGS. 33A–33C are graphs of the voltage waveform applied to form the pattern of FIG. 32.
Figure 33B:
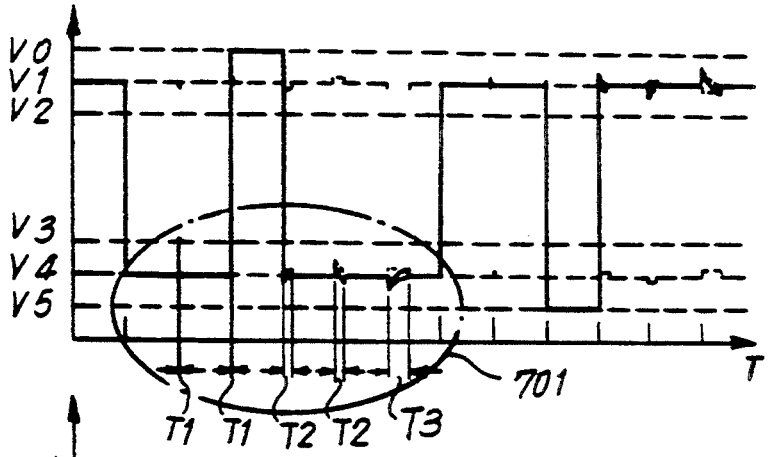
Figure 33C:
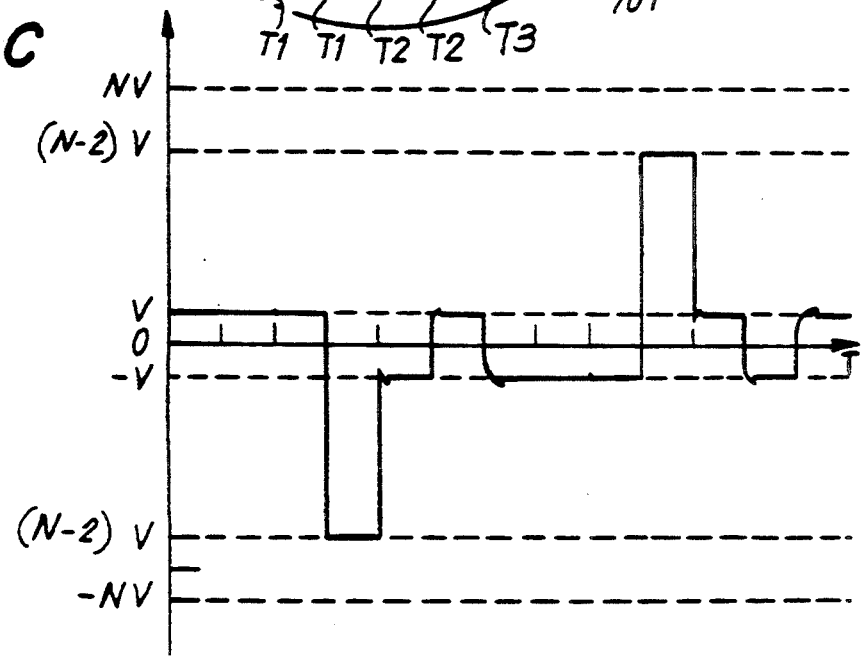

The voltages indicated by the dashed lines in FIGS. 33A and 33B indicate voltages V0, V2, V3, and V5 of X power source 107 and voltages V0, V1, V4 and V5 of Y power source 106.

Figure 34:
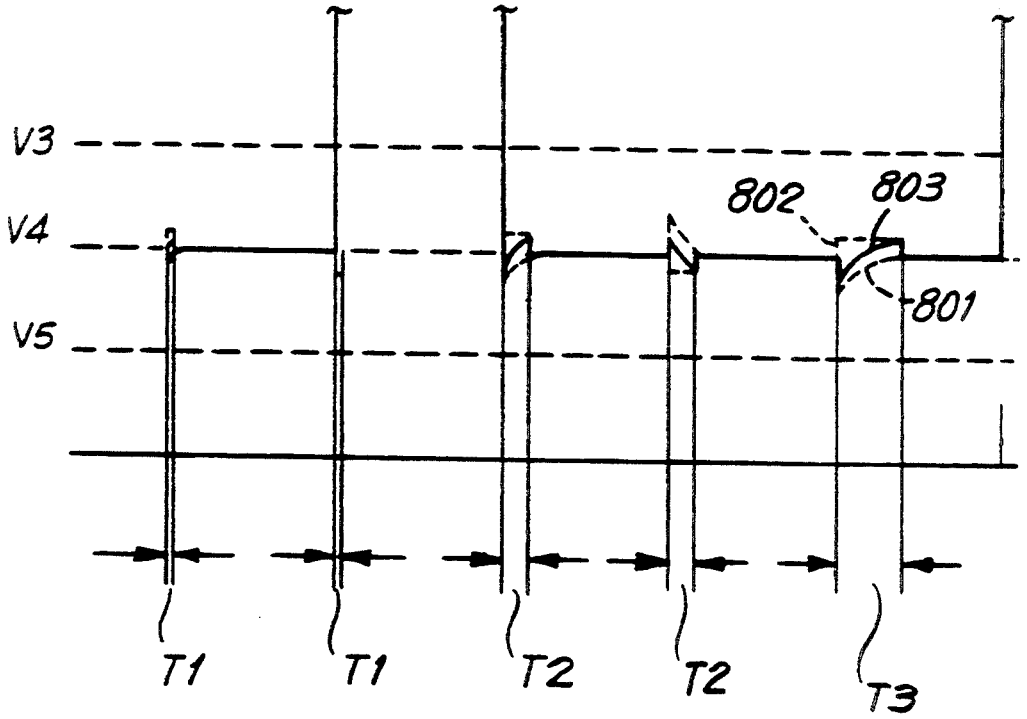
FIG. 34 is a partial exploded view of the waveform of FIG. 33B.

Reference is made to FIG. 34 in which the portion indicated by the circled area 701 in FIG. 33B is shown. A spike shaped noise voltage 801 tends to occur in the common electrode A changeable non-selected voltage 802 is formed by Y power source 106. Voltages 801 and 802 are combined to form voltage 803.

Figure 32:
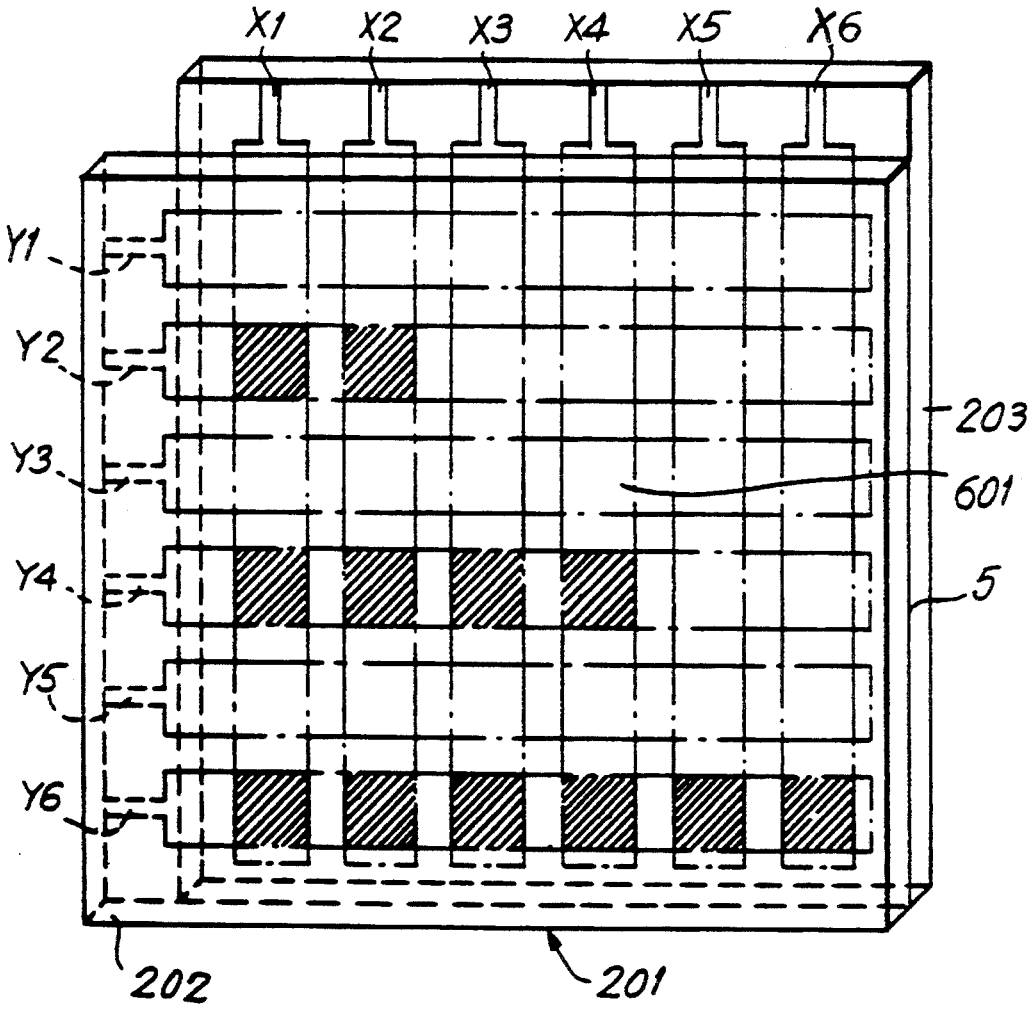
FIG. 32 is a perspective view of a liquid crystal panel wherein a display pattern is displayed.

When the pattern of FIG. 32 is displayed, the difference I between the number of ON dots $N_{ON}$ on the nth common electrode and the number of ON dots $M_{ON}$ on the (n+1)th common electrode at the time of changing the selection from the nth common electrode to (n+1)th common electrode is as follows. When the selection moves from the first common electrode Y1 to the second common electrode Y2, I=−2; when the selection moves from the second common electrode Y2 to the third common electrode Y3, I=2; when the selection moves from the third common electrode Y3 to the fourth common electrode Y4, I=−4; when the selection moves from the fourth common electrode Y4 to the fifth common electrode Y5, I=4; when the selection moves from the fifth common electrode Y5 to the sixth common electrode Y6, I=−6; and when the selection moves from the sixth common electrode Y6 to the first common electrode Y1, I=6.

Thus, in accordance with changes from electrode Y1 to electrode Y2, electrode Y2 to electrode Y3, electrode Y3 to electrode Y4 and so on, the noise voltage 801 increases. However, the period for which the non-selected voltage 802 changes in the direction opposed to the noise voltage 801 increases from T1 to T3, so that combined voltage 803 is compensated. Therefore, the voltage applied to display dot 601 is compensated, thereby realizing an improved display without zebra crosstalk. As mentioned above, when the selected common electrode switches from the nth common electrode to the (n+1)th common electrode of liquid crystal panel 201, the non-selected voltage of Y power source 106 is changed for a period in accordance with the difference I between the number of ON dots on the nth common electrode and the number of ON dots on the (n+1)th common electrode, thereby providing an improved display without zebra crosstalk.

The present embodiment provides a structure for changing the period in which the non-selected voltage is increased or decreased to perform the compensation. Hereinafter this is referred to as a time base compensation of the non-selected voltage.

Reference is now made to FIGS. 35 through 39 wherein a second embodiment of a liquid crystal display device for removing zebra crosstalk is provided.

As discussed above, LCD 100 illustrates a way of providing improved display without zebra crosstalk by compensating the time base of the non-selected voltage. However, the same effect can be obtained even though the non-selected voltage is changed by an amount corresponding to the voltage width based upon the value I over a predetermined period.

Figure 35:
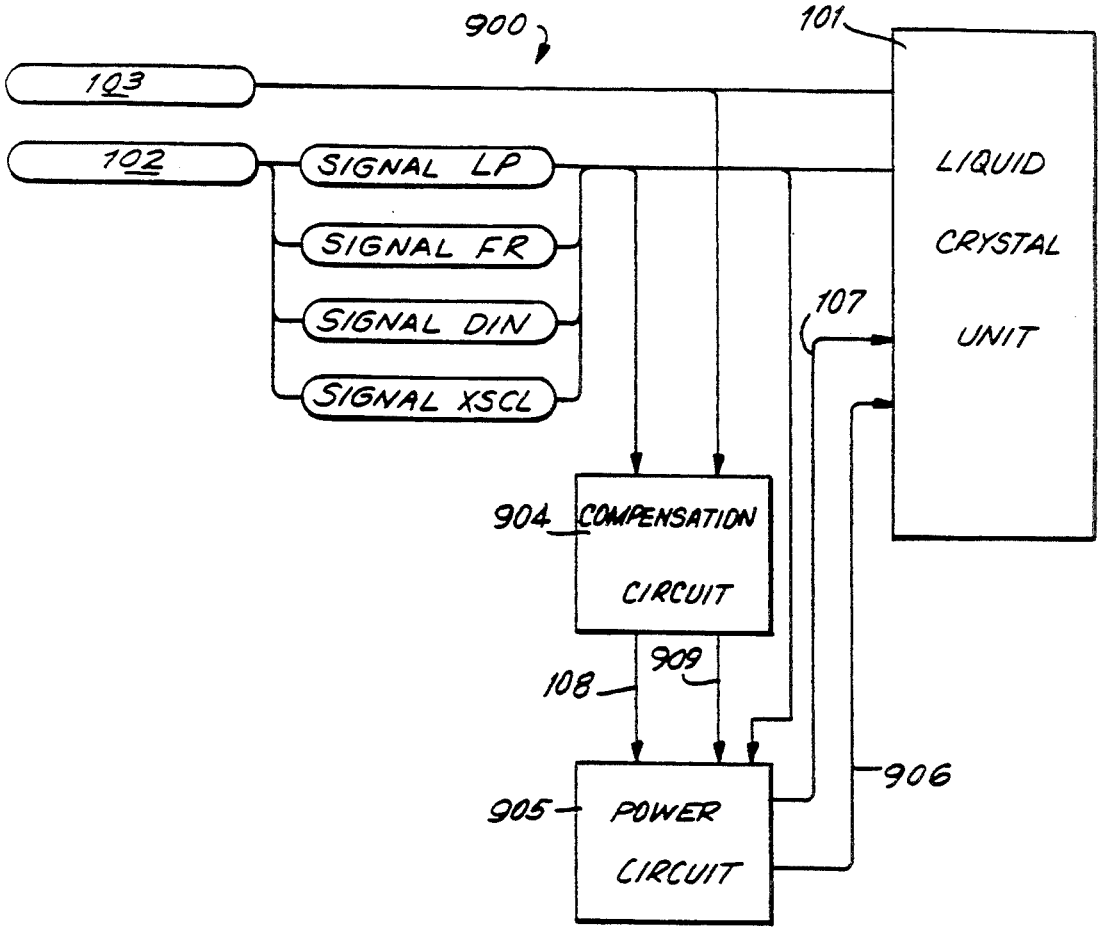
FIG. 35 is a block diagram of a liquid crystal display device in accordance with a second embodiment of the invention.

Reference is now specifically made to FIG. 35 in which a second embodiment of an LCD, generally indicated as 900, is provided. LCD 900 is similar to LCD 100. Like numerals are utilized to indicate like parts, the primary difference being the replacement of compensation circuit 404 and power circuit 105.

A compensation circuit 904 counts the value of I as did compensation circuit 104. The value of I is transmitted to a power circuit 905. Again, the sign of I is sign signal 108 and the absolute value of I is a strength signal 909. Power circuit 905 changes the non-selected voltage of Y power source 906 which is input to liquid crystal unit 101. Y power source 906 is input in a direction corresponding to sign signal 108 and a voltage width in accordance with strength signal 909 over a predetermined period.

In accordance with the above method, the non-selected voltage is changed for the voltage width corresponding to the noise strength for a predetermined period in a direction causing the cancellation of the spike shaped noise generated on the common electrodes of liquid crystal panel 201, thereby providing an improved display without zebra crosstalk. Sign signal 108 determines the direction of change and strength signal 909 determines the width of voltage.

Figure 36:
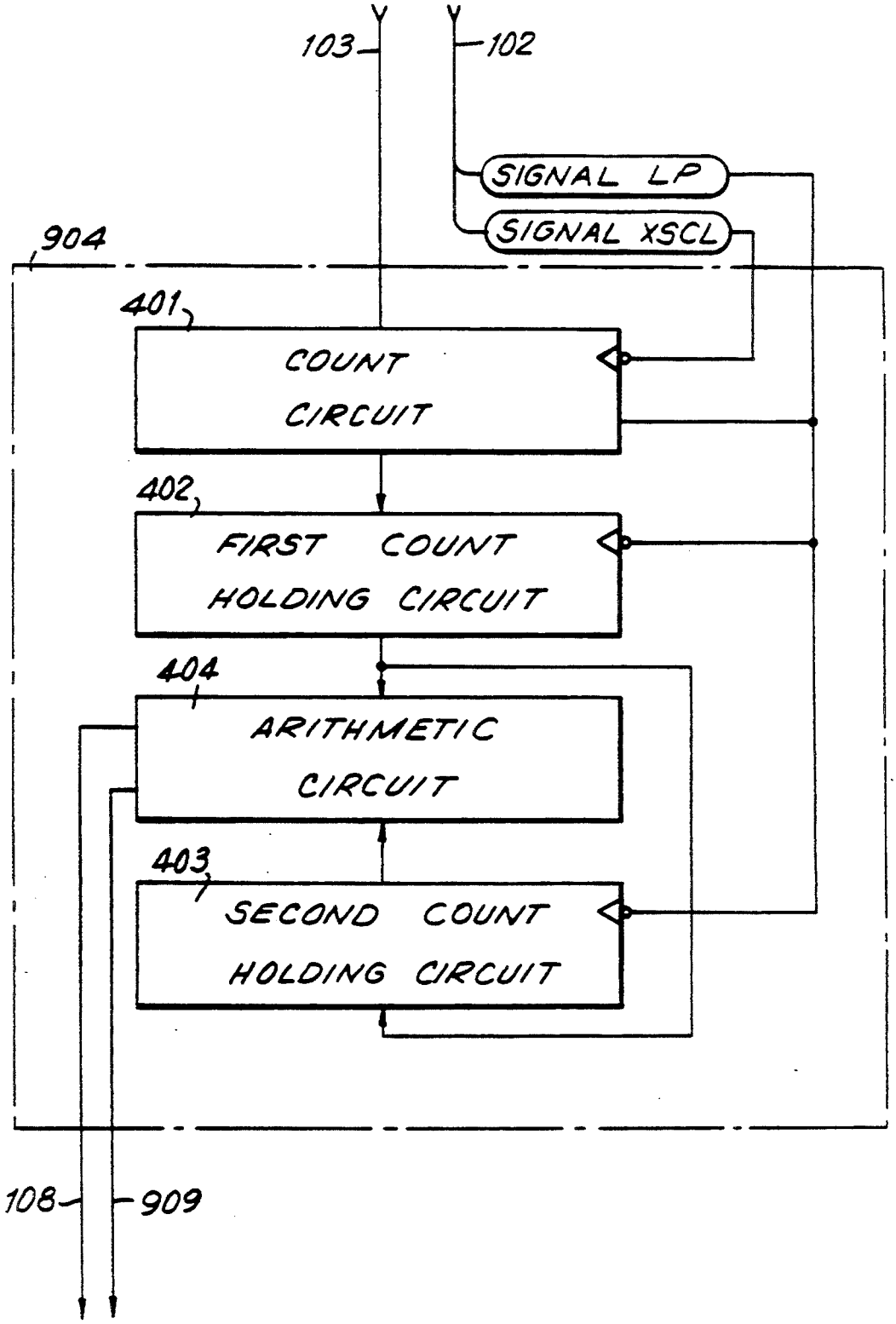
FIG. 36 is a block diagram of a compensation circuit in accordance with the second embodiment of the invention.

Reference is now specifically made to FIG. 36 in which a block diagram for a compensation circuit 904 is provided. Compensation circuit 904 includes a counter circuit 401, a first counter holding circuit 402, a second counter holding circuit 403 and an arithmetic circuit 404 which all function in the same manner as the equivalent structures of compensation circuit 104. Counter circuit 401 counts the number of ON dots from data signal 103. First counter holding circuit 402 and second counter holding circuit 403 store the number of ON dots $M_{ON}$ and $N_{ON}$ on the (n+1)th and nth common electrodes 202, respectively, whereby arithmetic circuit 403 calculates the value of I. Sign signal 108 and strength signal 909 representing the absolute value of I are output in response to signal LP of the control signal 102.

Figure 37:
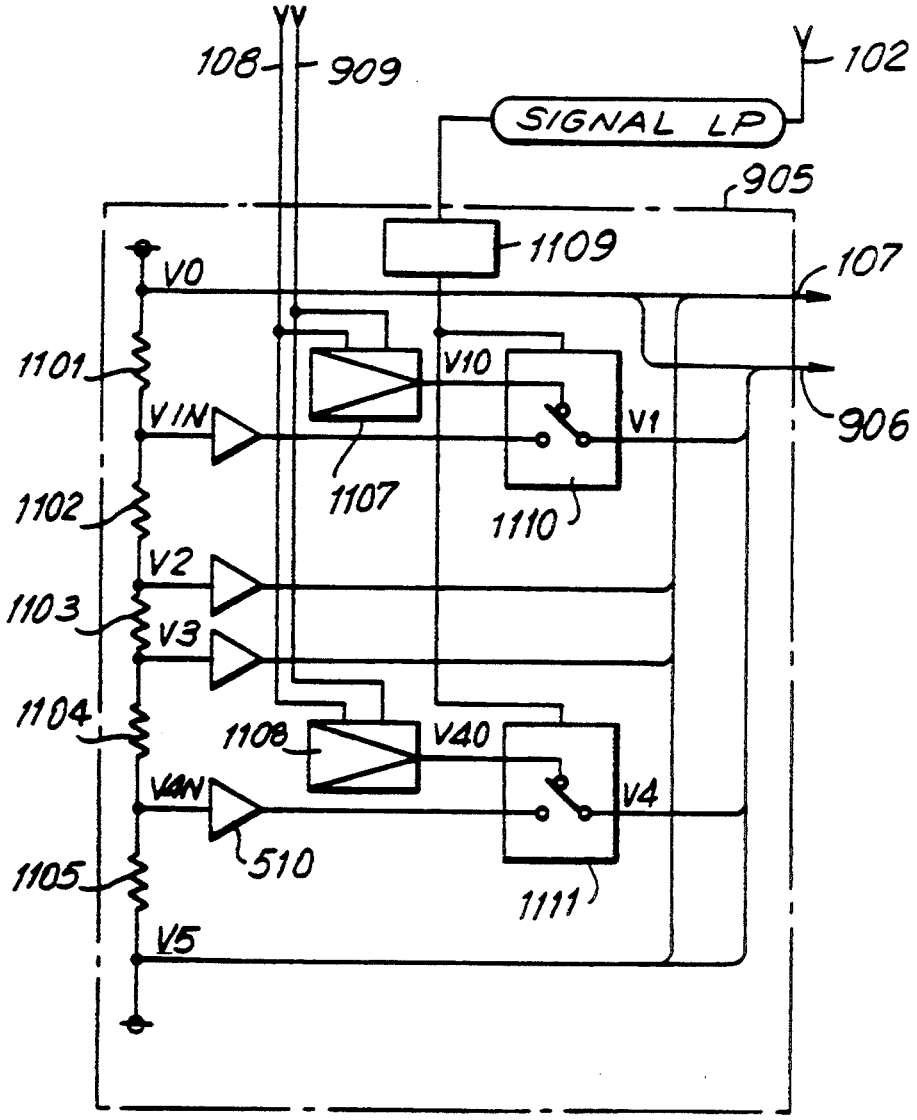
FIG. 37 is a circuit diagram of a power circuit in accordance with the second embodiment of the invention.

Reference is now specifically made to FIG. 37 in which a circuit diagram for power circuit 905 is provided. A plurality of resistors 1101 through 1105 are serially connected. A voltage V0 and V5 are applied at both ends of resistors 1101 through 1105 providing at each coupling of successive resistors.

The resistance value of each resistor 1101 through 1105 is r0, r1, r2, r3, and r4, respectively, and the values are in the following relation:

$$r0=r1=r3-r4$$

$$(n-4)\times r0=r2$$

(n is a constant)

The divided voltage applied at the end portions of each resistor 1101 through 1105 has a respective value V0, V1N, V2, V3, V4N, and V5, which may be expressed by $$V0-V1N=V1N-V2=V3-V4N=V4N-V5=(V2-V3)/(n-4)$$

(n is a constant)

Voltages V1N, V2, V3 and V4N are output through a voltage stabilizing circuit 510 as in power circuit 105.

A pair of voltage generating circuits 1107 and 1108 receive sign signal 108 and strength signal 909 and generate a voltage in accordance with the sign signal 108 and strength signal 909. A D/A converter is contained within voltage generating circuits 1107 and 1108. When sign signal 108 indicates a positive value, voltage generating circuit 1107 generates a voltage N1C in which the value of the output voltage shifts relative to the voltage V1N to the voltage V0 side for a voltage width corresponding to the absolute value of I indicated by strength signal 909. Similarly, voltage generating circuit 1108 generates the voltage V4C in which the value of voltage shifts relative to the voltage V4N to the voltage V5 side for a voltage width corresponding to the absolute value of I indicated by strength signal 909. On the other hand, when sign signal 108 indicates a negative value, each voltage generating circuit 1107 and 1108 generates the voltages V1C and V4C, respectively in which each value of voltage shifts to each side of voltage V2 and V3 for a voltage width corresponding to the absolute value of I indicated by strength signal 909.

The size of the above voltage width which varies in accordance with the absolute value of I indicated by strength signal 909 can be changed when the sign I indicated by sign signal 108 is either positive or negative.

A pulse width generating circuit 1109 receives signal LP and generates the signal which triggers the active state only for a predetermined period. The signal is output in response to the signal LP of the control signal 102. However, the signal is not output when signal FR of the control signal 102 is switched.

A switch 1110 selects between the voltage V1N and V1C. A switch 1111 selects between voltages V4N and V4C. Additionally, each above switch is switched by the signal output by pulse width generating circuit 1109. Namely, each switch 1110 and 1111 selects the voltages V1C and V4C, respectively, during a predetermined period corresponding to the pulse width when the signal output from pulse width generating circuit 1109 is in the active state. Conversely, when the signal output from pulse width generating circuit 1109 is in the passive state, each voltage is switched to the voltage V1N and the voltage V4N, respectively. The output of switch 1110 is V1 and the voltage output of switch 1111 is V4. Accordingly, voltages V1 and V4 output from the switches 1110 and change by the value of I for a predetermined period, wherein the direction of change is in accordance with the sign of I and the size of change is in accordance with the absolute value of I.

Power circuit 905 outputs the voltages V1 and V4, and the voltages V0 and V5 as Y power source 906 and outputs the voltages V0, V2, V3, and V5 as X power source 107.

Y power source 906 and X power source 107 output the following two groups of voltages to liquid crystal unit 101.

Namely, one voltage set is;

The voltage V0 of Y power source 906 (selected voltage)

The voltage V4 of Y power source 906 (non-selected voltage)

The voltage V5 of X power source 107 (ON voltage)

The voltage V3 of X power source 107 (OFF voltage), and the other voltage set is;

The voltage V5 of Y power source 906 (selected voltage)

The voltage V1 of Y power source 906 (non-selected voltage)

The voltage V0 of X power source 107 (ON voltage)

The voltage V2 of X power source 107 (OFF voltage).

In the above structure, the non-selected voltage varies in accordance with the value of I for a predetermined period in view of the direction and size of I.

Figure 38A:
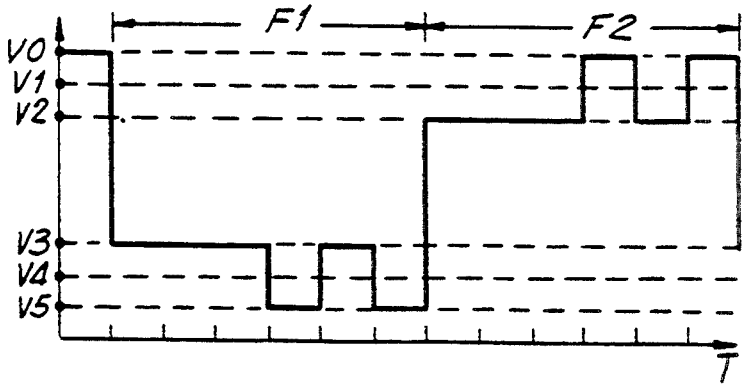
FIGS. 38A–38C are graphs of the voltage waveforms applied for forming the pattern shown in FIG. 32.
Figure 38B:
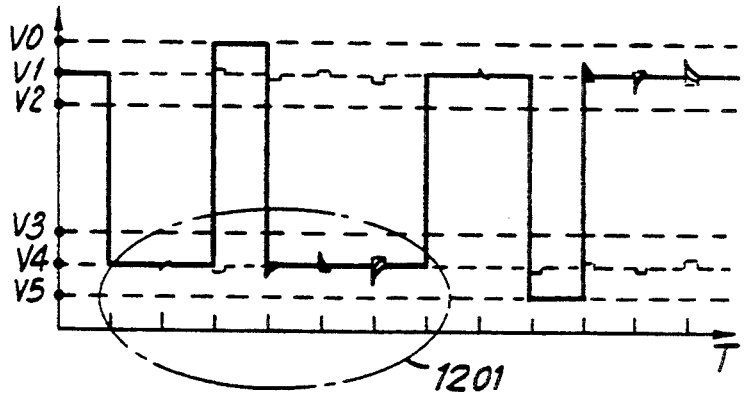
Figure 38C:
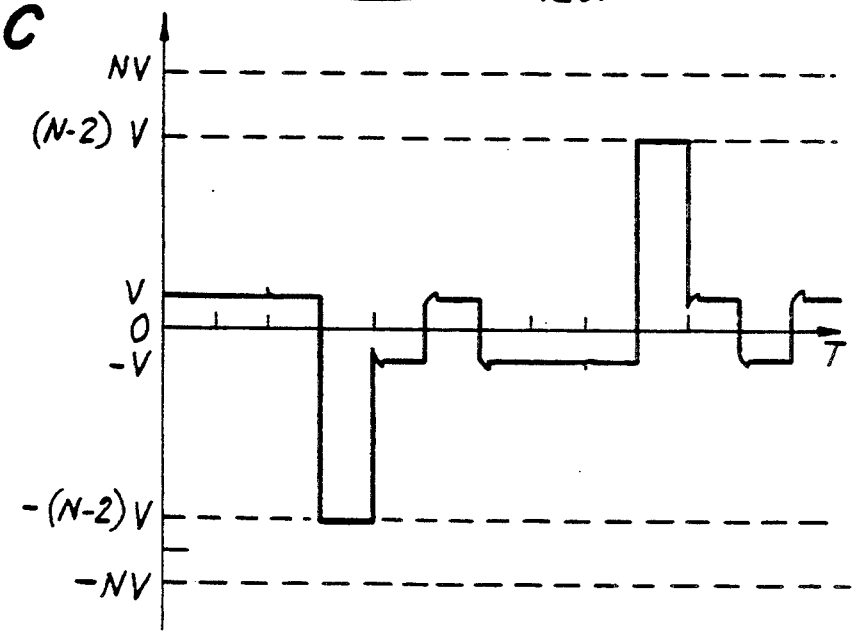
Figure 39:
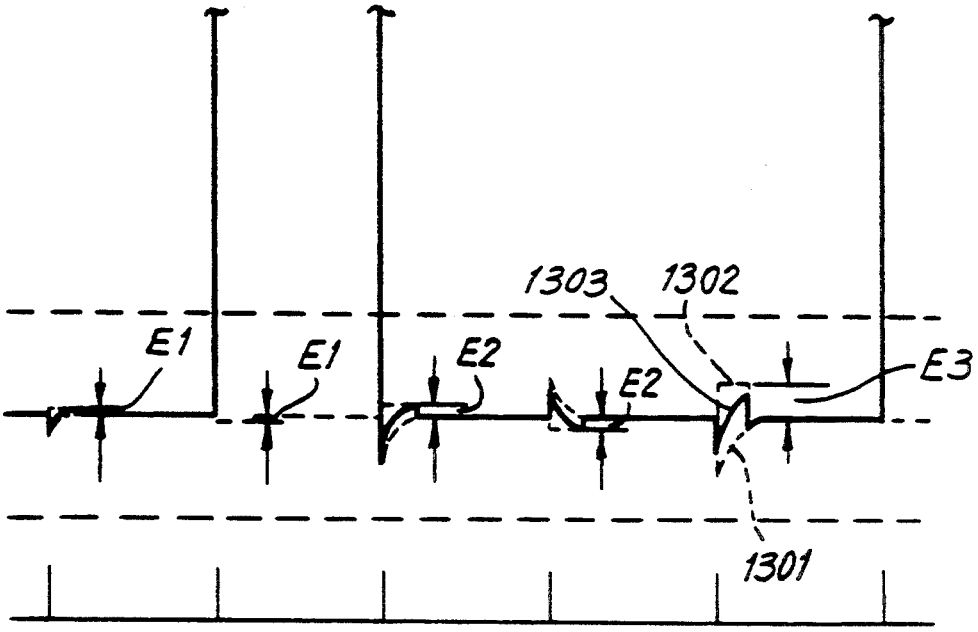
FIG. 39 is a partial exploded view of the waveform of FIG. 38B.

Reference is now made to FIGS. 32, 38 and 39 wherein the operation of LCD 900 is explained in connection with the display pattern of FIG. 32. FIG. 38 shows one example of an applied voltage waveform. FIG. 38A illustrates the segment voltage waveform applied to segment electrode X4 for forming display dot 601. FIG. 38B shows the voltage waveform applied to common electrode Y3 for forming display dot 601. FIG. 38C shows the combined voltage waveform applied at display dot 601. The voltages marked by the dashed lines of FIGS. 38A and 38B show the voltages V0, V2, V3, and V5 of X power source 107 and the voltages V0, V1, V4, and V5 of Y power source 906.

Reference is made to FIG. 39 in which an enlarged portion of FIG. 38B indicated by encircled area 1201 is provided. A spike shaped noise voltage 1301 is generated on the common electrode. A changeable non-selected voltage 1302 is formed by Y power source 906. The voltage widths for changing are marked by E1 through E3. A voltage 1303 is composed of voltages 1301 and 1302.

The difference I between the number of ON dots on the nth common electrode and the number of ON dots on the (n+1)th common electrode at the time when the selected electrode is changed from the nth common electrode to the (n+1)th common electrode is performed as follows: from the first electrode to the second electrode, I=−2; from the second electrode to the third electrode, I=2; from the third electrode to the fourth electrode, I=−4; from the fourth electrode to the fifth electrode, I=4; from the fifth electrode to the sixth electrode, I=−6; and from the sixth electrode to the first electrode, I=6.

As mentioned above, in accordance with the movement from the first electrode to the second electrode, the second electrode to the third electrode, and so on, the noise voltage 1301 increases. The width of non-selected voltages for changing in the direction opposed to the generated noise voltage 1301 for a predetermined period from E1 to E3, also increases, thereby compensating the voltage 1303. Therefore, the voltage added to the display dot 601 is compensated providing an improved display without zebra crosstalk.

As mentioned above, when the selection moves from the nth common electrode of liquid crystal panel 201 to the (n+1)th common electrode, the non-selected voltage of Y power source 906 is changed for a predetermined period in accordance with the difference I between the number of ON dots on the nth common electrode and on the (n+1)th common electrode, thereby providing an improved display without zebra crosstalk.

Accordingly., in the present embodiment, the non-selected voltage is changed for a predetermined period for the voltage width in accordance with the value of I, thereby achieving the necessary compensation. This is known as a voltage base compensation of the non-selected voltage.

Figure 40:
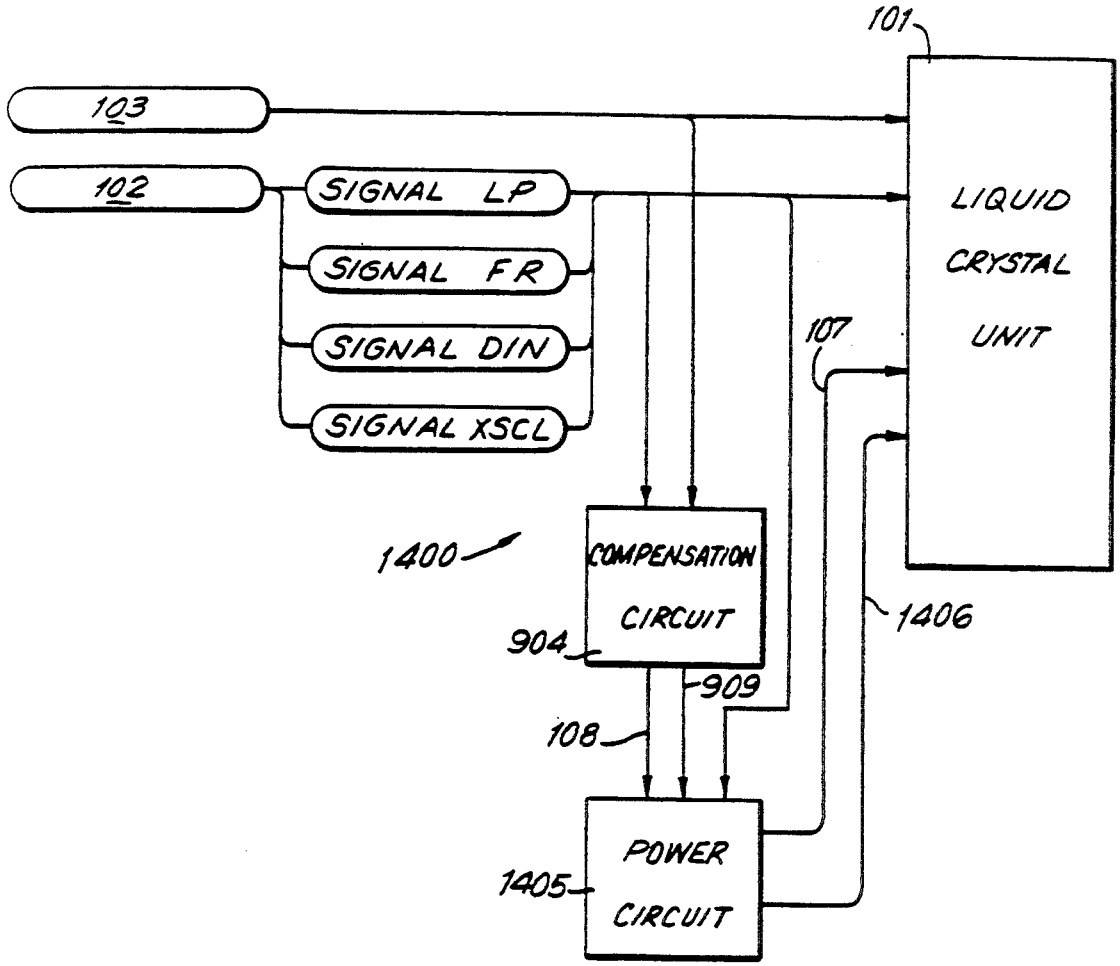
FIG. 40 is a block diagram of the liquid crystal display device in accordance with a third embodiment of the invention.
Figure 41:
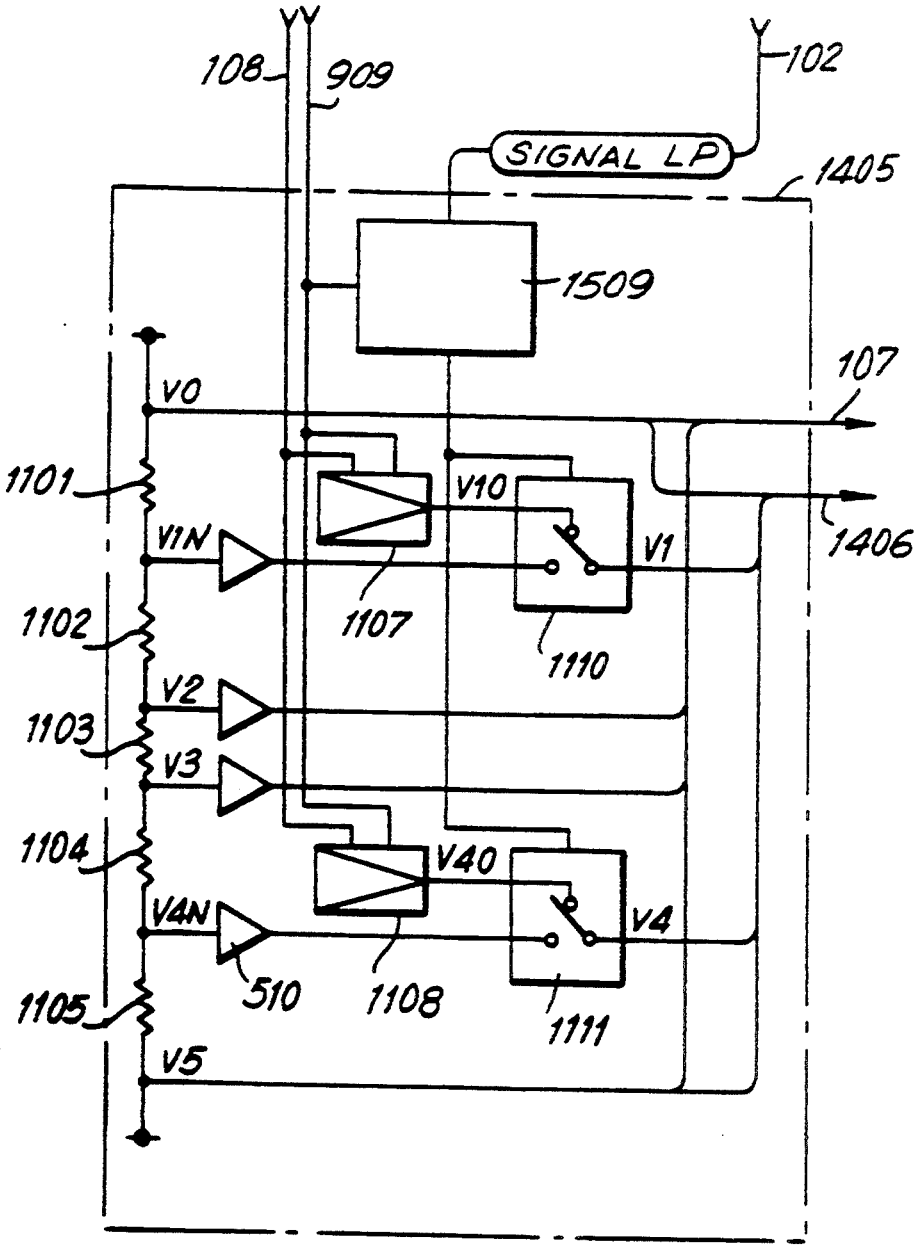
FIG. 41 is a circuit diagram of a power circuit constructed in accordance with the third embodiment of the invention.

Reference is now made to FIGS. 40 and 41 wherein a third embodiment for removing zebra crosstalk for an LCD generally indicated as 1400, is provided.

LCDs 100 and 900 demonstrate a structure for compensating the non-selected voltage by either time or voltage in accordance with the value of I. However, as in LCD 1400, both the period and voltage may be compensated in accordance with the value of I, thereby also obtaining the same effect.

In FIG. 40, the structure and operation of LCD 1400 is the same as LCD 900 with the exception of a power circuit 1405 and a Y power source 1406 formed by power circuit 1405. For the remaining structure like structure are identified by like numerals. FIG. 41 is a circuit diagram for power circuit 1405. The structure and operation of power circuit 1405 is the same as the structure of power circuit 905 with the exception of a pulse width control circuit 1509. For the remaining structure like parts are indicated by like numerals.

Pulse width control circuit 1509 outputs an active signal for the period corresponding to the value of strength signal 909. Pulse width control circuit 1509 is triggered by the falling edge of signal LP of control signal 102. However, the signal is not output when signal FR of control signal 102 is switched. The signal from pulse width control circuit 1509 controls switches 1110 and 1111, and switches the switches 1110 and 1111 for a period corresponding to the value of I.

LCD 1400 allows the period and voltage width of the non-selected voltage of Y power source 1406 to be changed in accordance with the value of I, thereby compensating the noise voltage generated in liquid crystal panel 201. Thereby, an improved display without zebra crosstalk can be realized as in LCD 100 and LCD 900. As mentioned above, in LCD 1400, the non-selected voltage is compensated in accordance with I. This is referred to as a time-voltage base compensation.

In the circuits of the above embodiments, spike shaped noise waveforms generated on the common electrodes of the liquid crystal panel 201 are compensated by applying a square-shaped waveforms to the common electrodes. However, the generated noise waveform, in fact, is spike shaped, rather than square-shaped. The generated noise waveform is a waveform based upon the voltage generated from a differentiating circuit and is defined by an exponential function. The differentiating circuit comprises the resistors of the common and segment electrodes of liquid crystal panel 201 and a capacitor of liquid crystal layer 215. Accordingly, to more accurately compensate the voltage waveform, the voltage waveform having a peak value according to the value I and having a shape similar to the generated noise waveform is applied to the non-selected voltage, thereby making it possible to provide an improved display quality without zebra crosstalk.

Figure 42:
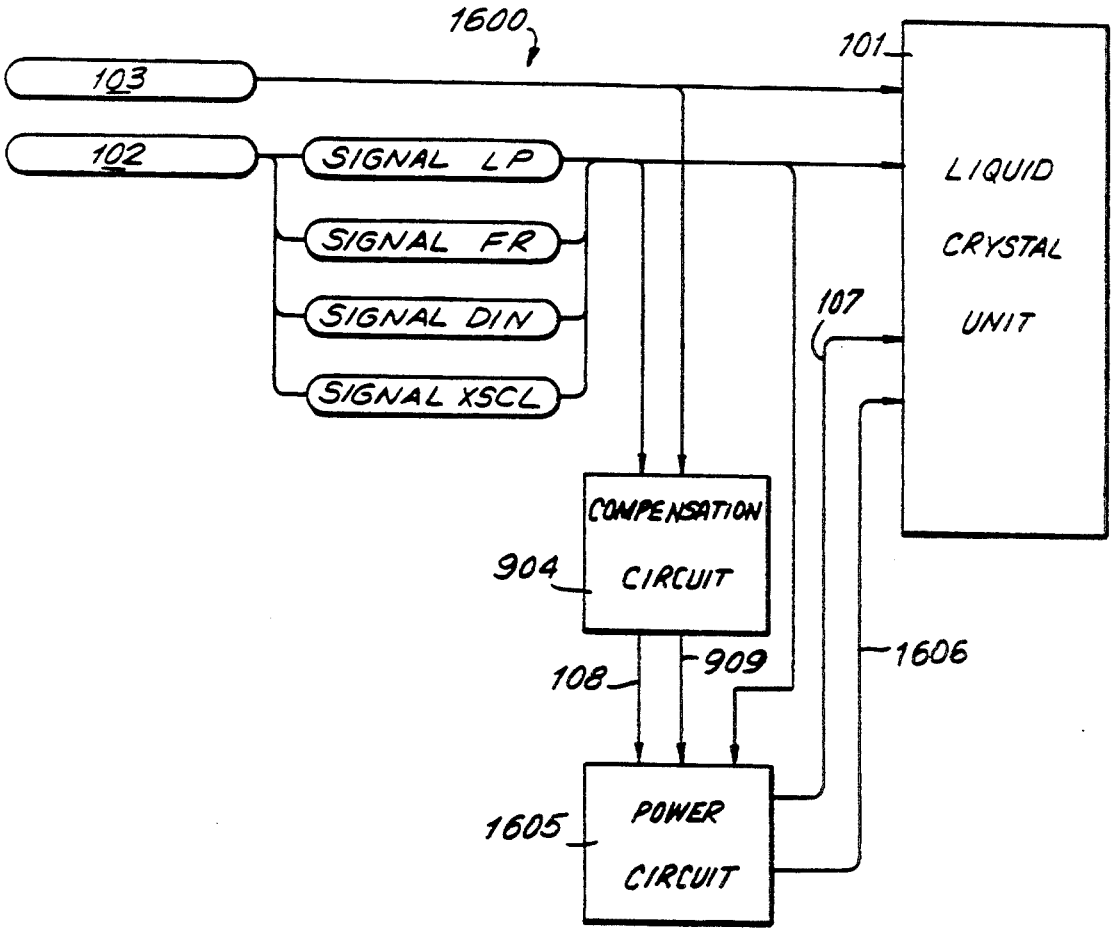
FIG. 42 is a block diagram of a liquid crystal display device in accordance with a fourth embodiment of the invention.

Reference is now made to FIG. 42 in which a circuit diagram for a fourth embodiment of an LCD, generally indicated as 1600, for compensating such voltage waveforms is provided. LCD 1600 is similar in structure and operation to LCD 900 with the exception of a power source circuit 1605 and a Y power source 1606 generated by power circuit 1605.

Figure 43:
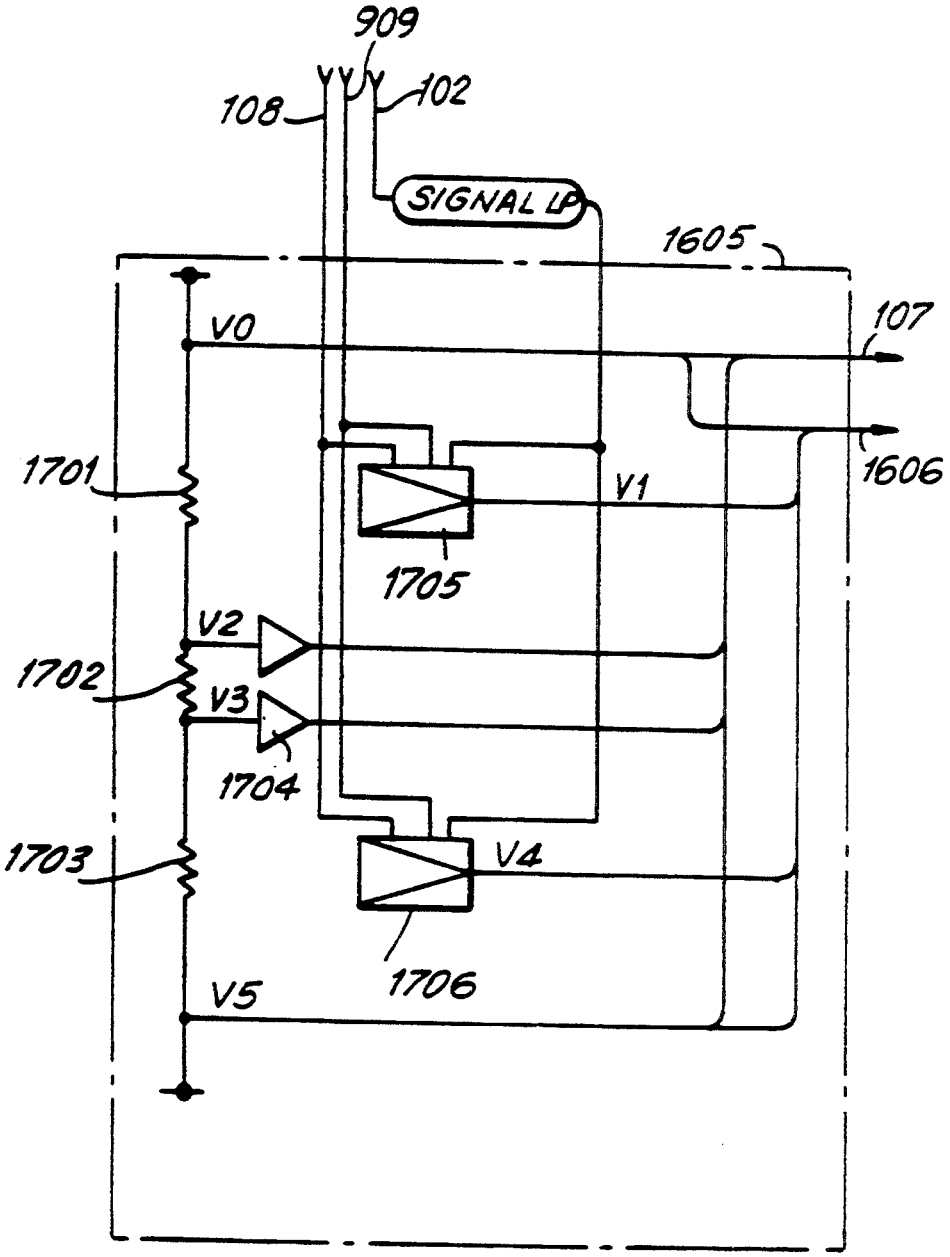
FIG. 43 is a circuit diagram of a circuit constructed in accordance with the fourth embodiment of the invention.

Reference is now made to FIG. 43 in which a circuit diagram for power circuit 1605 is provided. Three resistors 1701, 1702, 1703 are serially connected and have respective resistance values r1, r2 and r3. The resistance relationship is as follows:

$$r1/2=r2/2=r3/(n-4)$$

(n is a constant)

A voltage V0, and a voltage V5 are applied across the ends of resistors 1701 and 1703. Voltage V0 is greater than voltage V5. Voltage dividers are formed at the resistor junctions so that voltages V0, V2, V3 and V5 are the voltages existing at the ends of respective resistors 1701, 1702, 1703.

The relationship between voltages is expressed by the following equations:

$$(V0-V2)/2=(V3-V5)/2=(V2-V3)/(n-4)$$

(n is a constant)

The voltages V2 and V3 are stabilized by respective voltage stabilizing circuits 1704 which function identically to voltage stabilizing circuit 510.

Herein, a voltage V1N and a voltage V4N are defined as follows:

$$V1N=(V0-V2)/2+V2$$

$$V4N=(V3-V5)/2+V5$$

Namely, voltage V1N is an intermediate value between the voltages V0 and V2, and voltage V4N is an intermediate value between the voltages V3 and V5.

A pair of function waveform generating circuits 1705 and 1706 receive sign signal 108, strength signal 909 and signal LP as inputs. Waveform generating circuits 1705 and 1706 output function. waveform voltages V1 and V4 of which the direction and the peak value is changed by sign signal 108 and strength signal 909.

Figure 44:
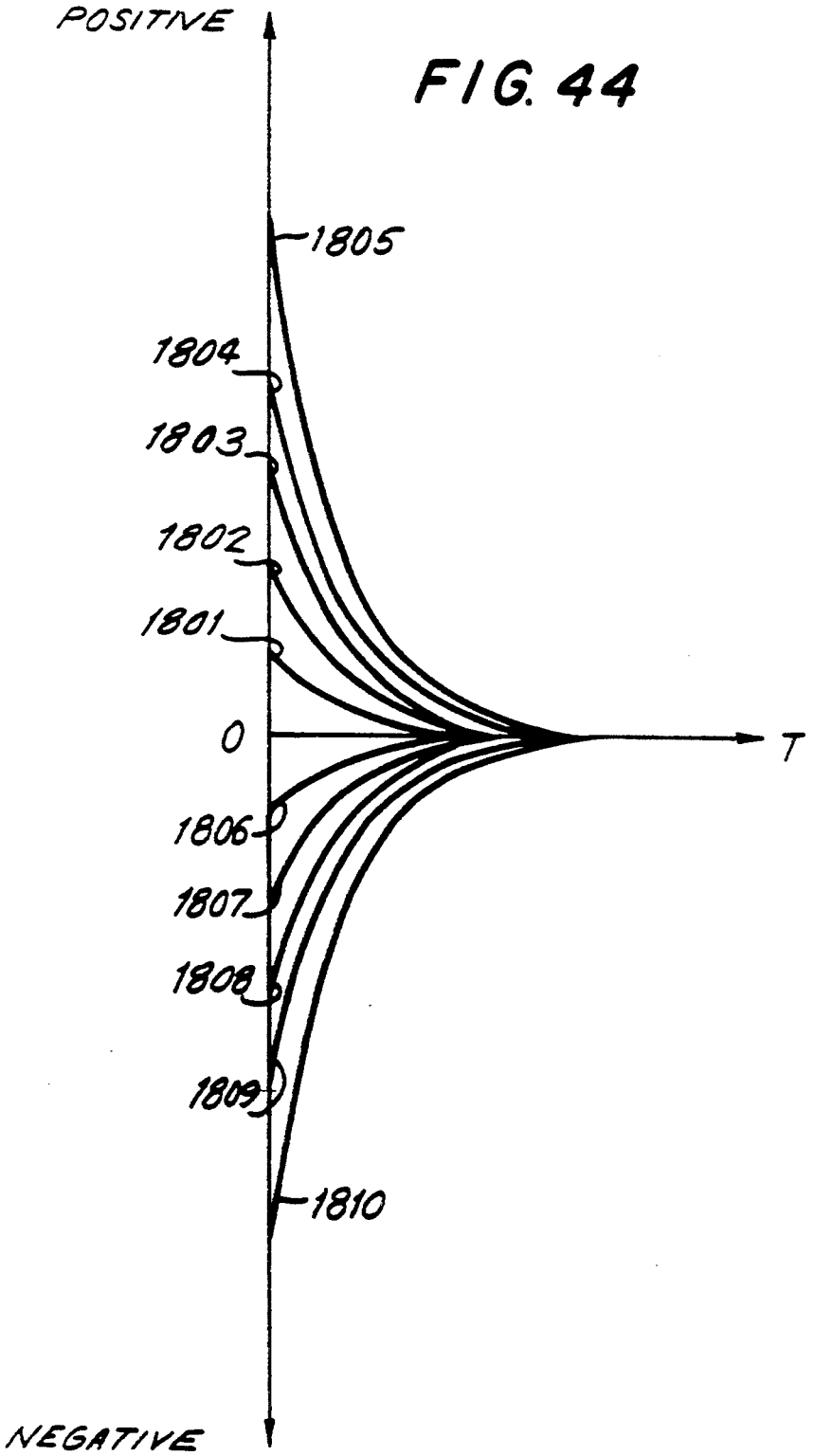
FIG. 44 is a graph of an experimental function waveform.

Reference is now made to FIG. 44 in which the voltage waveforms produced by function waveform circuits 1705 and 1706 are provided. Compensation voltage V1 output by function waveform circuit 1705 is either a voltage V1N or voltage V1N in combination with a voltage E having a potential function waveform (FIG. 44). In this case, the exponential function waveform of voltage E may be expressed by the following equation:

$$E=\alpha\times exp\,(-\beta\times T)$$

wherein $\alpha$ and $\beta$ are constants, and T is time.

Similarly, a compensation voltage V4 output by comprising is either a voltage V4N or voltage V4N and voltage E having an exponential function waveform E (FIG. 44). Again, the voltage E is expressed by the following equation:

$$E=-\alpha\times exp\,(-\beta\times T)$$

The sign of $\alpha$ corresponds to the signal indicated by sign signal 108. Upon receipt of sign signal 108, the direction in which the compensation voltage is applied is switched. The absolute value of $\alpha$ is changed in accordance with strength signal 909, thereby making it possible to change the peak value of the waveforms.

When sign signal 108 is positive and the value of strength signal 909 gradually increases, the waveforms 1801, 1802, 1803, and so on are generally generated by function waveform generating circuit 1705. When sign signal 108 is negative, the waveforms 1806, 1807, 1808 and so on are generated. However, when sign signal 108 is positive and the value of strength signal 909 is gradually increased, waveform generating circuit 1706 outputs waveforms 1806, 1807, 1808, . . . . When sign signal 108 is negative, waveform generating circuit 1706 generates waveforms 1801, 1802, 1803, . . . .

Compensation voltages V1 and V4 are generated by function waveform generating circuit 1705 and 1706, respectively, in synchronism with signal LP of control signal 102. However, when signal FR of control signal 102 is switched, voltages V1N and V4N are generated by respective function waveform generating circuits 1705 and 1706, and not in synchronism with signal LP of the control signal 102.

Figure 45:
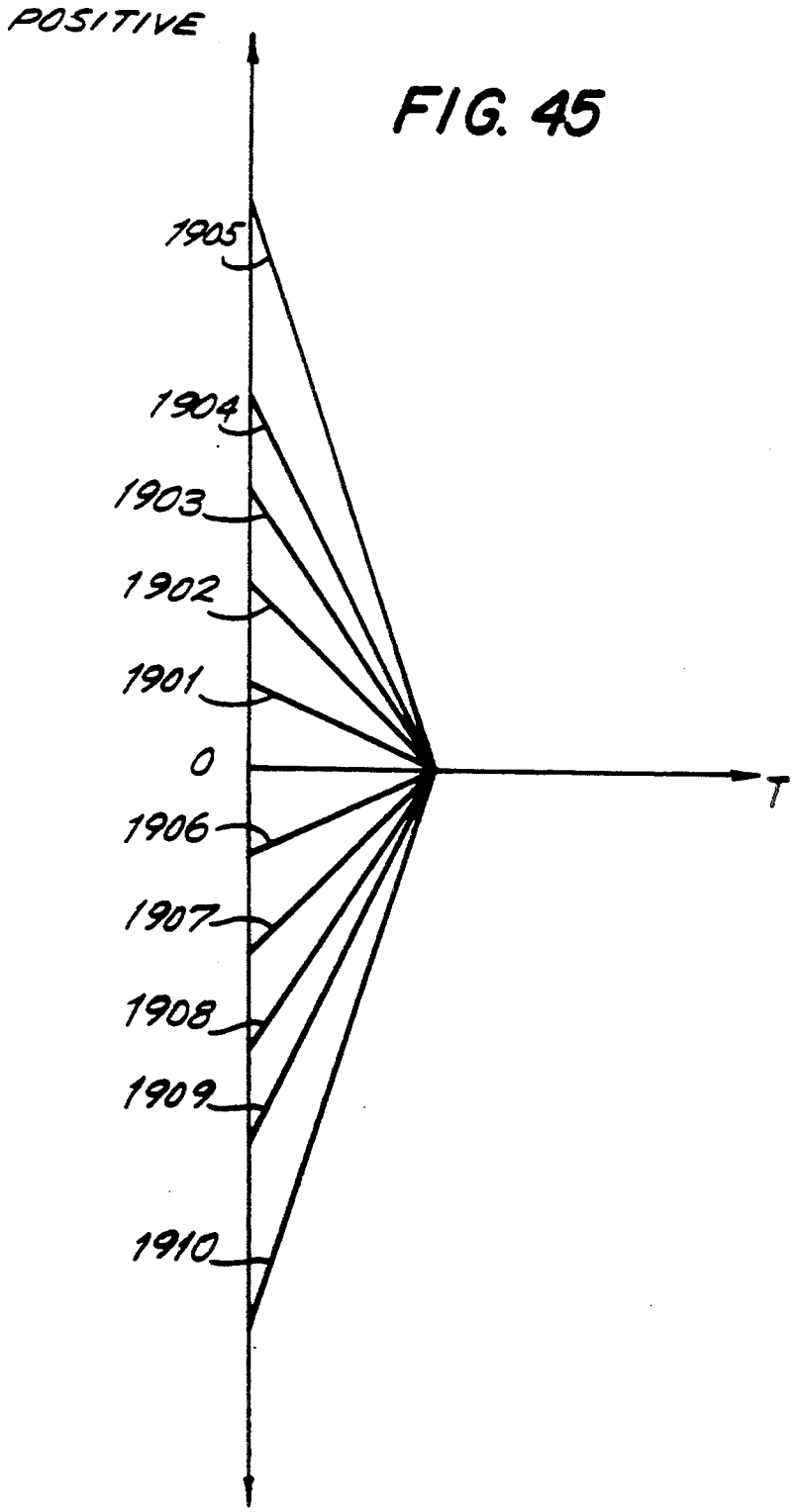
FIG. 45 is a graph of a ramp voltage waveform.

Reference is now made to FIG. 45 in which a second voltage waveform is provided. Function waveform generating circuit 1705 also outputs a voltage V1 comprising voltage V1N and a triangular waveform voltage E (FIG. 45). Voltage E may be closely expressed as an exponential function obtained by the following equation:

$$E=\alpha(\beta-T)$$

$\beta\geqq T$ $$E=0$$

$\beta<T$ wherein $\alpha$ and $\beta$ are constants and T is time.

Similarly, function waveform generating circuit 1706 outputs a voltage V4 comprising voltage V4N and a triangular waveform voltage E (FIG. 45) which may be closely expressed as an exponential function obtained by the following equation:

$$E=-\alpha(\beta-T)$$

$\beta\geqq T$ $$E=0$$

$\beta<T$

Herein, the sign of $\alpha$ corresponds to the negative or positive values of sign signal 108, and changes the applied direction of the voltage in accordance thereto. Additionally, the absolute value of $\alpha$ changes in accordance with strength signal 909, thereby making it possible to change the peak value of the waveform.

Specifically, when sign signal 108 is positive and the value of strength signal 909 is gradually increased, waveforms 901, 1902, 1903 and so on and waveforms 1906, 1907, 1908 and so on are output by respective function waveform generating circuits 1705 and 1706. Conversely, when sign signal 108 is negative waveforms 906, 1907, 1908 and so on and waveforms 1901, 1902, 1903 and so on are output by respective function waveform generating circuits 1705 and 1706.

Figure 46:
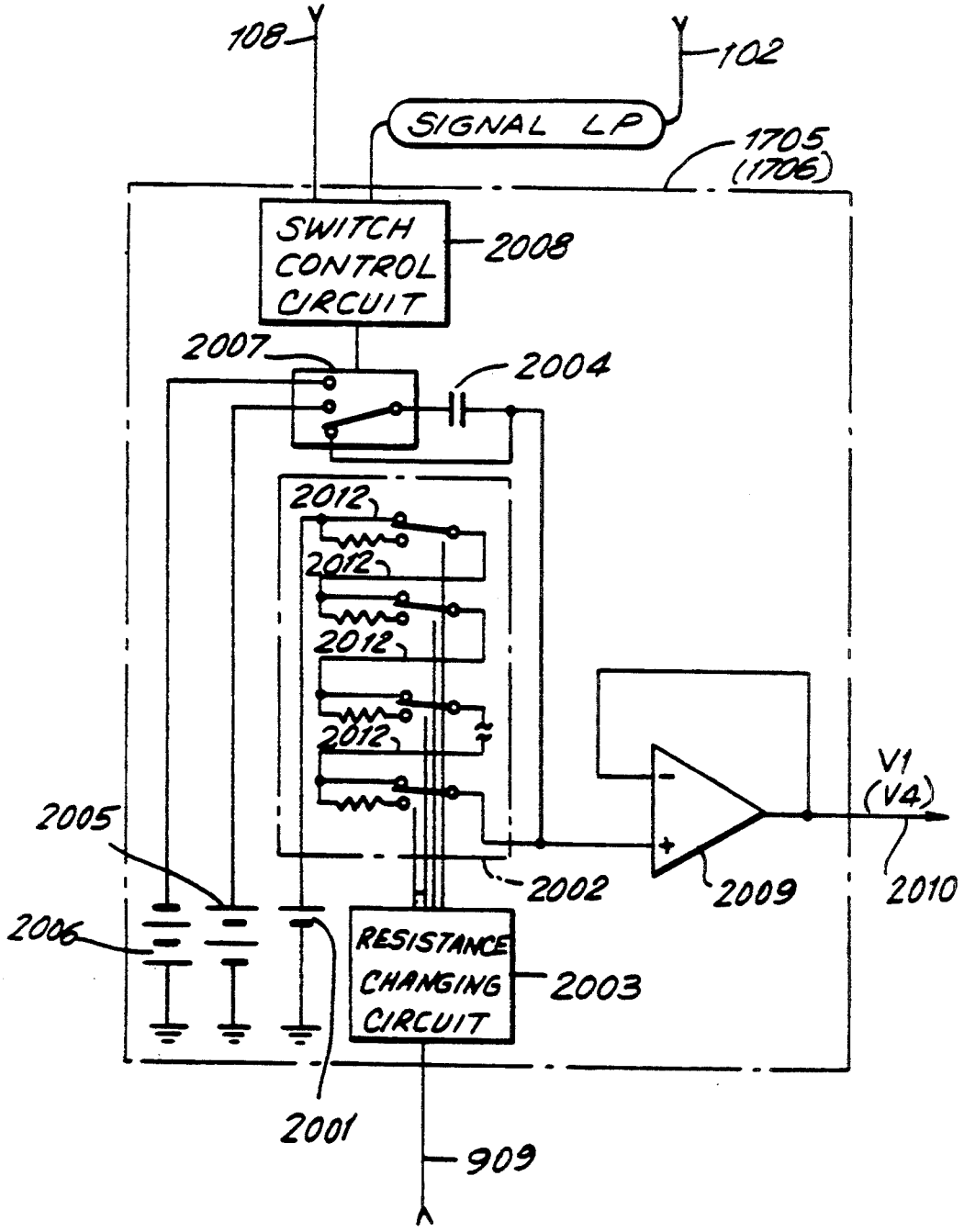
FIG. 46 is a schematic diagram of a function waveform generating circuit constructed in accordance with the invention.

Reference is now made to FIG. 46 in which a circuit diagram of respective function waveform circuits 1705 and 1706 is provided. The structure of function waveform circuits 1705 and 706 are identical, however, in 1705 the reference voltage 2001 is used as V1N and in function generating circuit 1706 a different reference voltage, V4N is utilized.

A variable resistor 2002 comprises a plurality of resistors 2012 wherein the resistance value is increased exponentially as expressed by the relationship $\gamma$, $2\gamma$, $4\gamma$ through 2m. Switches located within resistor 2012 may be controlled to change the value of resistor 2002. A resistance changing circuit 2003 receives strength signal 909 and changes the value of variable resistor 2002, in accordance with the values of strength signal 909. As strength signal 909 is gradually increased, the value of the variable resistor 2002 increases. A capacitor 2004 is coupled to variable resistor 2002 to form a differential circuit.

A first switching power source 2005 has a voltage higher than reference voltage 2001. However, the voltage V0 may be substituted for power source 2005 in function waveform generating circuit 1705, and further, the voltage V3 may be substituted in function waveform generating circuit 1706. A second switching power source 2006 has a voltage lower than reference voltage 2001. The voltage V2 may be substituted in function waveform generating circuit 1705 for voltage 2006 and further, the voltage V5 may be substituted in function waveform generating circuit 1706.

A switch 2007 is connected to the opposing electrodes of capacitor 2004, and may select either first switching power source 2005 or second switching power source 2006. A switch control circuit 2008 receives signal LP and sign signal 108 and controls switch 2007 according to the condition of sign signal 108, in synchronism with signal LP of control signal 102, except when signal FR of control signal 102 is switched.

Specifically in function waveform generating circuit 1705, when sign signal 108 indicates a positive sign, switch 2007 is switched so as to be connected to first switching power source 2005. When sign signal 108 indicates a negative sign, switch 2007 is switched so as to be connected to second switching power source 2006. However, in function waveform generating circuit 1706, when sign signal 108 indicates a positive sign, switch 2007 is switched so as to be connected to second switching power source 2006, and when sign signal 108 indicates a negative sign, switch 2007 is switched so as to be connected to first switching power source 2005.

Then, prior to inputting the next signal LP of control signal 102 to switch control circuit 2008, switch 2007 is switched to the opposing electrode of the capacitor 2004.

A voltage follower circuit 2009 having an operational amplifier is provided to reduce the impedance of the voltage applied to the non-inverted input terminal to output a voltage waveform having the reduced impedance. An output voltage 2010 of voltage follower circuit 2009 is output as V1 from function waveform generating circuit 1705 and is output as V4 from function waveform generating circuit 1706.

In function waveform circuits 1705 and 1706, since either the first switching power source 2005 or the second switching power source 2006 is connected to the differential circuit comprising the capacitor 2004 and the variable resistor 2002, the voltage waveform of the exponential function is generated at the non-inverted input terminal of the voltage follower circuit 2009. The voltage waveform has a value which varies according to the capacitance of capacitor 2004 and the resistance of variable resistor 2002. Therefore, the larger the value of strength signal 909, the larger the resistance value of variable resistor 2002 and the larger the voltage waveform. Additionally, the direction in which the voltage is applied is determined by the output of sign signal 108.

Voltage follower circuit 2009 functions to reduce the impedance of the voltage applied to the non-inverted input terminal and produce a voltage waveform having reduced impedance. Further, the voltages V1 and V4 generated by function waveform generating circuits 1705 and 1706 are combined with voltages V0 and V5 as a Y power source 1601 and are output to liquid crystal unit 101.

The voltages V0, V2, V3 and V5 are combined as X power source 107 and are output to liquid crystal unit 101. At this time, in accordance with I as input by sign signal 108 and strength signal 909, a voltage having a different direction and value of the exponential function waveform, or the voltage having the trigonometric function waveform similar to the exponential function waveform, is superimposed and is applied to the non-selected voltage.

In LCD 1600 when the selected electrode is changed from the nth common electrode to the (n+1)th common electrode on liquid crystal panel 201, the exponential function voltage waveform or the trigonometric function waveform, which is closely expressed by an exponential function voltage waveform having a peak value corresponding to the difference I between the values of ON dots on the nth common electrode and (n+1)th common electrode, is output as the non-selected voltage of Y power source 1606. The output voltage waveform has a direction opposed to the direction of the spiked-shape noise waveform and the same shape as that of the spike-shaped noise waveform. By superimposing the output waveform on the noise waveform, the spike-shaped noise waveform is substantially omitted, compensating the voltages applied to the respective display dots 204 improving display quality without zebra crosstalk, As discussed above, such a compensation is carried out by superimposing the function waveform on the non-selected voltage. This structure is referred to as "the function waveform compensation of the non-selective voltage".

In LCDs 100, 900, 1400 and 1600, the non-selected voltages are compensated in accordance with the value I. However, the same effects can be obtained by compensating the ON/OFF voltages in accordance with the value I, making it possible to provide an improved display quality without zebra crosstalk.

Figure 47:
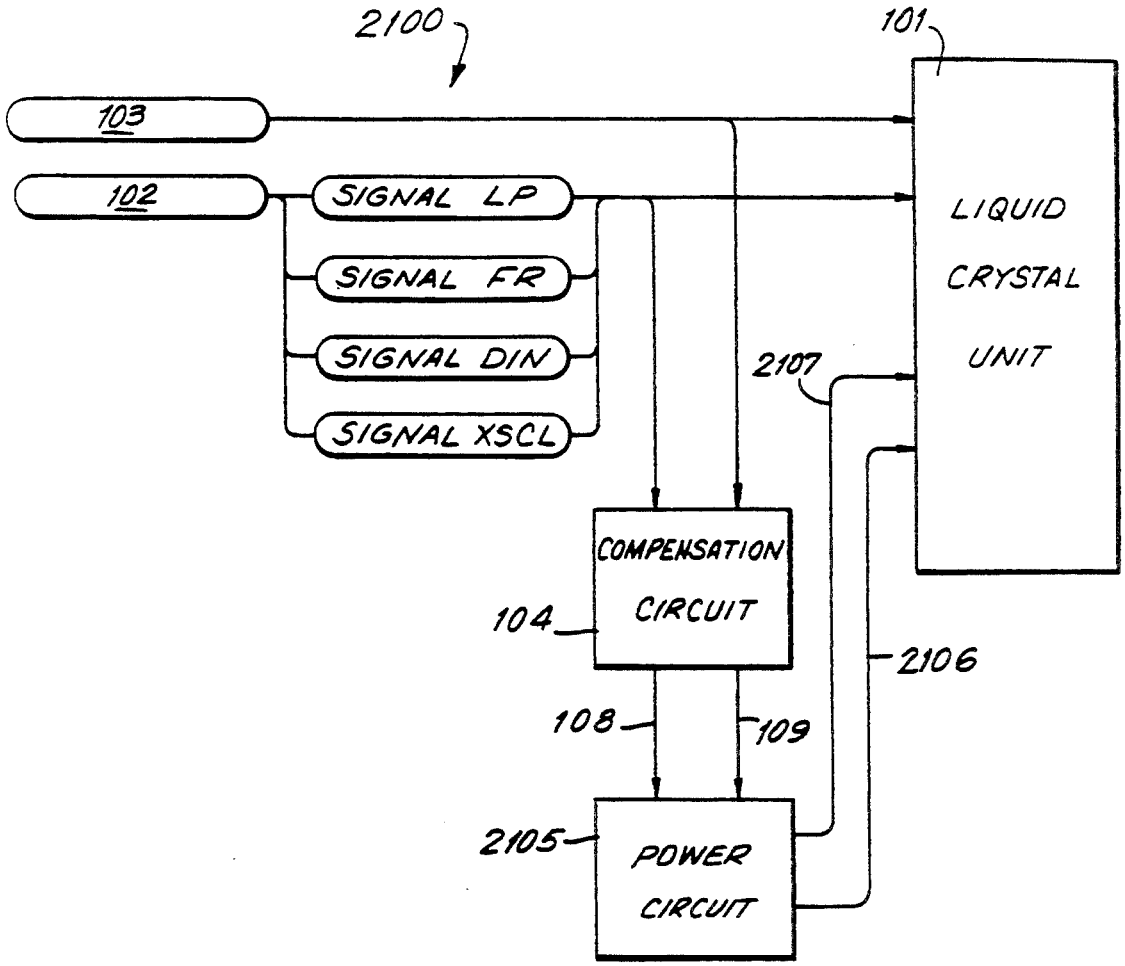
FIG. 47 is a block diagram of a liquid crystal display device constructed in accordance with a fifth embodiment of the invention.

Accordingly, reference is made to FIG. 47 in which a block diagram of a fifth embodiment of an LCD, generally indicated as 2100, for compensating the period during which the ON/OFF voltages are applied is provided. The constituent parts of LCD 2100 operate in the same manner as LCD 100 with the exception of a power circuit 2105, a Y power source 2106 generated by power source circuit 2105 and an X power source 2107. Like numbers are utilized to indicate like structure.

Upon the input of sign signal 108 and strength signal 09, power source circuit 2105 outputs X power source 2107 of variable ON/OFF voltages and Y power source 2106 of which the selected/non-selected voltages are fixed.

Figure 48:
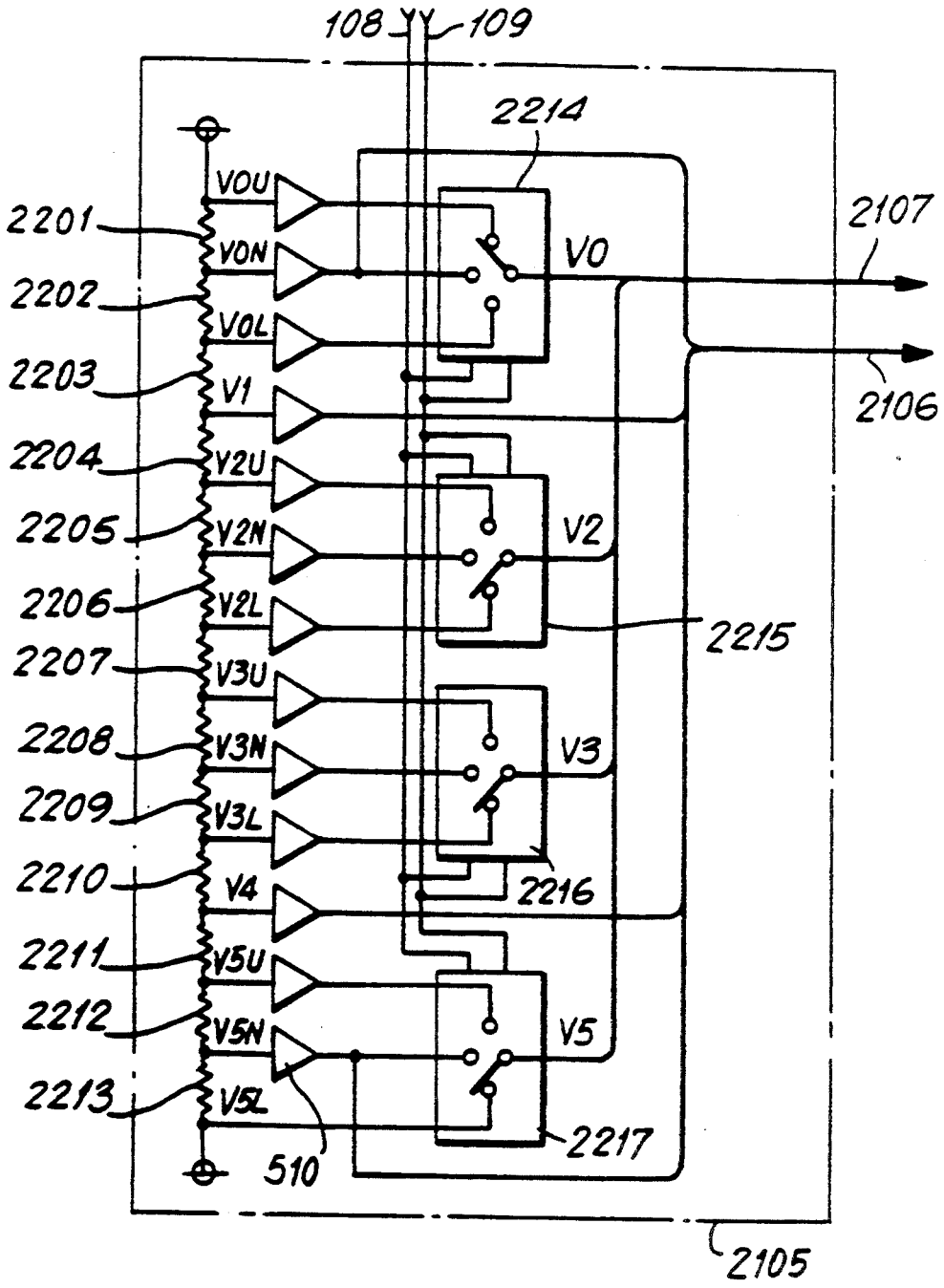
FIG. 48 is a circuit diagram of a power source constructed in accordance with the fifth embodiment of the invention.

Reference is now made to FIG. 48 wherein a circuit diagram of power circuit 2105 is provided. A plurality of resistors 2201 through 2213 are serially connected providing associated voltage dividers. Voltages V0U and V5L are applied across the ends of the resistor series. The voltages V0U, V0N, V0L, V1, V2U, V2L, V3U, V3N, V3L, V4, V5U, V5N and V5L are the divided voltages generated at the terminals of respective resistors 2201 through 2213. The voltage values are set and may be expressed by the following equations:

$$V0N - V1 = V1 - V2N$$
$$= V3N - V4 = V4 - V5N$$
$$= (V2N - V3N) / (n - 4) \text{ (} n \text{ is a constant)}$$

Further, $$(V0N - V0L) / (V0N - V1)$$
$$= (V2N - V2L) / (V1 - V2N)$$
$$= (V3U - V3N) / (V3N - V4)$$
$$= (V5U - V5N) / (V4 - V5N)$$

Furthermore, $$(V0U - V1N) / (V0N - V1)$$
$$= (V2U - V2N) / (V1 - V2N)$$
$$= (V3N - V3L) / (V3N - V4)$$
$$= (V5N - V5L) / (V4 - V5N)$$

The divided voltages V0N through V5N which are obtained at the terminals of respective resistors 2201 through 2213 are each stabilized by a voltage=stabilizing circuit 510 as in power circuit 105. Four switches 2214 through 2217 each receive sign signal 108 and strength signal 109 and selected switch position based upon the signal values. For example, when strength signal 109 is active and sign signal 108 indicates a positive sign, respective switches 2214 through 2217 select the following voltages:

switch 2214—Voltage V0U
switch 2215—Voltage V2U
switch 2216—Voltage V3L
switch 2217—Voltage V5L Further, when sign signal 108 indicates a negative value, respective switches 2214 through 2217 select the following voltages:

switch 2214—Voltage V0L
switch 2215—Voltage V2L
switch 2216—Voltage V3U
switch 2217—Voltage V5U Furthermore, when strength signal 109 is not active, respective switches 2214 through 2217 select the following voltages, regardless of the condition of sign signal 108:

switch 2214—Voltage V0N
switch 2215—Voltage V2N switch 2216—Voltage V3N
switch 2217—Voltage V5N When the voltages output by switches 2214 through 2217 are V0, V2, V3 and V5, power circuit 2105 outputs a combined voltage of V0, V2, V3 and V5 as X power source 2107 and outputs a combined voltage of V0N, V1, V4 and V5 as Y power source 2106. The voltage of Y power source 2016 and the voltage of X power source 2107 are applied to liquid crystal unit 101 as either of two sets.

In the first set, the combined voltage YON of Y power source 2106 is the selected voltage and the voltage V4 of Y power source 2106 is the non-selected voltage. The voltage V5 of X power source 2107 is the ON voltage and the voltage V3 of X power source 2107 is the OFF voltage. In the second set the voltage V5N of Y power source 2106 is the selected voltage and the voltage V1 of Y power source 2106 is the non-selected voltage. The voltage V0 of X power source 2107 is the ON voltage and the voltage V2 of X power source 2107 is the OFF voltage. Either of the two sets of controlling voltages is selected in the same manner as in LCD 100.

When the selection of common electrodes Y1 through Y6 on the liquid crystal panel 210 is changed from the common electrode to the (n+1)th common electrode and the difference I between the number of ON dots on both the nth and (n+1)th common electrodes is positive, the voltages V01U, V2U, V3L and V5L are applied as the voltages V0, V2, V3 and V5 by X power source 2107 to liquid crystal unit 101 for a period corresponding to the absolute value of I. Conversely, when I has a negative value the voltages V0L, V2L, V3U and V5U are applied to liquid crystal unit 101 as the voltages V0, V2, V3 and V5 for a period corresponding to the absolute value of I.

Figure 49A:
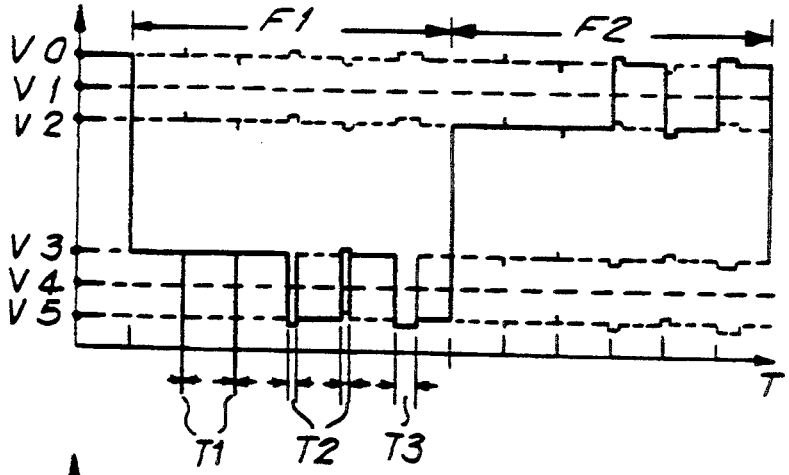
FIGS. 49A–49C are graphs of the applied voltage waveform for forming the display pattern of FIG. 32.
Figure 49B:
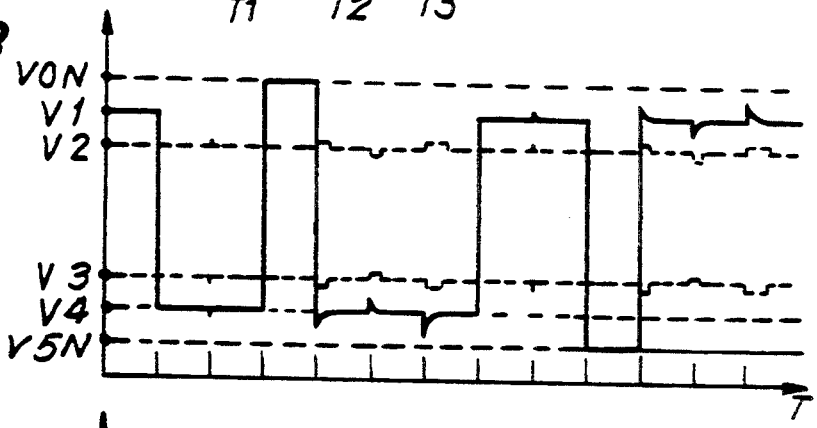
Figure 49C:
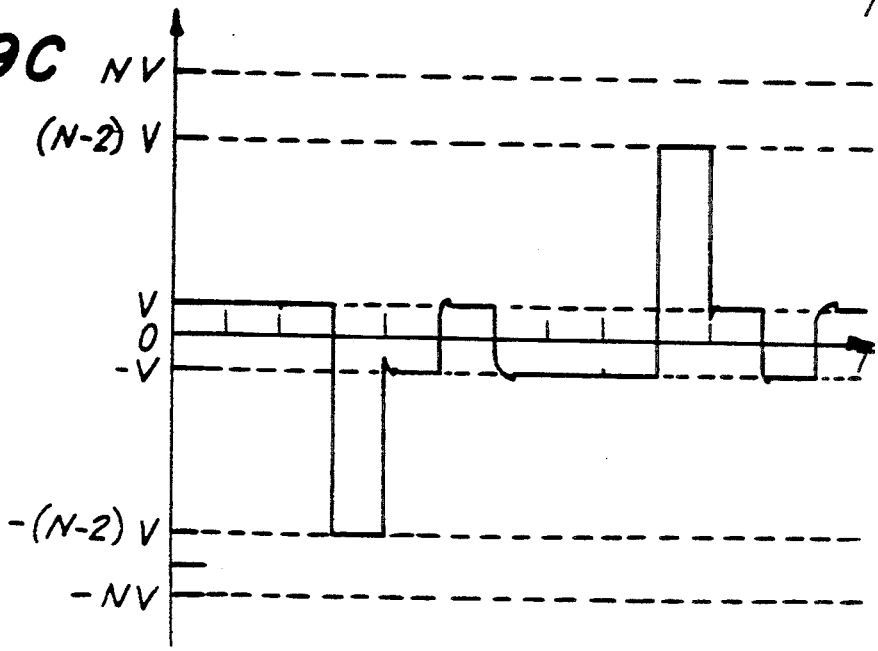

Reference is now made to FIGS. 49A–49C where waveforms for producing the display of FIG. 32 by LCD 2100 is provided. FIG. 49A illustrates a voltage waveform applied to segment electrode X4 for forming display dot 601. FIG. 49B illustrates a voltage waveform applied to common electrode Y3 for forming display dot 601. FIG. 49C illustrates the combined voltage waveform applied to the display dot 601.

As discussed above, when the selected electrode is moved from one common electrode to the next common electrode, the greater the difference I between the number of ON dots on the common electrode and the number of ON dots on the next selected common electrode, the larger the spike-shaped noise waveform superimposed to the non-selected voltage becomes. However, as seen in FIG. 49A ON/OFF voltages are changed in the direction of generated superimposed spike-shaped noise and the period during which the ON/OFF voltages are changed is increased according to the difference I, as shown in periods T1, T2 and T3. Under such a construction, it is possible to provide an improved display without zebra crosstalk by compensating the effective voltage. As noted above, ON/OFF voltages are changed for the period corresponding to the value I, thereby obtaining the same effects as in LCD 100, 900, 1400 and 1600. The above mentioned compensation is known as "time base compensation of ON/OFF voltages".

In a sixth embodiment, it is possible to compensate the voltage base, the time-voltage base, or the functional waveform of the ON/OFF voltages. In these cases, the same effects as those of LCD 2100 can be obtained. Further, it is also possible to compensate the voltage base, the time-voltage base or the functional waveform of non-selected voltage and either the ON voltage or the OFF voltage, or all three voltages. Additionally, such constructions are easily achieved based upon the above described embodiments therefore the description of the constructions are omitted herein.

As mentioned above, in each of the embodiments when the selected common electrode Y1 through Y6 is changed from one common electrode to the next common electrode, the non-selected voltage, or the ON/OFF voltages are changed in accordance with the difference I between the number of ON dots of the one common electrode and the next selected common electrode, thereby making it possible to provide an improved display quality without zebra crosstalk. While specific embodiments have been illustrated and described herein, the means for compensating the voltage is not limited thereto. It is also possible to utilize any means that can compensate the effective voltages applied to the display dots in accordance with the value of I.

Figure 50:
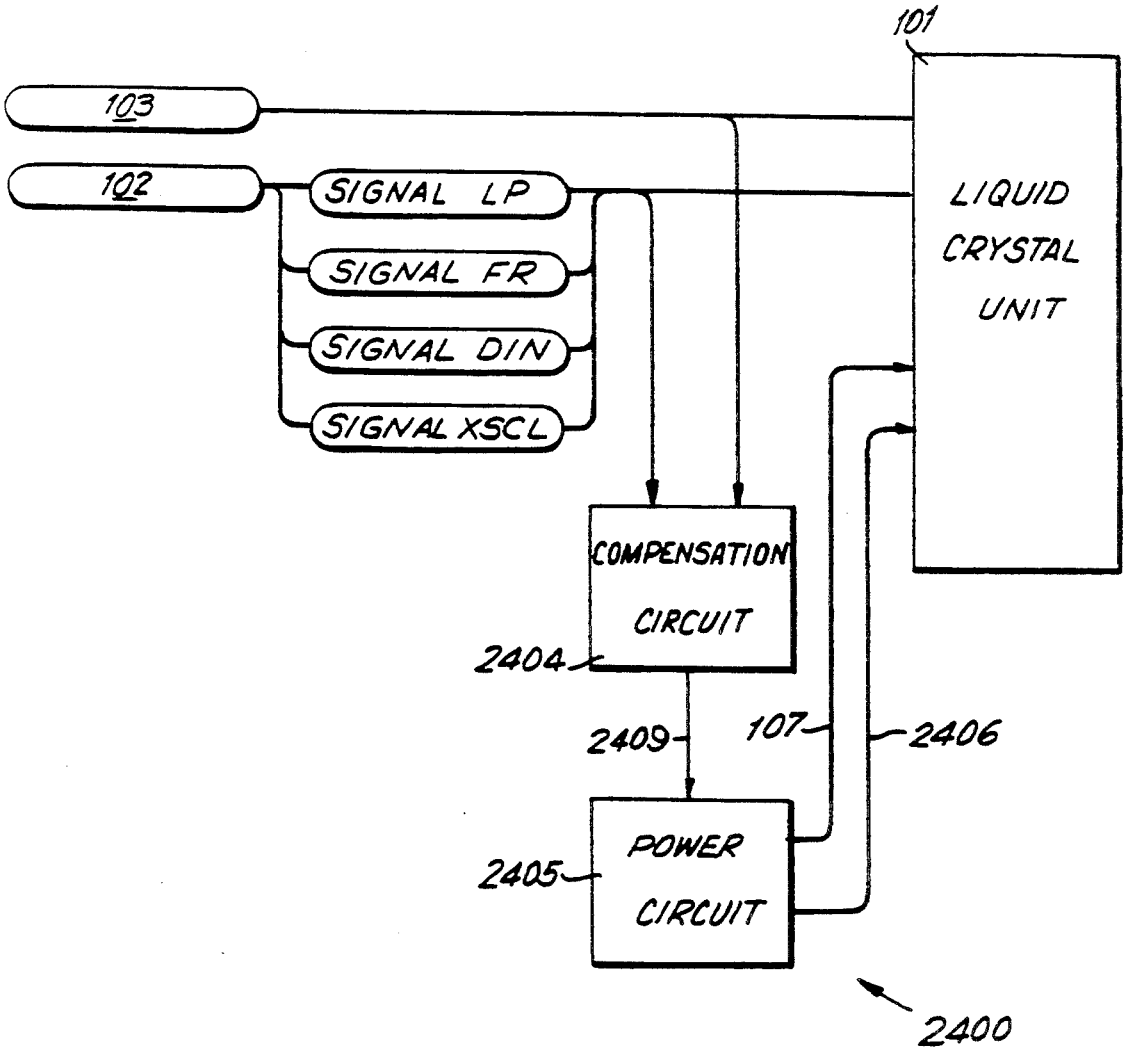
FIG. 50 is a block diagram of a liquid crystal device constructed in accordance with a seventh embodiment of the invention.

Reference is now made to FIG. 50 wherein a block diagram of a seventh embodiment of an LCD, generally indicated as 2400 for providing a display without horizontal crosstalk is provided. As discussed above, the degree of horizontal crosstalk is determined by the number of ON dots on the selected common electrode. Therefore, it is necessary to compensate the waveform in accordance with a counted value Z during operation of the liquid crystal display device.

LCD 2400 includes a compensation circuit 2409 for counting the number of ON dots Z on the next selected common electrode and producing a strength signal 2409 for a period corresponding to the value Z. Compensation circuit 2404 receives data signal 103 and control signal 102 and calculates Z in synchronism with signal LP of control signal 102. A power circuit 2405 receives strength signal 2409, and outputs a Y power source 2406 and an X power source 107. Power source 106 includes a selected voltage which may be varied. The voltage width of the selected voltage is uniform, and the period of the changed voltage width is defined by strength signal 2409. Accordingly, the period of the selected voltage is varied according to the value Z. Therefore, the selected voltage is compensated by varying the period according to the value Z counted by the compensation circuit 2404.

Figure 51:
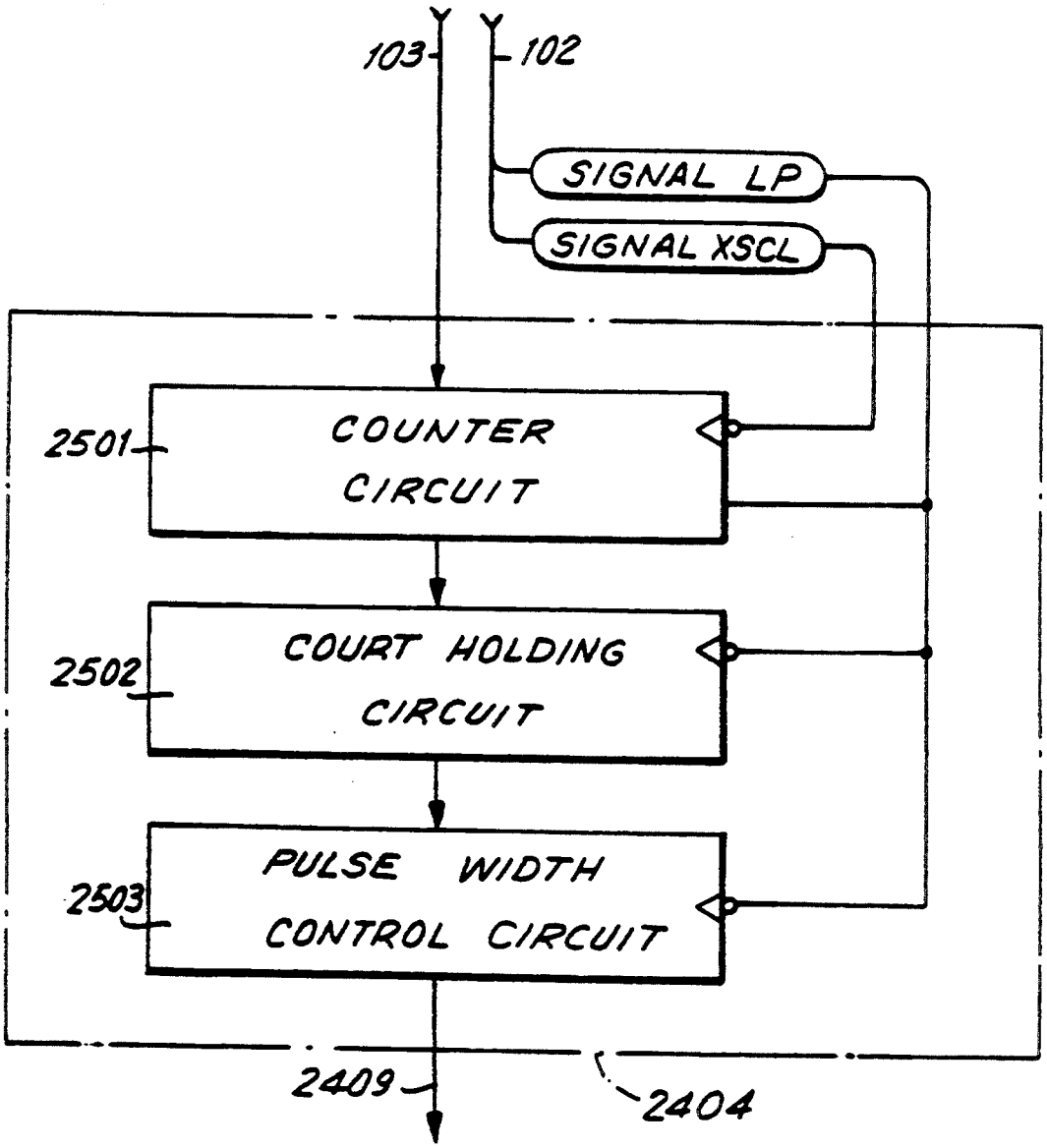
FIG. 51 is a block diagram of a compensation circuit constructed in accordance with the seventh embodiment.
Figure 52:
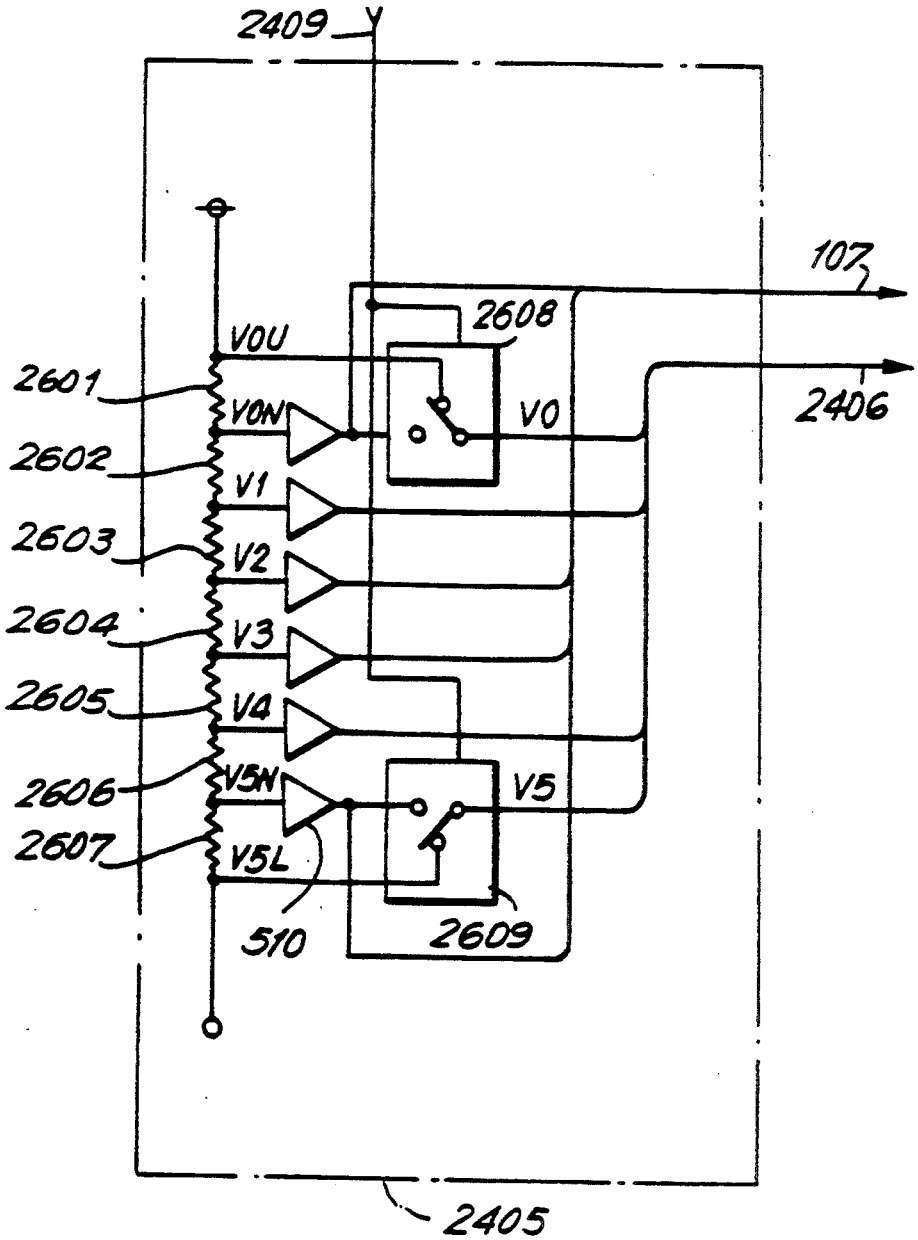
FIG. 52 is a circuit diagram of a power circuit constructed in accordance with the seventh embodiment of the invention.

Reference is now made to FIG. 51 wherein an exemplary embodiment of compensation circuit 2404 is provided. A counter circuit 2501 and a count holding circuit 2502 operate in the same manner as counter circuit 401 and count holding circuit 402. Generally, the value $M_{ON}$ of ON dots of the next selected common electrode is counted by counter circuit 2501 and is output as the value Z into count holding circuit 2502. A pulse width control circuit 2503 receives the output of count holding circuit 2502 and signal LP and is triggered by output strength signal 2409 which is active for a period corresponding to the value Z. The output of pulse width control circuit 2503 is triggered by the falling edge of signal LP of control signal 102.

The period W over which strength signal 2409 is active is represented by the following equation:

$$W=\Sigma a_k Z^{1/k}+\Sigma b_k Z^{1/k}$$

$a_k$ and $b_k$ are constants. K is a natural number. In compensation circuit 2404 the period is represented by the following equation:

$$W=a_0+a_1 Z+a_2Z^2+b_2^{\frac{1}{2}}$$

Compensation circuit 2404 comprises the above construction. Therefore, when the selected common electrode changes from the nth common electrode to the (n+1)th common electrode, strength signal 2409 is output for a period in accordance with the value Z of ON dots on the (n+1)th common electrode.

Reference is now made to FIG. 51 in which circuit diagram for power circuit 2405 is provided. A plurality of resistors 2601 through 2607 are serially connected forming associated voltage dividers. Voltages V0U and V5L are applied across each end of the series of resistors.

Accordingly, voltages V0U, V0N, V1, V2, V3, V4, V5N and V5L are the voltages generated at the respective terminals of resistors 2601 through 2607. The relationship among the respective voltages is defined as follows:

$$V0N - V1 = V1 - V2$$
$$= V3 - V4 = V4 - V5N$$
$$= (V2 - V3) / (n - 4) \text{ (} n \text{ is a constant).}$$

Further, $$(V0U - V0N) / (V1 - V2)$$
$$= (V5N - V5L) / (V4 - V5N)$$

Furthermore, the voltages V0N through V5N generated by the above resistors 2601 through 2607 are stabilized by a respective voltage stabilizing circuit 510 in the same manner as in power circuit 105.

Two switches 2608 and 2609 each receive strength signal 2409. Switch 2608 receives V0U and V0N as inputs and switch 2609 receives switch V5L and V5N as inputs. Switches 2608 and 2609 select the appropriate voltages based upon strength signal 2409. When strength signal 2409 is active, switches 2608 and 2609 are select voltages V0U and V5L, respectively. When strength signal 2409 is not active, switches 2608 and 2609 select voltages V0N and V5N, respectively. The voltages output by switches 2608 and 2609 are output voltages V0 and V5. Y power source 2406 includes voltages V0 and V5 and voltages V1 and V2. Voltages V0N, V2, V3 and V5N are output as X power source 107. When strength signal 2409 generated by compensation circuit 2404 is active, voltages V0U and V5L are output as voltages V0 and V5 of Y power source 106. When strength signal 2409 is not active, voltages V0N and V5N are output as Y power source 106.

Furthermore, the selected voltage, non-selected voltage, ON voltage and OFF voltage are applied to liquid crystal unit 101 in two sets by Y power source 2406 and X power source 107 as in the above embodiments. The selected voltage of Y power source 2406 is varied in accordance with values of Z. In LCD 2600 when the selected common electrode is changed from the nth common electrode to the (n+1)th common electrode of liquid crystal panel 201, voltages V0U and V6L not V0N and V5N, are generated as voltages V0 and V5 of Y power source 2406 for a period corresponding to the value Z of ON dots on the (n+1)th common electrode.

Figure 55A:
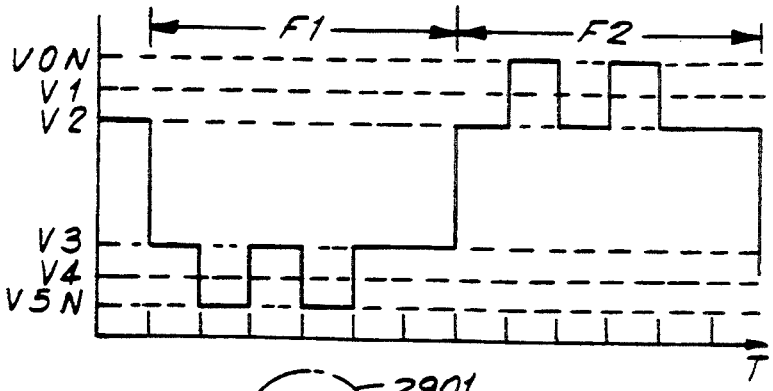
Figure 55B:
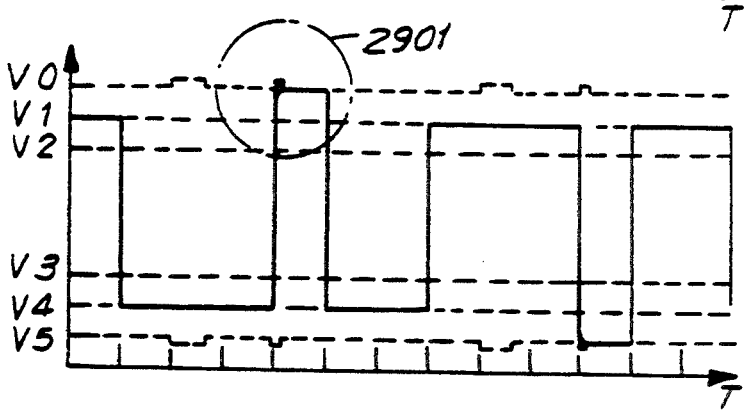
Figure 55C:
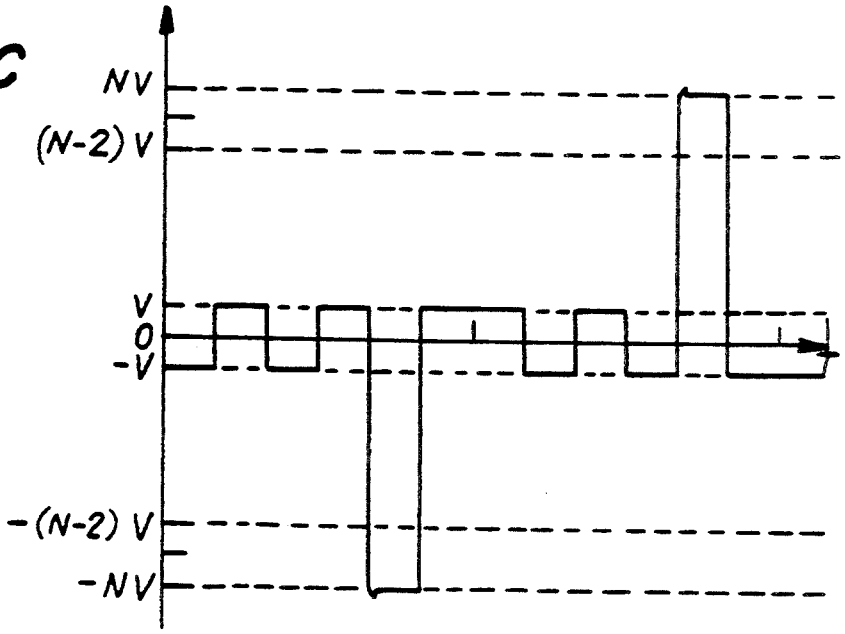

Reference is now made to FIGS. 53-55C in which one embodiment of a display pattern formed in accordance with LCD 2600 is provided. FIG. 54A illustrates a voltage waveform applied to segment electrode X1 to form an ON dot 2701. FIG. 54B illustrates a voltage waveform applied to common electrode Y4 to form ON dot 2701. FIG. 55C illustrates a combined voltage waveform applied at ON dot 2701.

Similarly, FIG. 55A illustrates a voltage waveform applied to segment electrode X1 to form an ON dot 2702. FIG. 55B illustrates a voltage waveform applied to common electrode Y4 to form ON dot 2702. FIG. 55C illustrates a combined voltage waveform applied to ON dot 2702. Voltages applied by Y power source 2406 and Y power source 107 are represented by dashed lines.

Figure 56:
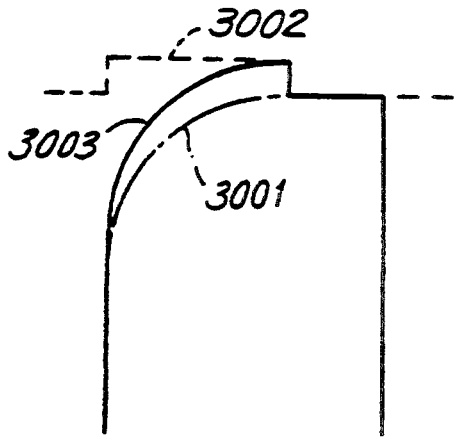
FIG. 56 is partial exploded view of the waveform of FIG. 54C.
Figure 57:
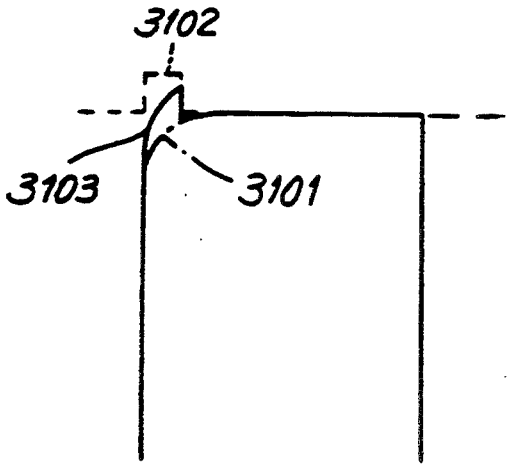
FIG. 57 is a partial exploded view of the waveform of FIG. 55C.

Reference is also made to FIGS. 56 and 57 in which a region of FIG. 55B, generally indicated as 2801 and an exploded view of FIG. 56B, generally indicated as 2901, are provided. A rounded waveform 3001 is generated in second common electrode Y2 when common electrode Y2 is switched from the non-selected voltage to the selected voltage. A waveform of the selected voltage 3002 is applied by Y power source 2406, resulting in a combined waveform 3003, voltage waveform 3003 is applied to second common electrode Y2.

Similarly, a round waveform 3101 is generated in fourth common electrode Y4 when switched from the non-selected voltage to the selected voltage. Again a selective voltage waveform 3102 is applied by Y power source 2406. A waveform 3013 is obtained by the combination of waveforms 3101 and 3102, and is the actual voltage waveform applied to the fourth common electrode Y4.

Figure 53:
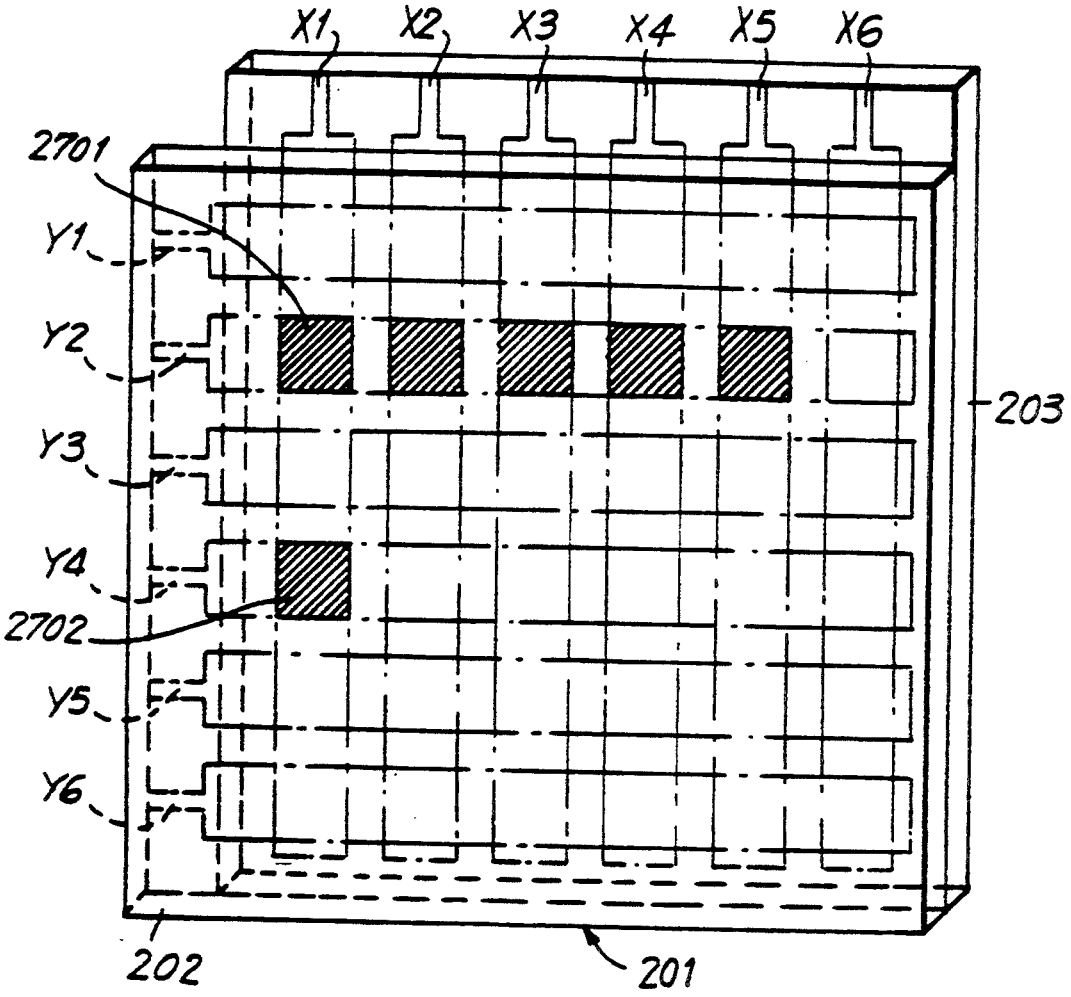
FIG. 53 is a perspective view of a liquid crystal panel wherein another display pattern is displayed.
Figure 54A:
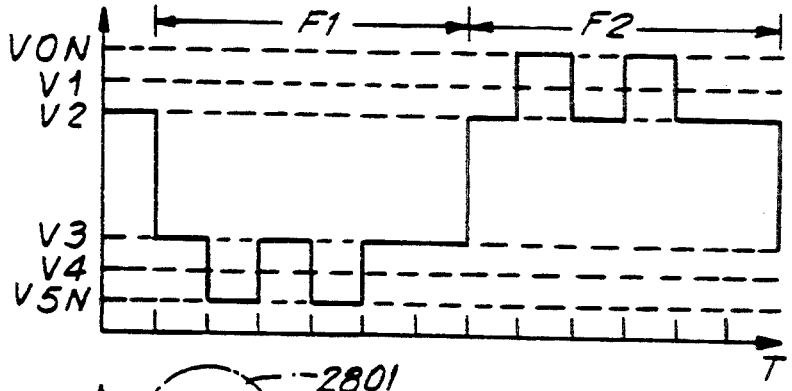
FIGS. 54A–54C and 55A–55C are graphs of the waveforms of the voltage applied to the liquid crystal panel for forming the display pattern of FIG. 23.
Figure 54B:
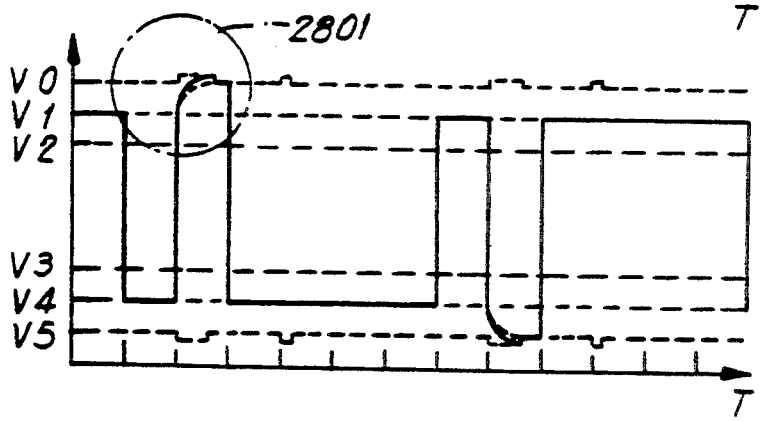
Figure 54C:
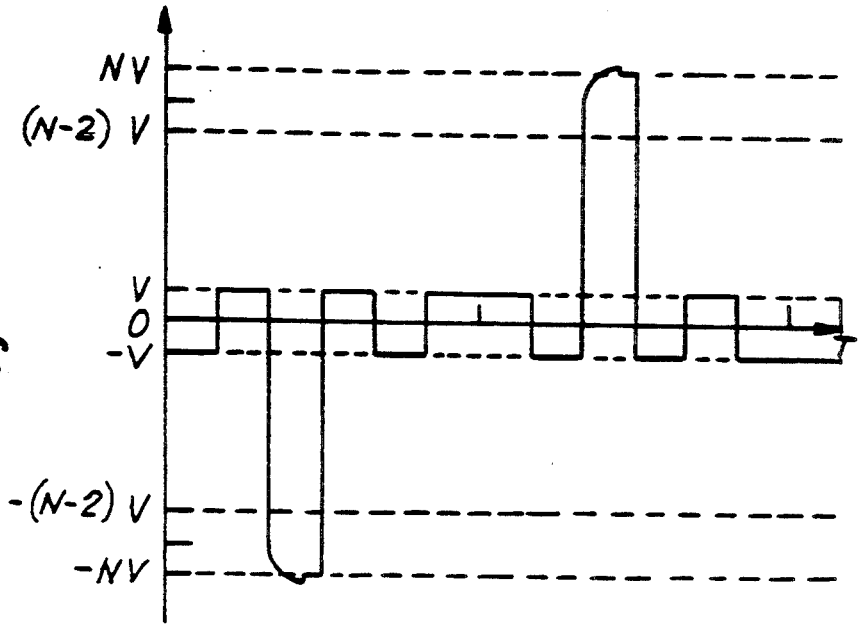

Herein, when the display pattern shown in FIG. 53 is formed, the respective values for Z of ON dots on common electrode substrate 202 are as follows:

| | |
|---|---|
| first common electrode Y1 | Z = 0 |
| second common electrode Y2 | Z = 5 |
| third common electrode Y3 | Z = 0 |
| fourth common electrode Y4 | Z = 0 |
| fifth common electrode Y5 | Z = 1 |
| sixth common electrode Y6 | Z = 0 |

As is apparent from the comparison between waveform 3001 and waveform 3101, a larger rounded waveform may occur on second common electrode Y2, than on fifth common electrode Y5, when switching from non-selected voltage to the selected voltage occurs. However, waveform 3002 of the selected voltage changes more quickly in the direction in which voltage on the common electrode is applied and for a longer time than those of waveform 3102. Accordingly, the selected voltages are compensatively applied in accordance with the respective degree of the roundness of each waveform 3101, resulting in no difference between the effective voltage applied to ON dots 2701 and 2702, respectively. Therefore, it is possible to provide a superior display quality without horizontal crosstalk.

As noted, it is possible to provide an improved display without horizontal crosstalk by compensating the period during which the selected voltage is applied in accordance with a value Z of ON dots on the selected common electrode.

In an eighth embodiment, it is also possible to compensate the voltage base, the time-voltage base, or the functional waveform of the selected voltage in accordance with the value Z of the ON dots on the selected common electrode as in FIG. 28. The same effects as those of LCD 2400 can then be obtained. In a ninth embodiment, it is possible to compensate the voltage, the time-voltage base or the functional waveform of the ON voltage and the OFF voltage in accordance with the value Z of the ON dots on the selected common electrodes of substrate 202.

Figure 58:
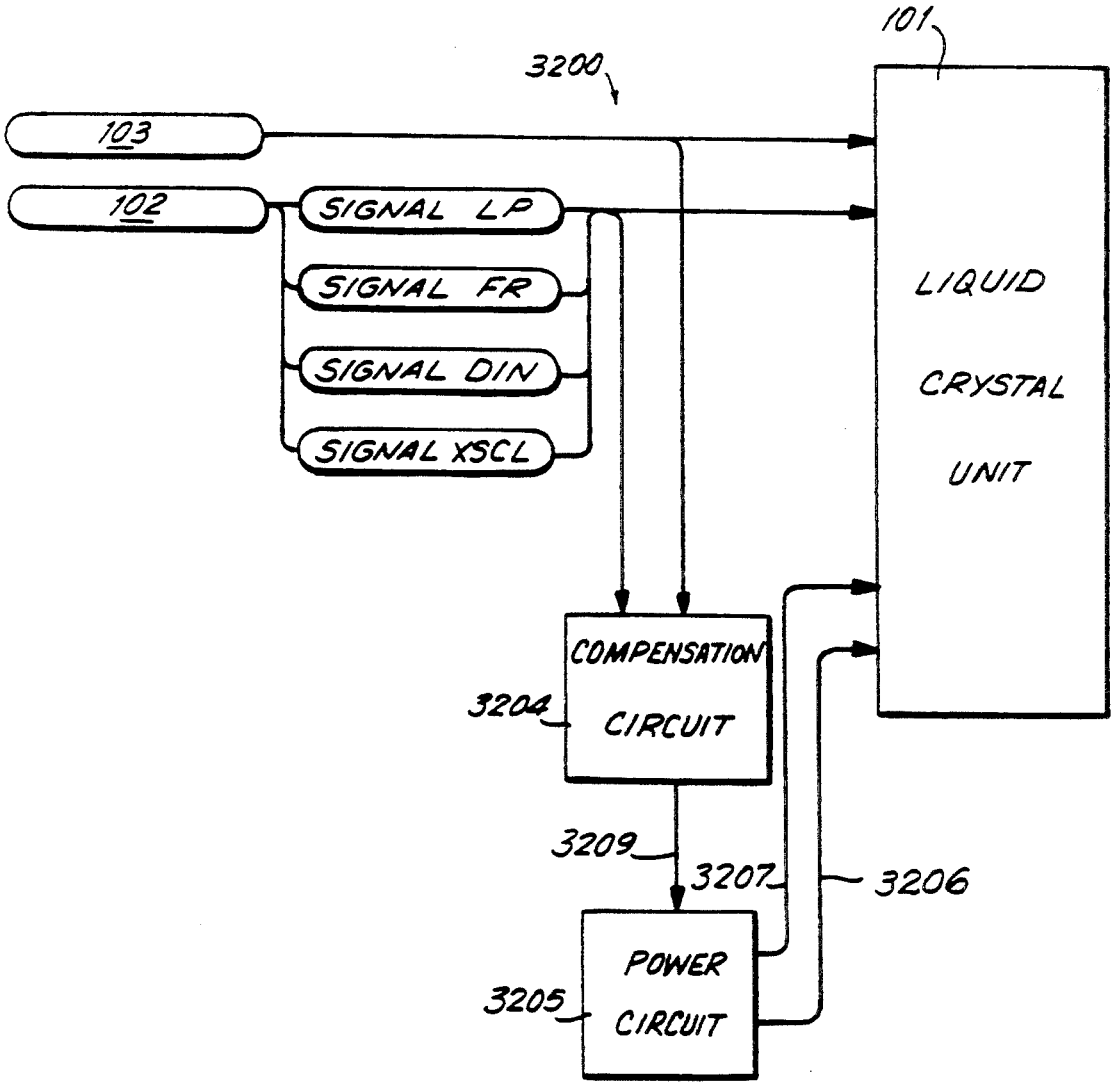
FIG. 58 is a block diagram of a liquid crystal display of a tenth embodiment of the invention.

Reference is made to FIG. 58 in which a block diagram of a tenth embodiment of an LCD, generally indicated as 3200, which displays a pattern without vertical crosstalk is provided. As mentioned above, the degree of vertical crosstalk is determined by the difference T' between the number T of ON dots and the value L of OFF dots on the liquid crystal panel. Since the sum of T and L is G, the total number of display dots on the liquid crystal panel, T' is expressed by the following equation:

$$\begin{aligned} T' &= T - L \\ &= T - (G - T) \\ &= 2 \times T - G \quad (G \text{ is a constant}). \end{aligned}$$

Therefore, when the liquid crystal display device is operated, it is not necessary to count both the values T and L, but only the value T and then compensate the applied voltage in accordance with the value T.

LCD 3200 includes a compensation circuit which receives data signal 103, signal XSCL and signal DIN and counts the number of ON dots on liquid crystal panel 201. Compensation circuit 3204 outputs a strength signal 3209 to a power circuit 3205. Power circuit 3205 shifts the potential value of the OFF voltage of Y power source 3206 in accordance with the input value of strength signal 3209. It thus becomes possible to prevent vertical crosstalk and provide a superior display.

Figure 59:
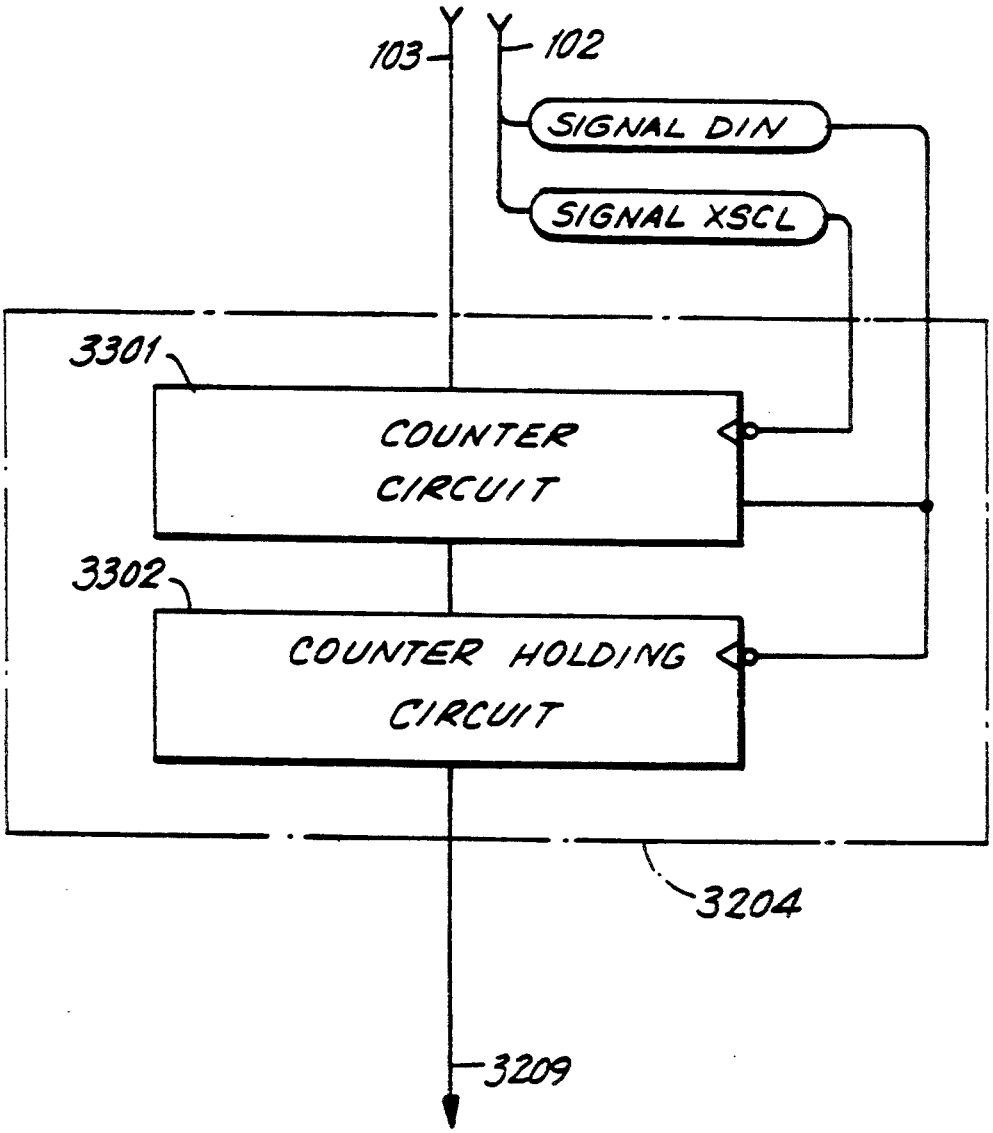
FIG. 59 is a block diagram of a compensation circuit constructed in accordance with the tenth embodiment.

Reference is now made to FIG. 59 in which a block diagram of compensation circuit 3204 is provided. A counter circuit 3301 counts the total number of ON dots on liquid crystal panel 201 and more particularly, counts the number of ON dots for a period between successive signal DINs of control signal 102 when data signal 103 is active and at the falling edge of signal XSCL. The counted number is then output to a counter holding circuit 3302. The counted number of counter circuit 3301 is returned to zero. Counter circuit 3301 again counts the number of ON dots. By such a construction, it is possible to count the value T of the ON dots on liquid crystal panel 201. In addition, it is not required to make an errorless count. Errors of up to approximately five percent of the total number of display dots 204 on liquid crystal panel 201 do not effect the quality of the display.

Counter holding circuit 3302 is provided to hold the value T generated by counter circuit 3301. The counted value T is output as strength signal 3209. Thus, compensation circuit 3204 outputs the value T of ON dots on liquid crystal panel 201 as strength signal 3209.

Figure 60:
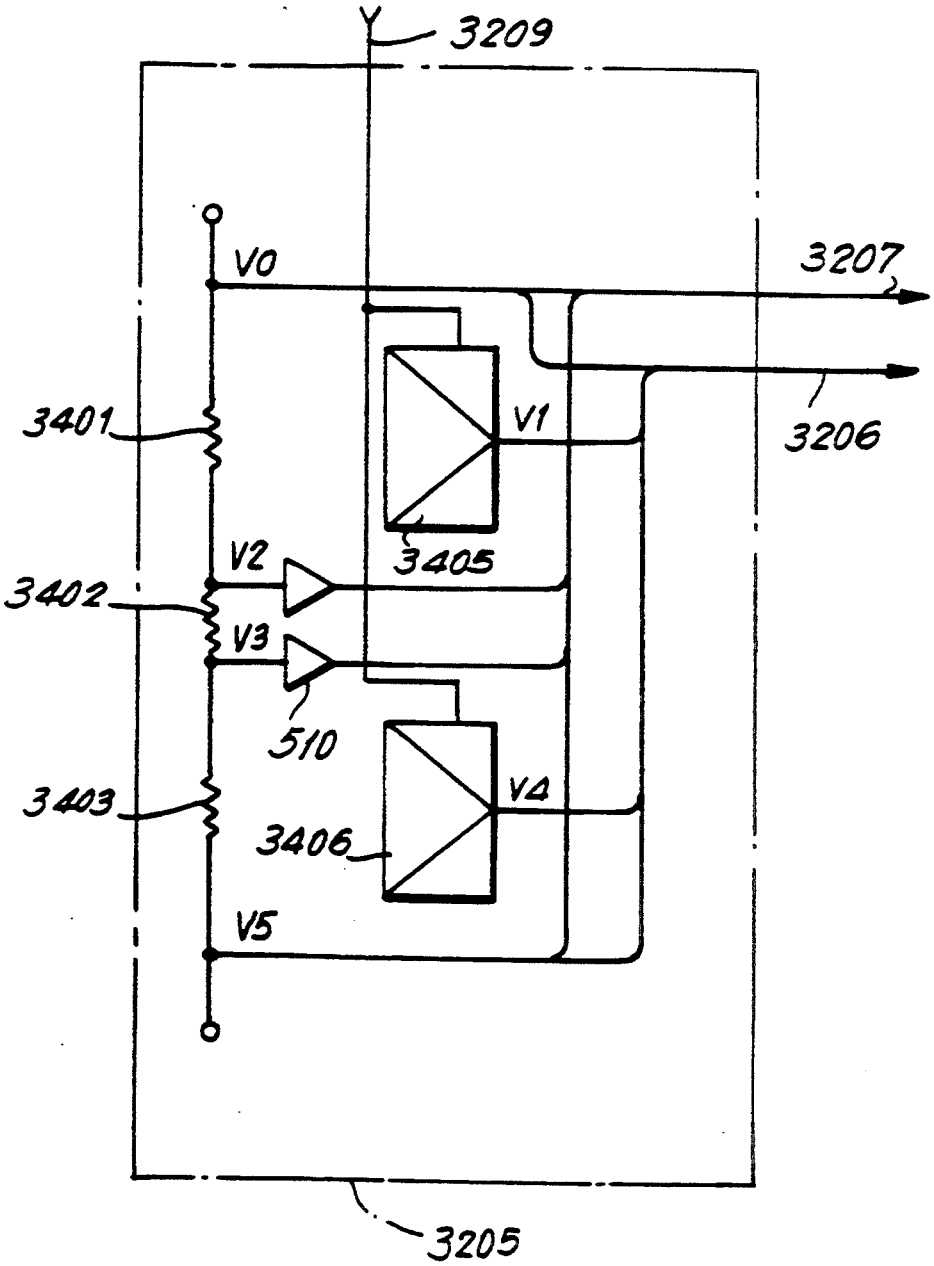
FIG. 60 is a block diagram of a power circuit constructed in accordance with the tenth embodiment of the present invention.

Reference is now made to FIG. 60 in which a circuit diagram of power circuit 3205 is provided. Three resistors 3401, 3402, 3403 are serially connected. Voltages V0 and V5 are applied across the ends of the series of connected resistors providing voltage dividers. The divided voltage V0, V2, V3 and V5 represent the divided voltages at the terminals of respective resistors 3401, 3202 and 3403. The respective voltage values are predetermined and represented as follows:

$$(V0-V2)/2=(V3-V5)/2$$

Further, to stabilize the voltages V2 and V3, a voltage stabilizing circuit 510 which functions identically as in power circuit 105 is provided.

Herein, the voltages V1N and V4N are defined as follows:

$$V1N=(V0+V2)/2$$

$$V4N=(V5+V3)/2$$

The voltages V1N and V4N are set to be an intermediate voltage between voltages V0 and V2, and an intermediate voltage between the voltages V3 and V5, respectively.

Voltage generating circuits 3405 and 3406 receive strength signal 3209 and generate output voltages which are varied in accordance with changing values of strength signal 3209. Voltage generating circuits 3405 and 3406 comprise a digital to analogue convertor. Herein, P, the strength signal 3209, is defined as follows:

$$P=T-(\gamma \times G)$$

where G indicates the total number of dots on liquid crystal panel 201 and is approximately $\frac{1}{2}$. In an exemplary embodiment, $\alpha$ is $\frac{1}{2}$.

Voltage generating circuit 3405 is controlled to output a voltage V1N which is shifted in accordance with the absolute value of P in the direction of voltage V2 when P is positive ($T>(\gamma \times G)$) and in the direction of the voltage V0 when P is negative ($T<(\gamma \times G)$). Similarly, when the value T of the strength signal 3209 is larger than the constant ($\gamma \times G$), voltage generating circuit 3406 outputs a voltage corresponding to the absolute value of P which is shifted in the direction of the voltage V3 relative to the voltage V4. When the value T of strength signal 3209 is smaller than the constant, the voltage generating circuit 3406 outputs a voltage corresponding to the absolute value of P which is shifted in the direction of the voltage V5 relative to voltage V4. The voltage generated by voltage generating circuits 3405 and 3406 serve as V1 and V4. Voltages V1, V4 and voltages V0 and V5 are generated by the power circuit 3205 as a Y power source 3206. The voltage V0, V2 and V5 are generated by power circuit 3205 as an X power source 3207. Y power source 3206 and X power source 3207 are applied to liquid crystal panel 201 in either set as discussed above in the other embodiments. The voltages V1 and V4 are non-selected voltages of Y power source 3206 and their potential values are changed in accordance with the value T as discussed above.

In LCD 3200, when a small number of dots on liquid crystal panel 201 are in the ON state, the non-selected voltage of Y power source 3206 has a value approximating the ON voltage. However, when a large number of dots on liquid crystal panel 201 are in the ON state, the non-selected voltage has a value approximating the OFF voltage.

Figure 61:
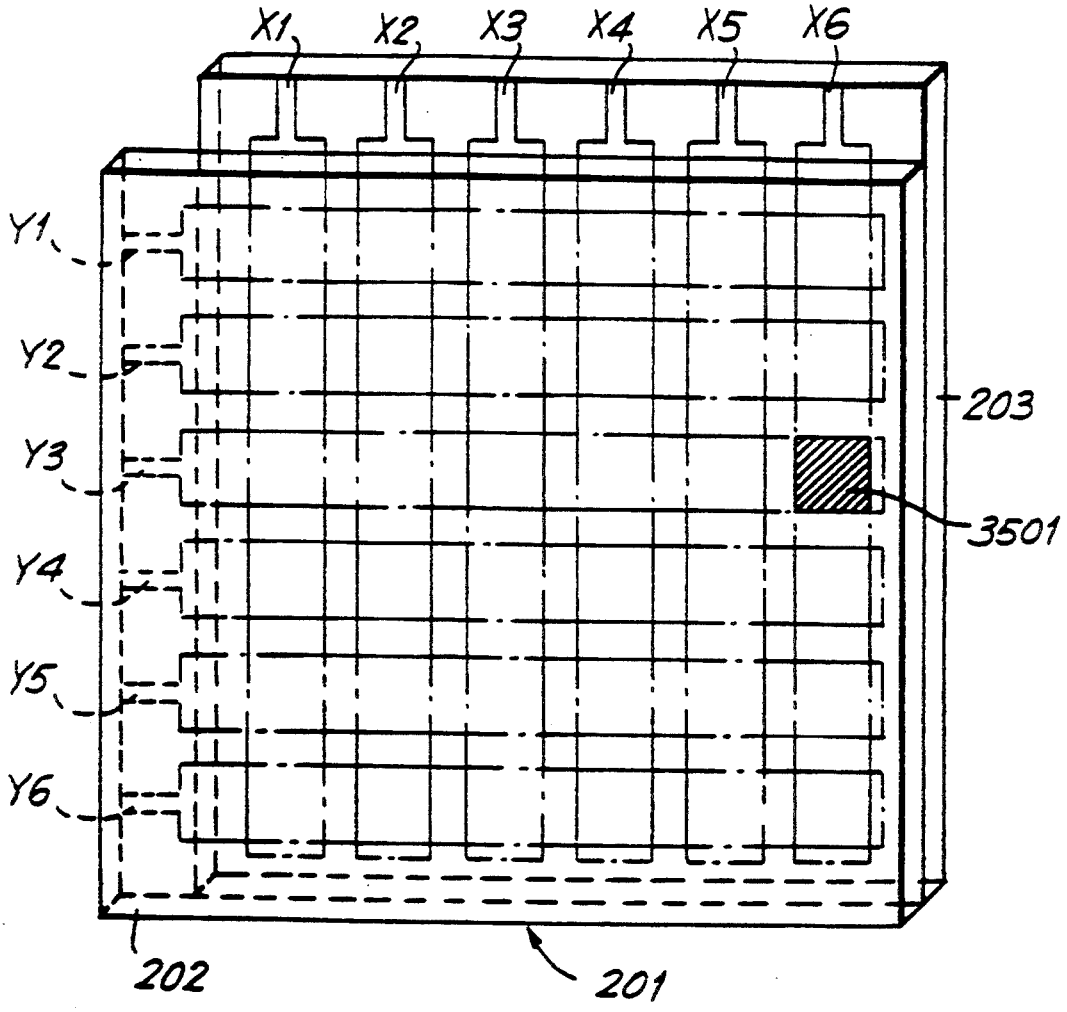
FIG. 61 is a perspective view of a liquid crystal panel wherein another display pattern is displayed.
Figure 62A:
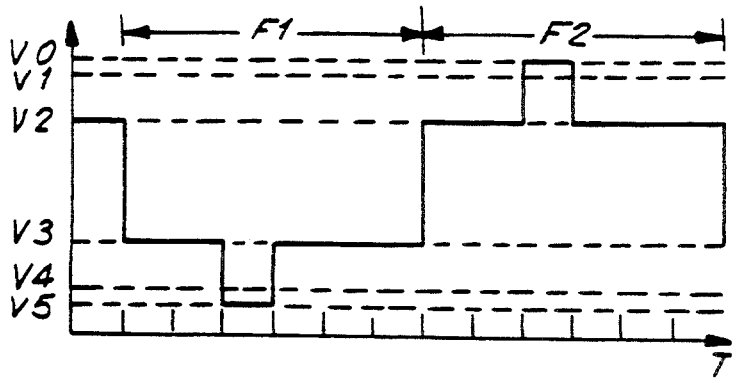
FIGS. 62A–62C are graphs of the waveforms of the voltage applied to the liquid crystal panel for forming the display pattern shown in FIG. 61.
Figure 62B:
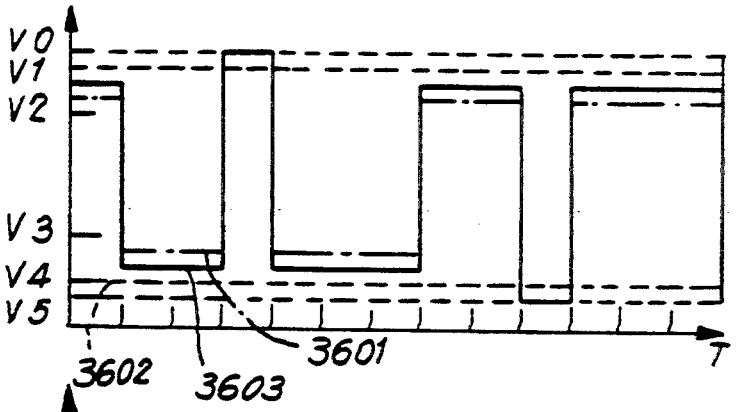
Figure 62C:
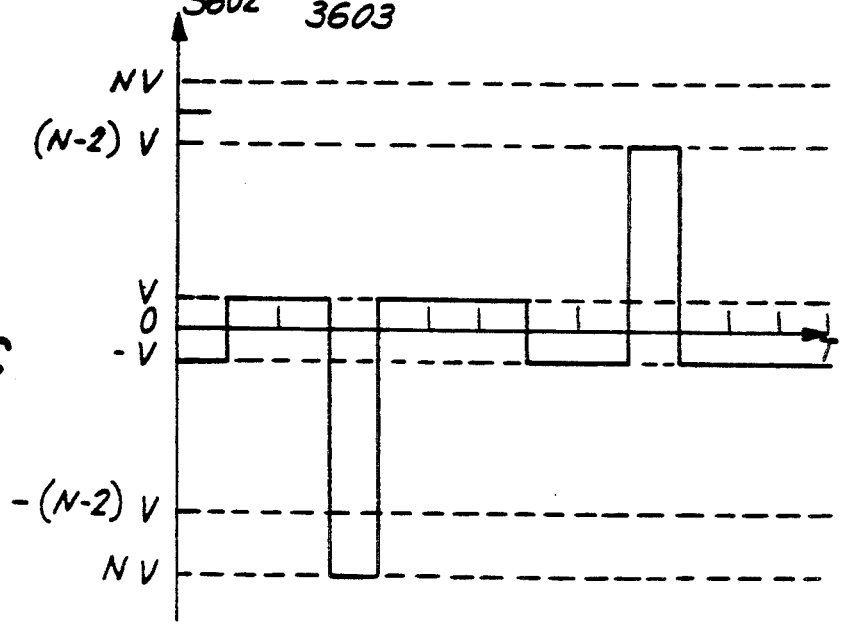

Reference is now made to FIGS. 61 through 62C in which one embodiment of a display pattern and waveforms input to LCD 3200 are provided. Liquid crystal panel 201 provides a display pattern having a small number of ON dots. FIG. 62A illustrates a voltage waveform applied to segment electrode X6 to form a ON dot 3501. FIG. 63B illustrates a voltage waveform applied to common electrode Y3 to form ON dot 3501.

FIG. 63C shows the combined voltage waveform applied at ON dot 3501.

A voltage 3601 is the voltage to be shifted on the common electrode. A voltage 3602 is the non-selected voltage generated by Y power source 3206. A voltage 3603 on the common electrode is obtained by combining voltages 3601 and 3602.

Since the display pattern has a small number of ON dots on the liquid crystal panel 201 ($T<\gamma\times G$), the non-selected voltage on the common electrode is likely to be changed to a value approximating the non-selected voltage as shown in voltage 3601. However, since the display pattern has a small number of ON dots on liquid crystal panel 201, the non-selected voltage generated by Y power source 3206 approximates the ON voltage, as shown by voltage 3602. Accordingly, voltage 3603 is compensated to be an intermediate value between the ON/OFF voltages, resulting in no difference between the effective voltages applied to the display dots of liquid crystal panel 201.

Conversely, when the display pattern has a large number of ON dots on liquid crystal panel 201 ($T>(\gamma\times G)$), the non-selected voltage on the common electrode is likely to be changed to a value near the OFF voltage. However, since the display pattern has a large number of ON dots on liquid crystal panel 201 ($M_{ON}$), the selected voltage generated by Y power source 3206 approximates the OFF voltage, so that the voltage is compensated in the same way.

As discussed, the value of the non-selected voltage is changed in accordance with the value T of the number of ON dots on liquid crystal panel 201, thereby making it possible to provide a good display quality without vertical crosstalk.

In an eleventh embodiment the value of ON/OFF voltages may also be changed in accordance with the value T of the number of ON dots on liquid crystal panel 201, to obtain the same effects. Namely, rather than compensate the value of the non-selected voltage, ON/OFF voltages can be changed by the same value and in the same direction as the value and the direction in which the non-selected voltage applied to the common electrode is likely to be changed, thereby making it possible to provide a high quality of display without any vertical crosstalk.

While specific embodiments have been illustrated and described herein, the means for compensating the voltage is not limited thereto. It is also possible to apply any means that can compensate the difference of the effective voltages generated in accordance with the value T of the number of ON dots on the liquid crystal panel 201.

Figure 63:
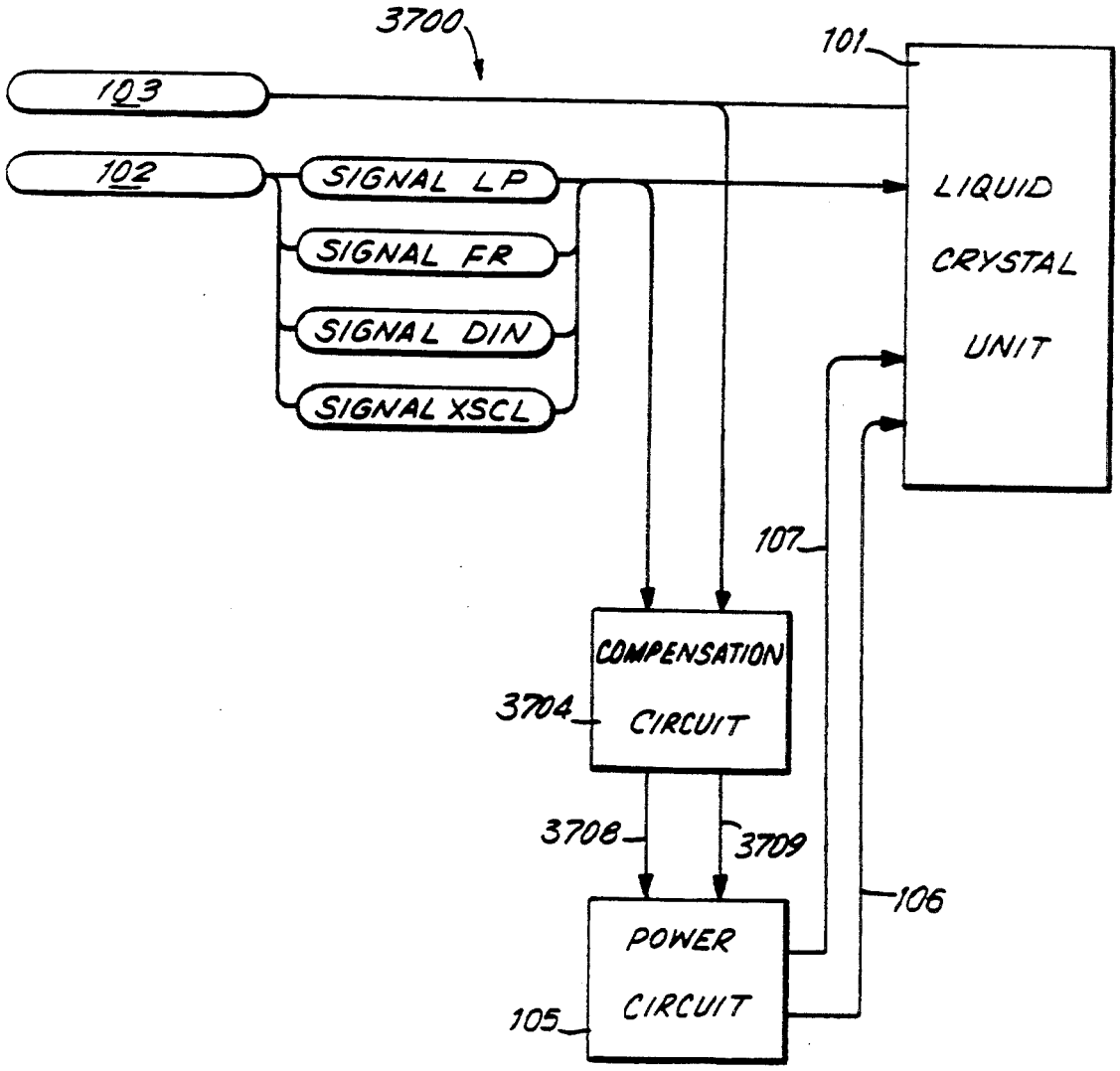
FIG. 63 is a block diagram of a liquid crystal display device constructed in accordance with a twelfth embodiment of the invention.

Reference is now made to FIG. 63 in which a block diagram of a twelfth embodiment of an LCD, generally indicated as 3700, for providing a display without inversion crosstalk is provided. As mentioned above, if the polarity is reversed when the selected common electrode is switched from the nth common electrode to the (n+1)th common electrode, the degree of inversion crosstalk is determined by a value F which is the difference between the sum of the display dots and the sum of the ON dots on both the nth and (n+1)th common electrodes. Therefore, at the time of changing the LCD, it is necessary to count the value F and compensate the voltage in accordance with the value F.

The construction of LCD 3700 is the same as that of LCD 100 with the exception of a compensation circuit 3704, a sign signal 3708 and a strength signal 3709. Like numerals are utilized to indicate like structure.

Upon the inputting of control signal 102 and data signal 103 to compensation circuit 3704, the value F is counted by compensation circuit 3704 and the sign of F is output as sign signal 3708 by compensation circuit 3704. Further, strength signal 3709 which is generated for a period corresponding to the absolute value of F is also output by compensation circuit 3704 in synchronism with signal LP when signal FR of control signal 102 changes. Power circuit 105 receives both strength signal 3709 and sign signal 3708. Upon the input of sign signal 3708 and strength signal 3709, power circuit 105 changes the non-selected voltage of Y power source 106 to compensate the applied voltage.

Figure 64:
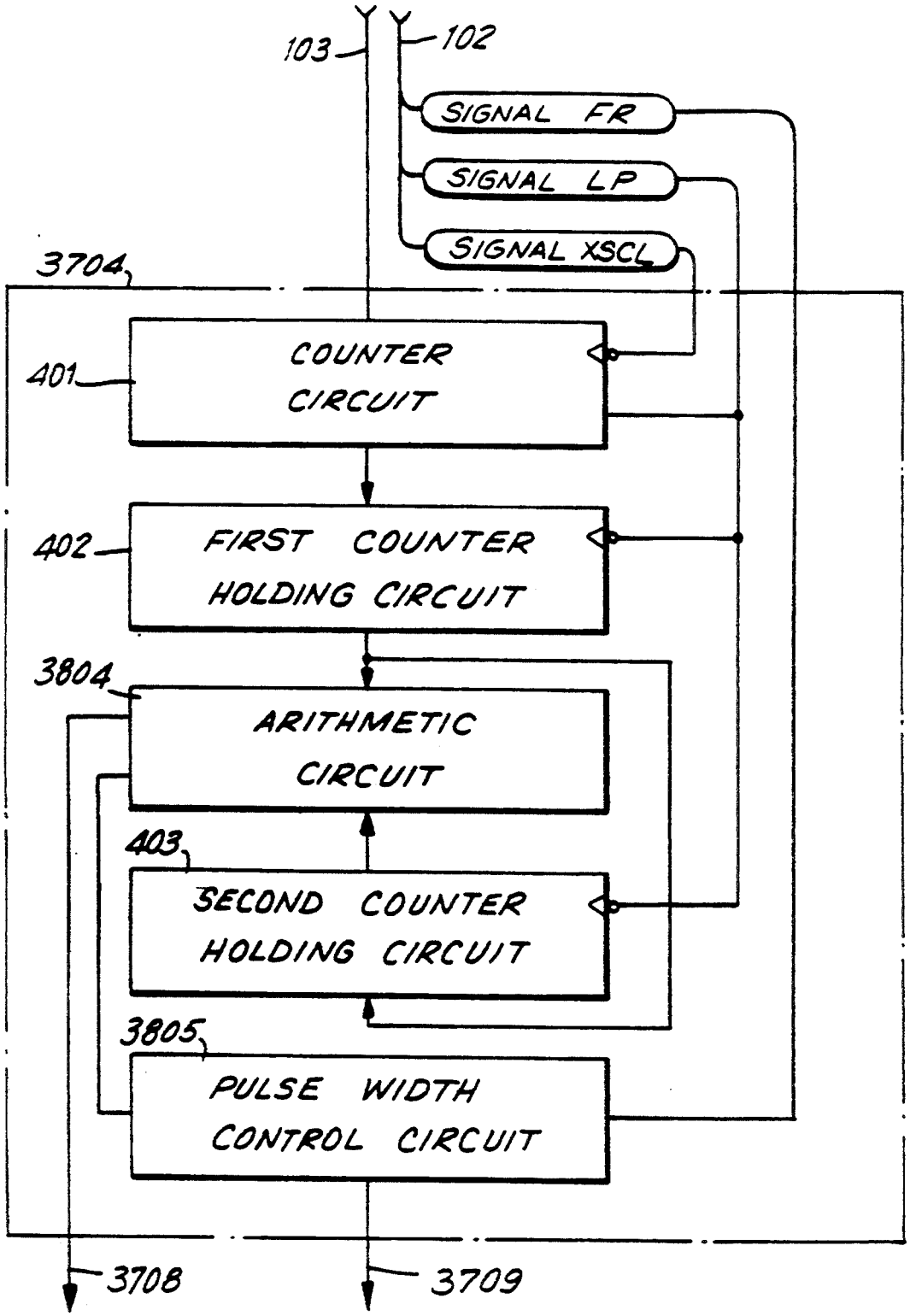
FIG. 64 is a block diagram of a compensation circuit constructed in accordance with the twelfth embodiment of the invention.
Figure 65:
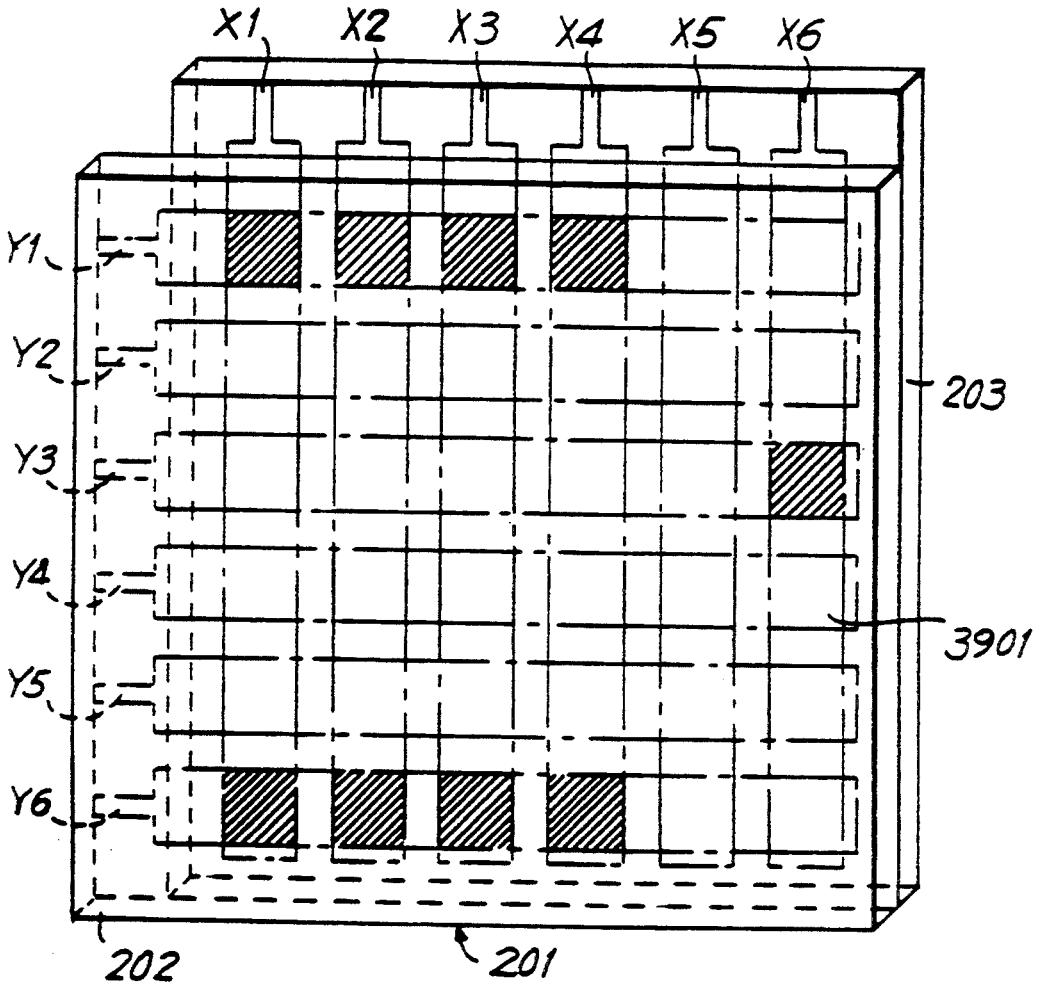
FIG. 65 is a perspective view of a liquid crystal panel wherein another display pattern is displayed.

Reference is now made to FIG. 64 wherein a block diagram of compensation circuit 3704 is provided. Compensation circuit 3704 includes counter circuit 401, a first counter holding circuit 402 and a second counter holding circuit 403 which all operate in the same way manner as in compensation circuit 104. However, an arithmetic circuit 3804 is provided to calculate the following equation:

$$F=-(N_{ON}+M_{ON}-Q)$$

Where Q is a number approximating the number of segment electrodes X1 through X6. In an exemplary embodiment, Q is predetermined as the number of segment electrodes X1 through X6. The sign of F obtained by arithmetic circuit 3804 is output as a sign signal 3708 and the absolute value of F is output to a pulse width control circuit 3805. Pulse width control circuit 3805 outputs strength signal 3709 which is generated over a period corresponding to the absolute value of F in synchronism with signal LP when signal FR of control signal 102 changes. The relation between the output period of strength signal 3709 and the absolute value of F is the same as that of the pulse width control circuit 405. Further, sign signal 3708 and strength signal 3709 generated by compensation circuit 3704 operate in the same manner as sign signal 108 and strength signal 109.

In compensation circuit 3704, if the polarity of F is reversed when the selected electrode is switched from the nth common electrode to the (n+1)th common electrode, when the sum of the number of ON dots on the nth and (n+1)th common electrodes is larger than the number of segment electrodes X1 through X6, the non-selected voltage applied to common electrodes Y1 through Y6 is changed for a period corresponding to the difference between the number of ON dots and the number of segment electrodes in the direction of the OFF voltage. However, when the sum of the number of ON dots on the nth and (n+1)th common electrodes is smaller than the number of segment electrodes X1 through X6, the non-selected voltage is changed for a period corresponding to the difference between the number of ON dots and segment electrodes in the direction of the ON voltage.

Reference is now made to FIGS. 65 through 70 which illustrate other embodiments of a display pattern provided by LCD 3700. FIG. 66A illustrates a voltage waveform applied to the segment electrode X6 to form an ON dot 3901. FIG. 66B illustrates a voltage waveform applied to common electrode Y4 to form ON dot 3901. FIG. 66C illustrates a combined voltage waveform applied to ON dot 3901. A spike-shaped noise waveform 4101 (FIG. 67) is generated on the common electrode. A waveform 4102 of the selected voltage is applied by Y power source 107 to produce a waveform 4103 obtained by the combination of waveforms 4101 and 4102, on common electrode with a value V.

Figure 69A:
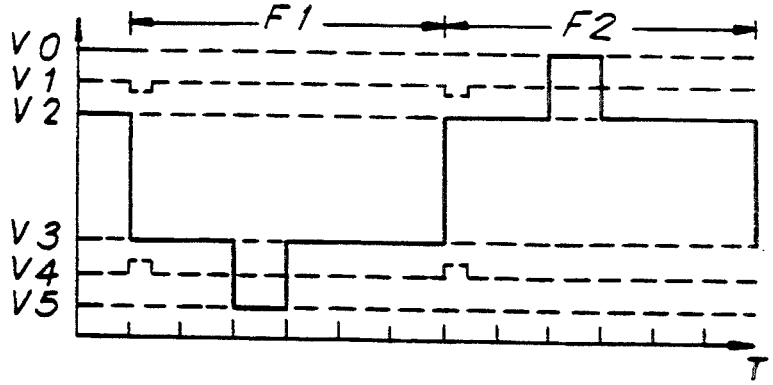
FIGS. 69A–69C are graphs of the waveforms applied to the liquid crystal panel for forming the display pattern of FIG. 68.
Figure 69B:
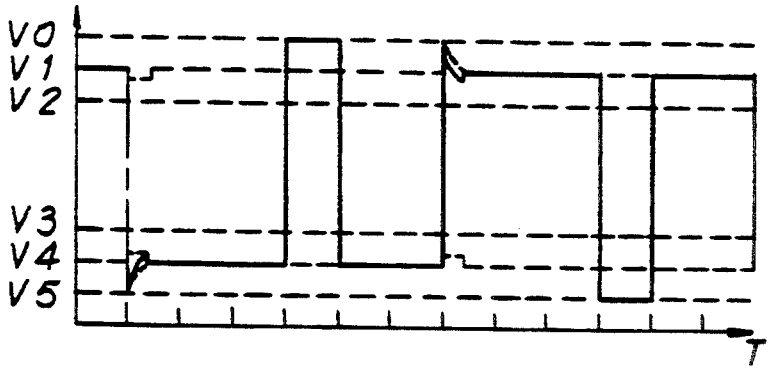
Figure 69C:
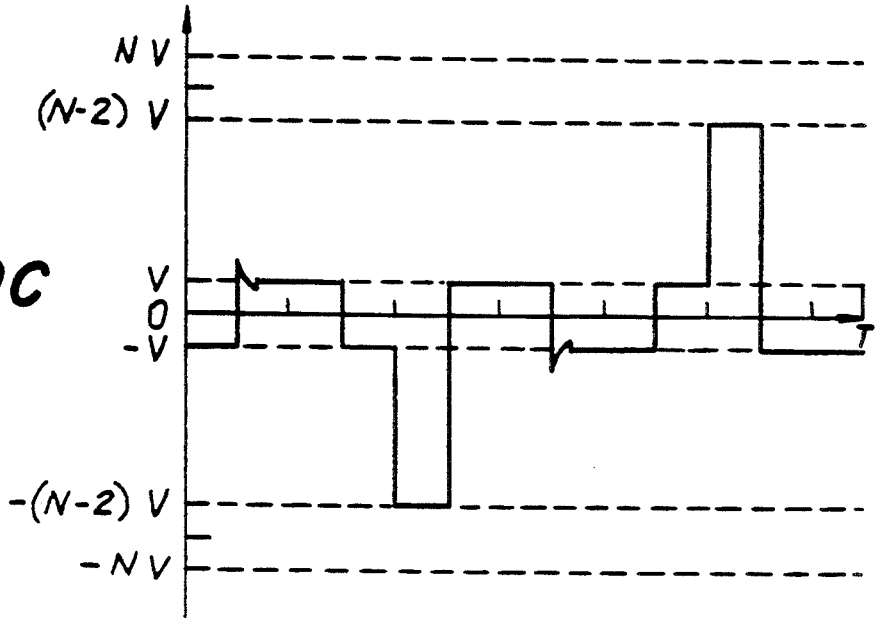

FIG. 69A illustrates a voltage waveform applied to segment electrode X6 to form the display dot 4201. FIG. 69B illustrates a voltage waveform applied to segment electrode Y4 to form display dot 4201. FIG. 69C illustrates a combined waveform of the voltage applied at the display dot 4201.

Figure 66A:
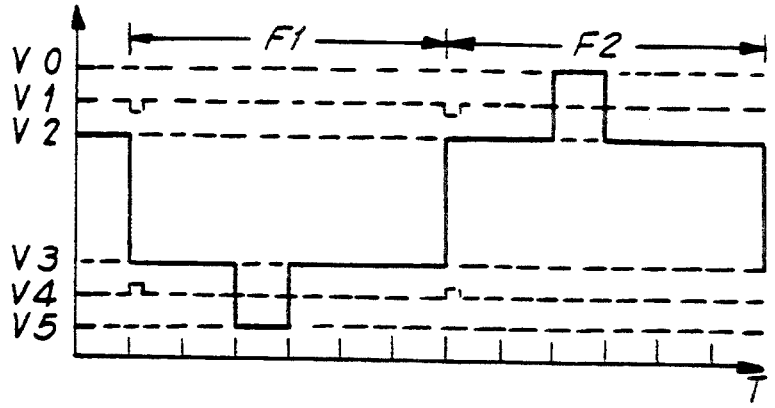
FIGS. 66A–66C are graphs of waveforms of the voltage applied to the liquid crystal panel of FIG. 65.
Figure 66B:
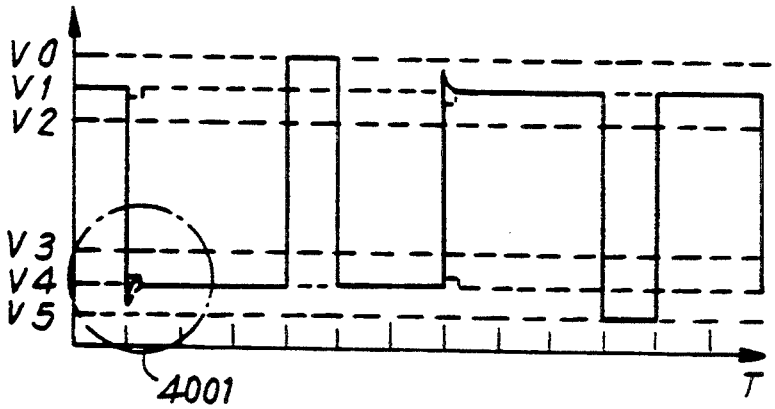
Figure 66C:
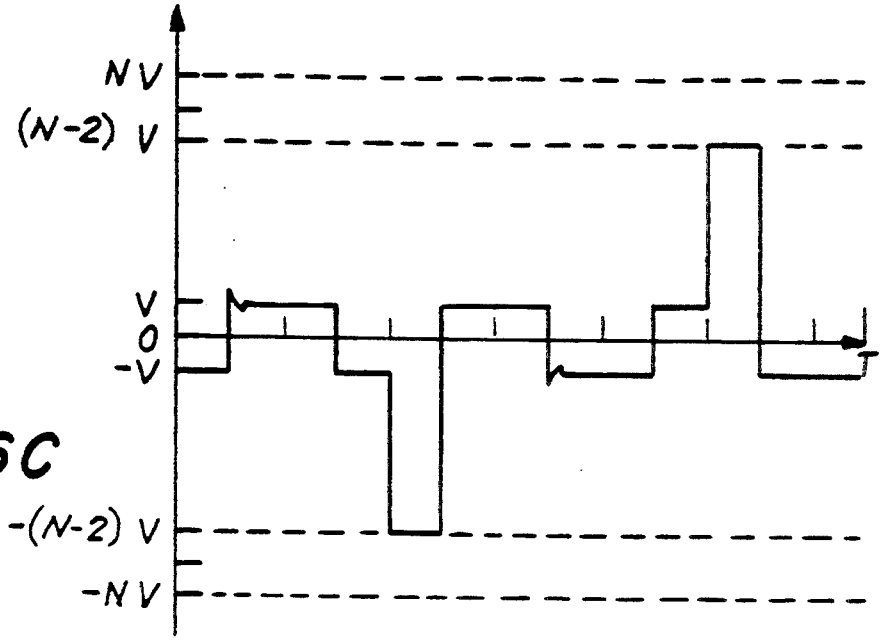
Figure 67:
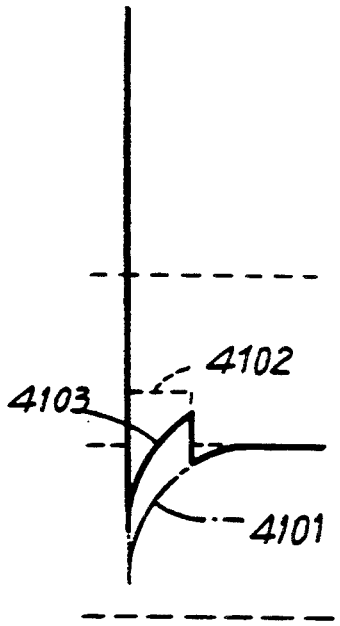
FIG. 67 is a partial exploded view of the waveform of FIG. 64C.
Figure 70:
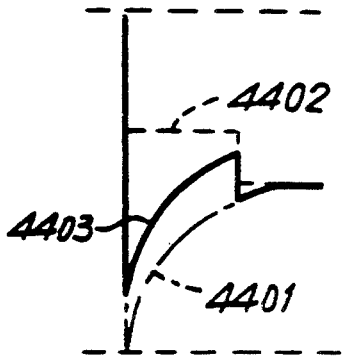
FIG. 70 is an exploded view of the waveform of FIG. 69B.
Figure 68:
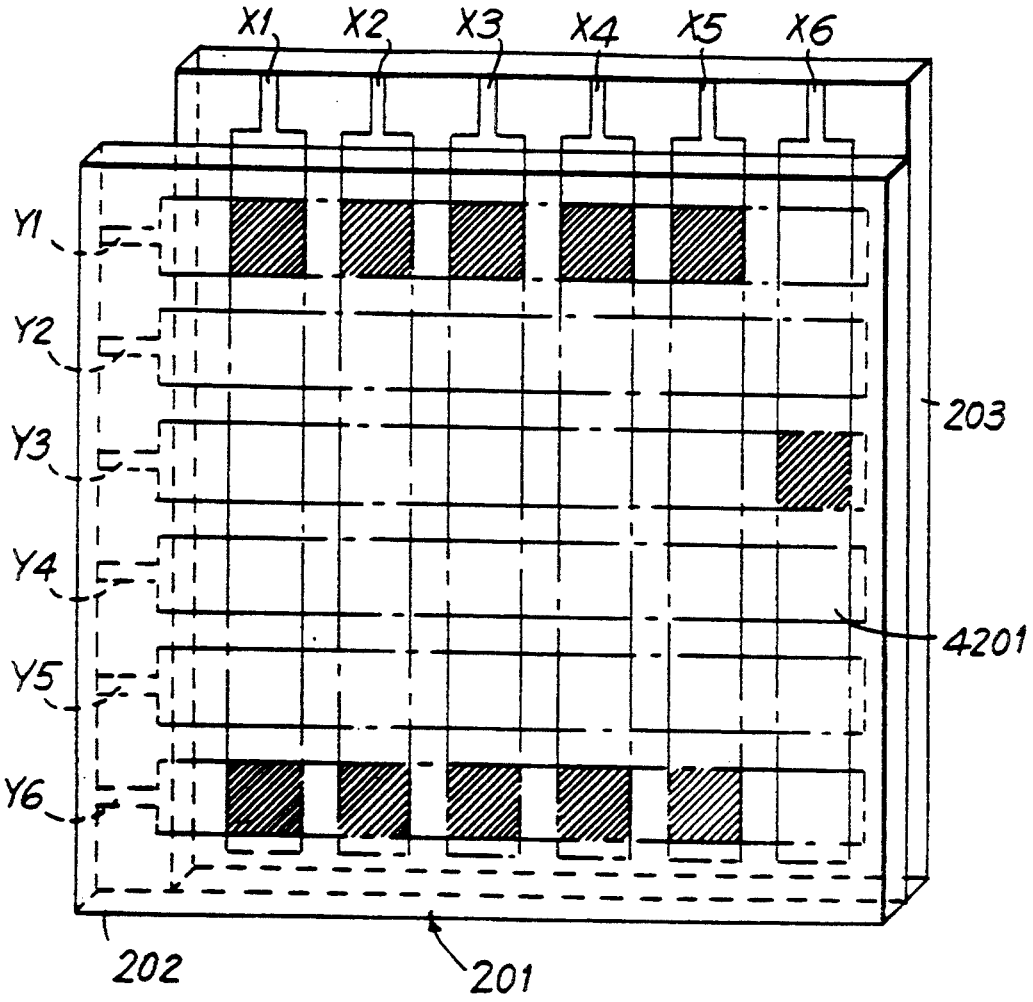
FIG. 68 is a perspective view of a liquid crystal panel wherein another display pattern is formed.

Reference is now made to FIG. 70 in which an enlarged area of FIG. 69B generally indicated as 4001 is provided. A spike-shaped noise waveform 4401 is generated on the common electrode. A waveform 4102 of the non-selected voltage of Y power source is applied to the common electrode 107 resulting in waveform 4101 obtained by the combination of waveforms 4401 and 4402. In addition, FIGS. 67 and 70 are enlarged in a constant ratio. So that herein, in FIG. 65, the value of F is $-2$ ($F=-2$), while in FIG. 68, the value F is $-4$ ($F=-4$). The resulting voltage of FIG. 70 becomes a larger rounded waveform 4401 than the waveform 4101 of the resulting voltage of FIG. 66.

However, the non-selected voltage is compensatively changed and the voltage waveform 4402 is applied for a longer period than that of the voltage waveform 4102, in accordance with the value F to prevent any noise waveform. By such a construction, the non-selected voltage is compensated, and no difference arises between the effective voltage applied to the display dots as shown in FIGS. 66C and 69C. As mentioned above, the period of the non-selected voltage is compensated in accordance with the value F, thereby making it possible to improve the display quality during the reversing of the polarity.

In a thirteenth embodiment, it is possible to compensate the voltage base, the time-voltage base, or the functional waveform of the non-selected voltage in accordance with the value F. Thus, the same effects as those obtained by LCD 3700 can be obtained.

In a fourteenth embodiment, it is also possible to compensate the voltage base, the time-voltage base, or the functional waveform of ON/OFF voltages in accordance with the value F. In this case, the same effects as those of LCD 2400 can be obtained.

While specific embodiments have been illustrated and described herein, the means for compensating the voltage is not limited thereto. It is also possible to apply any means that can compensate the difference of the effective voltages on the common electrodes Y1 through. Y6 by changing the non-selected voltage according to the value F.

To provide an improved high quality display without respective modes of crosstalk, several embodiments have been illustrated and described above. The values according to the kinds and degree of the crosstalk are not limited to the values I, Z, T and F mentioned above. For example, it has been explained that horizontal crosstalk is determined by the number $M_{ON}$ of ON dots on the selected common electrode, that is, the value Z. In particular, as a result of the analysis of the charge/-discharge between the common and segment electrodes at the time of selecting the common electrodes, a value Z′ is derived and expressed by the following equation:

$$Z'=M_{ON}+\sigma\times(M_{ON}-N_{ON}),$$

where $\sigma$ is a constant based upon the liquid crystal material and driving method. In an exemplary embodiment $|\sigma|\leqq 2$. Z′ is defined by the relationship between the display pattern and the crosstalk and in accordance with the value Z′ the voltage is compensated, thereby making it possible to better improve display quality without horizontal crosstalk. In addition, the above equation, $Z'=M_{ON}+\times(M_{ON}-N_{ON})$ is calculated from the following equation:

$$Z'=M_{ON}+\sigma\times(d-c)$$

Herein, c is the number of segment electrodes which are switched from an ON voltage to an OFF voltage when the selected common electrode is changed to the next common electrode. d is the number of segment electrodes which are switched from an OFF voltage to an ON voltage during this period.

Due to crosstalk, changes in the voltages applied to the segment electrodes affect the voltages applied to the common electrodes. When the voltage on the common electrode is changed from the non-selected voltage to the selected voltage, it is possible to prevent the voltage on the common electrode from being changed to a selected voltage through crosstalk by calculating a value M corresponding to the horizontal crosstalk; that is, to increase the size of a rounded waveform. Herein, the direction in which the voltage is changed on the segment electrodes which are switched from an ON to an OFF voltage is in the direction opposed to the voltage direction in which the voltage is changed on the common electrodes, therefore it is possible to prevent the voltage on the common electrode from being changed to the selected voltage. Conversely, since the direction of the voltage change on the segment electrodes which are switched from an OFF voltage to an ON voltage is the same voltage and the same direction in which the voltage is changed on the common electrodes, the segment electrode serves to change the voltage on the common electrode to the selected voltage to some degree. Therefore, the degree of rounded waveform is determined by the difference (d−c) between the number c of segment electrodes which are switched from an ON voltage to an OFF voltage and the number d of segment electrodes which are switched from an OFF voltage to an ON voltage, when the voltage on the common electrodes is changed to the selected voltage.

Figure 71:
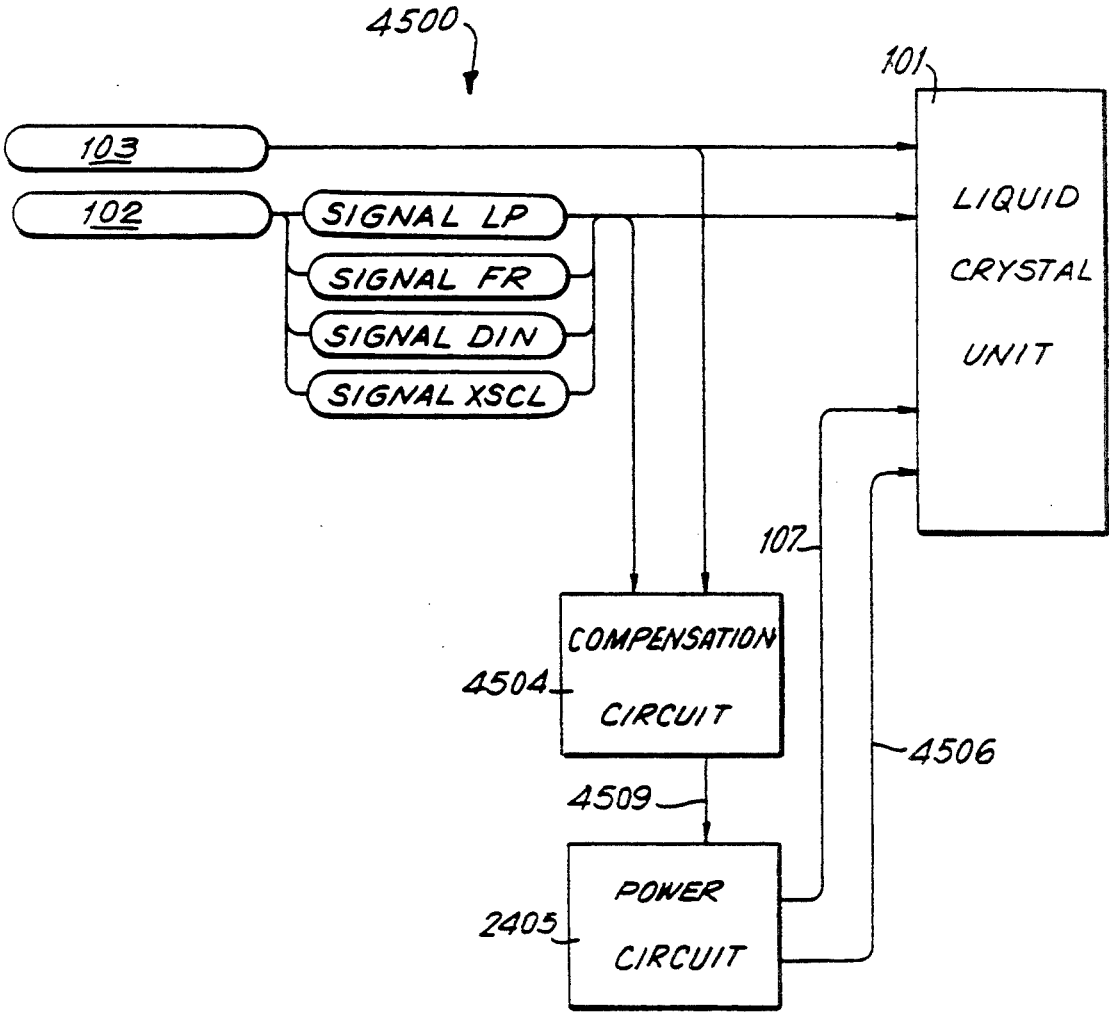
FIG. 71 is a block diagram of a liquid crystal device constructed in accordance with a fourteenth embodiment of the invention.

Reference is now made to FIG. 71 in which a block diagram of a fifteenth embodiment of an LCD, generally indicated as 4500, for compensating crosstalk according to a value Z′ is provided. LCD 4500 includes structure operated in the same manner as in LCD 2400 with the exception of a compensation circuit 4504, a strength signal 4509 generated by compensation circuit 4504, and a Y power source 4506 generated by power circuit 2405. Like structure is identified by like numerals.

Compensation circuit 4504 receives data signal 103 and control signal 102 as inputs. Upon the inputting of control signal 102 and data signal 103, compensation circuit 4504 counts the value of Z′. Compensation circuit 4504 outputs a strength signal 4509 in synchronism with signal LP of control signal 102. Strength signal 4509 is active for a period corresponding to the absolute value of Z′. Upon receipt of strength signal 4509, power circuit 2405 changes the selected voltage of Y power source 4506 to compensate the applied voltage.

Figure 72:
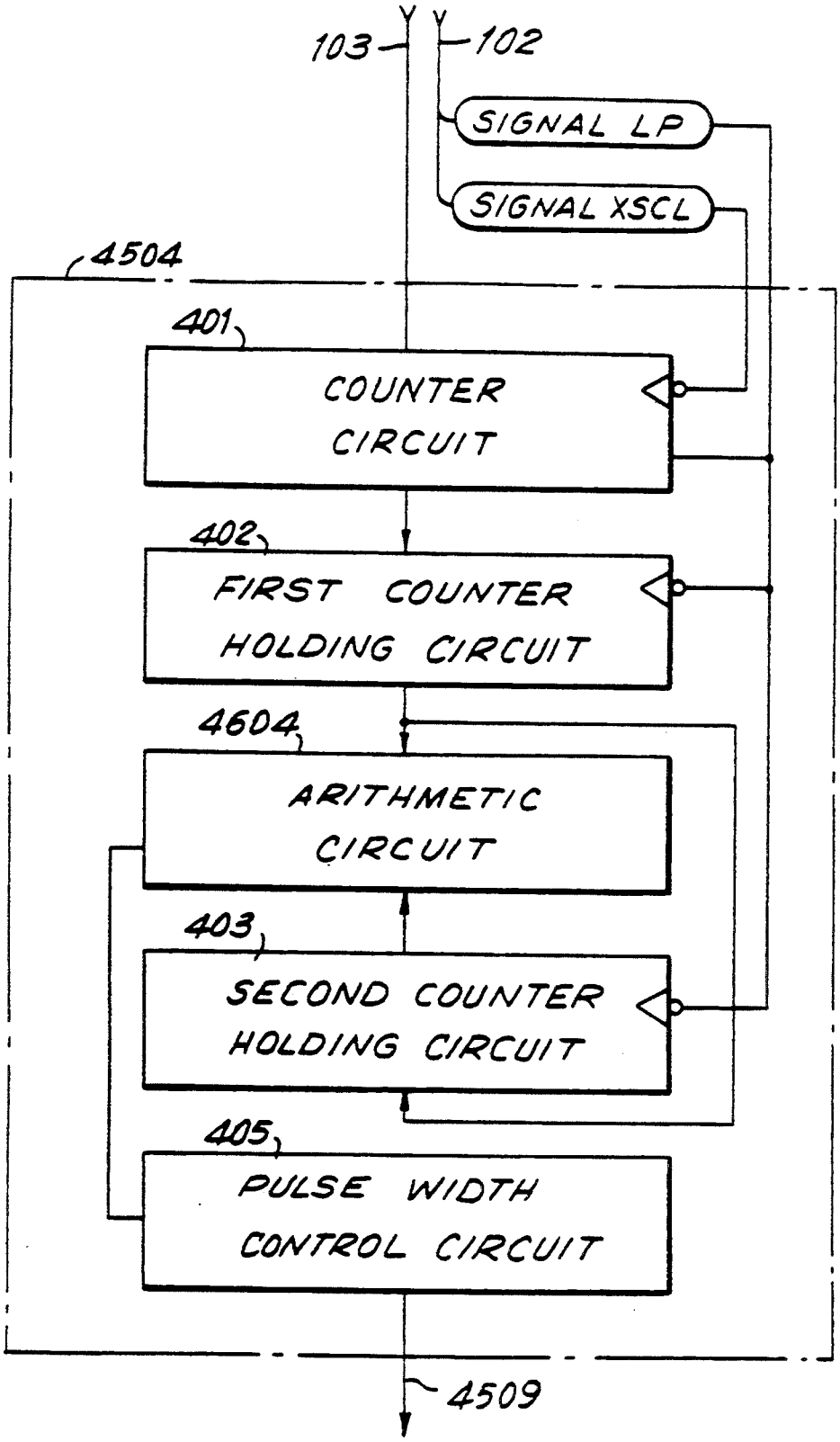
FIG. 72 is a block diagram of a compensation circuit constructed in accordance with the fourteenth embodiment of the invention.

Reference is now made to FIG. 72 in which a block diagram of compensation circuit 4504 is provided.

Compensation circuit 4504 includes a counter circuit 401, a first counter holding circuit 402 and a second counter holding circuit 403 which operate in the same manner as compensation circuit 104. An operative circuit 4604 is provided to perform the following calculation:

$$Z' = M_{ON} + \sigma \times (M_{ON} - N_{ON})$$

The value Z' obtained by the above equation is output to a pulse width control circuit 405. Upon the input of Z' from operative circuit 4604, strength signal 4509 which is active for the period corresponding to both Z' and a constant s is output from pulse width control circuit 405. Constant s is defined as the product of the number of segment electrodes X1 through X6 on liquid crystal panel 201 and $\sigma$, within a range that the value Z' is not negative. Because compensation circuit 4504 has the above construction, the selected voltage is changed during a period corresponding to the value Z' when nth common electrode is selected.

Figure 73:
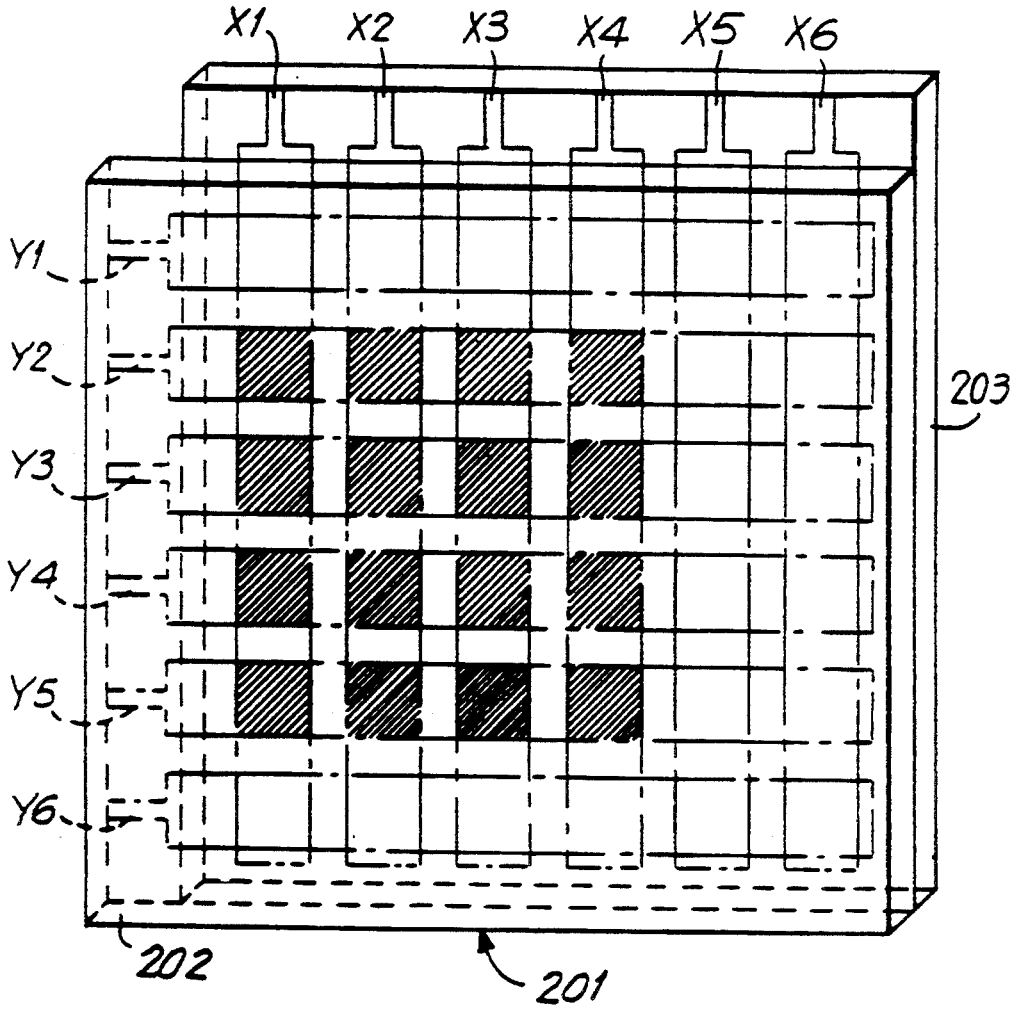
FIG. 73 is a perspective view of a liquid crystal panel wherein another display pattern is formed.

Reference is now made to FIG. 73 wherein one embodiment of a display pattern in which the above construction is applied to liquid crystal panel 201. Additionally, reference is made to FIG. 74 wherein a display condition after compensating the applied voltage to prevent horizontal crosstalk is provided. A remaining crosstalk 4801 (hereinafter referred to as a fine horizontal crosstalk) remains on liquid crystal panel 201 after compensating the applied voltage in accordance with the above construction. The fine horizontal crosstalk occurs on the common electrodes disposed at the boundary of ON/OFF dots, as shown in FIG. 74.

Figure 74:
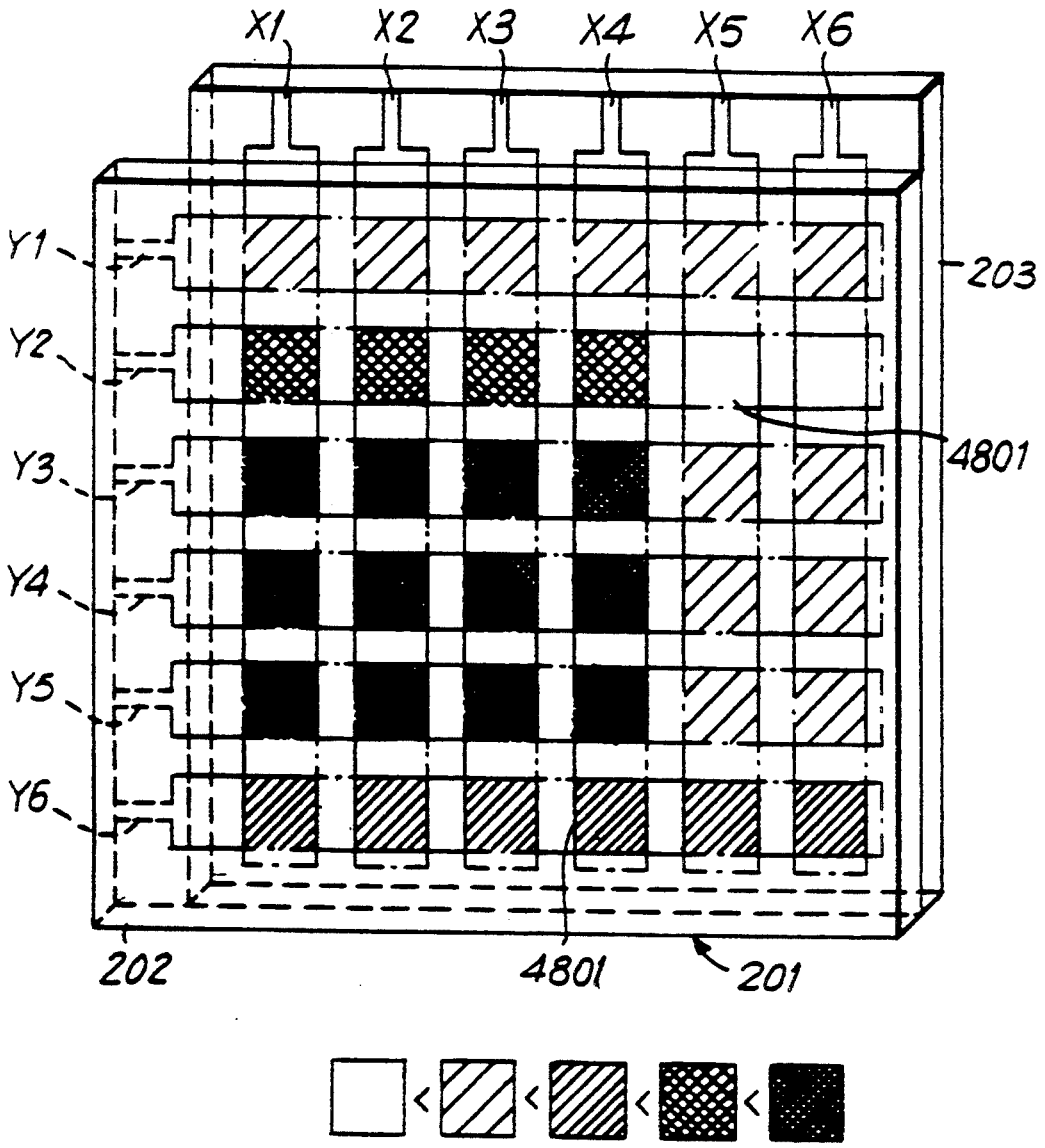
FIG. 74 is a perspective view showing a display condition during the forming of the display pattern of FIG. 71.

Herein, when the display pattern shown in FIG. 74 is formed, the respective values Z' are as follows:

| | |
|---|---|
| first common electrode Y1 | $Z' = 0$ |
| second common electrode Y2 | $Z' = 4 + 4 \times \sigma$ |
| third common electrode Y3 | $Z' = 4$ |
| fourth common electrode Y4 | $Z' = 4$ |
| fifth common electrode Y5 | $Z' = 4$ |
| sixth common electrode Y6 | $Z' = 0 - 4 \times \sigma$ |

Figure 75:
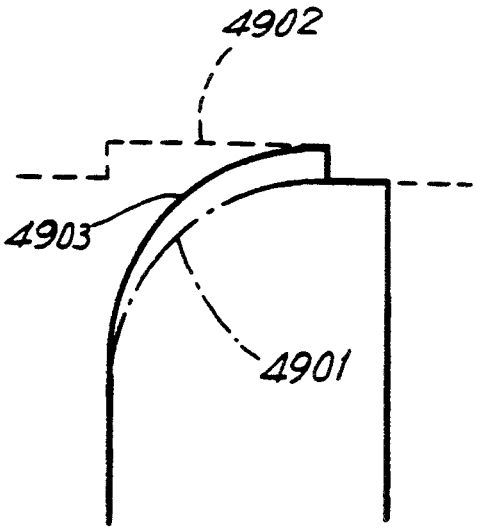
FIGS. 75 and 76 are exploded graphs of voltage waveforms applied to the electrodes when the common electrodes are changed from the non-selected voltage to the selected voltages.
Figure 76:
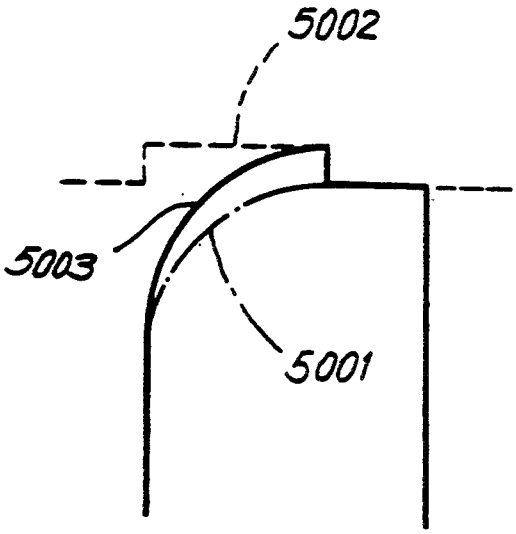

Reference is now made to FIGS. 75 and 76 wherein exploded views of the waveforms of third common electrode Y3 and fourth common electrode Y4 when they are respectively changed from the non-selected voltage to the selected voltage is provided., A rounded waveform 4901 is generated in third common electrode Y3. A changing waveform 4902 is applied as the selected voltage resulting in a combined waveform 4903 obtained by the combination of the waveforms 4901 and 4902. Waveform 4903 is the voltage applied to third common electrode Y3.

Similarly, as seen in FIG. 76, a rounded waveform 5001 is generated in fourth common electrode Y4. A changing waveform 5002 is applied as the selected voltage resulting in a waveform 5003 obtained by the combination of the waveforms 5001 and 5002. Waveform 5003 is the voltage applied to fourth common electrode Y4.

In FIG. 73, when the selected electrode is changed from first common electrode Y1 to second common electrode Y2, a rounded waveform 4901 may be generated in accordance with the number $M_{ON}$ or Z (=4) of ON dots on second common electrode Y2 and the difference $M_{ON} - N_{ON}$ (=4) between the number of ON dots on first common electrode Y1 and second common electrode Y2. Similarly, in FIG. 73, when the selected electrode is changed from third common electrode Y3 to fourth common electrode Y4, a rounded waveform 5001 may be generated in accordance with the number $M_{ON}$ or Z (=4) of ON dots on third common electrode Y3 and the difference $M_{ON} - N_{ON}$ (=0) between the number of ON dots on second common electrode Y2 and third common electrode Y3. As can be seen from a comparison between waveform 4901 and waveform 5001, waveform 4901 may have larger rounded section than that of waveform 5001 due to the difference in the number of ON dots. However, the waveform 4902 of the selected voltage is changed for a longer time than the selected voltage of the waveform 5002. By such a construction, waveform 4903 and waveform 5003 are compensated, resulting in an improved display without fine horizontal crosstalk.

As mentioned above, charge/discharge between the common and segment electrodes which are generated according to the display pattern on the liquid crystal panel 201 is analyzed. Based on the analysis, the differences of the effective voltages applied to the display dots are compensated by changing the voltages applied to the common electrodes Y1 through Y6 and the segment electrodes X1 through X6, resulting in an improved display. Further, charge/discharge between adjacent segment electrodes X1 through X6 through common electrodes Y1 through Y6 and charge/discharge between adjacent segment electrodes X1 through X6 through common electrodes Y1 through Y6 are analyzed. Based on the analysis, the difference of the effective voltages applied to the display dots are compensated by changing the voltages applied to the common electrodes Y1 through Y6 and the segment electrodes X1 through X6, resulting in an improved display.

The same effects can be obtained by counting OFF dots instead of ON dots. Furthermore, it is also possible to eliminate additional crosstalk by weighing respective ON dot positions when counting the number of ON dots.

Figure 77:
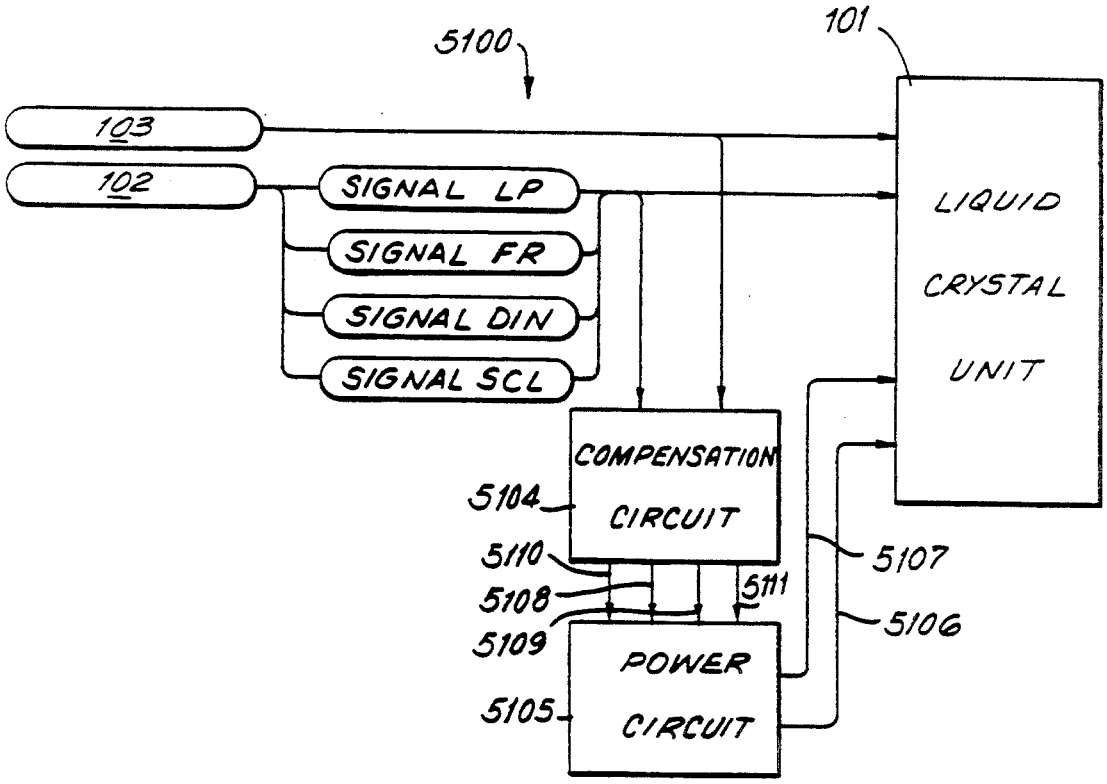
FIG. 77 is a block diagram of a liquid crystal display device constructed in accordance with a sixteenth embodiment of the invention.

Additionally, it is also possible to combine several of the above embodiments to simultaneously prevent several kinds of crosstalk. Reference is now made to FIG. 77 in which a block diagram of a sixteenth embodiment of an LCD, generally indicated as 5100, for preventing all four modes of crosstalk is provided. To prevent zebra crosstalk, the time base compensation of non-selected voltage is carried out according to the value I. To prevent horizontal crosstalk, the time base compensation of the selected voltage is carried out in accordance with the value Z. To prevent vertical crosstalk, the voltage base compensation of the non-selected voltage is carried out in accordance with the value T. To prevent inversion crosstalk, the time base compensation is carried out in accordance with the value of F.

LCD 5100 includes a compensation circuit 5104 and a power circuit 5105. Compensation circuit 5104 receives data signal 103 and control signal 102 and generates a Y power source 5106 and an X power source 5107. The sign signal 5108, a first strength signal 5109, a second strength signal 5110, and a third strength signal 5111. Power circuit 5105 receives each of the outputs of compensation circuit 5105 and produces a Y power source 5106 and an X power source 5107.

Compensation circuit 5104 counts the value I, outputs the sign (plus or minus) of I, and outputs a signal which is active for a period corresponding to the absolute value of I as first strength signal 5109, in synchronism with signal LP of control signal 102. However, when signal FR changes, strength signal 5109 is not output. Further, when FR signal changes, compensation circuit 5104 functions to count the value F, output the sign of F as sign signal 5108 and output a signal which is active for the period predetermined by the absolute value of F as first strength signal 5109, in synchronism with signal LP of control signal 102. Additionally, compensation circuit 5104 simultaneously functions to count the value T, and output the counted value as second strength signal 5110. Furthermore, compensation circuit 5104 functions to count the value Z, and output a signal which is active for the period corresponding to the value Z as third strength signal 5111, in synchronism with signal LP of control signal 102.

Power circuit 5105 functions to change at least one of Y power source 5106 and X power source 5107 in accordance with the first, the second and the third strength signals 5109 through 5111 and sign signal 5108, thereby making it possible to eliminate any crosstalk.

Figure 78:
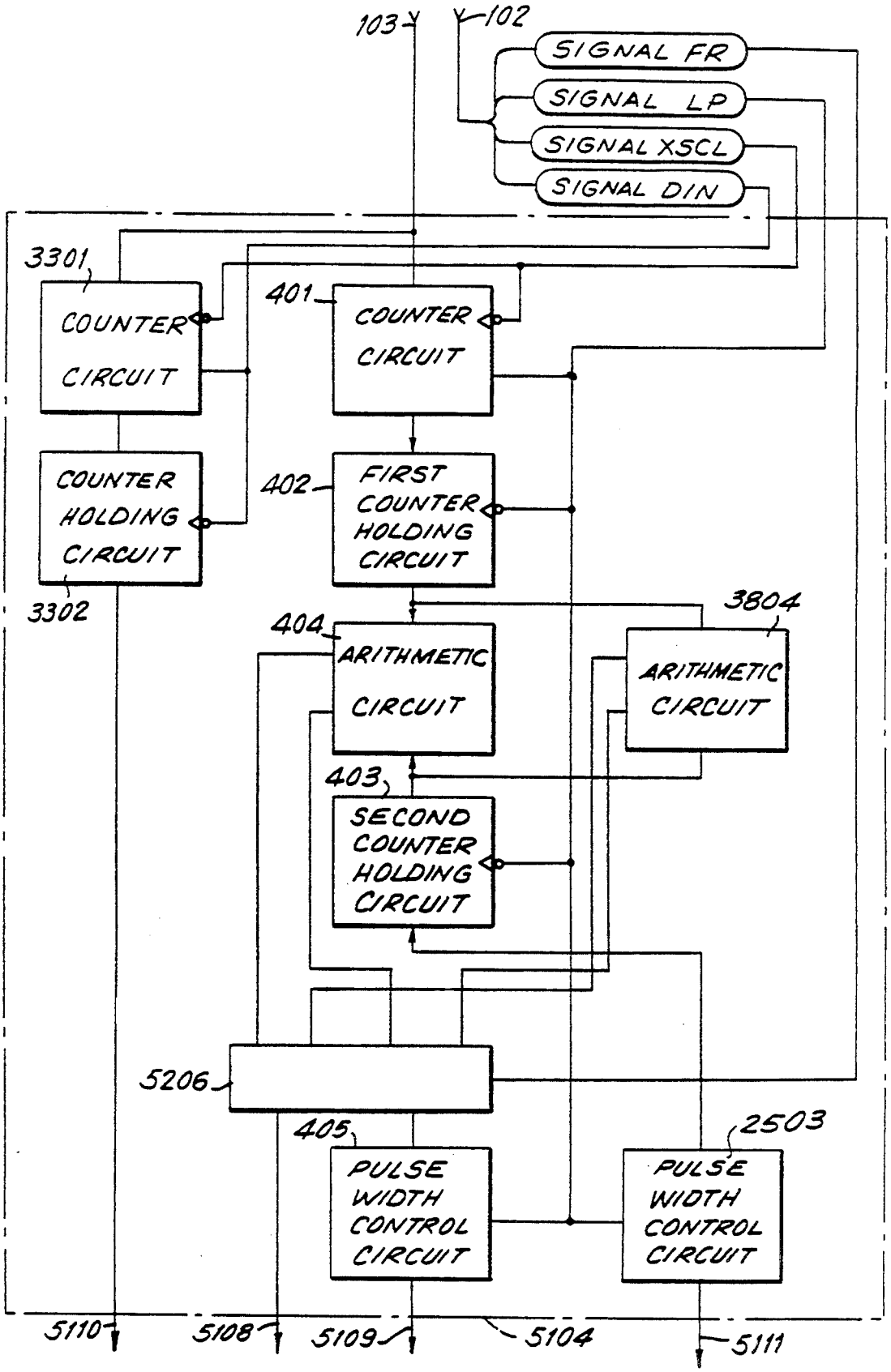
FIG. 78 is a block diagram of a compensation circuit constructed in accordance with the sixteenth embodiment of the invention.

Reference is now made to FIG. 78 in which a block diagram of compensation circuit 5109 is provided. Compensation circuit 5109 includes a counter circuit 401, a first counter holding circuit 402, a second counter holding circuit 403 and an operative circuit 404 which all function in the same manner as in compensation circuit 104. Counter circuit 401 counts the number of ON dots, first counter holding circuit 402 stores the value $M_{ON}$ and the second counter holding circuit 403 stores the value $N_{ON}$. Operative circuit 404 calculates the value I.

An arithmetic circuit 3804 counts the value F from the value $M_{ON}$ stored in first counter holding circuit 402 and the value $N_{ON}$ stored in the second counter holding circuit 403. A switching circuit 5206 receives the output of operative circuit 404 and arithmetic circuit 3804 and functions to pick up the sign of the value and the absolute value of the value which is generated from either the arithmetic circuit 404 or arithmetic circuit 3804. When signal FR of control signal 102 has not changed, switching circuit 5206 functions to select the value I of arithmetic circuit 404. When signal FR is changed, switching circuit 5206 functions to select the value F of arithmetic circuit 3804.

Switching circuit 5206 outputs the sign of I or F as sign signal 5108 and to output the value of I or F to a pulse width control circuit 405. Pulse width control circuit 405 functions in the same way as in compensation circuit 104; that is, it functions to output a signal which is active for a period corresponding to the absolute value of I or F as first strength signal 5109. Therefore, sign signal 5108 and first strength signal 5109 indicate the amount of the compensated voltage to prevent zebra and inversion crosstalk.

A counter circuit 3301 and a counter holding circuit 3302 are provided and operate in the same manner as in compensation circuit 3204. Counter circuit 3301 functions to count the value T and to output the counted value to holding circuit 3302. Holding circuit 3302 then outputs the value as second strength signal 5110. Therefore, second strength signal 5110 indicates the amount of the compensated voltage to prevent vertical crosstalk.

A pulse width control circuit 2503 receives an input from second holding circuit 403 and functions in the same way as in compensation circuit 2404. Pulse width holding circuit outputs a signal which is active for a period corresponding to the value $M_{ON}$ of first counter holding circuit 402, that is, the value Z, as third strength signal 5111. Therefore, third strength signal 5111 indicates the amount of the compensated voltage to be output to prevent horizontal crosstalk. Accordingly, since compensation circuit 5109 has the above mentioned construction, the respective amount of compensated voltage necessary to prevent the respective crosstalks are output as respective compensated signals.

Figure 79:
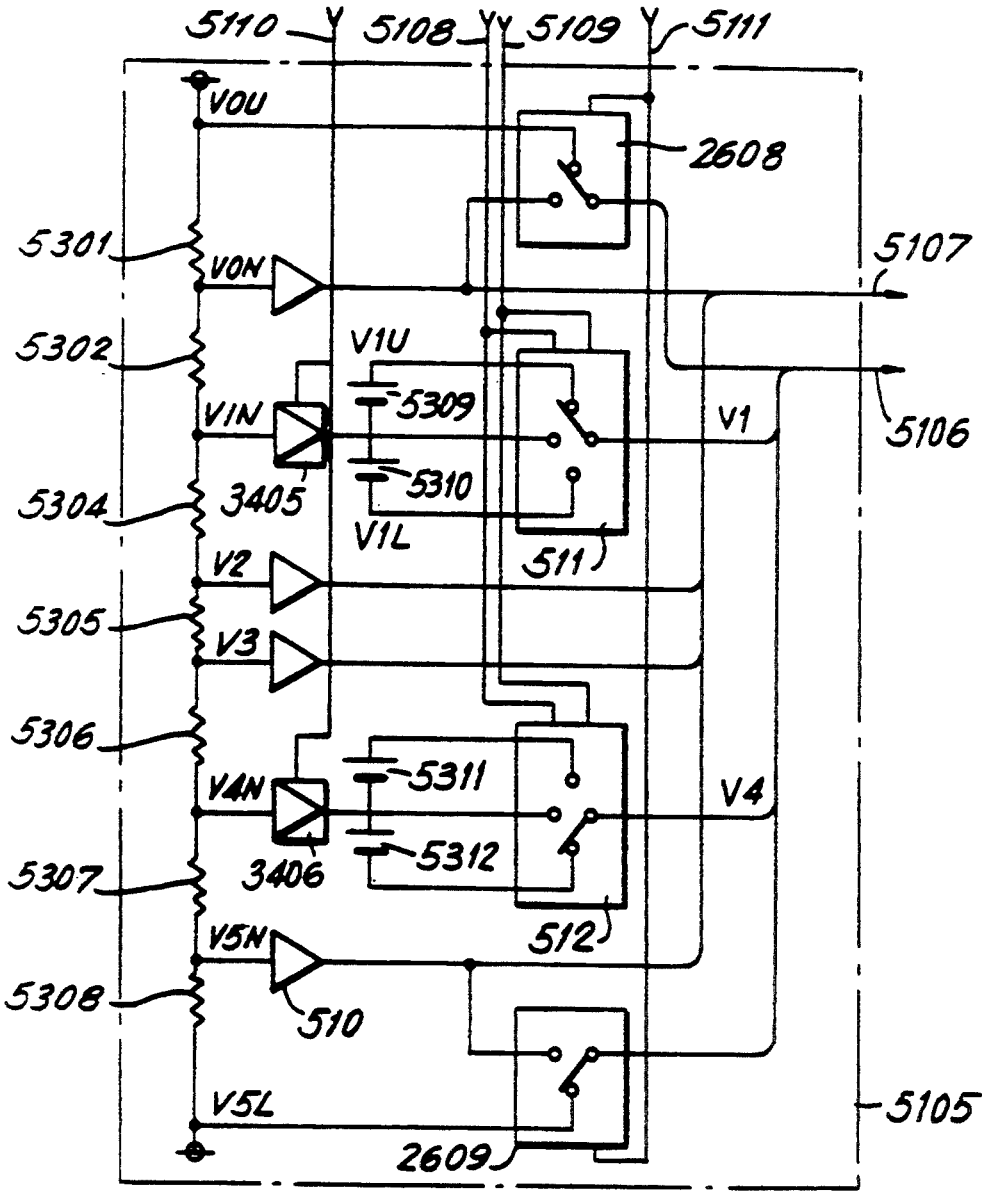
FIG. 79 is a circuit diagram of a power circuit constructed in accordance with the sixteenth embodiment of the invention.

Reference is now made to FIG. 79 wherein a circuit diagram for circuit 5105 is provided. Power circuit 5105 includes a plurality of resistors 5301 through 5308 connected serially. Voltages V0U and V5L are applied across both ends of the series of resistors creating voltage dividers at each resistors creating voltage dividers at each resistor junction.

Voltage V0U, V0N, V1, V2, V3, V4N, V5N, V5L represent the voltages provided at the respective terminals of resistors 5301 through 5308. The respective voltage values are predetermined and may be formulated as follows:

$$V0N - V1N = V1N - V2$$
$$= V3 - V4N = V4N - V5N$$
$$= (V2 - V3) / (n - 4) \text{ (} n \text{ is a constant).}$$

Further, $$(V0U - V0N) / (V0N - V1N)$$
$$= (V5N - V5L) / (V4N - V5N)$$

Furthermore, the voltages V0N, V2, V3 and V5N are stabilized by a voltage stabilizing circuit 510. Voltage generating circuits 3405 and 3406 are provided at V1N and V4N and function in the same way as those of power circuit 3305 and the voltage generated from the voltage generating circuits 3405 and 3406 are changed by the second strength signal 5110.

Reference voltages 5309 and 5310 receive the output of voltage generator 3405 while reference voltages 5311 and 5312 receive the output of voltage generator 3406. The absolute value of reference voltage 5309 is the same as that of the reference voltage 5312. These reference voltages have opposite signs on the basis of the voltages V1N and V4N, respectively. Similarly, reference voltages 5310 and 5311 have the same absolute values, and have the opposing signs (plus or minus) on the basis of voltages V1N and V4N. Voltages 5310 and 5311 are defined as V1L and V4L. A pair of switches 511 and 512 function in the same way as those in power circuit 105 and are switched by sign signal 5108 and first strength signal 5109. Namely, one of the voltages V1U, V1N and V1L is selected by switch 511, and one of the voltages V4U, V4N and V4L is selected by switch 512. The voltages generated from switches 511 and 512 are defined as the voltages V1 and V4, respectively. A second pair of switches 2608 and 2609 function in the same say as those of power circuit 2405 and are switched by third strength signal 5111. One of the voltages V0U and V0N is selected by switch 2608 and one of the voltage V5U and V5N is selected by switch 2609. The voltages generated from the switches 2608 and 2609 are defined as the voltages V0, V5 respectively.

The selected voltage of Y power source 5106 is changed by third strength signal 5111, and the non-selected voltage is changed by sign signal 5108, first strength signal 5109 and second strength signal 5110.

The selected/non-selected voltage of Y power source 5106 is changed by compensating signals comprising the sign signal, the first strength signal, second strength signal and third strength signals for the above mentioned respective compensations. Herein, any zebra crosstalk is compensated by the non-selected voltage when signal FR of control signal 102 is not changed. Any inversion crosstalk is compensated by the non-selected voltage when signal FR is changed. Any horizontal crosstalk is compensated by the selected voltages. Any vertical crosstalk is compensated by changing the voltages V1N and V4N of the non-selected voltage. Therefore, the means of compensating the respective crosstalks are substantially independent and can be easily combined.

LCD 5100, the period of the applied voltages are compensated according to the values I, Z and F. However, in addition to the means of compensating the voltage waveforms described in connection with LCD 5100, when the other compensating means of the other embodiments are combined, the same effects can be obtained.

When the degree of a crosstalk is small in LCD 5100, it is possible in a seventeenth embodiment to omit the means for compensating the voltage waveforms and simplify the construction of the circuits. For example, when the degree of vertical crosstalk is so small as to not affect the display quality, to simplify the construction of the circuits it is possible to omit counter circuit 3301 and counter holding circuit 3302 so as not to generate second strength signal 5110 and substitute voltage generating circuits 3405 and 3406 for stabilizing circuit 510.

The preceding embodiments are given by way of example and hence the present invention is not limited to these embodiments. The present invention in an eighteenth embodiment is also applicable to a liquid crystal display device performing any other display such as gray scale display wherein the voltage applied to the segment electrodes is switched to ON/OFF voltages for a period when the segment electrodes are selected. In this case, the same effects can be obtained.

The preceding embodiments all achieve correction by using the resistance properties of the electrodes and capacitance properties of the liquid crystal panel in connection with patterns to be produced to calculate a correction voltage. This correction voltage is then added to the driving voltage waveform. Another example of this is Japanese Patent Laid Open Hei 2-89. While achieving good results, the resulting liquid crystal display unit is complicated. A simpler construction is provided by directly monitoring voltage and current changes within the system and producing correction voltages in response thereto.

Figure 80:
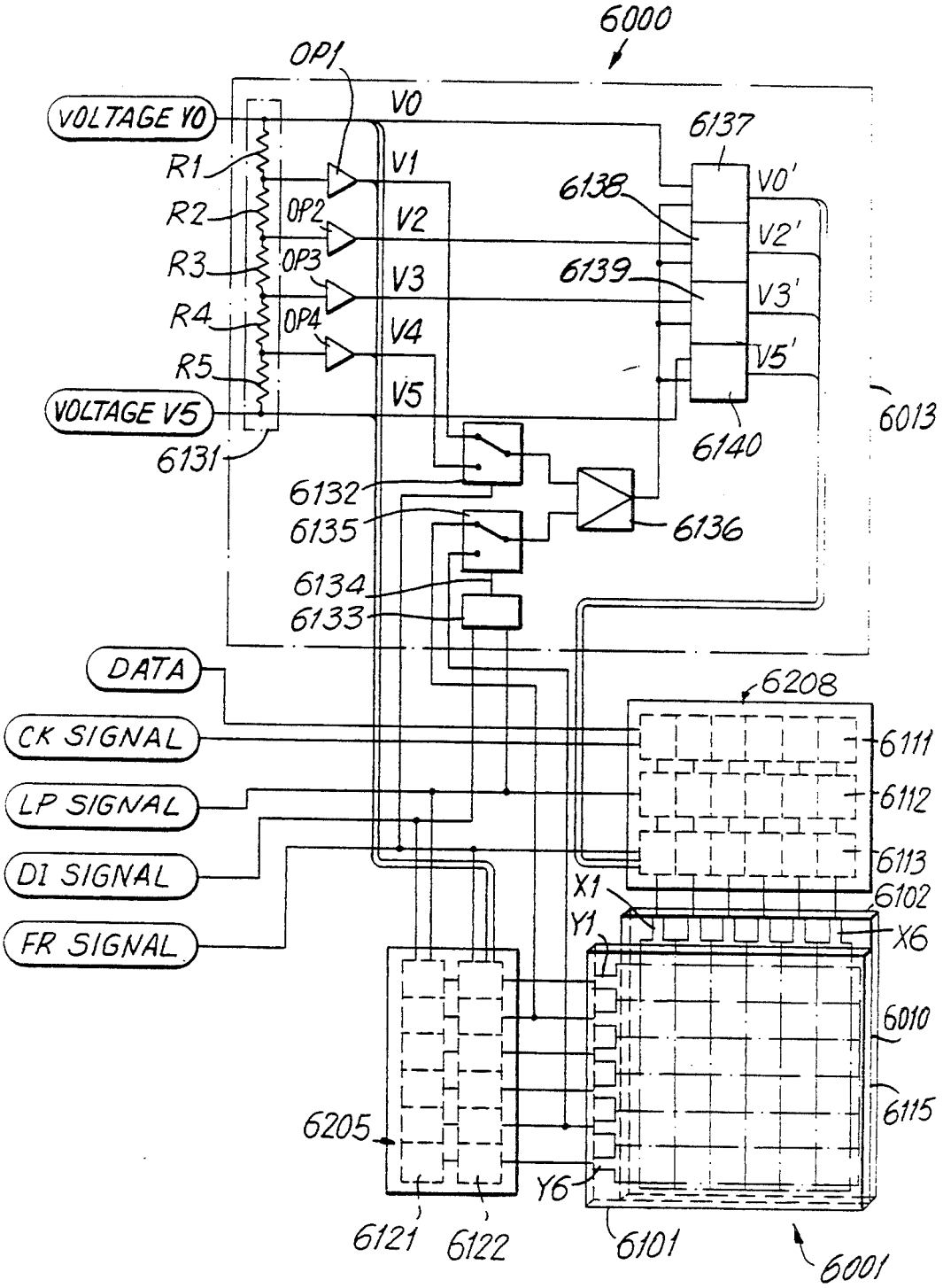
FIG. 80 is a schematic diagram of a circuit for driving a liquid crystal display constructed in accordance with the nineteenth embodiment of the invention.

Reference is now made to FIG. 80 wherein a nineteenth embodiment of a liquid crystal display, generally indicated as 6000 is provided. Liquid crystal display 6000 differs from liquid crystal display 100 in that the power circuit also operates as the compensation circuit removing the need for compensation circuit 104.

Liquid crystal display 6000 includes a power circuit 6013 for driving liquid crystal unit 6001. Liquid crystal unit 6001 includes a liquid crystal panel 6010 having a plurality of common electrodes Y1–Y6 horizontally oriented on a substrate 60101 and a plurality of segment electrodes X1–X6 vertically oriented on a substrate 6102. A liquid crystal layer 6115 is sandwiched between substrates 6101 and 6102. Common electrodes Y1–Y6 and segment electrodes X1–X6 intersect each other, forming a display dot, as discussed in detail above, at each intersection, forming a crystal panel having a 6 by 6 dot structure. The size is by way of example only for ease of explanation, the size of liquid crystal panel 6010 may be larger or smaller as desired.

A common electrode driving circuit 6205 includes a six bit shift register 6121 and a six bit four circuit/one contact analog switch 6122. The number of bits corresponds to the number of common electrodes of liquid crystal panel 6010. A DI signal and LP signal are input to six bit shift register 6121 which, in response thereto, provides an output to analog switch 6122. Analog 6122 also receives signal FR and a power signal from power circuit 6103 as inputs. The output from analog switch 6122 is introduced to each common electrode Y1–Y6 of liquid crystal panel 6010.

Segment electrode driving circuit 6208 includes a six bit shift register 6111, a six bit latch circuit 6112 and a six bit four circuit/one contact analog switch 6113. The number of bits corresponds to the number of segment electrodes of liquid crystal panel 6010. Shift register 6111 receives a DATA signal and a CK signal and provides an output to latch circuit 6112, which also receives LP signal and provides an output to analog switch 6113. Analog switch 6113 also receives signal FR, as well as an output from power circuit 6013 and outputs a voltage waveform to each segment electrode X1–X6 of liquid crystal panel 6010.

Power circuit 6013 includes a voltage divider circuit 6131 having series resistors R1–R5 coupled between a voltage V0 and a voltage V5. The resistances of resistors R1, R2, R4 and R5 are not equal. Resistor R3 has a resistance of (N−4)R. When voltage V0 and voltage V5 are applied at either end of voltage divider circuit 6131, i.e., at R1 and R5, the voltage therebetween is divided to generate voltages V1, V2, V3 and V4 at the junction between resistor pairs R1, R2; R2, R3; R3, R4; and R4, R5 respectively.

A first voltage follower circuit OP1 receives an input voltage V1 produced at the junction of resistor R1, R2. A second voltage follower circuit OP2 receives as an input voltage V2 and is coupled between resistors R2, R3, a voltage follower circuit OP3 is coupled between resistors R3, R4 and receives voltage V3 as an input and voltage follower circuit OP4 receives a voltage V4 and is coupled between resistor pair R4, R5. Voltage follower circuits OP1–OP4 are each formed as an operational amplifier circuit.

A reference voltage changeover switch 6132 receives an input from OP1, OP4 and the FR signal. Accordingly, reference voltage changeover switch 6132 selects between reference voltages V1, V4 output by voltage follower circuits OP1, OP2, in response to the FR signal and provides an output to a differential amplifier circuit 6136. A second input voltage changeover switch 6135 receives as a first input the driving voltage waveform applied to common electrode Y2, and as a second input the driving voltage waveform applied to common electrode Y5. A voltage changeover control circuit 6133 receives the LP signal and the DI signal and in response thereto, provides a control output 6134 to reference voltage changeover switch 6135 which selects a driving voltage waveform in response thereto and outputs the driving voltage waveform to differential amplifier circuit 6136. Switch control signal 6134 has a value of 0 when common electrode driving circuit 6205 is supplying a selected voltage to any of common electrodes Y1–Y3. Voltage changeover control circuit has a value of 1 when the common electrode driving circuit 6205 is supplying a selected voltage to any of the common electrodes Y4–Y6. This circuit is easily formed as a counter-circuit using the LP signal as a clock signal, the DI signal as a reset signal, a comparative circuit for comparing the magnitude of the output from the counter-circuit, and other components. Accordingly, this circuit may be easily formed as a counter-circuit.

When control signal 6134 has a value of 1, input voltage changeover switch 6135 outputs the common electrode driving voltage waveform which is being input to common electrode Y2. When switch control signal 6134 has a value of 0, in put voltage changeover switch 6135 outputs the voltage driving waveform being input at common electrode Y5. Differential amplifier circuit 6136 outputs a voltage corresponding to the difference between the output of voltage changeover switches 6132 and 6135.

A plurality of voltage addition circuits 6137, 6138, 6139, 6140 are coupled between differential amplifier circuits 6136 and analog switch 6113 and provide a voltage output to analog switch 6113. Voltage addition circuit 6137 receives an input voltage V0 as a reference voltage and the output of differential amplifier circuit 6136 and in response thereto outputs a voltage V0'. Voltage addition circuit 6138 receives voltage V2 output by voltage follower circuit OP2 and the output from differential amplifier circuit 6136 and outputs a voltage V2' in response thereto. Voltage addition circuits 6139 receives a reference voltage V3 output by voltage follower circuit OP3, as well as the output of differential amplifier circuit 6136 and outputs a voltage V3' in response thereto. Lastly, voltage addition circuit 6140 receives a reference voltage V5 and the output of voltage differential amplifier circuit 6136 and outputs a voltage V5' in response thereto.

Figure 81:
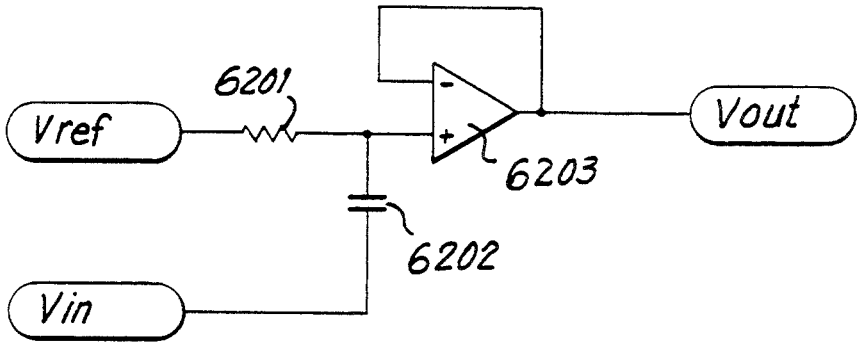
FIG. 81 is a schematic diagram of a voltage addition circuit constructed in accordance with the invention.

Reference is made to FIG. 81 wherein an example of a voltage addition circuit constructed in accordance with the invention is provided.. The reference voltage is received at a terminal Vref. This reference voltage is one of voltages V0, V2, V3 and V5. Vin represents a terminal at which the voltage output from differential amplifier circuit 6136 is input. A differentiating circuit is formed by resistor 6201 coupling terminal Vref to a voltage follower circuit 6203 formed as an operational amplifier and a capacitor 6202 coupled between Vin and voltage follower circuit 6203. The output of follower circuit 6203 is fed back in as the second input to voltage follower circuit 6203 and the output voltage is output at a terminal Vout.

The voltage output from differential amplifier circuit 6136, the voltage input at terminal Vin, is very close to a differentiated waveform. Therefore, adding this voltage to the terminal Vin of the differentiating circuit formed of resistor 6201 and capacitor 6202, a voltage approximating the sum of the voltages at terminal Vin and the voltage at terminal Vref can be output by voltage follower circuit 6203.

In power circuit 6013, if reference voltages V0–V5, have the following relationship:

$$V0 - V1 =$$
$$V1 - V2 =$$
$$V3 - V4 =$$
$$V4 - V5 =$$
$$= V$$

and $$V0 - V5 = nV$$

where an n is a positive number and in an exemplary embodiment equals about 10, then six level voltages are required to drive the liquid crystal panel.

As seen in FIG. 80, voltages V0, V1, V4 and V5 are input to common electrode driving circuit 6205 and voltages V0', V2', V3' and V5' are supplied to segment electrode driving circuit 6208. Voltages V1 and V5 supplied to common electrode voltage driving circuit 6205 are the selection voltage and non-selection voltage. Voltages V0', V2' supplied to segment electrode driving circuit 6208 are the lighting voltage and non-lighting voltage in a first grouping of voltages. Voltages V0, V4 are the selection voltage and non-selection voltage and voltages V3' and V5' are the lighting voltage and non-lighting voltage respectively in a second group of voltages.

Figure 82:
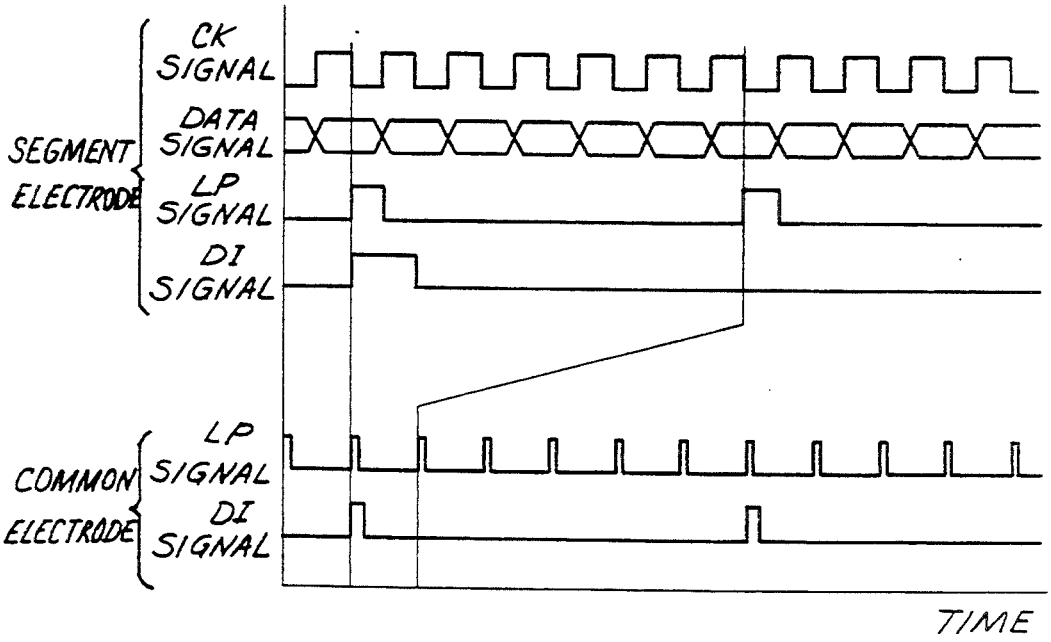
FIG. 82 is a timing diagram showing voltage waveforms utilized for driving the liquid crystal display unit in accordance with the nineteenth embodiment of the invention.

Reference is now made to FIG. 82 in which the operation of liquid crystal display system 6000 is described. In connection with segment electrode driving circuit 6208, the DATA signal determines the content of a display. The DATA signal is read in synchronization with the CK signal so that DATA is successively input into shift register circuit 6111 to be shifted. When a number of DATA items corresponding to the number of segment electrodes of liquid crystal panel 6010 are supplied to shift register circuit 6111, the content of each bit in shift register 6111 is fetched as a corresponding bit in latch circuit 6112. Analog switch 6113 acting as a level shifter discussed in connection with segment electrode driving circuit 208, level shifter circuit 6113 outputs the content latched into latch circuit 6112 and the voltage input from voltage addition circuits 6137–6140 in response to the FR signal. As a result, segment electrode driving circuit 6208 outputs the lighting voltage if the content of each bit fetched into the latch circuit 6112 designates lighting (having a value 1), or outputs a non-lighting voltage if the content designates non-lighting (having a value 0). The voltage groups are selected in response to the FR signal. If the value of the FR signal is 0, then the first voltage group is selected. If the FR signal has a value of 1, the second group of voltages are selected and output.

Simultaneous with the operation of segment electrode driving circuit 6208, common electrode driving circuit 6205 determines which of the common electrodes receives which driving voltage waveform. The selection of the common electrodes is made in response to DI signal in synchronization with the LP signal. The information contained in DI signal is successfully input into shift register 6121 to be shifted. Analog switch 6122 acting as a level shifter circuit outputs the content fetched into shift register circuit 6121 which outputs the voltage in accordance to this shifting and the FR signal. Lever shifter circuit 6122 outputs the selection voltage if the content of each bit fetched into latch circuit 6121 designates selection or outputs the non-selection voltage if the content designates non-selection. If the FR signal has a value 0, the first group of voltages are output. If the FR signal has a value of 1, the second group of voltages are output.

During the time period during which the selection voltage is applied to scanning electrodes Y1–Y3, input changeover control circuit 6133 operates input voltage changeover switch 6135 to supply differential amplifier circuit 6136 with the voltage which is being input at common electrode Y5. During the period of time through which the selection voltage is applied to common electrodes Y4–Y6, the input voltage changeover control circuits causes the input voltage changeover switch 6135 to supply the differential amplifier circuit 6136 with the driving voltage waveform which is being input to common electrode Y2. As a result, power circuit 6013 becomes self adjusting because a distortion correction voltage is superimposed on the voltage waveforms being supplied to the segment electrodes where voltages V1 and V4 are being changed prior to input to the voltage addition circuits in response to the FR signal as output by the differential amplifier circuit 6136. During this time, reference voltage changeover circuit 6132 outputs one of voltages V1 and V4 to differential amplifier circuit 6136 in response to the FR signal. Accordingly, only the distortion component of the voltage waveform output by common electrode driving circuit 6205 to electrodes Y2 or Y5 is output to differential amplifier circuit 6136. This distortion component is added to voltages V0, V2, V3 and V4 by voltage addition circuits 6137–6140 to obtain voltages V0′, V2′, V3′ and V4′ which in turn are output to segment electrode driving circuit 6208.

As a result, if a distortion (assumed to be Ve) is generated in the voltage waveform on the common electrode to which the non-selecting voltage (V1 or V4) is applied, the voltage on the common electrode is Vc+Ve, where Vc is the correcting voltage. The voltages being applied to the segment electrodes are V0′, V2′ or V3′, V5′ obtained by adding Ve to voltages V0, V1 or V3, V5. Therefore, the difference between the scanning electrode and the signal electrode is $$V0-V1=(V0-Ve)-(V1+Ve)=V,$$

$$V1-V2=(V1-Ve)-(V2+Ve)=V,$$

$$V3'-V4=(V3-Ve)-(V4+Ve)=V,$$

or $$V4-V5'=(V4-Ve)-(V5+Ve)=V.$$

As can be seen, the difference is constant irrespective of the magnitude of the distortion. As a result, there are no differences between the effective voltages applied to the dots on the liquid crystal panel 6010, so that there is no display non-uniformity.

Figure 83:
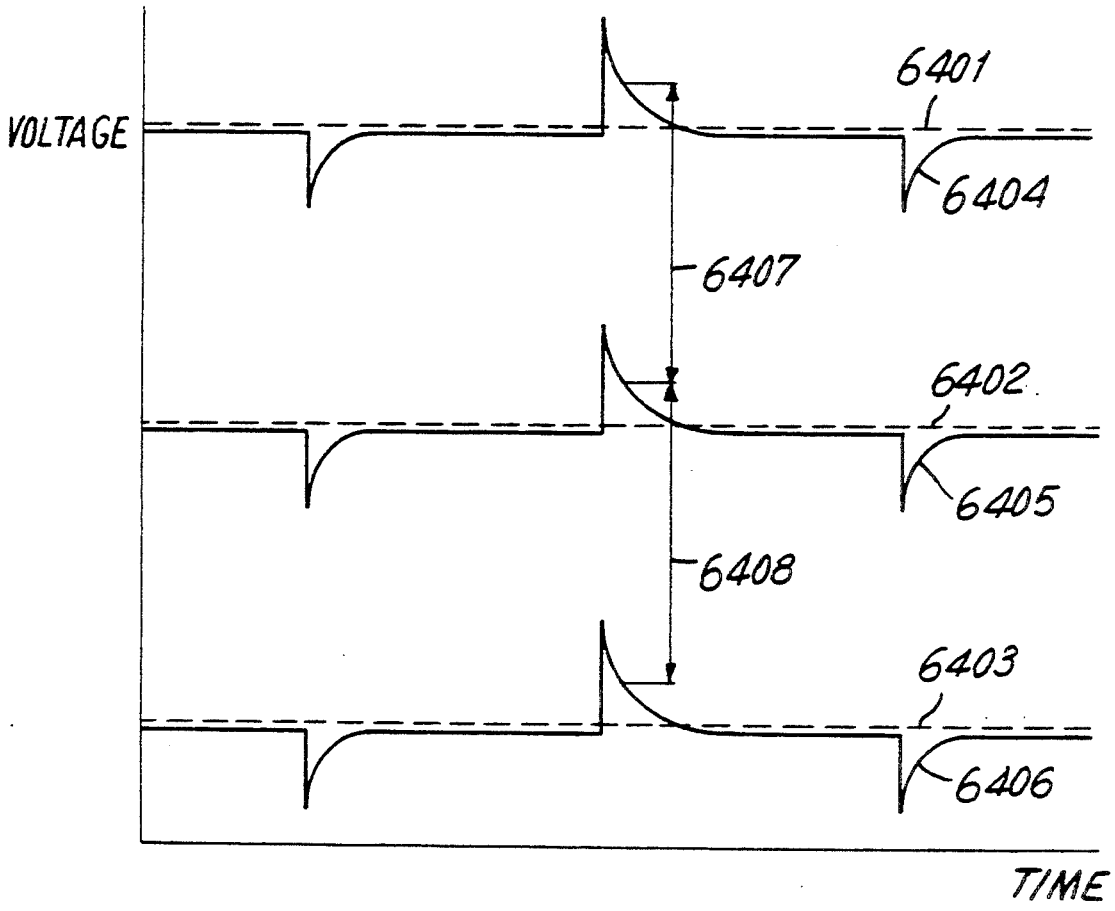
FIG. 83 is a timing voltage diagram showing voltages produced in accordance with the nineteenth embodiment of the invention.

Reference is now made to FIG. 83 where this effect is shown. FIG. 83 shows a portion of each of voltages V0–V2 when the waveform is being applied to common electrode Y2 or Y5 when a certain display is formed on liquid crystal panel 6010. Broken lines 6401, 6402 indicate voltages V0, V2 while solid lines 6404 and 6406 indicate voltages V0′ and V2′. Solid line 6405 indicates the waveform applied at common electrodes Y2, Y5. Voltages 6407 and 6408 represent the voltage differential between the electrode driving waveform 6405 output by common electrode driver 6205 and voltages V0′ and V2′ respectively. For ease of reading voltages 6401, 6402 and 6403, they are slightly shifted away from the superimposed voltages 6404, 6405, 6406.

If voltage waveform 6405 output by common electrode driving circuit 6205 is distorted causing a voltage change, voltages 6404 and 6406, i.e., voltages V0′ and V2′ are also changed in accordance with this voltage change so that voltage differences 6407 and 6408 are constant and are not influenced by the distortion. The operation has been described with respect to the first group of voltages. However, the same operation is also performed with respect to the second group of voltages.

As described above, the distortion component in the voltage waveform output by common electrode driving circuit 6205 is simply added to the voltage output by segment electrode driving circuit 6208. Because a larger distortion occurs in liquid crystal panel 6010 in comparison with the distortion in the voltage waveform output by common electrode driving circuit 6205, the voltage added to those voltages output by segment electrode driving circuit 6208 may be increased to compensate for this condition. This is easily achieved by increasing the gain of the differential amplifier 6136 to a suitable value. It is not always necessary to increase the voltages linearly with respect to the detected distortion.

Furthermore, in this embodiment common electrodes Y2 and Y5 have been described as reference scanning electrodes due to their symmetrically spaced location on the substrate. However, the reference electrodes are not limited to these two electrodes and may be selected at any other scanning electrodes. Also, an average of distortions with respect to a plurality of scanning electrodes may be used. As a result, display non-uniformity may be reduced in a simple manner by detecting the change in voltage on the common electrodes by correspondingly changing the voltages on the segment electrodes so the compensating circuit is integrated into the power circuit.

Figure 84:
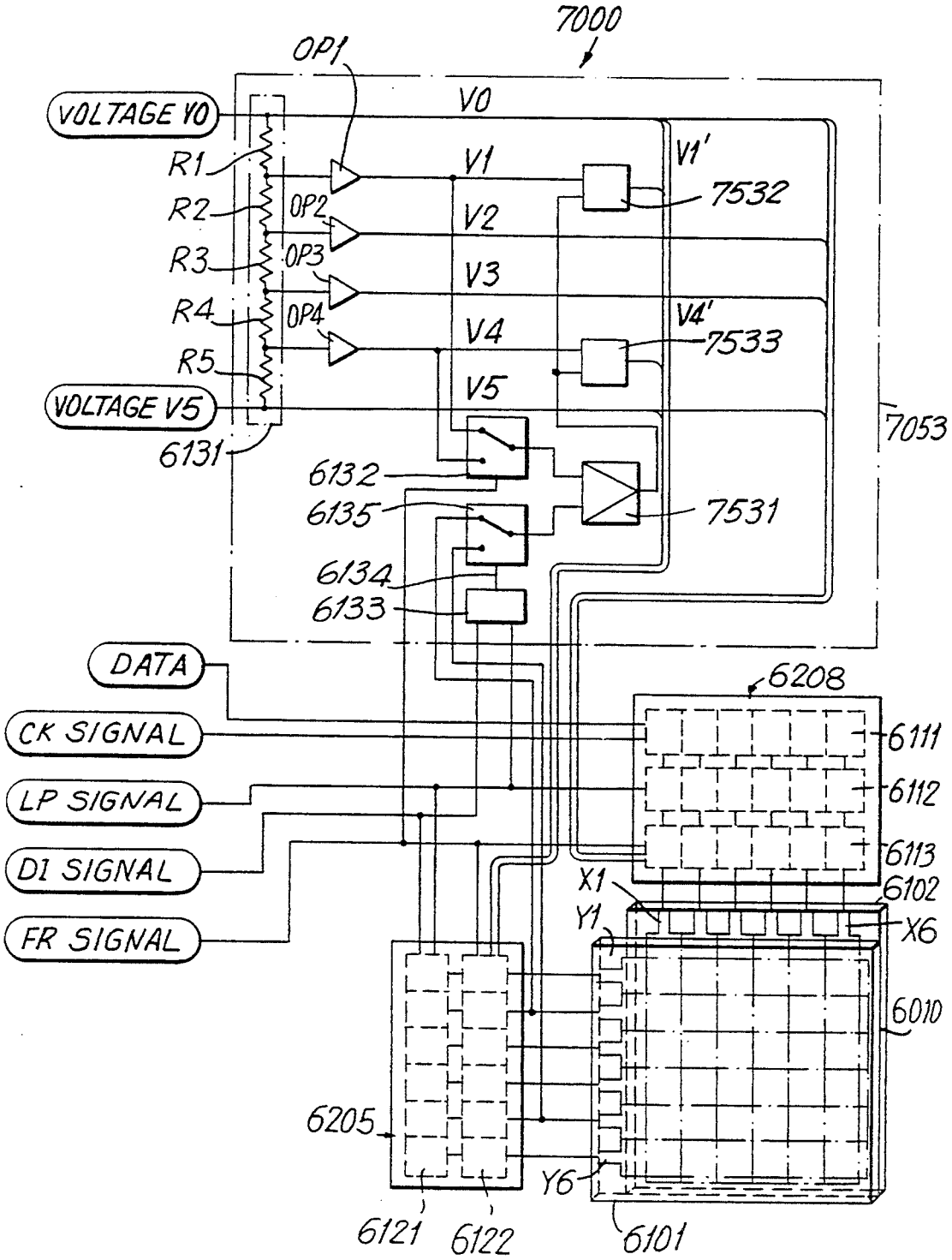
FIG. 84 is a schematic diagram of a liquid crystal display constructed in accordance with the twentieth embodiment of the invention.

Reference is now made to FIG. 84 wherein a liquid crystal display device constructed in accordance with another embodiment of the invention, generally indicated as 7000, is depicted. Liquid crystal display unit 7000 is similar to that of liquid crystal display unit 6000, the difference being in the operation of the power circuit. Liquid crystal display system 6000 adds a correction voltage to the driving voltage waveform supplied to the segment electrodes. However, the same effect can also be achieved by adding a correction voltage to the driving voltage waveform supplied to the common electrodes. This method is utilized by liquid crystal display unit 7000. Like numerals are utilized to indicate like structure.

Power circuit 7053 differs from power circuit 6013 in the utilization of voltage addition circuits. Only two voltage addition circuits 7532 and 7533 are utilized in power circuit 7053. Additionally, differential amplifier circuit 7531 inverts the voltage differential which it outputs. Voltage addition circuit 7532 receives a reference voltage V1, as well as the voltage differential output by differential amplifier circuit 7531 and outputs a voltage of V1′ to common electrode driving circuit 6205. Voltage addition circuit 7533 receives a reference voltage V4, as well as the output of differential amplifier circuit 7531 and outputs a voltage V4′ to common electrode driving circuits 6205. Voltage addition circuits 7532 and 7533 have the same circuit arrangement as voltage addition circuits 6137–6140.

Differential amplifier circuit 7531 outputs the voltage difference between the voltages output from reference voltage changeover switches 6132, 6135. Differential amplifier circuit 7531 inverts the polarity of these voltages.

Voltage addition circuit 7532 adds the voltage output by differential circuit amplifier 7531 to voltage V1 and outputs voltage V1′. Voltage addition circuit 7533 adds the voltage output from differential amplifier 7531 to voltage V4 and outputs a voltage V4′. As a result, voltages V0, V1′, V4′ and V5 are input to common electrode driving circuit 6205 and voltages V0, V2, V3 and V5 are input to segment electrode driving circuit 6208. Voltages V1′ and V5 input to common electrode driving circuit 6205 are a non-selection voltage and selection voltage respectively. Voltages V0 and V2 supplied to segment electrode driver circuit 6208 are a lighting voltage and a non-lighting voltage respectively. Voltages V1', V5 and V0, V2 are the first group of voltages. Voltages V0, V4' input to the common electrode driving circuit 6205 are the selection voltage and non-selection voltage of the second group of voltages while voltages V3 and V5 input to the segment electrode driving circuit 6208 are the non-lighting voltage and lighting voltage of the second group of voltages.

If a distortion (Ve) occurs in the voltage present on the common electrode to which the non-selecting voltage (V1 or V4) is supplied, that is, if the voltage on the common electrode becomes increased to Vc+Ve, voltage addition circuit 7532 or 7533 adds a voltage (−Ve) to the voltages V1 or V4, so that the distortion is cancelled. Accordingly, there is substantially no distortion in the non-selection voltage on the common electrode and as a result, no display non-uniformity.

As discussed above, because a larger distortion occurs in the liquid crystal panel 6010 due to the capacitance and resistance inherent in the liquid crystal display, in comparison with the distortion in the voltage waveform output by the common electrode driving circuit 6205, the correction voltage added to the voltage input to the common electrode driving circuit 6205 may be increased in accordance with this condition. This may be easily achieved by setting the gain of the differential amplifier circuit 7531 to a suitable value. Such an increase need not be a linear increase with respect to the detected distortion. As a result, display non-uniformity may also be reduced by detecting the change in voltage of each common electrode and changing the voltage on each common electrode correspondingly. It should be noted that the compensation systems of power circuit 7053 and 6013 are not mutually exclusive and may be combined to provide compensation to both the segment electrodes and common electrodes.

Figure 85:
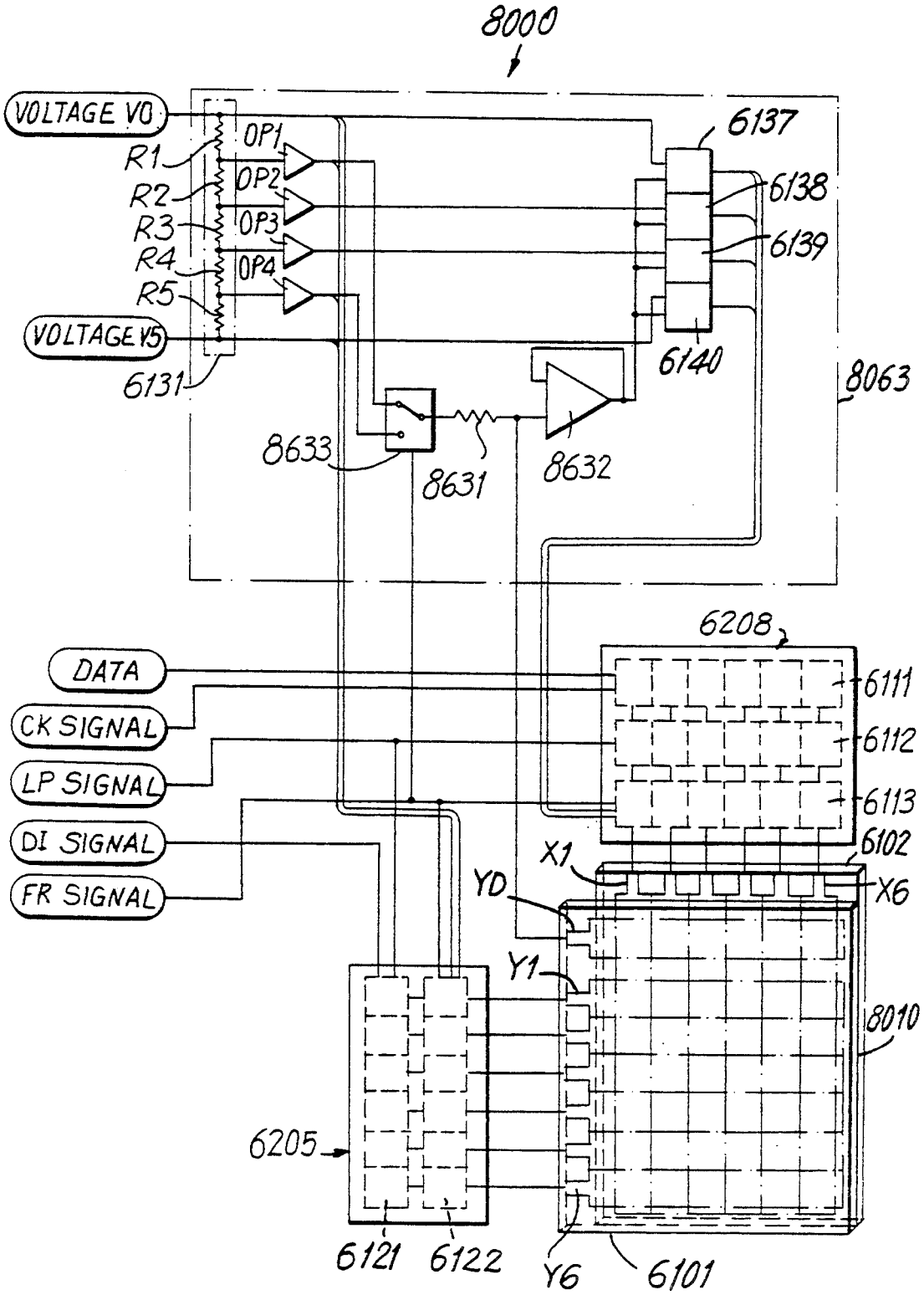
FIG. 85 is a schematic diagram of a liquid crystal display constructed in accordance with the twentieth embodiment of the invention.

Reference is now made to FIG. 85 wherein a liquid crystal display unit 8000 constructed in accordance with a further embodiment of the invention is provided. In liquid crystal display units 6000, 7000 the voltages supplied to the electrode driving circuit are changed in accordance with the distortion in the waveform being output from the common electrode driving circuit to a particular common electrode to reduce display non-uniformity. A distortion in the waveform of the common electrode driving circuit output or the voltage waveform on one common electrode is determined by the sum total of changes in the voltages of the segment electrodes with respect to the common electrode. As a result, a method may be adopted in which a voltage detection electrode is formed on the substrate which supports the common electrodes. The voltage detection electrode is capacitively coupled with the common electrodes through the liquid crystal layer interposed therebetween so that the sum of the changes in voltages along the segment electrodes is detected and a distortion of each common electrode may be estimated in response to this detection and the voltages applied to the segment electrode driving circuit may be changed in accordance with this distortion. This method is performed by liquid crystal display unit 8000.

Like numerals are utilized to indicate like structures. The difference between liquid crystal display unit 8000 and the liquid crystal display 6000 is the incorporation of a voltage detection electrode YD on liquid crystal display 8010. As a result, there is no need for a differential amplification circuit.

Instead, a power circuit 8063 includes a switch circuit 8633 coupled between voltage follower circuit OP1 and voltage follower circuit OP4 and selects between voltages V1 and V4 in response to the FR signal. A resistor 8631 is coupled between switch circuit 8633 and a voltage follower circuit 8632 which receives as one input a voltage detected by voltage detection electrode YD and the voltage across resistor 8631 and as its second input a feedback from its own output. The output of the voltage follower circuit 8632 is input as the Vin input to voltage addition circuits 6137–6140.

Liquid crystal panel 8010 includes a substrate 6101 upon which a voltage detection electrode YD is supported. Voltage detection electrode YD is disposed on substrate 6101 substantially parallel with common electrodes Y1–Y6 and substantially intersects the entire plurality of segment electrodes X1–X6. It should be noted that if the influence of the voltage change of segment electrodes X1–X6 upon the common electrodes varies with respect to the positioning of the segment electrodes, the width of the voltage detection electrode YD and may be made non-uniform. For example, the voltage detection electrode YD may be formed so as to gradually increase in width in a direction extending from the voltage inputs to the common electrodes so that the widest portion of detection electrode YD is positioned adjacent the end of common electrodes Y1–Y6 not being directly coupled to common electrode driving circuit 6205. As a result, the capacitance and ability to monitor voltage changes is varied.

Resistor 8631 forms a differentiating circuit in association with the capacitor formed by voltage detection electrode YD acting in cooperation with segment electrodes X1–X6 in facing relationship with voltage detection electrode YD. Voltage follower circuit 8632 outputs a voltage generated on voltage detection electrode YD by reducing the impedance thereof. Voltage follower circuit 8632 is a non-inverting amplifier having an amplification factor which is not necessarily one.

Switch circuit 8633 is changed to select one of voltages V1 and V4 applied at a first end of resistor 8631. These voltages are the reference voltage for a voltage following circuit 8632. Accordingly, when common electrode driving circuit 6205 is using voltage V1 as a non-selected voltage, voltage V1 is applied to the first end of resistor 8631. Conversely, when common electrode driving circuit 6205 is using voltage V4, voltage V4 is applied to the first end of resistor 8631. By this arrangement, the voltage follower circuit 8632 generates a voltage change in accordance with the sum of the changes in segment electrodes X1–X6. This is a result of providing an input from voltage detection electrode YD. As a result, voltages V0', V2', V3' and V5' are generated by voltage addition circuits 6137–6140.

As a result, the driving voltages for segment electrodes X1–X6 are compensated. As a result, the same effect is provided by liquid crystal display system 8000 as is provided in liquid crystal display 6000. If the driving method utilized to illuminate liquid crystal panel 8010 is not a voltage averaging method, and liquid crystal panel 8010 is driven by a method in which different voltage waveforms of two value voltages are applied to common electrodes to perform driving as disclosed, in Japanese Patent Laid Open Publication 60-247224 by way of example, it is difficult to directly detect distortion on the common electrodes because the voltage waveforms on the common electrodes are different from each other. In such a case, the method of detecting a distortion on the common electrodes by a voltage detection electrode in accordance with this embodiment becomes more effective.

Switch circuit 8633 is required for the use of two non-selection voltages V1 and V4 in connection with scanning of electrode driving circuit 6205. That is, at the time of detection voltage changes on the segment electrodes with respect to the non-selection voltage output by the common electrode circuit 6205, it is necessary to change the reference voltage applied to the first end of resistor 8631 when the non-selection voltage output from the common driving circuit 6205 changes from voltage V1 to voltage V4 in response to the FR signal. Accordingly, power circuit 8063 may be operated so that the two non-selected voltages are combined into one common non-selection voltage and the common electrode driver operates with respect to selection voltages which are a pair of positive and negative voltages equal in absolute value on the basis of the non-selection voltage and the segment electrode driver also operates with respect to a pair of positive and negative voltages equal in absolute value. As a result, it is no longer required that switch circuit 8633 have a comparatively high voltage threshold when operating to change between voltages V1 and V4. The reference voltage applied to the first end of resistor 8631 may be set to any constant voltage. By way of example, the reference voltage may be set to a middle voltage value between V0 and V5.

Furthermore, switch 8633 is not needed to control voltage switching in response to the FR signal. For example, a circuit which does not forcibly generate a correction voltage in response to the FR signal, for example by having a low voltage threshold switch capable of short circuiting resistor 8633, the reference voltage will still be applied without the need for a switch.

Liquid crystal display unit 8000 adds a correction voltage to the segment electrode driving voltage waveform. However, by utilizing an inverting amplifier circuit for inverting the polarity of the voltage output from voltage follower circuit 8632 may be provided by adding output voltage as a correction voltage to the common electrode driving voltage waveform as discussed above in connection with liquid crystal display unit 7000.

In liquid crystal display unit 8000, a single voltage detection electrode YD is formed on the substrate on which the common electrodes are formed. This voltage detection electrode is capacitively coupled with the segment electrodes through the liquid crystal layer to detect the sum of the voltage changes across the segment electrodes. A voltage waveform distortion on each common electrode is estimated from the result of this detection to change the voltages supplied to the segment electrode driving circuit. However, as the number of common electrodes is increased, i.e., the length of each segment electrode is increased, the segment electrode change may vary between one end of the segment electrode close to the segment electrode driving circuit and another portion remote from the segment electrode driving circuit. This variation is too great and becomes difficult to estimate the distortion on the common electrodes with accuracy. To compensate for such inaccuracies, a method and structure may be utilized in which a plurality of voltage detection electrodes are formed on a substrate and a correction voltage is generated by weighing the voltages as detected by these voltage detection electrodes. As a result, a suitable function may be utilized to produce a correction voltage, these detection voltages are utilized as variables in a correction voltage function and added to the segment voltage driving waveform.

A distortion in the waveform output by a common electrode driving circuit or the voltage waveform present on each common electrode is generated by a current flowing through the common electrode driving circuit and the common electrode. This current flows from the power circuit to the common electrode driving circuit. Therefore, it becomes possible to estimate the distortion by detecting current flowing through the power circuit. Knowing the current flowing through the power circuit and the distortion occurring therein, the voltages applied to the segment electrode driving circuit may be changed in response thereto to compensate for the distortions.

Figure 86:
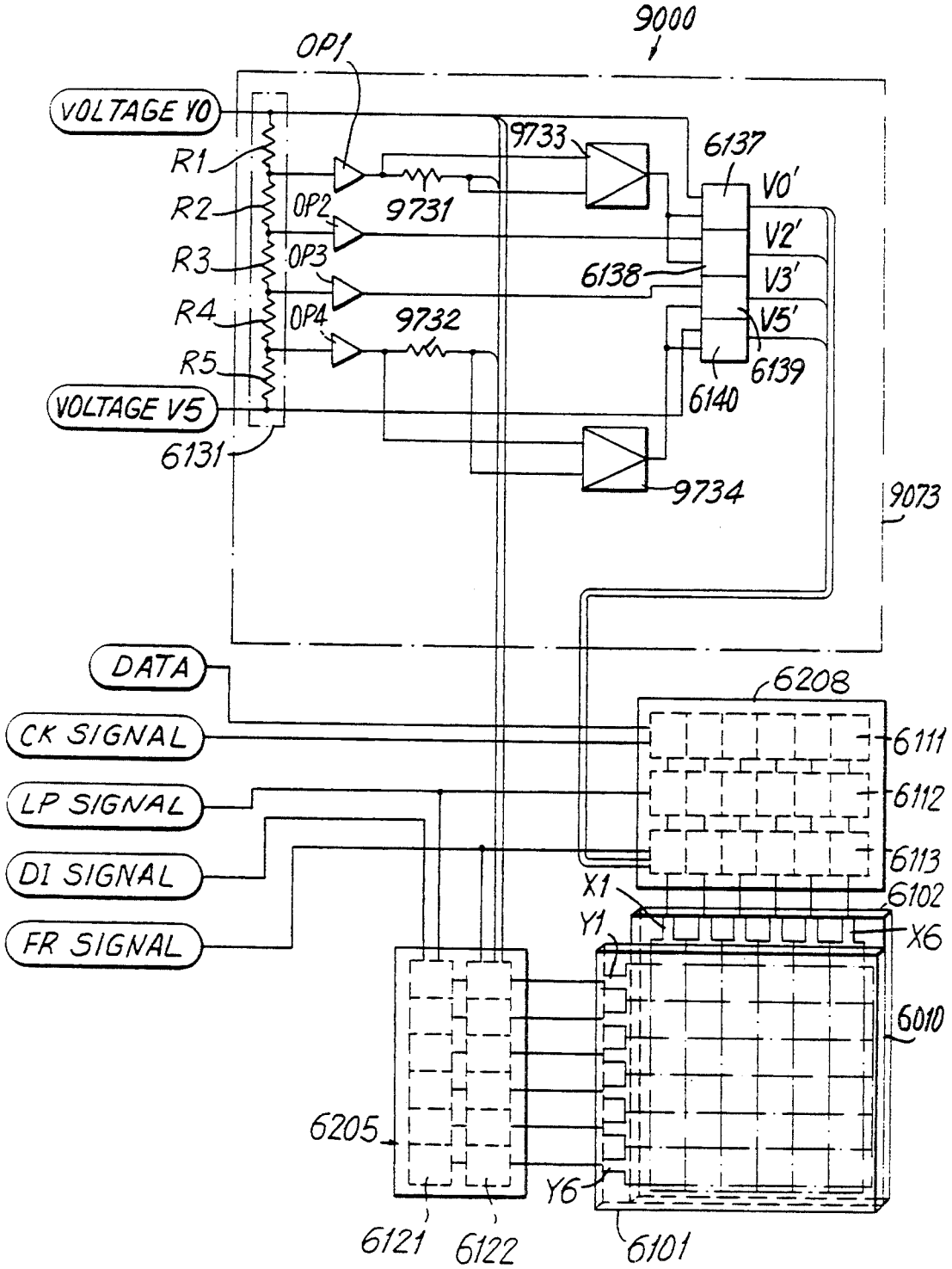
FIG. 86 is a schematic diagram of a liquid crystal display device constructed in accordance with the twenty-first embodiment of the invention.

Reference is now made to FIG. 86 wherein a liquid crystal display unit constructed in accordance with a twenty-first embodiment of the invention, generally indicated as 9000, is provided. In this embodiment of the invention, the current flowing through the power circuit is monitored to determine the amount of correction voltage to be applied to the segment electrodes. Like numerals are utilized to indicate like structure, the difference between liquid crystal display unit 9000 and liquid crystal display unit 6000 being in power circuit 9073 wherein the switching circuits are replaced by resistors 9731, 9732 and an additional differential amplifier circuit 9733.

A first resistor 9731 is a current detection resistor coupled between voltage follower circuit OP1 and a differential amplifier circuit 9733. Differential amplifier circuit 9733 receives an input for both ends of resistor 9731 and provides an output to voltage addition circuits 6137 and 6138. Voltage addition circuits 6137 and 6138 receive reference voltages V0, V2 respectively. Similarly, a second current detection resistor 9732 is coupled between both voltage following circuit OP3 and a voltage differential amplifier circuit 9734. Voltage differential amplifier 9734 also receives its inputs across resistor 9732 and provides an output to voltage addition circuits 6139, 6140. Voltage addition circuit 6139, 6140 also receive voltage reference inputs V3, V5 respectively.

Current detector resistors 9731 and 9732 have a small relative resistance. A voltage proportional to the current flowing through each resistor 9731, 9732 is generated across the respective resistor. Differential amplifier circuits 9733 and 9734 supply the voltage addition circuits with the voltage differential generated across the respective resistors 9731, 9732. Voltages V0′, V2′, V3′ and V5′ are generated by addition circuits 6137–6140 in response to the voltage differences generated by a voltage differential amplifier circuit 9733, 9734.

As a result, the same voltages are output to segment electrode driving circuit 6208 by power circuit 9073 as the output by power circuit 6013. It is possible to accomplish correction without the use of a reference voltage changeover switches 6132, 6135 or changeover control circuit 6133 resulting in a simplified correction circuit. Additionally, a voltage obtained by inverting the voltage output from each of differential amplifier circuits 9733 and 9734 may be added as a correction voltage to the common electrode driving waveform to achieve the same effect as in connection with liquid crystal display unit 7000.

Liquid crystal display unit 9000 has been described in connection with a method of detecting the current with respect to the non-selection voltage. However, since a distortion generated in the driving voltage waveform (non-selection of voltage) on the common electrodes by the segment electrodes is the sum of currents flowing through the segment electrodes when the voltage applied to each segment electrode is changed from the lighting voltage to the non-lighting voltage or from the non-lighting voltage to the lighting voltage, it is also possible to estimate the distortion generated in the driving voltage waveform (non-selection voltage) on the common electrodes by detecting currents with respect to the lighting voltage and non-lighting voltages output to the segment electrode driving circuit. This also may be accomplished by use of small resistance resistors or the like and by adding the detected currents. As a result, a correction voltage can also be easily produced in this manner and the same effect can be achieved.

In liquid crystal display unit 6000–9000 a display non-uniformity occurring in the direction of the positioning of a segment electrode on the liquid crystal display panel was reduced. However, it is also possible to correct a display non-uniformity occurring in the direction in which the common electrodes are arranged on the liquid crystal panel. This display non-uniformity is referred to as "lateral streak". Lateral streak is disclosed in detail in Japanese Patent Laid Open Hei 2-89. A capacitance exists in the liquid crystal display panel and is inherent in a liquid crystal layer. When the number of lighted display dots on each common electrode is increased, the capacitance of the capacitor formed by the display dots on the common electrode becomes greater and the common electrode driving waveform edge becomes rounded off at that portion of the driving waveform corresponding to the change from a non-selection voltage to a selection voltage. As a result, the effective voltage applied to the display dots on the common electrode is reduced causing lateral streak.

Lateral streak display non-uniformity can be reduced utilizing a method for forming a voltage detection electrode on the substrate supporting the segment electrodes, the voltage detection electrode being capacitively coupled with the common electrodes through the liquid crystal layer interposed therebetween, detecting the sum of the voltage changes along the segment electrodes, estimating a distortion on each common electrode from the result of this detection and changing the selection voltage supplied to the common electrode driving circuit.

Figure 87:
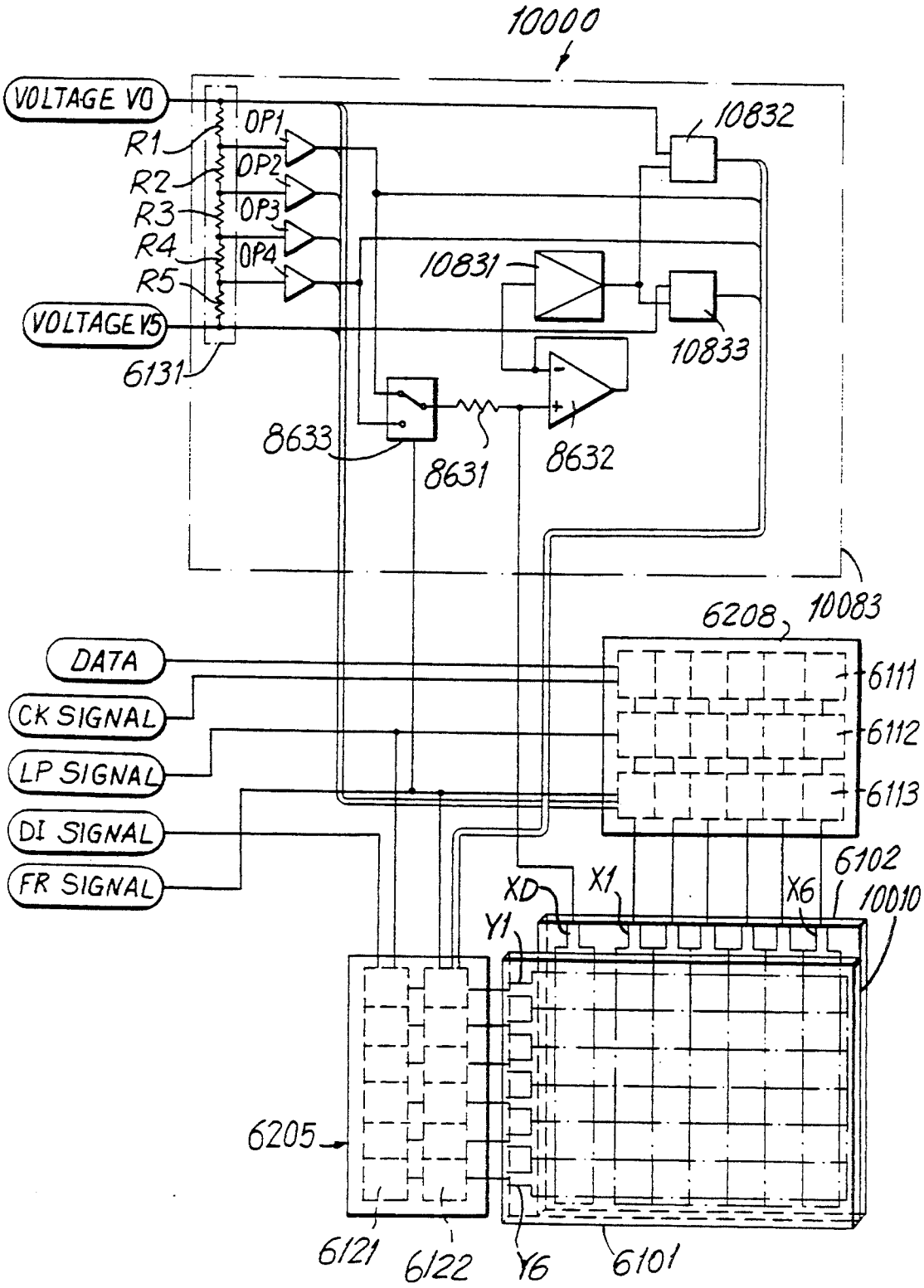
FIG. 87 is a schematic diagram of a liquid crystal display device constructed in accordance with the twenty-second embodiment of the invention.

Reference is now made to FIG. 87 in which a liquid crystal unit, generally indicated at 10000, utilizing a voltage detection electrode in accordance with the invention is provided. Liquid crystal unit 10000 is analogous in operation to liquid crystal unit 8000 and like numerals are utilized to indicate like structures. The difference between the two liquid crystal display units being the utilization of a detection electrode XD and the inclusion of a voltage differential amplification circuit in connection with the voltage following circuit.

Liquid crystal panel 10000 includes a substrate 6102. A voltage detection electrode XD is disposed on substrate 6102 to be in facing relationship with all of common electrodes Y1–Y6.

Voltage detection electrode XD operates in a fashion similar to Voltage electrode YD and provides an input to power circuit 10083 and is coupled to power circuit 10083 at a junction between resistor 8631 and voltage follower circuit 8632.

Figure 88:
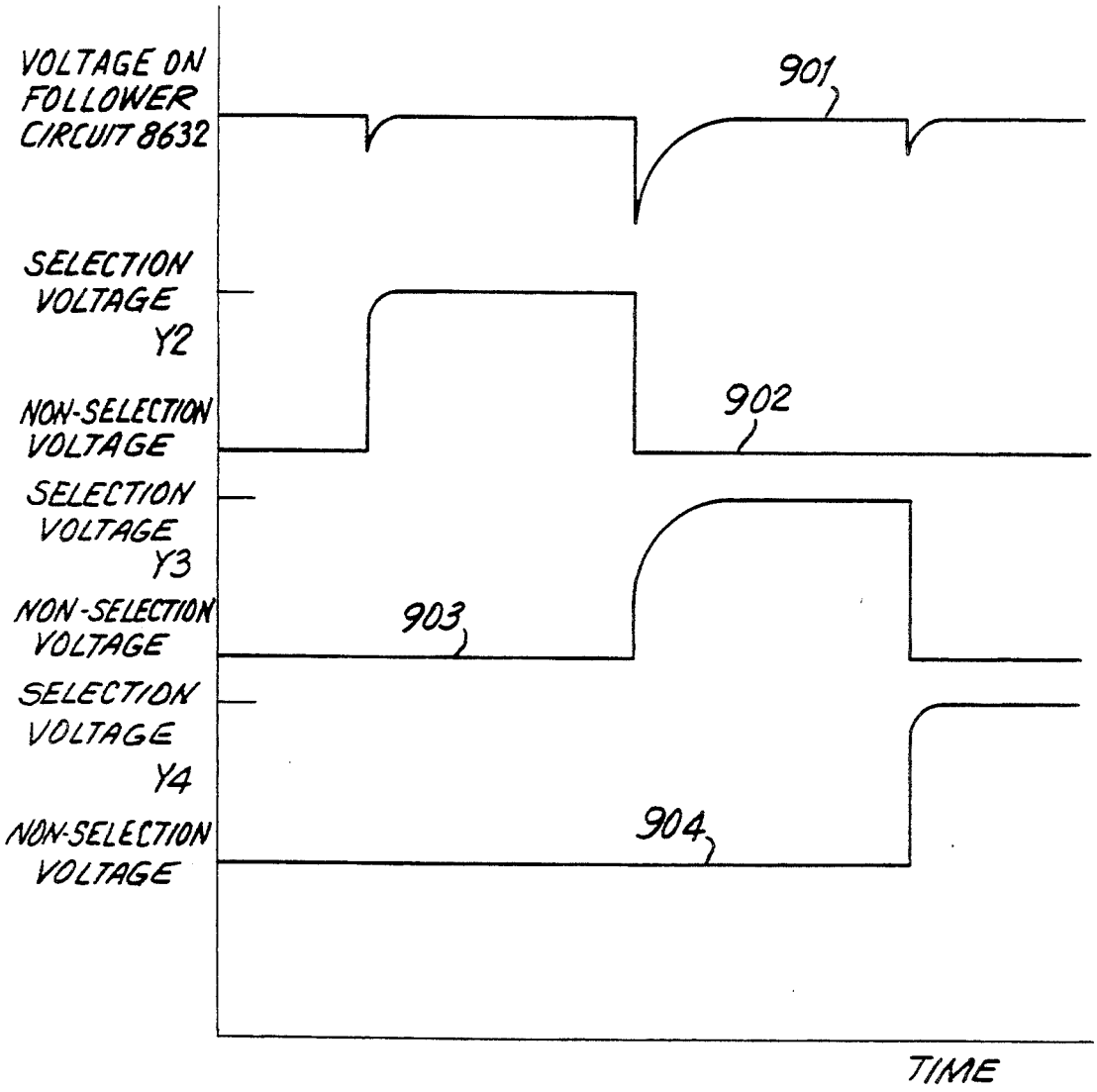
FIG. 88 is a voltage diagram showing voltages produced in accordance with the operation of the twenty-second embodiment of the invention.

Operation of liquid crystal display unit 10000 is now described in connection with the voltage diagrams of FIG. 88. As described in detail above, for ease of explanation, a selection voltage is applied successively to each common electrode Y1–Y6 in order. A non-selection voltage is applied when the selection voltage is not applied at a common electrode so that during the most basic operation of the common electrodes, five common electrodes exhibit the non-selection voltage while a single common electrode exhibits the selection voltage. FIG. 88 illustrates the voltage produced by voltage follower circuit 8632 in a top graph. The succeeding graphs are the voltages exhibited by common electrodes Y2–Y4. As expected, the selection voltage travels along the time axis for each successive common electrode. In the example of FIG. 88, a large number of display dots on common electrode Y3 are lighted while the number of lighted display dots on the remaining common electrodes is comparatively small.

Voltage waveform 901 represents the voltage waveform output by voltage follower circuit 86302. Waveforms 902, 903 and 904 represent the waveforms of common electrode Y2, Y3, Y4 respectively. The common electrode waveforms are shown with no voltage correction. Voltage waveform 901 represents the sum of the changes in the voltage waveform on all the common electrodes Y1–Y6. As can be seen, the magnitude of correction (the spikes) changes with the successive application of the selection voltage to the common electrodes Y1–Y4 as switching from successive common electrode to successive common electrode occurs.

As shown in FIG. 88, the common electrode to which the selection voltage is applied is changed to common electrode Y2 to common electrode Y3. Voltage waveform 903 on scanning electrode Y3 changes from the non-selection voltage level to the selection of voltage level. However, the rising edge of this transition exhibits a large rounded off portion. As a result, a large differentiated waveform having approximately the same magnitude as the rounded off portion of voltage waveform 903. This is the waveform generated by voltage follower circuit 8632. When the common electrode to which the selection of voltage is applied is changed from common electrode Y3 to Y4, the voltage waveform 904 on scanning electrode Y4 changes from a non-selection voltage to a selection voltage without any substantially large amount of rounding off. Because of the feedback mechanism provided by voltage detection electrode XD, the output of voltage follower circuit 8632 is a small differentiated waveform 901.

The polarity of the voltage follower circuit 8632 output is inverted by inverting amplifier circuit 10831. The inverted output is added as a correction voltage to the selection voltage by voltage addition circuits 10832 and 10833. As a result, when the voltage waveform 903 of common electrode Y3 increases to the selection voltage level, the rounded edge is corrected to become equal to the selected voltage faster. This is because the correction voltage has been added to the selection voltage for this time period. As a result, the amount of rounding off at the time of transition from the non-selection voltage to the selection voltage is made constant regardless of the number of lighted display dots on the common electrodes, thereby preventing lateral streak from occurring.

The distortion in the output of the common electrode driving circuit or the distortion exhibited in the voltage waveform on each common electrode, is generated by current flowing through the common electrode driving circuit and the common electrode itself. The leading edge of the selection voltage applied to a single common electrode becomes largely rounded off if the number of lighted display dolls on the common electrode is large. This corresponds to a large current flowing through the selected common electrode. As a result, the distortion can be estimated by detecting the current flowing through the common electrode or the current flowing through the power supply circuit from which the selection voltage is generated. Knowing this information, the voltage supplied to the common electrode driving circuit may be changed in accordance therewith.

Figure 89:
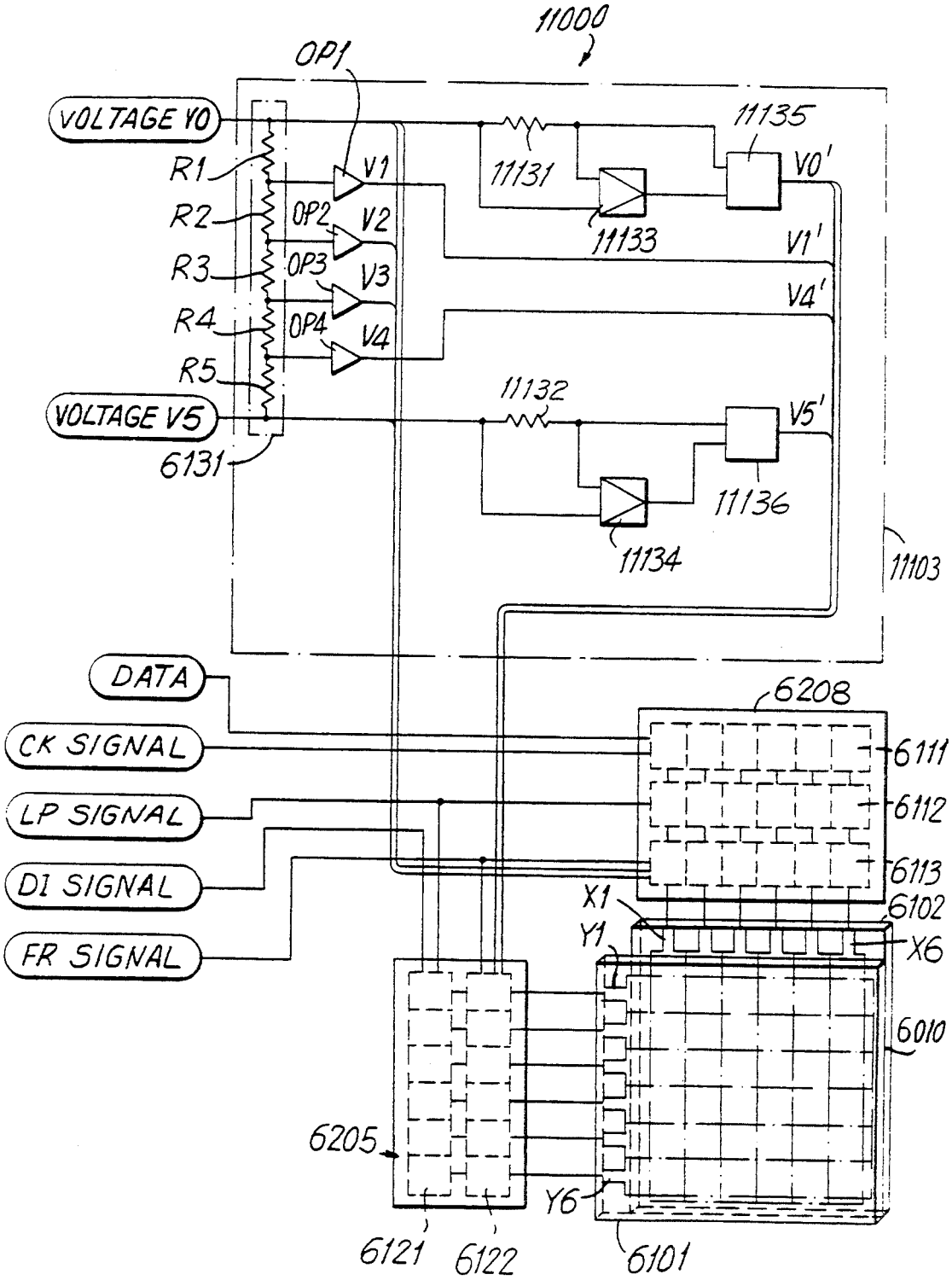
FIG. 89 is a schematic diagram of a liquid crystal display unit constructed in accordance with the twenty-third embodiment of the invention.

Reference is now made to FIG. 89 in which another embodiment of the invention, generally indicated as 11000 is depicted. Liquid crystal display unit 11000 is similar to liquid crystal display unit 9000 and like numerals are utilized to indicate like structure. The substantial difference being that the correction voltage in liquid crystal display unit 11000 is applied to the common electrode driving circuit. As a result, fewer addition circuits are required within the power circuit.

Power circuit 11103 includes a first resistor 11131 coupled between a reference voltage V0 and a first voltage addition circuit 11135. A differential amplifier circuit 11136 is coupled across resistor 11131 and provides a second input to voltage addition circuit 11135. Voltage addition circuit 11135 outputs a correction voltage V0′ in response to the reference signal V0 and the voltage output by differential amplifier circuit 11133. A second resistor 11132 is coupled between a reference voltage V5 and a second voltage addition circuit 11136. A differential amplifier circuit 11134 is coupled across resistor 11132 and provides a second input to voltage addition circuit 11136. Voltage addition circuit 11136 outputs a correction voltage V5′. Voltages V5′, V1, V4 are input to common electrode driving circuit 6205.

Resistors 11131 and 11132 are current detection resistors which have a very small resistance respectively. A voltage proportional to the current flowing through each resistor 11131 and 11132 is generated across the respective resistors. Differential amplifiers 11133 and 11134 output voltage differences generated across resistors 11131 and 11132 multiplied by desired value. These multiplied voltages are input to voltage addition circuits 11135 and 11136 respectively. Voltage addition circuit 11136 adds the voltage difference to reference voltage V5 and generates voltage V5′. Similarly, voltage addition circuit 11135 adds the voltage difference to voltage V0 and outputs a voltage V0′. When the selection voltage is applied to a common electrode and when the voltage waveform on this common electrode begins to increase, large currents flow through resistors 11131 and 11132. As a result, voltages V0′ and V5′ have absolute values greater than those of voltages V0 and V5. The combination of the voltages reduces to a large extent the rounding off of the rising edge of the voltage waveform on this particular common electrode. As a result, the same effect is achieved as in liquid crystal display unit 10000.

Figure 90:
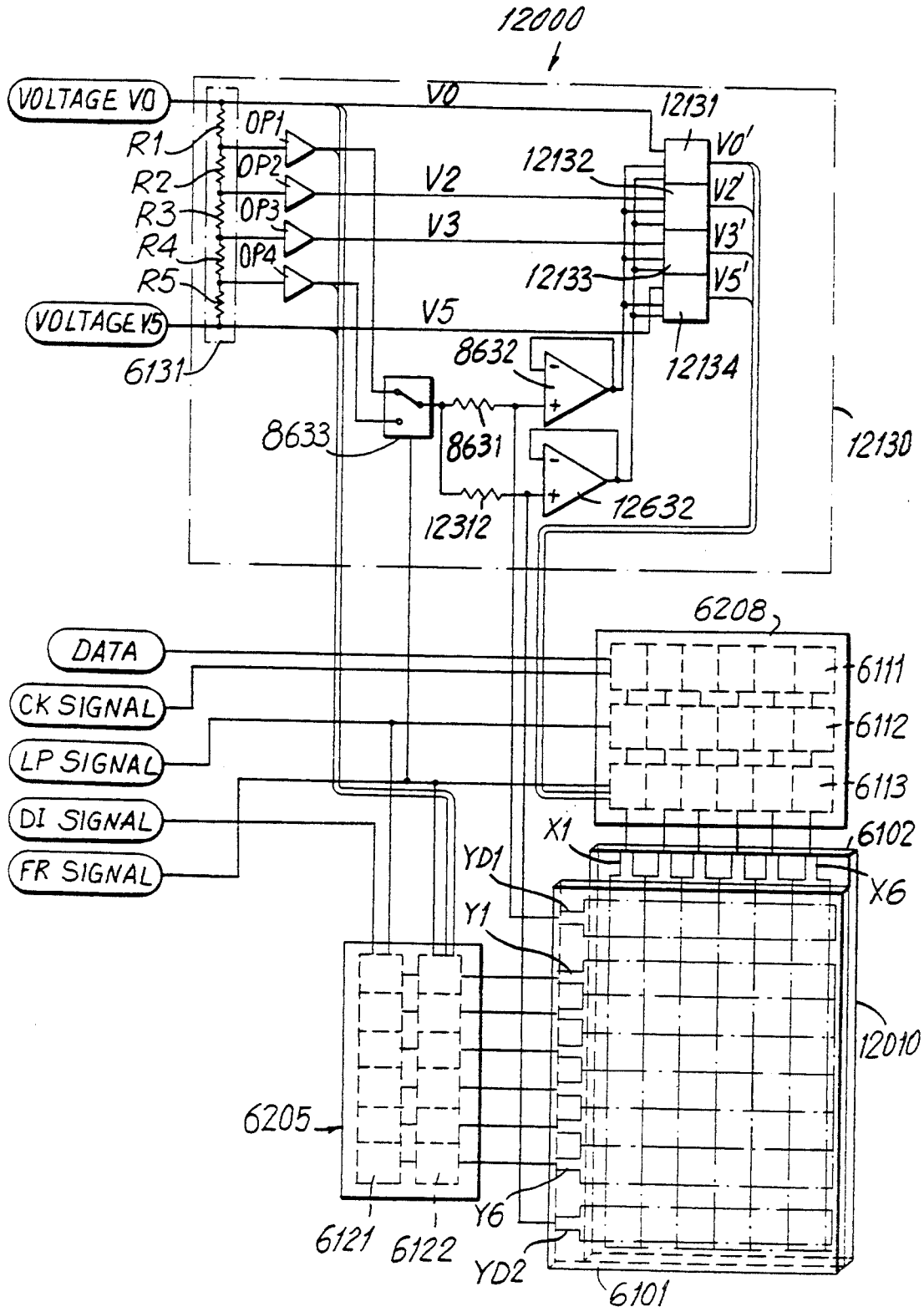
FIG. 90 is a schematic diagram of a liquid crystal display unit constructed in accordance with the twenty-fourth embodiment of the invention.

Reference is made to FIG. 90 in which another embodiment of the liquid crystal display unit, generally indicated as 12000, constructed in accordance with the invention is provided. Liquid crystal display unit 12000 is similar to liquid crystal display unit 8000 and like numerals are utilized to indicate like structure. The substantial difference being the inclusion of a second voltage detection electrode YD2 mounted within the liquid crystal display panel 12010 and the addition of a second resistor and voltage follower circuit arrangement in the power circuit.

A second resistor 12312 is coupled between switch circuit 8633 and a second voltage follower circuit 12632. Voltage follower circuit 12632 receives the voltage input across resistor 12312, as well as the voltage detected by voltage detection electrode YD2 and provides a feedback input to itself, as well as an output to each of voltage addition circuits 12131–12134. Each voltage addition circuit receives an input from each of voltage follower circuits 8632 and 12632, as well as a respective reference voltage V0, V2, V3, V5. Voltage addition circuits 12131–12134 output respective voltages V0′, V2′, V3′ and V5′ which are input to segment electrode driving circuit 6208.

Voltage detection electrodes YD1 and YD2 are positioned on opposed sides of substrate 6101 in a substantially parallel configuration with each other. Voltage detection electrodes YD1 and YD2 are both disposed to be in facing relationship with all of the segment electrodes X1–X6. If the relative influence of voltage changes on segment electrodes X1–X6 upon the common electrodes varies with respect to the segment electrodes, the voltage detection electrode YD may be non-uniform with and may be formed of a different shape to compensate therefor. By way of example, the respective voltage detection electrode YD may be formed so as to gradually increase in width in a direction relative to the voltage waveform inputs to the liquid crystal panel. Voltage detection electrode YD1 provides an input to voltage follower circuit 8632 and voltage detection electrode YD2 provides an input to voltage follower circuit 12632.

Power circuit 12130 includes resistors 6311, 6312 which form differentiating circuits in connection with the capacitors formed by voltage detection electrodes YD1 and YD2 interacting with segment electrodes X1–X6 in facing relationship with voltage detection electrodes YD1 and YD2. Voltage follower circuits 8632 and 12632 output voltages generated on voltage detection electrodes YD1 and YD2 respectively by reducing the impedances thereof. Follower circuits 8632 and 12632 may be a non-inverting amplifier whose amplification factor need not be one and may assume any amplification factor. As discussed above, in various combinations voltage adding circuits 12131–12134 add the voltages output from voltage follower circuits 8632 and 12632 to voltages V0, V2, V3 and V5 to generate voltages V0′, V2′, V3′ and V5′. Unlike the previously described voltage addition circuits, voltage addition circuits 12131–12134 operate on three input voltages, one of which is a reference voltage and two of which have varying values.

Figure 91:
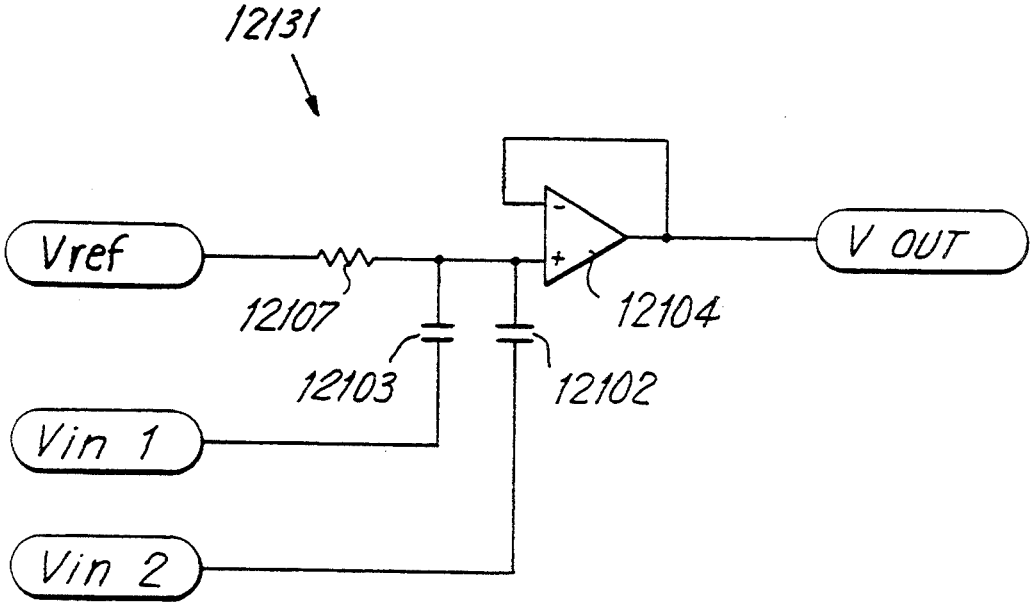
FIG. 91 is a diagram of a voltage addition circuit constructed in accordance with the twenty-fourth embodiment of the invention.

Reference is made to FIG. 91 wherein an exemplary embodiment of a voltage addition circuit generally indicated as 12131 constructed in accordance with the invention is provided. A resistor 12101 is coupled between a reference voltage input Vref and a first input to a voltage follower circuit 12104. A first capacitor 12103 is coupled between resistor 12101, the input to voltage follower circuit 12103 and a second terminal voltage Vin1. A second capacitor 12102 is coupled between resistor 12101, voltage follower circuit 12104 and a second voltage input Vin2. Resistor 12101 and capacitors 12102, 12103 form a two input differentiating circuit. Voltage follower circuit 12104 is formed of an operational amplifier circuit and receives the input from the differentiating circuit. Voltage follower circuits 8632 and 12632 provide inputs at Vin1 and Vin2. One of reference voltages V0, V2, V3 and V5 is input at terminal Vref Voltages V0', V2', V3' or V5' are output at terminal Vout in response to the inputs of the differentiating circle.

The voltages output by voltage follower circuits 8632 and 12632 which in turn are input through terminals Vin1, Vin2 closely resemble differentiated waveforms. Therefore, by inputting the voltages at input terminals Vin1, Vin2 of the differentiating circuit, a voltage approximating to the sum of the voltage at the terminal Vref and the voltages terminal Vin1 and Vin2 is output by voltage follower circuit 12104.

If capacitors 12102 and 12103 have equal capacitances then the voltages monitored by voltage detection electrodes YD1 and YD2 will be given equal weight in producing the output voltage at terminal Vout. Therefore, the correction voltage will in effect be an averaging of these voltage. However, the two capacitors may have different capacitances if required. By way of example, capacitor 12102 may have capacitance greater than that of capacitor 12103 so that the contribution of voltage detection electrode YD2 is a greater component of the correction voltage with respect to a voltage change.

The capacitances of capacitors 12102 and 12103 may be easily determined through experiment. The capacitances of capacitors 12102 and 12103 may be set to equal values while the voltage detection electrodes YD1 and YD2 may be formed so that the voltage detection electrode YD2 is wider than voltage detection electrode YD1, providing the same effect with regard to increasing the contribution to the correction voltage.

Accordingly, by utilizing a plurality of voltage detection electrodes, a distortion occurring in the driving waveform of the common electrodes the accuracy of correcting the non-uniformities is improved. Furthermore, the display non-uniformity is now reduced more effectively. It should be noted that a plurality of voltage detection electrodes may be disposed on the substrate supporting the segment electrodes in a manner to be in facing relationship to the common electrodes Y1–Y6. With slight adjustments to the power circuit to provide the correction voltage to the common electrode driving circuit lateral streak may be cured as well.

In liquid crystal display unit 12000, a plurality of voltage detection electrodes are formed on a substrate which also supports the common electrodes. A correction voltage is produced as a function utilizing voltages generated on these voltage detection electrodes as a plurality of variables operated upon and in accordance with the function. By using the sum of driving voltage changes on the segment electrodes at one position on the liquid crystal panel such as the left hand position and the sum of changes in the driving voltage waveforms on the segment electrodes in an opposed portion of the liquid crystal panel such as the right hand side, the resulting display non-uniformity can be reduced more effectively by applying different correction voltages to the segment electrodes. Accordingly, display non-uniformity can be further reduced by a method generating a plurality of correction voltages in response to voltage changes for a plurality of voltage detection electrodes and separately add the correction voltage in such a manner that one correction voltage is added to the driving voltage waveform for the segment electrode or the common electrode that the voltage detection electrode from which the correction voltage is generated intersects.

Figure 92:
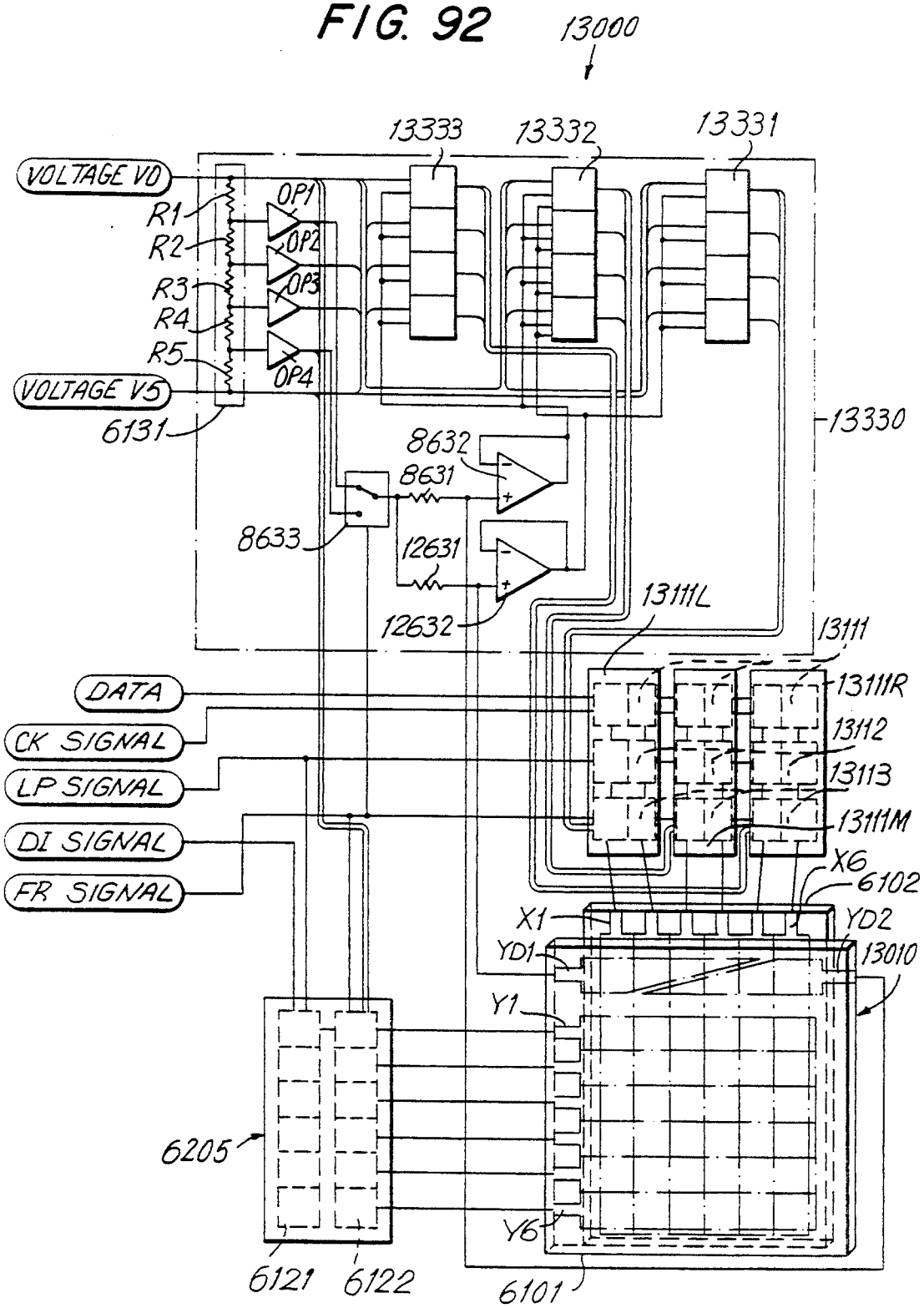
FIG. 92 is a schematic diagram of a liquid crystal display unit constructed in accordance with the twenty-fifth embodiment of the invention.

Reference is now made to FIG. 92 in which a liquid crystal display constructed in accordance with an embodiment in which distinct correction voltages are applied to distinct groupings of segment electrodes, generally indicated as 13000 is provided. The operation of liquid crystal display unit 13000 is similar to the dual electrode operation of liquid crystal display 12000 and like numerals are utilized to indicate like structure. The substantial difference between the two units is the positioning and shape of voltage detection electrodes YD1, YD2, which are positioned substantially co-linearly with each other and are shaped as wedges so as not to overlap, and the division of the segment electrode driving circuit into three individual circuits, as well as the dividing of the addition circuit into three voltage addition circuits within the power circuit.

A liquid crystal 13010 has a first substrate 6101 upon which a first voltage detection electrode YD1 is disposed to be in facing intersecting relationship with at least a portion of segment electrodes X1–X5. A second voltage detection electrode YD2 is formed substantially co-linearly with first voltage detection electrode YD1 on substrate 6101 and is in substantially facing relationship with and intersects at least a portion of segment electrode X2–X6. Voltage detection electrode YD1 provides an input to voltage follower circuit 12632 and voltage detection electrode YD2 provides an input to voltage follower circuit 8632. A first segment electrode driving circuit 13111L provides voltage waveforms to segment electrodes X1, X2. Similarly, a second segment electrode driving circuit 13111M provides a voltage waveform to segment electrodes X3, X4. A third segment electrode driving circuit 13111R provides a voltage waveform to segment electrodes X5, X6. The internal structure of the segment electrode driving circuits are identical and include a shift register circuit 13111 in which provides input to a latch circuit 13112 which in turn provides an output to an analog switch acting as a level shifter circuit 13113 as described in detail in connection with a segment electrode driving circuit 6208, the only difference being the number of bits being operated upon, two versus six.

Because there are now three segment electrode driving circuits, three voltage addition circuits are contained within power circuit 1330. A first voltage addition circuit 1333 receives reference voltage V0 and the output of voltage follower circuit 8632 and provides an input to segment electrode driving circuit 13111R. A second voltage addition circuit 13332, receives an input voltage V0, as well as the voltage output by both voltage follower circuits 8632 and 12632. Voltage addition circuits 13332 provides an input to a segment electrode driving circuit 13111M. A third group of voltage addition circuits 13331 receives a voltage input V0, V5 and the output of voltage follower circuit 12632 and provides a correction voltage to segment electrode driving circuit 13111L.

Liquid crystal panel 13010 is formed with the two voltage detection electrodes YD1, YD2 thereon. The opposed portions of the voltage detection electrodes YD1 and YD2 having a wedge-like shape so as to intersect a portion of signal electrodes X2–X5 in common. However, it is not always necessary for the opposed portions to intersect the same segment electrodes in common. Furthermore, it is not always necessary to separate the two voltage detection electrodes YD1 and YD2. They may be electrically connected if desired.

Power supply circuit 13330 operates in substantially the same manner as power supply circuit 12130, the difference being the operation of voltage addition circuits 1331–1333. Voltage addition circuits 13331 and 13333 are groups of adders; each formed identically to the voltage addition circuit shown in FIG. 81. Voltage addition adder circuits 13331 and 13333 output voltages V0′, V2′, V3′, and V5′ in response to the inputs from voltage following circuits 8632, 12632. The group of adders 13332 form voltage adder circuits identical to the voltage adder circuit 12131 and produces voltages V0′, V2′, V3′ and V5′ in response to the outputs of voltage adder circuits 8632, 12632.

Because voltage detection electrodes YD1, YD2 are formed as wedges, the voltages which are detected are more heavily weighted at one end at each respective voltage detection electrode than the other and both overlap at the center of the matrix panel to produce relatively equal voltage outputs at that portion relative to each other. In this arrangement, the sum of voltage changes in the driving voltage waveforms for the segment electrodes X1–X5 is generated on voltage detection electrode YD1. The effect of the wedge-like end of voltage detection YD1 causes the values by which the voltage changes in the driving voltage waveforms are weighted to be reduced in a direction from segment electrode X1 to segment electrode X5. Similarly, the sum of voltage changes in the driving voltage waveforms for the segment electrodes X2–X6 is generated on voltage detection electrode YD2, and the values by which the voltage changes in the driving voltage waveforms are weighted are reduced in a direction from segment electrode X6 to segment electrode X2.

Accordingly, voltage follower circuit 8632 receiving an input from voltage detection electrode YD2 receives the sum of voltage changes which are substantially the voltage changes in the driving voltage waveform on the far end (X6 end) segment electrodes of liquid crystal panel 13010, while voltage follower 12632 outputs the sum of voltage changes which are primarily the voltage changes in the driving voltage waveforms on the close end (X1 end) segment electrodes.

The output of voltage follower circuit 12632 is input to voltage adder circuit group 13331 as a correction voltage and in turn the output from the voltage adder circuit group 13331 is supplied to segment electrode driving circuit 13111L. Similarly, the output voltage from voltage follower circuit 8632 is supplied to voltage addition circuit group 13333 as a correction voltage and the output from voltage addition circuit group 13333 is supplied to segment electrode driving circuit 13111R. The outputs from both voltage follower circuits 8632 and 12632 are supplied as two correction voltages to the group of voltage addition circuits 13332 which in turn outputs a voltage in which a correction voltage is obtained by averaging these two correction voltages and is output to segment electrode driver circuit 13111M.

As a result, a correction voltage obtained as the sum of the changes in the driving voltage waveforms which are heavily weighted with respect to the changes in the driving voltage waveforms for the far end segment electrode is added to the driving voltage waveforms for the far end segment electrodes of the liquid crystal display and a correction voltage obtained as the sum of the changes in the driving voltage waveforms which are heavily weighted with respect to the changes in the driving voltage waveforms for the near end segment electrodes is added to the driving voltage waveforms for the near end segment electrodes. Also, a correction voltage averaged from the voltages from the far end signal electrodes and close end signal electrodes is input with respect to the central portion of the liquid crystal panel. Therefore, correction voltages which are generally optimized are separately added to the driving voltage waveforms for the segment electrodes. A display uniformity is further reduced in an effective manner.

In this embodiment, the voltage addition circuit known from FIG. 81 is used for each of the adders of voltage addition circuit groups 13331 and 13333.

However, the circuit may be arranged so that voltage addition circuit 12131 is used in each voltage addition circuit group and supplied with two outputs from the voltage follower circuits 8632 and 12632 and weighing the contribution of the input voltages in utilizing the capacitances of capacitors 12102 and 12103.

In this embodiment, the number of different correction voltages is three. However, this number may be changed in accordance with the size of the liquid crystal panel and other factors. Additionally, a method using voltage detection electrodes has been described. However, the currents with respect to the lighting voltage and non-lighting voltage supplied to the three respective drivers may be detected by small resistance resistors or the like and added to each other. It is also possible to obtain a plurality of correction voltages as in this embodiment in this manner and to achieve the same effect as that of this embodiment by the same correction using three correction voltages. The display non-uniformity could be further reduced by setting different correction voltages with respect to the positions of the common electrodes on the liquid crystal display.

In liquid crystal display unit 13000, a plurality of voltage detection electrodes are formed on a substrate of the liquid crystal panel and the voltages generated on these voltage detection electrodes are utilized as a plurality of variables for a function utilized to generate a correction voltage. However, it is still possible to use three correction voltages even where a single voltage detection electrode is utilized and the correction voltage is added to the driving voltage waveform for a particular one or group of segment electrodes. By way of example, it has been experimentally confirmed that at the terminals for applying driving voltage waveforms to the common electrodes of a liquid crystal panel are located on the near side (X1 side) a display non-uniformity can be reduced more effectively by a method in which a correction voltage obtained by amplifying a voltage obtained through one voltage detection electrode that a smaller rate is added to a segment electrode located at a near position on the liquid crystal panel while an amplified correction of voltage is applied to segment electrodes located at the far end (X6 end) of the liquid crystal panel.

Figure 93:
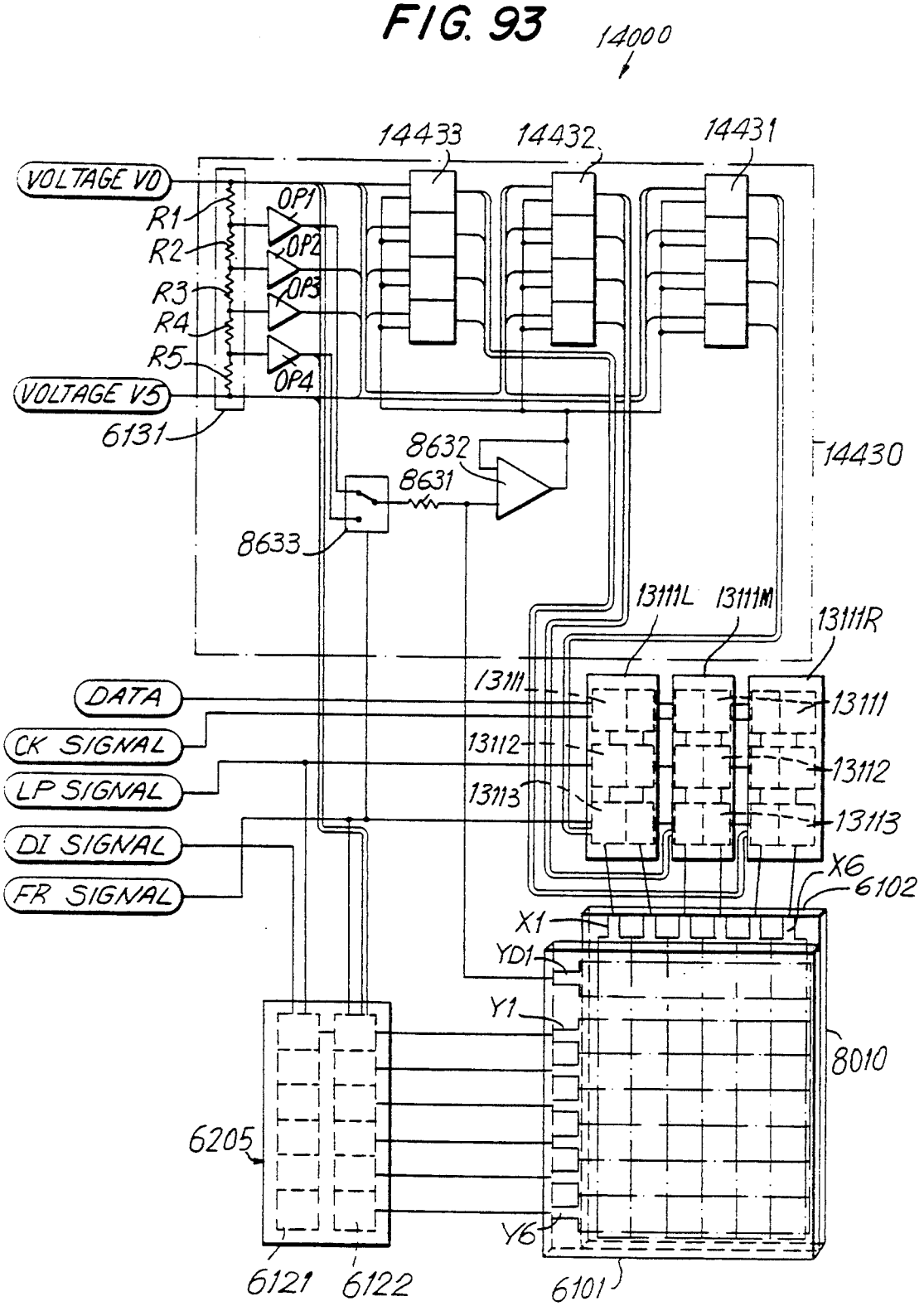
FIG. 93 is a schematic diagram of a liquid crystal display unit constructed in accordance with the twenty-fifth embodiment of the invention.

Reference is now made to FIG. 93 wherein a liquid crystal display unit, generally indicated as 14000, which operates utilizing three distinct segment electrode driving circuits controlled by the inputs from a single voltage detector is provided. The operation of liquid crystal display unit 14000 is similar to the operation of liquid crystal display unit 13000, the substantial difference being the removal of the second voltage detection circuit YD2 and the corresponding resistor and voltage following circuitry. Like numerals are utilized to indicate like structure.

A power circuit 14430 includes three groups of voltage addition circuits 14331, 14332, 14333. Each voltage addition circuit group receives an input from voltage follower circuit 8632 and reference voltage V0, V5. Voltage addition circuit 14331 provides a correction voltage to segment electrode driving circuit 13111L, voltage addition circuit 14332 provides a correction voltage to segment electrode driving circuit 13111M, and voltage addition circuit group 1431 provides a correction voltage to segment electrode driving circuit 13111R. Voltage addition circuits 1431–1434 include voltage addition circuits as shown in FIG. 81. However, the capacitance of capacitor 6202 has a small capacitance with respect to the voltage addition circuits of voltage addition circuit group 14331, a large capacitance with respect to the group of voltage addition circuits 14333 and an intermediate capacitance with respect to the group of voltage addition circuits 14332. The arrangement is such that, even though the same voltage is applied to each terminal Vin, the correction voltage obtained by the group of voltage addition circuits 14331 is lowest, the correction voltage produced by voltage addition circuit group 14332 is of a medium strength and the correction voltage obtained by the group of voltage addition circuits 14332 is highest.

In liquid crystal display unit 14000 a plurality of correction voltages may be generated from a voltage obtained by a single voltage detection electrode. A higher correction voltage is applied to segment electrodes removed for the common electrode driving terminal. It is thereby possible to effectively further reduce display non-uniformity.

The exact shape of a voltage detection electrode has not been specifically addressed with the exception of the wedge-shaped electrodes discussed above. However, it is possible to further reduce display non-uniformity by changing the shape of the voltage detection electrode depending upon the configuration of the liquid crystal panel.

Figure 94:
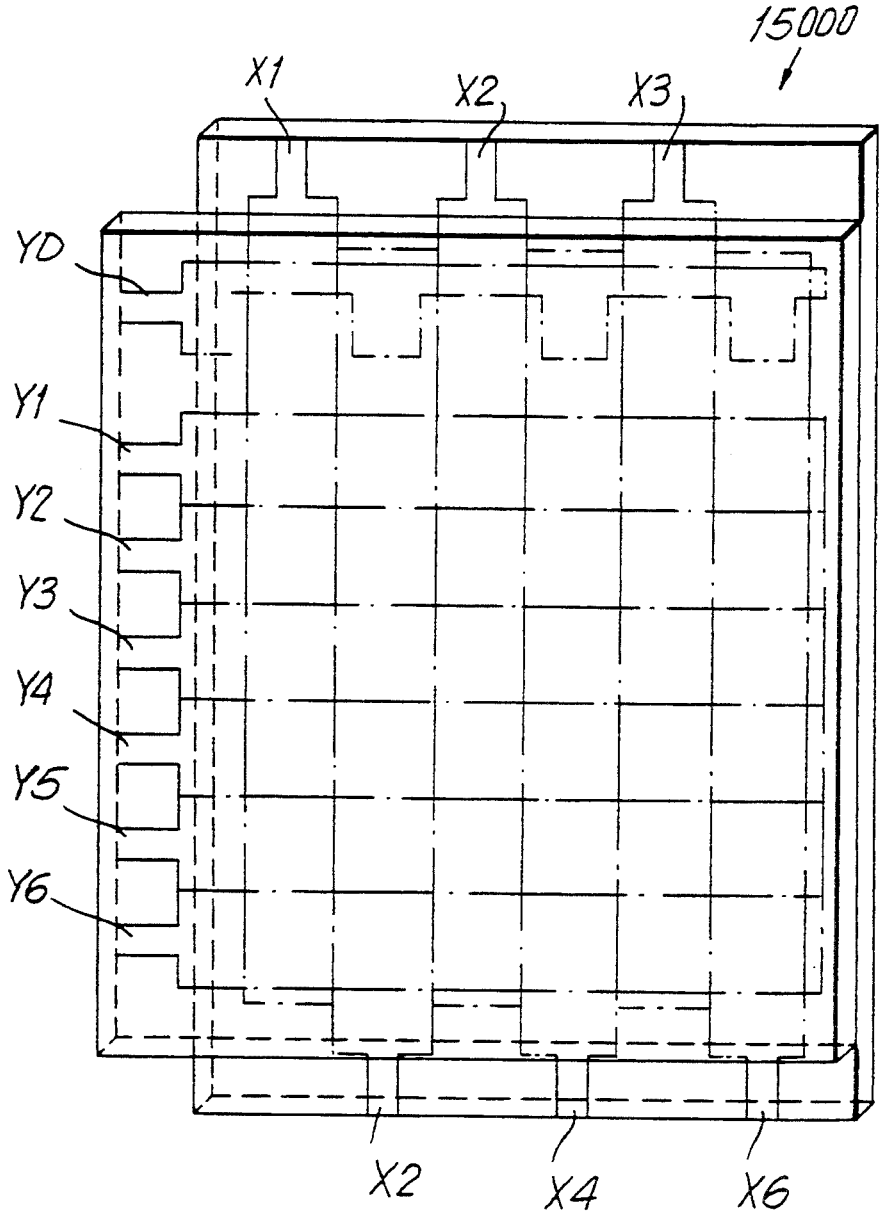
FIG. 94 is a perspective view of a liquid crystal display panel constructed in accordance with a twenty-sixth embodiment of the invention.

Reference is now made to FIG. 94 wherein a liquid crystal panel generally indicated as 15000 constructed in accordance with the invention is provided to illustrate factors governing the shape of the voltage detection electrode.

Liquid crystal panel 15000 is similar to the liquid crystal panel as discussed above with the arrangement of the segment electrodes being different. The arrangement of common electrodes Y1–Y6 of this embodiment is exactly the same as the liquid crystal panel 6010. However, the segment electrodes are formed in an alternating pattern in which the odd numbered electrodes are driven at the upper side of liquid crystal panel 15000 and the even numbered electrodes are driven at the lower portion of liquid crystal panel 15000. A voltage detection electrode YD is formed on an upper portion of liquid crystal panel 15000 to intersect with each one of segment electrodes X1–X6. Voltage detection electrode YD has a smaller width at the portions intersecting the even numbered segment electrodes than the portions intersecting the odd numbered segment electrodes.

As a result of this shape, the capacitive coupling between voltage detection electrode YD and the odd numbered segment electrodes is reduced, while the capacitive coupling between the voltage detection electrode YD and the even numbered segment electrodes is increased. Accordingly, at the position of voltage detection electrode YD, a differentiated voltage is generated on voltage detection electrode YD by a change in the driving voltage waveform of the odd numbered segment electrodes of a lower attenuation rate so as to be weighted by a smaller value (because of its proximity to the driving waveform input), while a differentiated voltage is generated on the voltage detection electrode YD by a change in the driving voltage waveforms on the even numbered signal electrodes of a higher attenuation rate so as to be weighted by a larger value (because of its distance from the driving waveform input). Consequently, the voltage change with respect to the voltage detection electrode YD on the segment electrodes positioned remote from the driving voltage waveform application terminals and the voltage changes detected on the segment electrodes close to the application terminals can be evenly detected through voltage detection electrode YD. A distortion occurring in each common electrode can thereby be estimated with improved accuracy and a more accurate correction voltage can be generated. As a result, it becomes possible to further reduce corresponding display non-uniformity.

In the above embodiments, a correction voltage is obtained by amplifying by a particular amplification factor a voltage detected by a voltage detection electrode. The potential difference between the voltage detection electrode and the opposed segment electrode is about zero volts. However, the actual potential difference between the segment electrode and the opposed common electrode is several volts in terms of effective voltage.

Generally, the dielectric constant of a liquid crystal increases as the applied effective voltage is increased. It follows that the capacitance of capacitors formed by the liquid crystal panel will be increased if a larger number of display dots of the liquid crystal panel are lighted. Accordingly, a greater distortion is generated in the driving voltage waveform on each common electrode, even when the sum of voltage changes in the common electrode driving waveform is constant. However, the degree of capacitive coupling between the voltage detection electrode and the opposed segment electrode is constant regardless of the display content as demonstrated above and there is a possibility of correction voltage deficiency depending upon the number of lighted display dots. Therefore, the level of correction voltage may be changed in accordance with the number of lighted displayed dots to enable a display free from displaying non-uniformity.

Figure 95:
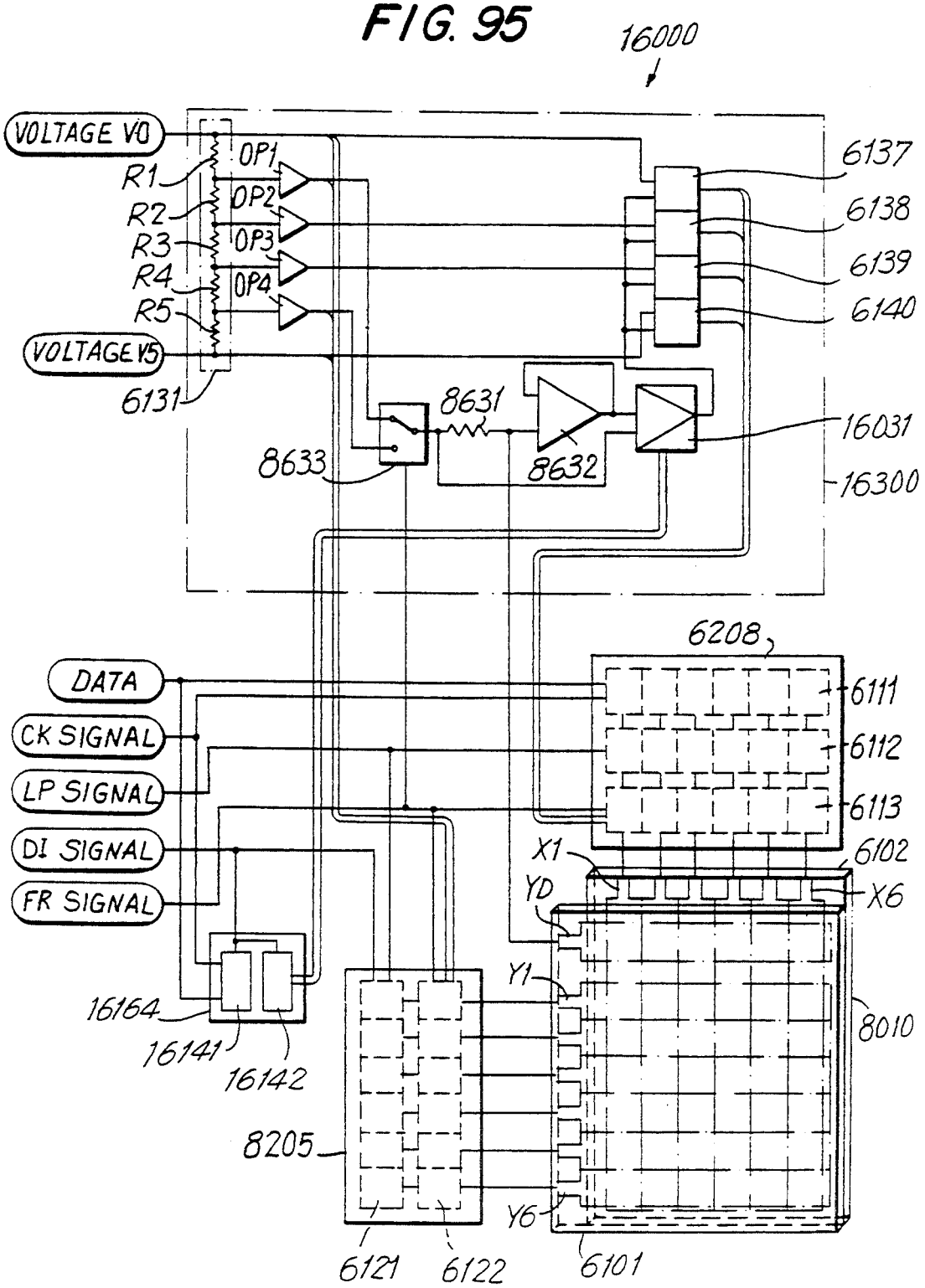
FIG. 95 is a schematic view of a liquid crystal display unit constructed in accordance with the twenty-seventh embodiment of the invention.

Reference is made to FIG. 95, wherein a liquid crystal display unit, generally indicated as 16000, which corrects the driving voltage in accordance with voltage changes detected by a voltage detection electrode and in response to the number of lighted dots is provided. Liquid crystal display unit 16000 is similar in structure to liquid crystal display unit 8000 and like numerals are utilized to indicate like structure. A substantial difference between liquid crystal display unit 16000 and liquid crystal display unit 8000 is the incorporation of light dot counting circuitry and a variable amplifier which increases its amplification factor in response to a number of lighted dots, A lighted dot count circuit 16164 includes a count circuit 16141 which receives the CK signal and DATA signal and provides an output which is combined with the DI signal. A latch circuit 16142 also receives the output of count circuits 16141. Count circuit 16141 counts up in synchronization with the CK signal each time the DATA signal has a value of one and supplies a count value to a latch circuit 16142 in synchronization with the DI signal and simultaneously sets the count value to zero to begin counting again, An output from latch circuit 16142 is input into a variable amplifier 16031 of power circuit 16300.

Variable amplifier 16031 also receives an input from switch 8633 and voltage following circuit 8632 and provides a voltage differential output to each of voltage addition circuits 6137–6140. The amplification factor of variable amplifier 16031 is increased in response to the increases in the count value output by lighted dot count circuit 16164.

Figure 96:
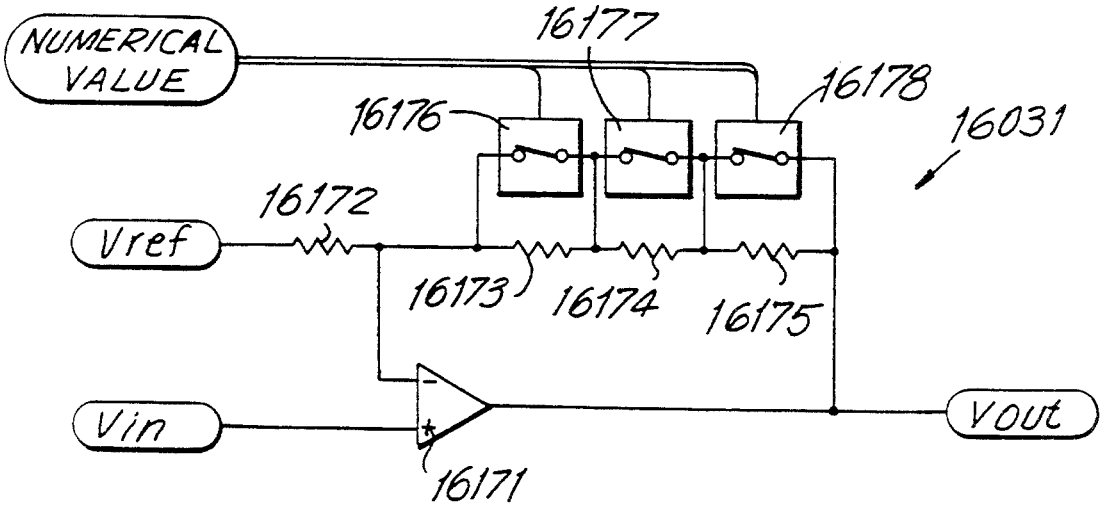
FIG. 96 is a schematic diagram of a variable amplifier constructed in accordance with the twenty-seventh embodiment of the invention.

Reference is made to FIG. 96 wherein a schematic diagram of an exemplary embodiment of variable amplifier 16031 is provided. First resistor 16172 is serially coupled between an input terminal Vref and a first input of an operational amplifier 16171. The second input of operational amplifier 16171 receives an input directly from input terminal Vin and resistor 16172. Resistor 16173 has resistance which is half the resistance of resistor 16174 which has a resistance which is half the resistance of resistor 16175, A first switching circuit 16176 is parallel with resistor 16173. A second switching circuit is coupled and parallel with resistor 16174 and a third switching circuit 16178 is coupled parallel with resistor 16175. Each of switching circuit 16176, 16177, 16178 receives a numerical value input from lighted dot counter circuit 1614 which controls the opening and closing of the respective switching circuits. Switch circuit 16178, resistor 16175 and the output of operational amplifier 16171 are coupled to an output terminal Vout.

The number of resistors and the number of switch circuits are set at three in this embodiment, but may be changed as required. The output from switch circuit 8633 and the output from voltage follower circuit 8632 are input at terminals Vref and Vin respectively. As a result, a non-inverting amplification circuit is formed having an amplification factor in accordance with the ratio of the resistance of resistors 16172 and the resistance between resistors 16173 and 16175. A voltage input through the terminal Vin is amplified by this amplification factor and is output. Switch circuits 16176–16178 are turned ON/OFF by the binary values of a plurality of bits output from the lighted dot count circuit 16164. By way of example, each switch is OFF when the binary value output by the lighted dot count circuit 16164 is one and each switch is ON when the binary value is zero. Switch circuit 16178 is controlled by an upper digit value, while switch circuit 16176 is controlled by a lower digit value. If the values are increased, the resistance between resistors 16173 and 16175 are increased proportionally. Accordingly, if the number of lighted dots is increased, the amplification is increased.

In the above-described arrangement, as the number of lighted display dots of the liquid display panel 8010 is increased, the correction voltage becomes higher, so that a display can be made without any display non-uniformity relating to the number of lighted dots.

In liquid crystal display unit 9000, the current flowing through power circuit 9073 with respect to the non-selection voltage (V1, V4) is monitored to add a correction voltage to the voltages supplied to the segment electrode driving circuit. A correction voltage may also be added to the voltages supplied to the common electrode driver circuit.

Figure 97:
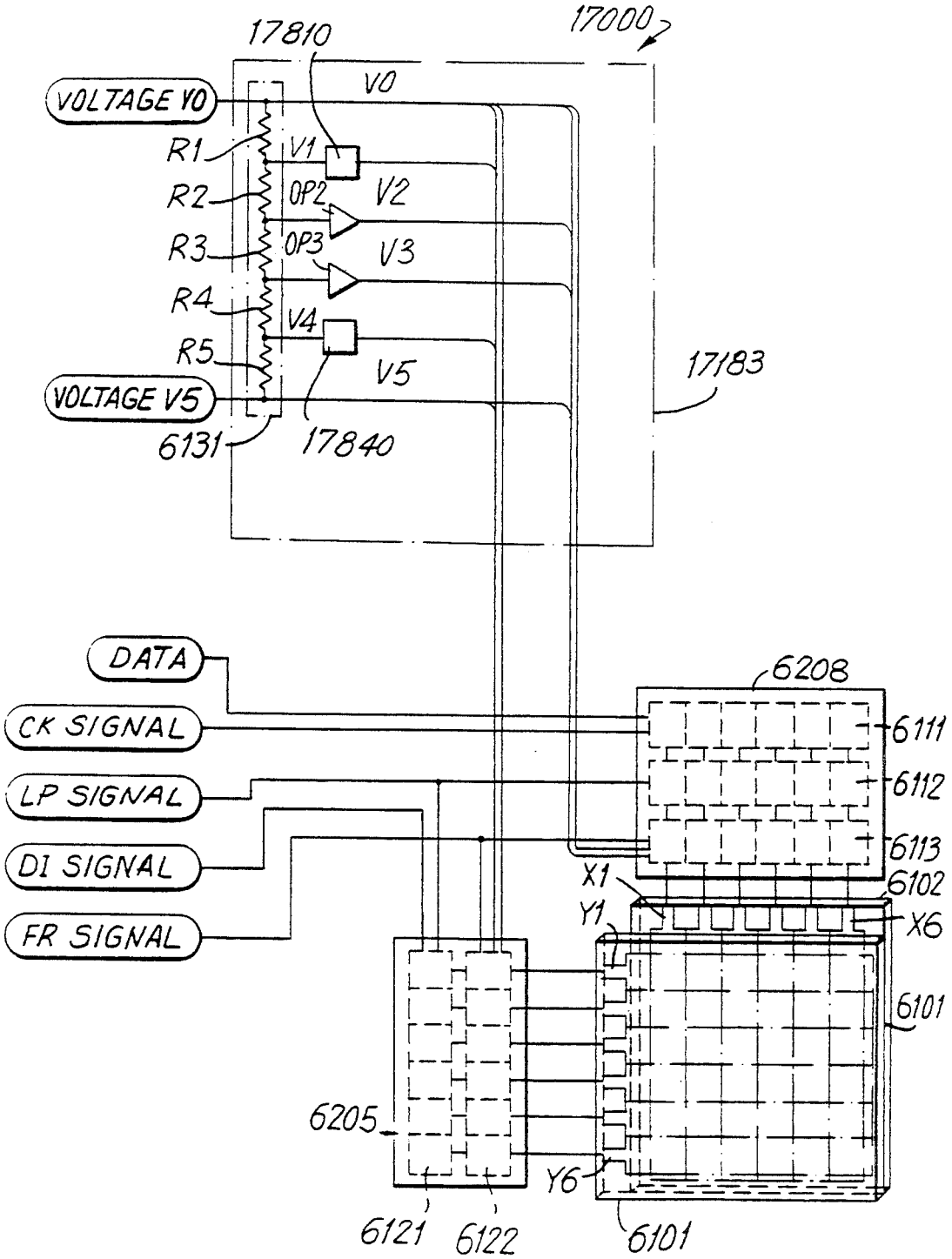
FIG. 97 is a schematic diagram of a liquid crystal display unit constructed in accordance with the twenty-eighth embodiment of the invention.

Reference is now made to FIG. 97, wherein a liquid crystal unit, generally indicated as 17000, constructed in accordance with an embodiment of the invention which provides a correction voltage to the common electrode driving circuit is provided. With the exception of driving circuit 17183, the structure of liquid crystal display unit 17000 is identical to liquid crystal display unit 6000 and like numerals are used to indicate like structures.

Power circuit 17183 includes voltage divider 6131, including serially positioned resistors R1, R2, R3, R4 which are disposed between reference voltages V0, V5. Voltage followers OP2, OP3 output voltages V2, V3 respectively, which in addition to voltages V0, V5 are input to segment electrode driving circuit 6208. A voltage V1 is input to a first voltage correction circuit 17810 and outputs a correction voltage to common electrode driving circuit 6205. A second voltage correcting circuit 17840 receives a reference voltage V4 and outputs a second correcting voltage to common electrode driving circuit 6205.

Voltage correction circuits 17810 and 17840 add correction voltages to voltages V1 and V4 respectively. The voltage correction circuits are positioned between voltage divider circuit 6131 and common electrode driving circuit 6205. The voltage correction circuits 17810 and 17840 have the same circuit arrangement.

Figure 98:
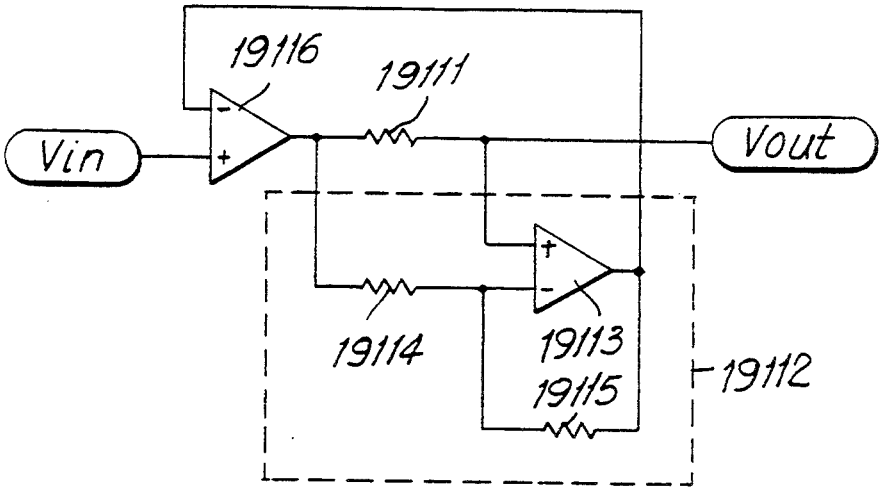
FIG. 98 is a schematic diagram of a voltage correction circuit constructed in accordance with the twenty-eighth embodiment of the invention.

Reference is now made to FIG. 98 wherein a first example of a voltage correction circuit constructed in accordance with the invention is provided. For ease of description, the following embodiments of the voltage correction circuit are described in an operation during a time period in which voltage V1 is used as a non-selection voltage in response to the FR signal. However, operation would be identical with respect to the periods of time during which voltage V4 is used as the non-selection voltage.

In a first embodiment of the voltage correction circuit, a voltage terminal Vin provides an input to an operational amplifier 19116, which provides an output through a resistor 19111. The output of operational amplifier 19116 is output voltage at output terminal Vout. A voltage across resistor 19111 is input to an inverting amplifier circuit 19112. Inverting amplifier circuit 91112 includes an operational amplifier 19113 receiving its inputs across resistor 19111 so that resistor 19111 acts as a current detection resistor across which a voltage proportional to the sum of currents flowing through the common electrode to which the non-selection voltage is applied is generated. A resistor 19114 is provided in series between an input of operational amplifier 19113 and the output of operational amplifier 91116. A second resistor 19115 is placed in parallel with operational amplifier 19113 and provides a feedback output to operational amplifier 19116.

By setting the amplification factor of inverting amplifier circuit 19112 in accordance with the resistances of resistors 19114 and 19115, a voltage which is output from the inverting amplifier circuit 19112 (referred to hereinafter as Vd) can be made approximately equal to the voltage on the common electrodes to which the non-selection voltage distorted by the influence by transient current is applied. Operational amplifier 19116 outputs a voltage (Vc) which equalizes voltage V1′ applied to the inverting input terminal of operational amplifier 19116 and the voltage applied at the non-inverting input terminal through terminal Vin. By the above-described construction and operation, even when a transient current flows, the voltage on the common electrodes to which the non-selection voltage is applied and voltage V1 can be maintained at the same voltage. A current flowing through power circuit 17183 as the non-selected voltage is detected and a correction voltage is added to the non-selection voltage supplied to common electrode driver 6205. It becomes possible to limit the change in voltage on the common electrodes to which the non-selected voltage is applied while easily reducing display non-uniformity in a simple manner.

Figure 99:
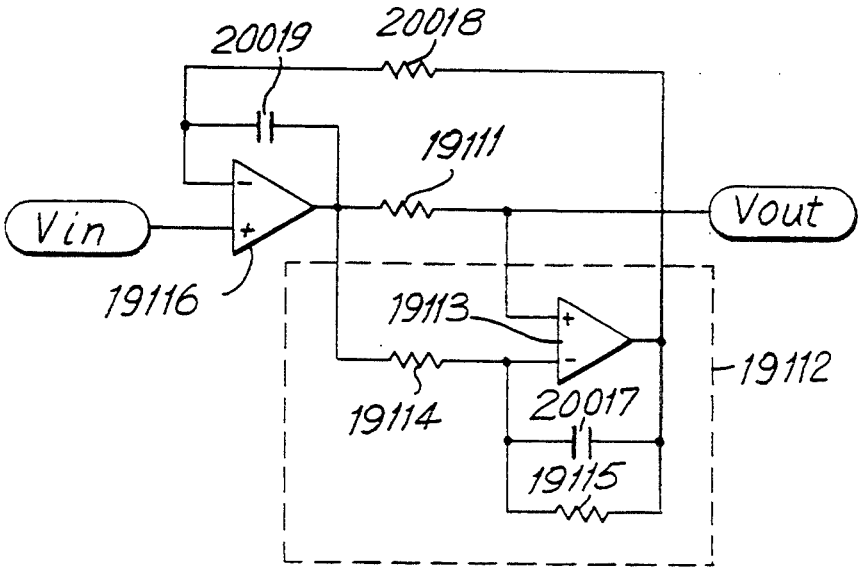
FIG. 99 is a schematic diagram of a voltage correction circuit constructed in accordance with another embodiment of the invention.

The circuitry shown in FIG. 98 is not limiting to the circuitry which may be utilized as a voltage correction circuit. By way of example, reference is now made to FIG. 99 wherein a second embodiment of a voltage correction circuit is shown. Like numerals are utilized to indicate like parts the difference between the two embodiments being the addition of a capacitor 20017 in inverting amplifier circuit 19112 disposed in parallel with resistor 19115 to provide a time constant T1 of the inverting amplifier circuit 19112. A resistor 20018 and a capacitor 20019 are used in conjunction with the inputs to operational amplifier 19116 to set a second time constant T2.

In this embodiment, time constants T1 and T2 are set along with the amplification factor and are set to suitable values such that when a transient current flows with respect to voltage V1, the effective voltage per LP signal of the voltage on the common electrodes to which the non-selection voltage is applied can be made equal to voltage V1, thereby achieving the same effect as the previous embodiment. Furthermore, the amount of voltage change per unit time in the output voltages of amplifier circuits 19113 and 19116 is reduced so that a low through rate low priced operational amplifier can be used in proving the stability of the circuit. With respect to this embodiment, detecting the current flow through the power supply circuit with respect to the non-selection voltage has been described. With respect to the selection voltage or where generally correcting a correction voltage by using a voltage detection electrode is desired, the same circuit arrangement may be adapted to achieve the same effect.

In the above embodiments, the current flowing through the power circuit is detected utilizing a resistor having a small resistance. However, such a structure is not always necessary and other elements may be utilized to detect current. By way of example, a transformer may be used as a different current detection device in substitute of voltage detection resistors 19111 and 19114. By way of example, reference is made to FIG. 100 wherein a transformer formed in connection with operational amplifier 19116 is utilized.

A transformer 2120 is formed of a primary winding 21121 and a secondary winding 21122. By setting the ratio of the number of turns of the primary and secondary windings, 21121 and 21122 to a suitable value, transformer 21120 may be utilized to detect current. The output of secondary coil 21122 is fed back as the inverter input of operational amplifier 19116. As a result, a simplified voltage correction circuit is provided.

Figure 100:
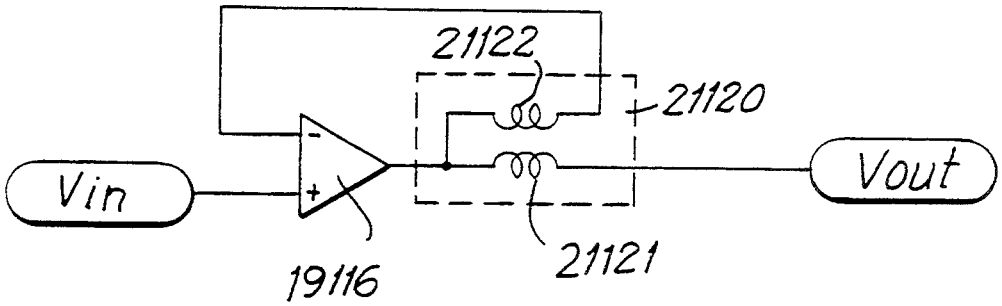
FIG. 100 is a schematic diagram of a voltage correction circuit constructed in accordance with another embodiment of the invention.
Figure 101:
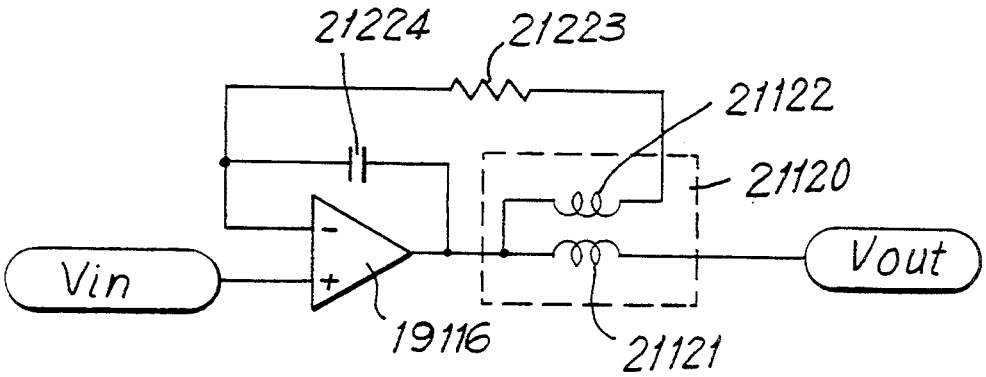
FIG. 101 is a schematic diagram of a voltage correction circuit constructed in accordance with another embodiment of the invention.

Reference is now made to FIG. 101 wherein yet another voltage correction circuit is provided. Like numerals are utilized to indicate like structure. The difference between the embodiments of FIG. 101 and FIG. 100 is the introduction of a resistor 21223 and a capacitor 21224 to provide a time constant T2 as discussed above for controlling operation of the voltage correction circuit. The time constant T2 of the operational amplifier circuit 19116 is set by the added resistor and capacitor.

Figure 102:
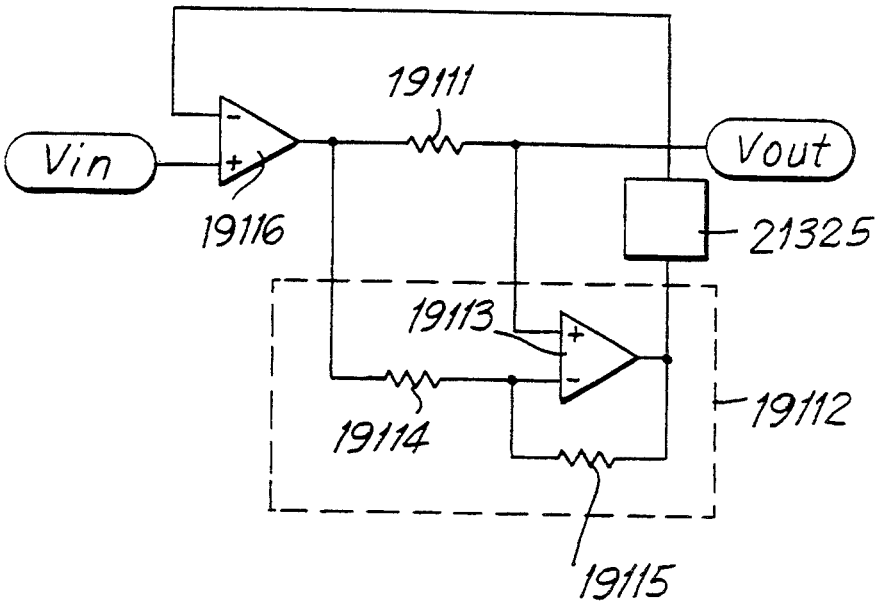
FIG. 102 is a schematic diagram of a voltage correction circuit constructed in accordance with yet another embodiment of the invention.

In the above embodiments, the non-selection voltage changes substantially in a real time manner. However, the voltage correction circuits 17310 and 17840 may be replaced by the voltage correction circuit shown in FIG. 102 to achieve the same effect as that discussed above, as well as stabilize the operation of the voltage correction circuit. The voltage correction circuit of FIG. 102 is identical to that of FIG. 98 with the exception of the addition of a time delay circuit 2325 interposed between operational amplifier 19113 and the inverted input of operational amplifier 19116. Like numerals are utilized to indicate like structure. Delay device 21325 may be a switched capacitor or a charged coupled device. As a result, a correction voltage is added to the non-selection voltage with a lag during a single LP signal. The non-selection voltage to which the correction voltage is added is supplied to the common electrode driving circuit in a non-real time feedback manner. Also, the correction voltage circuits cannot easily isolate stabilizing operation. The insertion of a delay device can also be made, for example, in the embodiments of FIGS. 100–101.

Figure 103:
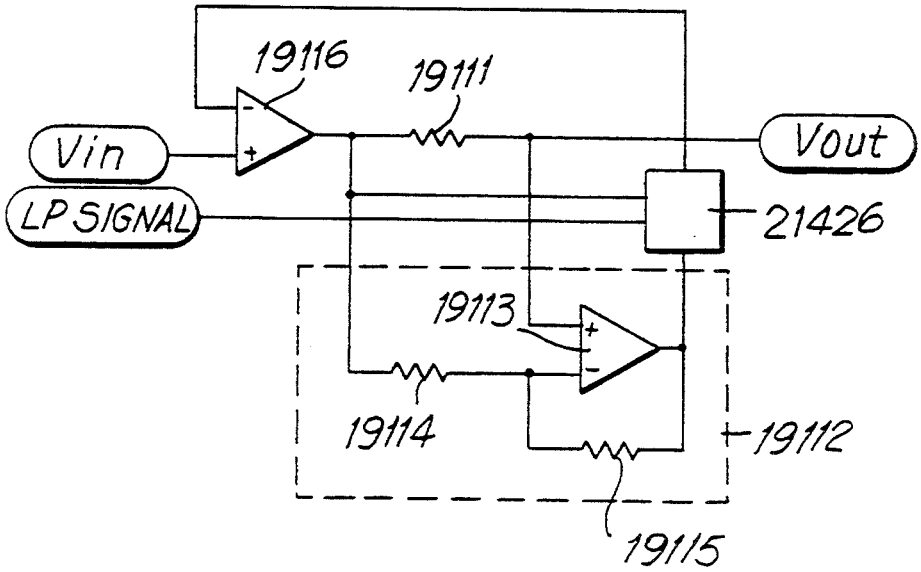
FIG. 103 is a voltage correction circuit constructed in accordance with yet another embodiment of the invention.

Reference is now made to FIG. 103. A method for voltage correction may also be used in which the instantaneous current value or a peak current value of the current flowing through the power circuit with respect to the non-selection voltage, the instantaneous value appearing every LP period at the start of each LP period or a certain period of time thereafter, is detected and a correction voltage based on the detected current value is added to the non-selection voltage V1 as a constant period correction voltage of the LP period. Such a circuit is shown in FIG. 103 which is similar in structure to that shown in FIG. 102, the time delay circuit being replaced by a sample and hold circuit 21426. Sample and hold circuit 21426 samples and holds the voltage Vd output from the inverting amplifier circuit 19113 in response to a transient current in response to output voltage Vc of operational amplifier circuit 1916 utilizing the LP signal, or a signal obtained delaying the LP signal by a predetermined time period. That is, a voltage represented by $Dv=Vd-Vc$ is held.

Because $Vc+dV$ is applied to the non-inverting terminal of the operational amplifier 91116, a constant voltage expressed as $V1-dV$ is output during the LP period.

The held voltage Vd is proportional to the effective voltage V1 of the voltage of each common electrode to which the non-selection voltage is applied during each LP period. Therefore, the effective voltage per LP period of the voltage on each common electrode to which the non-selection voltage is applied can be made equal to the voltage V1, even when a transient current is generated, thus removing non-uniformities.

The current flowing through the power circuit is detected with respect to the non-selection voltage. When detecting the current with respect to a selection voltage or generating a correction voltage by utilizing a voltage detection electrode, the same circuit arrangement may be adapted to achieve the same effect.

In each of the above embodiments, only the liquid crystal panels having a driving voltage waveform applied at one end of each group of common electrode and segment electrodes have been described. However, the above-described embodiments can be applied to liquid crystal panels having a structure in which driving voltage waveforms are applied from opposite ends with respect to one or both of the groups of common and segment electrodes. Where one or more voltage detection electrodes are provided to generate a correction voltage, a circuit in which terminals for extracting voltages from a voltage detection electrode are provided at opposite ends thereof may also be adapted, or a terminal of each voltage detection electrode may be formed at a side opposite to the side where the driving voltage terminals of the common or segment electrodes are provided. Furthermore, voltage detection electrodes may be formed in the vicinity of any of upper, lower, left and right sides of the liquid crystal panel and may be formed in a central portion if there is no problem relating to its display performance.

Each of the embodiments discussed above utilizes a liquid crystal panel having a single group of segment electrodes and a single group of common electrodes which intersect with each other to form display dots. However, where the liquid crystal panel is formed of two groups of segment electrodes and two groups of common electrodes intersecting to form two distinct intersecting regions, i.e., a two-frame drive liquid crystal panel, the correction methods above may still be utilized by adding a correction voltage for each frame to the voltage driving waveform output by the segment electrode driving circuits and common electrode driving circuits responsible for driving each intersecting region or frame.

To accomplish such an embodiment, a signal obtained by inverting the FR signal supplied to the common electrode driving signal and the segment electrode driving circuit for driving one frame is supplied as the FR signal to the segment and common electrode driving circuit for the other frame. As a result, a common circuit may be utilized for driving the two frames simplifying the overall circuit arrangement. For example, when V0 (5), V4 (1), V5 (0), and V3 (2) are used as the selection, non-selection, lighting and non-lighting voltages for a first frame, then V5 (0), V1 (4), V0 (5), and V2 (3) are used as the driving voltages on the other frame. Therefore, where a method for adding a correction voltage to the non-selection voltage is used, a correction for a display on one frame is added to V1 to be input as the driving voltage waveform for this frame and when V1 is used for the first frame, a correction voltage to be input for displaying on the other frame is simultaneously added to V4 to be supplied to the voltage driving waveform for driving the second frame. As a result, a correction circuit can be used in common with both frames.

The above embodiments have also been described primarily using examples of correction for the voltage averaging driving method. However, the above correction methods are effective in reducing display non-uniformities with respect to a driving method in which the voltages applied to the segment electrodes are changed during the period of time when the selection voltage is applied to the common electrodes, i.e., a gradation display method using pulse, width modulation, in which the time for application of lighting and non-lighting voltages is changed, a driving method in which the selection voltage is simultaneously applied to a plurality of common electrodes, or a method in which a driving voltage waveform having a multiplicity of voltage levels is supplied to common electrodes or segment electrodes to perform electrode driving, as well as numerous other methods.

As demonstrated above, the power circuits which do not require voltage correction circuits or encompass the voltage correction circuit within the power circuit may be applied to electronic apparatus requiring a display function such as personal computers, word processors, and electronic pocket notebooks or the like to improve the display quality.

By providing a correction power circuit which detects a voltage change or current change on a portion of the liquid crystal display or internally to the power circuit, the distortions occurring on a liquid crystal panel may be predicted and a correction voltage may be generated based upon the predicted distortion and added to the driving voltage waveform to remove non-uniformities. As a result, a liquid crystal display unit requiring no circuit for calculating the amount of distortion from the display data and capable of making a high quality display utilizing a simplified circuit is provided. An electronic apparatus utilizing the display unit of the invention described above, may be designed to have a high quality display while reducing overall size and weight. Also, by detecting voltage changes and current changes, display non-uniformity may be reduced regardless of the driving method because the number and timing of the actual display dots is measured.

As mentioned above, according to the liquid crystal display device of the present invention, at least one of the voltage waveforms of the common electrodes and the voltage waveforms of the segment electrodes is compensated, based upon the conversion of the display patterns of drawings or characters into a quantized value, thereby making it possible to provide a remarkably improved display quality without crosstalk.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode; and said power circuit means including voltage compensation means for compensating distortion of said voltage waveforms which occurs and varies according to the display pattern by detecting a voltage change within said matrix liquid crystal display device, determining an amount of distortion occurring as a function of said display pattern in one of said segment voltage waveforms and common voltage waveforms in response to said voltage change and generating a correction voltage based upon said voltage change, said correction voltage being added to the segment voltage waveform and common voltage waveform exhibiting said amount of distortion.

2. The matrix liquid crystal display panel of claim 1, wherein said compensation means includes detection means for detecting the sum of the segment voltage waveforms on said plurality of segment electrodes and producing a voltage sum in response thereto; and voltage addition means for adding said voltage sum to a group of said plurality of voltages to produce a plurality of correction voltages, said segment electrode driving means outputting a corrected segment voltage waveform in response to said corrected voltage.

3. The matrix liquid crystal display panel of claim 2, wherein the plurality of segment electrode is divided into at least a first group of segment electrodes, a second group of segment electrodes and a third group of segment electrodes;

said segment electrodes driving means includes at least a first segment electrode driver for driving said first group of segment electrodes, a second segment electrode driver for driving said second group of segment electrodes, and a third segment electrode driver for driving said third set of segment electrodes;

said voltage addition means providing a first correction voltage to said first segment electrode driver, a second correction voltage to said second segment electrode driver and a third correction voltage to said third electrode driver.

4. The matrix liquid crystal panel device of claim 3, wherein said first correction voltage does not equal the second correction voltage and the second correction voltage does not equal the third correction voltage.

5. The matrix liquid crystal panel device of claim 2, wherein said compensation means further comprises voltage differential means for receiving said voltage detection electrode voltage and a group of said plurality of voltages and outputting a voltage differential voltage waveform in response thereto, said voltage addition means receiving said voltage differential waveform and outputting a correction voltage in response thereto; and said segment electrode driving means receiving said correction voltage and outputting a corrected voltage waveform in response thereto.

6. The matrix liquid crystal display device of claim 5, wherein said correction means further comprises a lighted dot count means outputting a dot count value in response to a DATA signal for amplifying the detected voltage sum in response to said count value, increasing the amplification value in response to an increase in the count value.

7. The matrix liquid crystal display device of claim 6, wherein said amplifier means includes a first through fourth resistors coupled in series, a first switching circuit coupled in parallel with said second resistor, a second switching circuit coupled in parallel with said third resistor and, a third switching circuit coupled in parallel with said fourth resistor, the count value being formed as an upper digit value, a middle digit value and a lower digit value, said first switching circuit being operated in response to the lower digit value, said second switching circuit being operated in response to said middle digit value and the third switching circuit being operated in response to said upper digit value, said first, second and third switching circuits being coupled in parallel to said voltage detection electrode.

8. The matrix liquid crystal display panel of claim 1, wherein said compensation means includes detection means for detecting the sum of the common voltage waveforms on said plurality of common electrodes and producing a voltage sum in response thereto; and voltage addition means for adding said voltage sum to a group of said plurality of voltages to produce a plurality of correction voltages, said common electrode driving means outputting a corrected common voltage waveform in response to said corrected voltage.

9. The matrix liquid crystal display device of claim 1, wherein said power circuit receives a first reference voltage and a second reference voltage; said power circuit means including voltage divider means for receiving said first reference voltage, and said second reference voltage and producing a first divided voltage, a second divided voltage, third divided voltage and fourth divided voltage; said first reference voltage and said second reference voltage, said second divided voltage and third divided voltage being input to said segment electrode driving means as said plurality of voltages; a first voltage correction means for receiving said first divided voltage and a second voltage correction means for receiving said fourth divided voltage outputting a second correction voltage, said first correction voltage, said second correction voltage and said first reference voltage and second reference voltage being input to said common electrode driving means as said plurality of voltages, said common electrode driving means outputting a corrected common voltage waveform in response thereto.

10. The matrix liquid crystal display device of claim 9, wherein said first voltage correction means has a circuitry identical to the circuitry of said second voltage correction means.

11. The matrix liquid crystal display device of claim 10, wherein said first voltage correction means includes a voltage input terminal, a current detection resistor coupled to said voltage input terminal and an inverting amplifier coupled across said current detection resistor.

12. The matrix liquid crystal display device of claim 11, wherein said first voltage correction means further includes an operational amplifier coupled between said voltage input terminal and said current detection resistor, said operational amplifier operating in accordance with a first time constant and said inverting amplifier circuit operating in accordance with a second time constant.

13. The matrix liquid crystal display device of claim 11, wherein said voltage correction means further comprises delay means for delaying the time period during which the corrected voltage is output by said first and second voltage correction means.

14. The matrix liquid crystal display device of claim 11, wherein said voltage correction means further comprises a sample and hold circuit for sampling and holding the voltage output by said inverting amplifier.

15. The matrix liquid crystal display device of claim 11, wherein said voltage correction means includes an operational amplifier and transformer.

16. The matrix liquid crystal display device of claim 15, wherein said operational amplifier operates in accordance with a time constant.

17. The matrix liquid crystal display device of claim 1, wherein said power circuit receives a first reference voltage and a second reference voltage; and said compensation means includes a first current detection resistor serially coupled with said first reference voltage, first voltage differentiating means for detecting a change in voltage across said first current detection circuit and producing a voltage difference signal in response to a voltage change across said first current detection resistor, a first voltage addition circuit for adding said voltage change voltage and said first reference voltage and producing a first correction voltage, a second current detection resistor coupled in series with said second reference voltage, a second voltage differentiation means coupled across said second current detection resistor for detecting a voltage change across said second current detection resistor and outputting a voltage change in response thereto, a second voltage addition circuit for receiving said second reference voltage and said voltage change voltage and producing a second correction voltage; said common electrode driving means receiving said first correction voltage and second correction voltage and producing a corrected common electrode voltage waveform in response thereto.

18. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode; and said power circuit means including voltage compensation means for detecting a voltage change within said matrix liquid crystal display device, determining an amount of distortion in one of said segment voltage waveforms and common voltage waveforms in response to said voltage change and generating a correction voltage based upon said voltage change, said correction voltage being added to the segment voltage waveform and common voltage waveform exhibiting said amount of distortion; said common electrode driving means applying a common electrode voltage waveform to each common electrode respectively, said compensation means detecting the voltage waveforms applied to at least two of said common electrodes, and said compensation means determining a voltage change between said two detected common voltage waveforms and portion of said two detected common voltage waveforms and a portion of said plurality of voltages and compensating said segment voltage waveforms in response thereto.

19. The matrix liquid crystal display panel device of claim 18, wherein said compensation means includes differential means for determining the difference between said subset of said plurality of voltage waveforms and said common voltage waveforms and outputting a differential voltage representative thereof and further comprising adding means, said adding means adding said differential voltage to a subset of said plurality of voltage waveforms to produce said correction voltage, said segment electrode driving means receiving said correction voltage and providing a corrected segment voltage waveform in response thereto.

20. The matrix liquid crystal display panel device of claim 18, wherein said compensation means includes differential means for determining the difference between a group of said plurality of voltage waveforms and said common voltage waveforms and outputting a differential voltage representative thereof and further comprising adding means, said adding means adding said differential voltage to a subset of said plurality of voltage waveforms to produce said correction voltage, said common electrode driving means receiving said correction voltage and providing a corrected common voltage waveform.

21. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode; and said power circuit means including voltage compensation means for detecting a voltage change within said matrix liquid crystal display device, determining an amount of distortion in one of said segment voltage waveforms and common voltage waveforms in response to said voltage change and generating a correction voltage based upon said voltage change; said correction voltage being added to the segment voltage waveform and common voltage waveform exhibiting said amount of distortion, said voltage compensation means including detection means for detecting the sum of the segment voltage waveforms on said plurality of segment electrodes and producing a voltage sum in response thereto; and voltage addition means for adding said voltage sum to a group of said plurality of voltages to produce a plurality of correction voltages, said segment electrode driving means outputting a corrected segment voltage waveform in response to said corrected voltage, said compensation means including a voltage detection electrode mounted on said first substrate and disposed to be in facing relation with said plurality of segment electrodes and being capacitively coupled with said plurality of segment electrodes.

22. The matrix liquid crystal display panel of claim 21, wherein said detection means includes a voltage detection electrode mounted on said second substrate and disposed in facing relation with said plurality of common electrodes and being capacitively coupled with said plurality of common electrodes.

23. The matrix liquid crystal display device of claim 21, wherein said detection means comprises a second voltage detection electrode disposed on said first substrate at a position spaced from said first voltage detection electrode, said second voltage detection electrode being disposed in facing relationship with said plurality of segment electrodes, said second voltage detection electrode producing a second voltage output, said addition means adding said voltage output to said voltage sum and said group of said plurality of voltages.

24. The matrix liquid crystal display panel of claim 23, wherein the plurality of segment electrodes is divided into at least a first group of segment electrodes, a second group of segment electrodes, and a third group of segment electrodes;

said segment electrode driving means includes at least a first segment electrode driver for driving said first group of segment electrodes, a second segment electrode driver for driving said second group of segment electrodes and a third segment electrode driver for driving said third set of segment electrodes;

said voltage addition means providing a first correction voltage to said first segment electrode driver means, a second correction voltage to said second segment electrode driver means and a third correction voltage to said third electrode driver means.

25. The matrix liquid crystal panel device of claim 24, wherein said first correction voltage does not equal the second correction voltage and the second correction voltage does not equal the third correction voltage.

26. The matrix liquid crystal panel device of claim 23, wherein said first voltage detection electrode is disposed in a co-linear non-overlapping relation with said second voltage detection electrode.

27. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode; and said power circuit means including voltage compensation means for compensating for distortion of said voltage waveforms which occurs and varies according to the display pattern by detecting a current change within said matrix liquid crystal display device, determining an amount of distortion in one of said segment voltage waveforms and common voltage waveforms in response to said current change and generating a correction voltage based upon said current change, said correction voltage being added to the segment voltage waveform and common voltage waveform exhibiting said amount of distortion.

28. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode, said common electrode driving means applying a common electrode voltage waveform to each common electrode respectively, and said power circuit means including voltage compensation means for compensating for distortion of said voltage waveforms which varies according to the display pattern detecting means for detecting the voltage waveforms applied to at least two of said common electrodes, and said compensation means determining a voltage change between said two detected common voltage waveforms and a portion of said plurality of voltages and compensating said segment voltage waveforms in response thereto.

29. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode; and said power circuit means including voltage compensation means for compensating for distortion of said voltage waveforms which varies according to the display pattern, said compensation means including detection means for detecting the sum of the segment voltage waveforms on said plurality of segment electrodes and producing a voltage sum in response thereto; and voltage addition means for adding said voltage sum to a group of said plurality of voltages to produce a plurality of correction voltages, said segment electrode driving means outputting a corrected segment voltage waveform in response to said corrected voltage.

30. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode; and said power circuit means including voltage compensation means for compensating for distortion of said voltage waveforms which varies according to the display pattern said power circuit receiving a first reference voltage and a second reference voltage and detecting said distortion; said power circuit means including voltage divider means for receiving said first reference voltage, and said second reference voltage and producing a first divided voltage, a second divided voltage, third divided voltage and fourth divided voltage; said first reference voltage and said second reference voltage, said second divided voltage and third divided voltage being input to said segment electrode driving means as said plurality of voltages; a first voltage correction means for receiving said first divided voltage and outputting a first correction voltage and a second correction means for receiving said fourth divided voltage outputting a second correction voltage, said first correction voltage, second correction voltage and said first reference voltage and second reference voltage being input to said common electrode driving means as said plurality of voltages, said common electrode driving means outputting a corrected common voltage waveform in response thereto.

31. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal sandwiched between said first substrate and second substrate;

power circuit means for generating a plurality of voltage waveforms;

segment electrode driving means for receiving at least a portion of said plurality of voltage waveforms and producing a voltage segment waveform in response thereto, said segment electrodes receiving said segment voltage waveforms and exhibiting either a lighting or non-lighting state in response thereto;

common electrode driving means for receiving at least a portion of said plurality of waveforms and producing in response thereto a common voltage waveform, said common electrodes receiving said common voltage waveform and exhibiting one of a selected and non-selected state in response thereto, said common electrode intersecting said scanning electrodes to define a matrix having a dot at each intersection, the dots being in either an ON state or an OFF state depending on the voltage applied to the intersecting common and segment electrode; and said power circuit means including voltage compensation means for compensating for distortion of said voltage waveforms which varies according to the display pattern, said compensation means including detection means for detecting the sum of the common voltage waveforms on said plurality of common electrodes and producing a voltage sum in response thereto; and voltage addition means for adding said voltage sum to a group of said plurality of voltages to produce a plurality of correction voltages, said common electrode driving means outputting a correction common voltage waveform in response to said corrected voltage.

* * * * *